US005624777A

United States Patent [19]

Kato et al.

[11] Patent Number: 5,624,777

[45] Date of Patent: Apr. 29, 1997

[54] ELECTROPHOTOGRAPHIC LITHOGRAPHIC PRINTING PLATE PRECURSOR

[75] Inventors: Eiichi Kato; Hiroshi Tashiro; Akio Oda; Kazuo Ishii, all of Shizuoka, Japan

[73] Assignee: Fuji Photo Film Co., Ltd., Kanagawa, Japan

[21] Appl. No.: 256,558

[22] PCT Filed: Jan. 11, 1993

[86] PCT No.: PCT/JP93/00023

§ 371 Date: Sep. 12, 1994

§ 102(e) Date: Sep. 12, 1994

[87] PCT Pub. No.: WO93/14447

PCT Pub. Date: Jul. 22, 1993

[30] Foreign Application Priority Data

Jan. 10, 1992 [JP] Japan ..... 4-020694

[51] Int. Cl.[6] ..... G03G 5/05

[52] U.S. Cl. ..... 430/96; 430/49

[58] Field of Search ..... 430/96, 49

[56] References Cited

U.S. PATENT DOCUMENTS

| | | | |
|---|---|---|---|
| 4,828,952 | 5/1989 | Kato et al. | 430/96 |
| 4,960,661 | 10/1990 | Kato et al. | 430/49 |
| 4,971,870 | 11/1990 | Kato . | |
| 4,977,049 | 12/1990 | Kato . | |
| 5,017,448 | 5/1991 | Kato et al. | 430/49 |
| 5,176,975 | 1/1993 | Kato et al. | 430/96 |

FOREIGN PATENT DOCUMENTS

| | | |
|---|---|---|
| 62-258476 | 11/1987 | Japan . |
| 1-0767 | 3/1989 | Japan . |
| 1-191157 | 8/1989 | Japan . |
| 1-191860 | 8/1989 | Japan . |
| 1-309067 | 12/1989 | Japan . |
| 2-15277 | 1/1990 | Japan . |

*Primary Examiner*—Christopher D. Rodee

*Attorney, Agent, or Firm*—Sughrue, Mion, Zinn, Macpeak & Seas

[57] ABSTRACT

An electrophotographic lithographic printing plate precursor having a photoconductive layer containing a resin which contains a functional group capable of forming —COOH group and a functional group capable of forming at least one group selected from $—SO_3H$ group, $—SO_2H$ group and $—PO_3H$ group and which has a crosslinking structure.

Owing to the specific polar group in the resin, a lithographic printing plate which is free from the occurrence of background stain and has excellent oil-desensitivity and high printing durability is provided.

16 Claims, No Drawings

ELECTROPHOTOGRAPHIC LITHOGRAPHIC PRINTING PLATE PRECURSOR

TECHNICAL FIELD

The present invention relates to an electrophotographic lithographic printing plate precursor for producing a printing plate through electrophotography and, more particularly, to an improvement in a composition for forming a photoconductive layer of the electrophotographic lithographic printing plate precursor.

TECHNICAL BACKGROUND

Various kinds of offset printing plate precursors for directly producing printing plates have hitherto been proposed, and some of which have already been put into practical use. A widely employed precursor is a light-sensitive material having a photoconductive layer comprising photoconductive particles such as zinc oxide particles and a binder resin provided on a conductive support. A highly lipophilic toner image is subsequently formed on the photoconductive layer surface by an ordinary electrophotographic process. The surface of the photoconductive layer having the toner image is then treated with an oil-desensitizing solution, called an etching solution, to selectively render the non-image areas hydrophilic thereby producing an offset printing plate.

In order to obtain satisfactory prints, an offset printing plate precursor must faithfully reproduce an original on the surface thereof; the surface of the light-sensitive material should have a high affinity for an oil-desensitizing solution so as to render non-image areas sufficiently hydrophilic and, at the same time, should be water resistant. When used as printing plate, the photoconductive layer having a toner image formed thereon should not come off during printing, and should be well receptive to dampening water so that the non-image areas can remain sufficiently hydrophilic to be free from stains, even after a large number of prints have been reproduced from the plate.

These properties are affected by the proportion of binder resin to zinc oxide in the photoconductive layer as already known. Specifically, when the proportion of binder resin to zinc oxide particles in the photoconductive layer is decreased, the oil-desensitivity of the photoconductive layer surface is enhanced and background stains are decreased. However, the internal cohesive force and mechanical strength of the photoconductive layer itself is lowered, resulting in the deterioration of the printing durability. On the contrary, when the proportion of resin binder is increased, the background stains are increased although the printing durability is heightened. Background stains are related to the oil-desensitivity of the photoconductive layer surface. Not only does the ratio of binder resin to zinc oxide in the photoconductive layer influence the oil-desensitivity of the photoconductive layer surface, but it has become apparent that the oil-desensitivity also depends greatly on the kind of the binder resin employed.

With respect to the offset master, the background stain resulting from insufficiency in oil-desensitization is a particularly serious problem. For the purpose of solving this problem, various binder resins for zinc oxide have been developed for improving the oil-desensitivity. Resins having an effect on improvement in oil-desensitivity of the photoconductive layer include those as follows: JP-B-50-31011 (the term "JP-B" as used herein means an "examined Japanese patent publication") discloses the combination of a resin which has a weight average molecular weight of from $1.8\times10^4$ to $1\times10^5$ and a glass transition point (Tg) of from 10° C. to 80° C. and which is prepared by copolymerizing a (meth)acrylate monomer and another monomer in the presence of fumaric acid, with a copolymer prepared from a (meth)acrylate monomer and a monomer other than fumaric acid; JP-A-53-54027 (the term "JP-A" as used herein means an "unexamined published Japanese patent application") discloses a terpolymer comprising a (meth)acrylic acid ester unit having a substituent which contains a carboxylic acid group apart from the ester linkage by at least 7 atoms; JP-A-54-20735 and JP-A-57-202544 disclose a tetra- or penta-polymer comprising an acrylic acid unit and a hydroxyethyl (meth)acrylate unit; and JP-A-58-68046 discloses a tercopolymer comprising a (meth)acrylic acid ester unit having an alkyl group containing from 6 to 12 carbon atoms as a substituent and a vinyl monomer containing a carboxylic acid group.

However, even with the practical use of the above-described resins which are described to enhance oil-desensitivity, the resulting offset masters are still insufficient in resistance to background stains and printing durability.

The lithographic printing plate precursor utilizing a photoconductive zinc oxide is rendered its surface hydrophilic upon a chemical treatment of zinc oxide with an oil-desensitizing solution under an acidic condition as well known in the art. However, the oil-desensitizing solution which has good oil-desensitivity is limited to that containing a ferrocyanide as the main component.

As a result, there are various restrictions and problems encountered in that a method of treating waste fluid of the oil-desensitizing solution containing a ferrocyanide as the main component is needed, in that since it is necessary to maintain an acidic condition during printing, a number of prints obtainable remarkably decreases (i.e., degradation of printing durability), when neutral paper is employed for printing, and in that because the principle of oil-desensitization is based on the generation of hydrophilic substance upon a chelating reaction, the oil-desensitizing solution tends to interact with polyvalent metal ions contained in a color ink during printing so that unusual emulsification of ink occurs and consequently, a number of prints obtainable decreases particularly in case of color printing.

In order to reduce or solve these problems, there has been developed a techinque for providing hydrophilicity to non-image areas by means of rendering a binder resin of the photoconductive layer hydrophilic upon a chemical reaction treatment. For instance, resins of the type which contain functional groups capable of producing hydrophilic groups through decomposition have been investigated on an aptitude for the resin binder. For example, the resins containing functional groups capable of producing hydroxy groups by decomposition are disclosed in JP-A-62-195684, JP-A-62-210475 and JP-A-62-210476, those containing functional groups capable of producing carboxy groups through decomposition are disclosed in JP-A-62-212669, JP-A-62-286064 and JP-A-1-63977, and those containing functional groups capable of producing a sulfo group or a phosphono group through decomposition are disclosed in JP-A-63-260439,-JP-A-1-70767.

Further, an improvement in a composition for a photoconductive layer has been investigated in which resin grains containing a polymer component capable of forming a carboxy group, a sulfo group, a phosphono group or a hydroxy group through decomposition are incorporated into the photoconductive layer as described, for example, in JP-A-1-261658, JP-A-1-284856 and JP-A-1-287571. The printing plates prepared using these techniques certainly exhibit improved water retentivity as compared with conventional plates.

PROBLEMS TO BE SOLVED BY THE INVENTION

As a result of the detailed investigations on properties of the lithographic printing plate precursor, however, it has been found that a narrow latitude for obtaining stably a large number of prints causes trouble. More specifically, a number of prints necessary for disapperance of background stain occurred from the start of printing increases and a number of prints obtained without the formation of background stain decreases depending upon fluctuation of printing conditions on an offset printing machine (for example, fluctuation of an amount of dampening water supplied during printing) or the kind of printing machine (for example, a syn-flow system or a molton system).

The present invention has been made for solving the problems of conventional electrophotographic lithographic printing plate precursors as described above.

Therefore, an object of the present invention is to provide an electrophotographic lithographic printing plate precursor having constantly excellent oil-desensitivity forming neither overall background stains nor dotted background stains on prints even when the printing conditions are flucturated during printing and color printing is performed.

Another object of the present invention is to provide an electrophotographic lithographic printing plate precursor capable of forming a printing plate which provides a very small number of losing paper at the start of printing and has high printing durability on any offset printing machine of different printing system.

A further object of the present invention is to provide an electrophotographic lithographic printing plate precursor of high printing durability which can be used in combination with a processing solution having no problem on environmental sanitation as an oil-desensitizing solution and dampening water.

A still further object of the present invention is to provide an electrophotographic lithographic printing plate precursor of high printing durability without cansing a problem during printing even when neutral paper is employed for printing in place of acidic paper.

Other objects of the present invention will be apparent from the following description.

DISCLOSURE OF THE INVENTION

These objects of the present invention can be accomplished by an electrophotographic lithographic printing plate precursor comprising a conductive support having provided thereon at least one photoconductive layer containing photoconductive compound and a binder resin, wherein the binder resin of the photoconductive layer comprises at least one binder resin (A) described below;

Binder Resin (A):

a copolymer comprising a polymer component (a) containing at least one functional group capable of forming a —COOH group upon a chemical reaction treatment and a polymer component (b) containing at least one functional group capable of forming a $—SO_3H$ group, a $—SO_2H$ group or a $—PO_3H_2$ group upon the chemical reaction treatment, and having a crosslinking structure formed from a polymer component (c) containing at least one heat- and/or photo-curable group.

The electrophotographic lithographic printing plate precursor according to the present invention is characterized by using a polymer having both a functional group capable of forming a —COOH group and a functional group capable of forming a $—SO_3H$ group, a $—SO_2H$ group or a $—PO_3H_2$ group upon chemical reaction treatment, and a crosslinking structure formed from a heat- and/or photo-curable group contained therein as a binder resin of a photoconductive layer thereof.

According to a preferred embodiment of the present invention, at least one functional group capable of forming a —COOH group in the polymer component (a) is directly bonded to the polymer main chain of the abovedescribed binder resin (A).

According to another preferred embodiment of the present invention, the photoconductive layer contains a heat- and/or photo-curable compound together with the above described binder resin (A).

According to a further preferred embodiment of the present invention, the photoconductive layer contains a photoconductive component selected from photoconductive zinc oxide and photoconductive titanium oxide and a spectral sensitizing dye.

According to a still further preferred embodiment of the present invention, the photoconductive layer further contains at least one binder resin (B) described below;

Binder Resin (B):

a resin having a weight average molecular weight of from $1\times10^3$ to $2\times10^4$ and containing not less than 30% by weight of a polymer component corresponding to a repeating unit represented by the general formula (I) described below and from 0.05 to 15% by weight of a polymer component having at least one polar group selected from $—PO_3H_2$, $—SO_3H$, —COOH, $—P(=O)(OH)Q_1$ (wherein $Q_1$ represents a hydrocarbon group or $—OQ_2$ (wherein $Q_2$ represents a hydrocarbon group)) and a cyclic acid anhydride group,

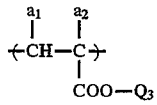

General Formula (I)

wherein $a_1$ and $a_2$ each represents a hydrogen atom, a halogen atom, a cyano group or a hydrocarbon group; and $Q_3$ represents a hydrocarbon group.

The electrophotographic lithographic printing plate precursor according to the present invention is based on a system different from conventional one wherein zinc oxide is subjected to a chemical treatment to generate hydrophilicity and the oil-desensitizing property against a printing ink is utilized. In the system according to the present invention, the binder resin used is water-insoluble and so designed as to be rendered hydrophilic, and zinc oxide does not employed at all for a purpose of generating the hydrophilicity. Therefore, any photoconductive substance suitable for a resin-dispersion type can be employed. Among them, photoconductive zinc oxide and/or photoconductive titanium oxide are advantageously employed taking a low cost of the electrophotographic lithographic printing plate precursor and no environmental pollution into consideration.

A conventional electrophotographic lithographic printing plate precursor utilizing zinc oxide exhibits printing durability of about 10,000 prints only under the particularly limited conditions. As a result of intensive invertigations, it has been found that an electrophotographic lithographic printing plate precursor having excellent performances in that the electrophotographic light-sensitive material used can form duplicated images having reproducibility of original as good as possible under various circumstances and in that a printing plate formed therefrom after the oil-desensitizing treatment exhibits high printing durability of more than 10,000 prints without the above described restrictions at printing is obtained by using the binder resin (A) according to the present invention.

According to the present invention, a good duplicated image is formed by an electrophotographic process and a printing plate is then prepared upon an oil-desensitizing treatment by means of a chemical reaction applied only to the binder resin. In order that a printing plate obtained by the chemical treatment aplied only to the binder resin exhibits the excellent performances, it is very important for the photoconductive layer as a whole after the oil-desensitizing treatment to be able to maintain an adequate water absorbing capacity in addition to extremely good wettability of the layer in the non-image areas after the oil-desensitizing treatment (more specifically, a contact angle with distilled water being 0°). It becomes apparent that the above described factors dominate whether the difference in a printing system or the change in an amount of dampening water supplied at the time of printing (i.e., change in the balance of dampening water with a printing ink on the printing machine) exerts a great influence upon or not. Moreover, it is also found that preservation of the above described conditions while conducting printing affects achievement of the high printing durability.

In order to produce and maintain the above described layer structure of lithographic printing plate, it is effective to have both a carboxy group and at least one group selected from a sulfo group, a sulfino group and a phosphono group as hydrophilic groups formed upon the oil-desensitizing treatment in the same polymer chain as shown in the binder resin (A) according to the present invention. Preferably, the carboxy group is directly bonded to the polymer main chain. The binder resin (A) also has a photo- and/or heat-curable group and the photoconductive layer formed is characterized by having a crosslinking structure of high order. It is preferred to use a photo- and/or heat-curable compound together with the binder resin for a purpose of sufficiently forming the crosslinking structure of high order.

Specifically, the polymer chain which has generated hydrophilicity upon an oil-desensitizing treatment according to the present invention exhibits sufficient oil-desensitivity and makes the hydrophilized polymer water-insoluble to maintain film strength and to preserve a definite water absorbing capacity since it forms the crosslinking structure of high order. It is believed that a degree of the formation of crosslinking structure of high order affects swellability of film which has an influence upon the water absorbing capacity of film.

When a conventionally known resin capable of forming a carboxy group is used, swelling of film is controlled to provide film strength obtaining a certain extent of printing durability. However, if a crosslinking structure of high order is formed to the extent that the film is not damaged, the surface wettability and water absorbing capacity of film decrease, resulting in occurrence of background stain on prints from the start of printing under the printing conditions as described above. It is assumed that the film can not maintain sufficient wettability and water absorbing capacity because of the insufficient hydrophilicity of carboxy group although it has good film strength.

On the other hand, when a conventionally known resin capable of forming a sulfo group or a phosphono group to which a crosslinking component necessary to form crosslinkage sufficient to restrain the swellability of film for maintaining high printing durability is introduced is employed, background stain occurres from the start of printing due to decrease in the wettability of surface since the crosslinking component introduced is oleophilic.

On the contrary, when a resin capable of forming a sulfo group or a phosphono group in which an amount of the oleophilic crosslinking component introduced is limited is used, prints free from background stain can be obtained from the start of printing since a sulfo group or a phosphono group formed has very high hydrophilicity as compared with a carboxy group and the film having the crosslinking structure of high order preserves a sufficient water absorbing capacity. However, the printing durability thereof decreases on a printing machine of large size wherein a severe printing pressure is applied at printing. These facts indicate that the film strength is incompatible with the surface wattability and water absorbing capacity of film.

As a means for satisfying both an enlarged latitude at printing and high printing durability, a printing plate precursor using the above described carboxy group-forming resin and sulfo group- and/or phosphono group-forming resin in a mixture has been investigated, but improvement in performance has not been found.

It has been confirmed, however, that the control on state of film of a printing plate precursor can be conducted and a printing plate precursor having excellent properties is provided as described above when the binder resin (A) according to the present invention is employed.

Moreover, it has been found that the surface wettability is further improved and the latitude of printing condition is further enlarged if a polymer of a chemical structure wherein at least one carboxy group to be generated is directly bonded to the polymer main chain is used.

Now, the binder resin (A) according to the present invention will be described in detail below.

The weight average molecular weight of the resin (A) is preferably from $5\times10^3$ to $1\times10^6$, and more preferably from $1\times10^4$ to $5\times10^5$, and the glass transition point of the resin (A) is preferably from −10° C. to 110° C., and more preferably from −5° C. to 100° C. If the molecular weight of the resin (A) is less than $5\times10^3$, the crosslinking effect of high order after the formation of photoconductive layer is insufficient and it may be difficult to maintain the film strength as a printing plate precursor. On the other hand, if the molecular weight is larger than $1\times10^6$, it is possible that the electrostatic characteristics of light-sensitive material degrade.

Each of the polymer components included in the resin (A) will be described in detail below.

Now, the functional group capable of forming at least one carboxy group (hereinafter simply referred to as a carboxy group-forming functional group, sometimes) upon a chemical reaction which can be used in the present invention will be described in greater detail below.

The carboxy group-forming functional group according to the present invention forms a carboxy group upon decomposition, the number of carboxy groups formed from one functional group may be one, two or more.

According to one preferred embodiment of the present invention, a carboxy group-forming functional group is represented by the following general formula (II):

General Formula (II)

$$-COO-L_1$$

wherein $L^1$ represents

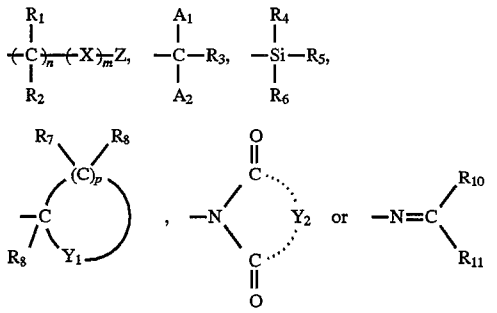

wherein $R_1$ and $R_2$, which may be the same or different, each represents a hydrogen atom or a hydrocarbon group; X represents an aromatic group; Z represents a hydrogen atom, a halogen atom, a trihalomethyl group, an alkyl group, a cyano group, a nitro group, $—SO_2—R_1'$, $—COO—R_2'$, $—O—R_3'$, or $—CO—R_4'$ (wherein $R_1'$, $R_2'$, $R_3'$, and $R_4'$ each represents a hydrocarbon group); n and m each represents 0, 1 or 2, provided that when both n and m are 0, Z is not a hydrogen atom; $A_1$ and $A_2$, which may be the same or different, each represents an electron attracting group having a positive Hammett's substituent constant of σ value; $R_3$ represents a hydrogen atom or a hydrocarbon group; $R_4$, $R_5$, $R_6$, R10 and $R_{11}$, which may be the same or different, each represents a hydrocarbon group or $—O—R_5'$ (wherein $R_5'$ represents a hydrocarbon group); $Y_1$ represents an oxygen atom or a sulfur atom; $R_7$, $R_8$, and $R_9$, which may be the same or different, each represents a hydrogen atom, a hydrocarbon group or $—O—R_6'$ (wherein $R_6'$ represents a hydrocarbon group); p represents an integer of 3 or 4; $Y_2$ represents an organic residue for forming a cyclic imido group.

The functional group represented by the general formula (II) which forms a carboxy group upon decomposition will be described in more detail below.

In a case where $L_1$ represents

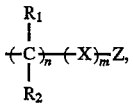

$R_1$ and $R_2$, which may be the same or different, each preferably represents a hydrogen atom or a straight chain or branched chain alkyl group having from 1 to 12 carbon atoms which may be substituted (e.g., methyl, ethyl, propyl, chloromethyl, dichloromethyl, trichloromethyl, trifluoromethyl, butyl, hexyl, octyl, decyl, hydroxyethyl, or 3-chloropropyl); X preferably represents a phenyl or naphthyl group which may be substituted (e.g., phenyl, methylphenyl, chlorophenyl, dimethylphenyl, chloromethylphenyl, or naphthyl); Z preferably represents a hydrogen atom, a halogen atom (e.g., chlorine or fluorine), a trihalomethyl group (e.g., trichloromethyl or trifluoromethyl), a straight chain or branched chain alkyl group having from 1 to 12 carbon atoms which may be substituted (e.g., methyl, chloromethyl, dichloromethyl, ethyl, propyl, butyl, hexyl, tetrafluoroethyl, octyl, cyanoethyl, or chloroethyl), a cyano group, a nitro group, $—SO_2—R_1'$ (wherein $R_1'$ represents an aliphatic group (for example an alkyl group having from 1 to 12 carbon atoms which may be substituted (e.g., methyl, ethyl, propyl, butyl, chloroethyl, pentyl, or octyl) or an aralkyl group having from 7 to 12 carbon atoms which may be substituted (e.g., benzyl, phenethyl, chlorobenzyl, methoxybenzyl, chlorophenethyl, or methylphenethyl)), or an aromatic group (for example, a phenyl or naphthyl group which may be substituted (e.g., phenyl, chlorophenyl, dichlorophenyl, methylphenyl, methoxyphenyl, acetylphenyl, acetamidophenyl, methoxycarbonylphenyl, or naphthyl)), $—COO—R_2'$ (wherein $R_2'$ has the same meaning as $R_1'$ above), $—O—R_3'$ (wherein $R_3'$ has the same meaning as $R_1'$ above), or $—CO—R_4'$ (wherein $R_4'$ has the same meaning as $R_1'$ above); and n and m each represents 0, 1 or 2, provided that when both n and m are 0, Z is not a hydrogen atom.

In a case wherein $L_1$ represents

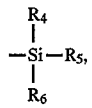

$R_4$, $R_5$, and $R_6$, which may be the same or different, each preferably represents an aliphatic group having 1 to 18 carbon atoms which may be substituted (wherein the aliphatic group includes an alkyl group, an alkenyl group, an aralkyl group, and an alicyclic group, and the substituent therefor includes a halogen atom, a cyano group, a hydroxy group, and —O—Q' (wherein Q' represents an alkyl group, an aralkyl group, an alicyclic group, or an aryl group)), an aromatic group having from 6 to 18 carbon atoms which may be substituted (e.g., phenyl, tolyl, chlorophenyl, methoxyphenyl, acetamidophenyl, or naphthyl), or $—O—R_5'$ (wherein $R_5'$represents an alkyl group having from 1 to 12 carbon atoms which may be substituted, an alkenyl group having from 2 to 12 carbon atoms which may be substituted, an aralkyl group having from 7 to 12 carbon atoms which may be substituted, an alicyclic group having from 5 to 18 carbon atoms which may be substituted, or an aryl group having from 6 to 18 carbon atoms which may be substituted).

In a case wherein $L_1$ represents

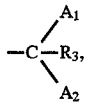

$A_1$ and $A_2$ may be the same or a different, at least one of $A_1$ and $A_2$ represents an electron attracting group, with the sum of their Hammett's $\sigma_p$ values being 0.45 or more. Examples of the electron attracting group for $A_1$ or $A_2$ include an acyl group, an aroyl group, a formyl group, an alkoxycarbonyl group, a phenoxycarbonyl group, an alkylsulfonyl group, an aroylsulfonyl group, a nitro group, a cyano group, a halogen atom, a halogenated alkyl group, and a carbamoyl group.

The Hammett's $\sigma_p$ value is generally used as an index for estimating the degree of electron attracting or donating property of a substituent. The greater the positive value, the higher the electron attracting property. The specific Hammett's $\sigma_p$ values of various substituents are described, e.g., in Naoki Inamoto, *Hammett Soku - Kozo to Han-nosei*, Maruzen (1984).

It seems that an additivity rule applies to the Hammett's $\sigma_p$ values in this system so that both of $A_1$ and $A_2$ need not be electron attracting groups. Therefore, where one of them is an electron attracting group, the other may be any group selected without particular limitation as far as the sum of their $\sigma_p$ values is 0.45 or more.

In a case wherein $L_1$ represents

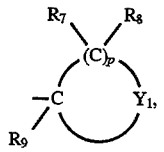

$Y_1$ represents an oxygen atom or a sulfur atom. $R_7$, $R_8$, and $R_9$, which may be the same or different, each preferably represents a hydrogen atom, a straight chain or branched chain alkyl group having from 1 to 18 carbon atoms which may be substituted (e.g., methyl, ethyl, propyl, butyl, hexyl, octyl, decyl, dodecyl, octadecyl, chloroethyl, methoxyethyl, or methoxypropyl), an alicyclic group which may be substituted (e.g., cyclopentyl or cyclohexyl), an aralkyl group having from 7 to 12 carbon atoms which may be substituted (e.g., benzyl, phenethyl, chlorobenzyl, or methoxybenzyl), an aromatic group which may be substituted (e.g., phenyl, naphthyl, chlorophenyl, tolyl, methoxyphenyl, methoxycarbonylphenyl, or dichlorophenyl), or —O—$R_6$' (wherein $R_6$' represents a hydrocarbon group and specifically the hydrocarbon group same as described for $R_7$, $R_8$, or $R_9$). p represents an integer of 3 or 4.

In a case wherein $L_1$ represents

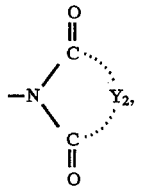

$Y_2$ represents an organic residue for forming a cyclic imido group, and preferably represents an organic residue represented by the following general formula (III) or (IV):

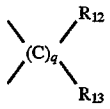

General Formula (III)

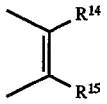

General Formula (IV)

In the general formula (III), $R_{12}$ and $R_{13}$, which may be the same or different, each represents a hydrogen atom, a halogen atom (e.g., chlorine or bromine), an alkyl group having from 1 to 18 carbon atoms which may be substituted (e.g., methyl, ethyl, propyl, butyl, hexyl, octyl, decyl, dodecyl, hexadecyl, octadecyl, 2-chloroethyl, 2-methoxyethyl, 2-cyanoethyl, 3-chloropropyl, 2-(methanesulfonyl)ethyl, or 2-(ethoxymethoxy)ethyl), an aralkyl group having from 7 to 12 carbon atoms which may be substituted (e.g., benzyl, phenethyl, 3-phenylpropyl, methylbenzyl, dimethylbenzyl, methoxybenzyl, chlorobenzyl, or bromobenzyl), an alkenyl group having from 3 to 18 carbon atoms which may be substituted (e.g., allyl, 3-methyl-2-propenyl, 2-hexenyl, 4-propyl-2-pentenyl, or 12-octadecenyl), —S—$R_7$' (wherein $R_7$' represents an alkyl, aralkyl or alkenyl group having the same meaning as $R_{12}$ or $R_{13}$ described above or an aryl group which may be substituted (e.g., phenyl, tolyl, chlorophenyl, bromophenyl, methoxyphenyl, ethoxyphenyl, or ethoxycarbonylphenyl)) or —NH—$R_8$' (wherein $R_8$' has the same meaning as $R_7$' described above). Alternatively, $R_{12}$ and $R_{13}$ may be taken together to form a ring, such as a 5- or 6-membered monocyclic ring (e.g., cyclopentane or cyclohexane) or a 5- or 6-membered bicyclic ring (e.g., bicyclopentane, bicycloheptane, bicyclooctane, or bicyclooctene). The ring may be substituted. The substituent includes those described for $R_{12}$ or $R_{13}$. q represents an integer of 2 or 3.

In the general formula (IV), $R_{14}$ and $R_{15}$, which may be the same or different, each have the same meaning as $R_{12}$ or $R_{13}$ described above. Alternatively, $R_{14}$ and $R_{15}$ may be taken together to form an aromatic ring (e.g., benzene or naphthalene), a 5- or 6-membered monocyclic ring (e.g., cyclopentane or cyclohexane) or a 5- to 12-membered aromatic ring (e.g., benzene, naphthalene, thiophene, pyrrole, pyran or quinoline).

In a case wherein $L_1$ represents

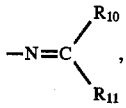

$R_{10}$ and $R_{11}$ each has the same meaning as $R_6$ described above.

According to another preferred embodiment of the present invention, the carboxyl group-forming functional group is a group containing an oxazolone ring represented by the following general formula (V):

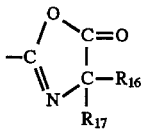

General Formula (V)

wherein $R_{16}$ and $R_{17}$, which may be the same or different, each represents a hydrogen atom or a hydrocarbon group, or $R_{16}$ and $R_{17}$ may be taken together to form a ring.

In the general formula (V), $R_{16}$ and $R_{17}$, which may be the same or different, each preferably represents a hydrogen atom, a straight chain or branched chain alkyl group having from 1 to 12 carbon atoms which may be substituted (e.g., methyl, ethyl, propyl, butyl, hexyl, 2-chloroethyl, 2-methoxyethyl, 2-methoxycarbonylethyl, or 3-hydroxypropyl), an aralkyl group having from 7 to 12 carbon atoms which may be substituted (e.g., benzyl, 4-chlorobenzyl, 4-acetamidobenzyl, phenethyl, or 4-methoxybenzyl), an alkenyl group having from 2 to 12 carbon atoms which may be substituted (e.g., vinyl, allyl, isopropenyl, butenyl, or hexenyl), a 5- to 7-membered alicyclic group which may be substituted (e.g., cyclopentyl, cyclohexyl, or chlorocyclohexyl), or an aromatic group which may be substituted (e.g., phenyl, chlorophenyl, methoxyphenyl, acetamidophenyl, methylphenyl, dichlorophenyl, nitrophenyl, naphthyl, butylphenyl, or dimethylphenyl). Alternatively, $R_{16}$ and $R_{17}$ may be taken together to form a 4- to 7-membered ring (e.g., tetramethylene, pentamethylene, or hexamethylene).

A functional group capable of forming at least one sulfo group upon the chemical reaction includes a functional group represented by the following general formula (VI) or (VII):

General Formula (VI)

$$-SO_2-O-L_2$$

General Formula (VII)

$$-SO_2-S-L_2$$

wherein $L_2$ represents

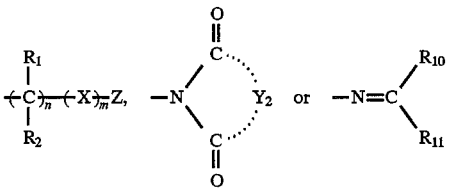

wherein $R_1$, $R_2$, X, Z, n, m, $Y_2$, $R_{10}$, and $R_{11}$ each has the same meaning as defined in the general formula (II) above.

A functional group capable of forming at least one sulfinic acid group upon the chemical reaction includes a functional group represented by the following general formula (VIII):

General Formula (VIII)

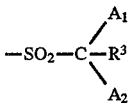

wherein $A_1$, $A_2$ and $R_3$ each has the same meaning as defined in the general formula (II) above.

A functional group capable of forming at least one $-PO_3H_2$ group upon the chemical reaction includes a functional group represented by the following general formula (IX):

General Formula (IX)

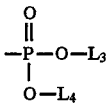

wherein $L_3$ and $L_4$, which may be the same or different, each has the same meaning as $L_1$ defined in the general formula (II) above.

Specific examples of the functional groups represented by the general formulae (II) to (IX) described above are set forth below, but the present invention should not be construed as being limited thereto. In the following formulae, the symbols used have the following meanings respectively:

$W_1$: —CO—, $—SO_2—$, or

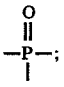

$W_2$: —CO— or $—SO_2—$;

$R_1$: $—C_nH_{2n+1}$ (n: an integer of from 1 to 8),

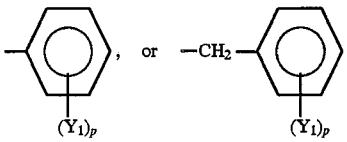

$Y_1$: —H, $—C_nH_{2n+1}$, $—OC_nH_{2n+1}$, —CN, $—NO_2$, —Cl, —Br, $—COOC_nH_{2n+1}$, $—NHCO—C_nH_{2n+1}$, or $—COC_nH_{2n+1}$;

p: an integer of from 1 to 5;

$R_2$: $—C_nH_{2n+1}$, $—CH_2C_6H_5$, or $—C_6H_5$;

$R_3$: $—C_mH_{2m+1}$ (m: an integer of from 1 to 4) or $—CH_2C_6H_5$;

$Y_2$: same meaning as $Y_1$.

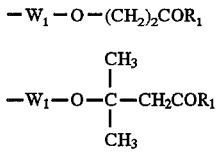

(1)

(2)

(3)

(4)

(5)

(6)

(7)

(8)

(9)

(10)

(11)

(12)

(13)

(14)

(15)

-continued
(16)
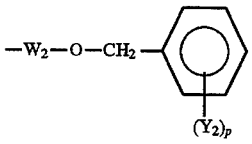
(17)
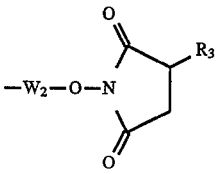
(18)
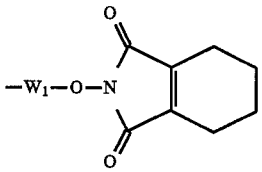
(19)
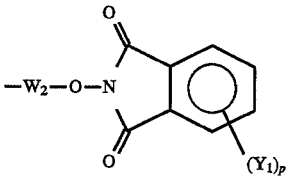
(20)
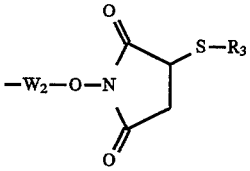
(21)
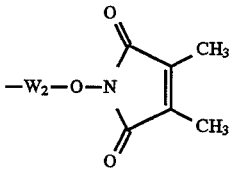
(22)
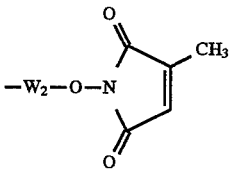
(23)
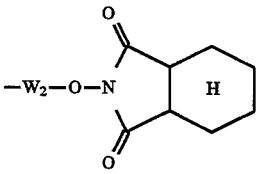
(24)
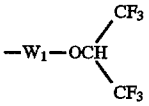
(25)
-continued
(26)
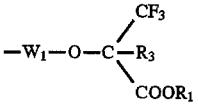
(27)
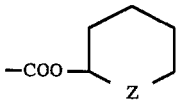
Z: —O—, —S—,
(28)
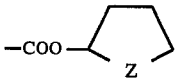
(29)
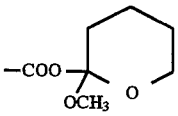
(30)
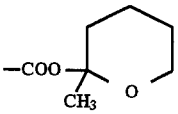
(31)
(32)
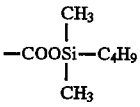
(33)
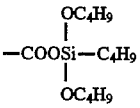
(34)
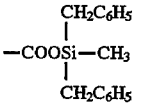
(35)
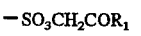
(36)
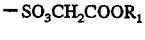
(37)
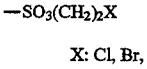
X: Cl, Br,
(38)
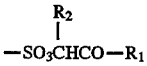
(39)
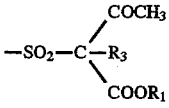
(40)
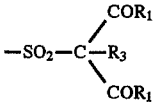
(41)
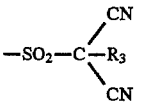

-continued

(42) 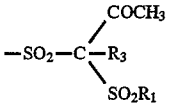

(43) 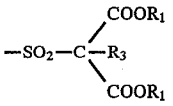

(44) 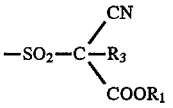

(45) 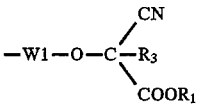

(46) 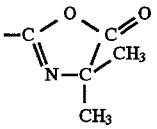

(47) 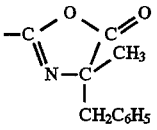

(48) 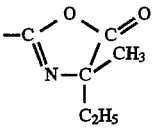

(49) 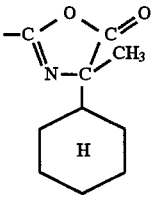

(50) 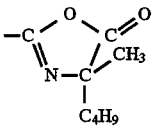

(51) 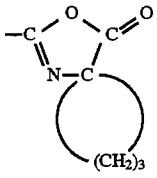

(52) 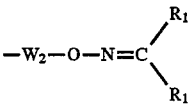

-continued

(53) 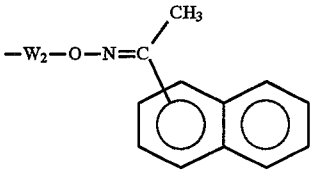

The polymer component which contains a functional group capable of forming at least one hydrophilic group selected from —COOH, —$SO_3H$, —$SO_2H$ and —$PO_3H_2$ upon the chemical reaction which can be used in the present invention is not particularly limited. Preferred examples thereof include a polymer component corresponding to a repeating unit represented by the following general formula (X):

General Formula (X)

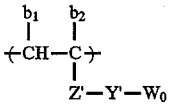

wherein Z' represents —COO—, —OCO—, —O—, —CO—,

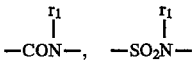

(wherein $r_1$ represents a hydrogen atom or a hydrocarbon group), —CONHCOO—, —CONHCONH—, —$CH_2$COO—, —$CH_2$OCO—, or

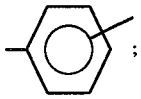

Y' represents a single bond or an organic moiety linking —Z'— and —$W_O$, or —Z'—Y'— means a mere bond through which $W_O$ is directly bonded to the moiety of

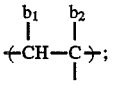

$W_O$ represents a functional group capable of forming a hydrophilic group, for example, a group represented by any of the general formulae (II) to (IX); and $b_1$ and $b_2$, which may be the same or different, each represents a hydrogen atom, a halogen atom, a cyano group, or a hydrocarbon group.

In more detail in the general formula (X), Z' preferably represents —COO—, —OCO—, —O—, —CO—,

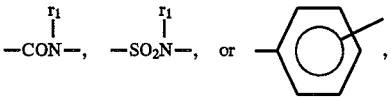

wherein $r_1$ represents a hydrogen atom, an alkyl group having from 1 to 8 carbon atoms which may be substituted (e.g., methyl, ethyl, propyl, butyl, pentyl, hexyl, octyl, 2-chloroethyl, 2-bromoethyl, 2-cyanoethyl, 2-methoxyethyl, 2-hydroxyethyl, or 3-bromopropyl), an aralkyl group having from 7 to 9 carbon atoms which may be substituted (e.g., benzyl, phenethyl, 3-phenylpropyl, chlorobenzyl, bromobenzyl, methylbenzyl, methoxybenzyl, chloromethylbenzyl, or dibromobenzyl), or an aryl group which may be substituted (e.g., phenyl, tolyl, xylyl, mesityl, methoxyphenyl, chlorophenyl, bromophenyl, or chloromethylphenyl).

Y' represents a single bond or an organic moiety linking —Z'— and —$W_0$.

The organic moiety represented by Y' which links —Z'— and —$W_0$ includes a carbon atom, a hetero atom (e.g., an oxygen atom, a sulfur atom or a nitrogen atom) and a combination thereof. Specific examples of the organic moiety include

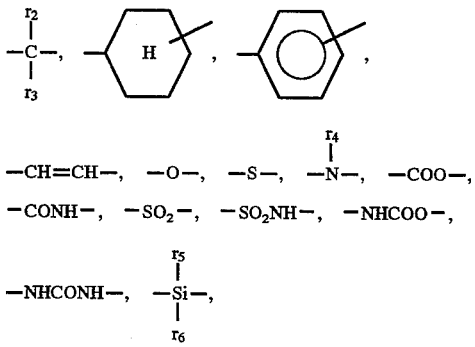

and and combinations thereof, wherein $r_2$, $r_3$, $r_4$, $r_5$ and $r_6$ each has the same meaning as $r_1$ described above.

$b_1$ and $b_2$, which may be the same or different, each represents a hydrogen atom, a halogen atom (e.g., chlorine or bromine), a cyano group, or a hydrocarbon group (for example, an alkyl group having from 1 to 12 carbon atoms which may be substituted (e.g., methyl, ethyl, propyl, butyl, methoxycarbonyl, ethoxycarbonyl, propoxycarbonyl, butoxycarbonyl, hexyloxycarbonyl, methoxycarbonylmethyl, ethoxycarbonylmethyl, or butoxycarbonylmethyl), an aralkyl group which may be substituted (e.g., benzyl or phenethyl), or an aryl group which may be substituted (e.g., phenyl, tolyl, xylyl, or chlorophenyl)).

Specific examples of a portion of the polymer component represented by the general formula (X) formed by omitting the hydrophilic group-forming functional group (e.g., those represented by the general formulae (II) to (IX)) therefrom are set forth below, but the present invention should not be construed as being limited thereto. In the following formulae, b represents H or $CH_3$; n represents an integer of from 2 to 8; and m represents an integer of from 0 to 8.

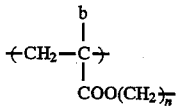

b-1)

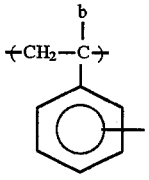

b-2)

-continued

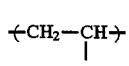

b-3)

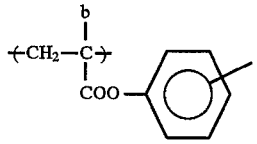

b-4)

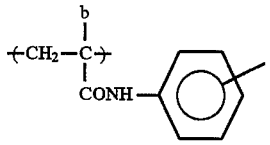

b-5)

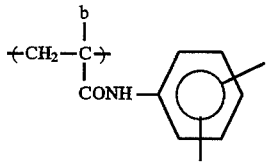

b-6)

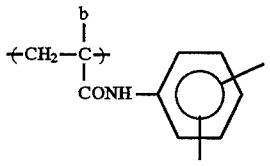

b-7)

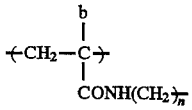

b-8)

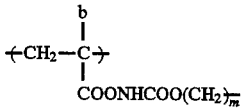

b-9)

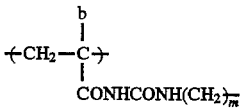

b-10)

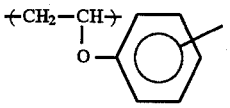

b-11)

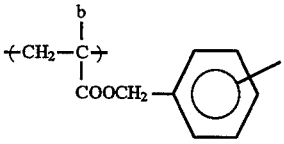

b-12)

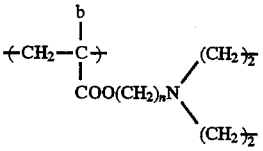

b-13)

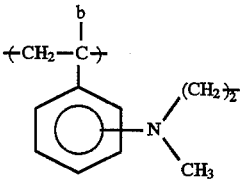

b-14)

-continued

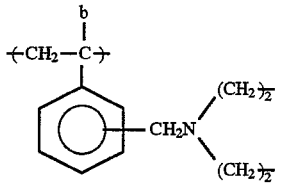

b-15)

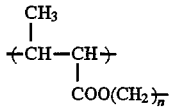

b-16)

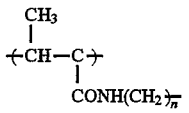

b-17)

The above-described functional group capable of forming at least one hydrophilic group selected from —COOH, —$SO_3H$, —$PO_3H_2$ and —$SO_2H$ upon the chemical reaction used in the present invention is a functional group in which such a hydrophilic group is protected with a protective group. Introduction of the protective group into a hydrophilic group by a chemical bond can easily be carried out according to conventionally known methods. For example, the reaction as described in J. F. W. McOmie, *Protective Groups in Organic Chemistry*, Plenum Press (1973), T. W. Greene, *Protective Groups in Organic Synthesis*, Wiley-Interscience (1981), Nippon Kagakukai (ed.), *Shin Jikken Kaqaku Koza*, Vol. 14, "Yuki Kagobutsu no Gosei to Hanno", Maruzen (1978), and Yoshio Iwakura and Keisuke Kurita, *Han-nosei Kobunshi*, Kodansha can be employed.

In order to introduce the functional group which can be used in the present invention into a resin, a process using a so-called polymer reaction in which a polymer containing both —COOH and at least one hydrophilic group selected from —$SO_3H$, —$PO_3H_2$ and —$SO_2H$ is reacted to convert its hydrophilic groups to protected hydrophilic groups or a process comprising synthesizing at least one monomer containing at least one of the functional groups, for example, those represented by the general formulae (II) to (IX) and then polymerizing the monomer or copolymerizing the monomer with any appropriate other copolymerizable monomer(s) is used.

The latter process (comprising preparing the desired monomer and then conducting polymerization reaction) is preferred for reasons that the amount or kind of the functional group to be incorporated into the polymer can be appropriately controlled and that incorporation of impurities can be avoided (in case of the polymer reaction process, a catalyst to be used or by-products are mixed in the polymer).

For example, a resin containing a carboxyl group-forming functional group may be prepared by converting a carboxyl group of a carboxylic acid containing a polymerizable double bond or a halide thereof to a functional group represented by the general formula (II) by the method as described in the literature references cited above and then subjecting the functional group-containing monomer to a polymerization reaction.

Also, a resin containing an oxazolone ring represented by the general formula (V) as a carboxyl group-forming functional group may be obtained by conducting a polymerization reaction of at least one monomer containing the oxazolone ring, if desired, in combination with other copolymerizable monomer(s).

The monomer containing the oxazolone ring can be prepared by a dehydrating cyclization reaction of an N-alcyloyl-α-amino acid containing a polymerizable unsaturated bond. More specifically, it can be prepared according to the method described in the literature references cited in Yoshio Iwakura and Keisuke Kurita, *Han-nosei Kobunshi*, Ch. 3, Kodansha.

Now, the polymer component containing a heat-and/or photo-curable group which is included in the resin (A) according to the present invention will be described below.

The term "heat- and/or photo-curable group" as used herein means a functional group capable of inducing a curing reaction of a resin on application of at least one of heat and light.

Specific examples of the photo-curable group include those used in conventional photo-sensitive resins known as photocurable resins as described, for example, in Hideo Inui and Gentaro Nagamatsu, *Kankosei Kobunshi*, Kodansha (1977), Takahiro Tsunoda, *Shin-Kankosei Jushi*, Insatsu Gakkai Shuppanbu (1981), G. E. Green and B. P. Strak, *J. Macro. Sci. Reas. Macro. Chem.*, C 21 (2), pp. 187 to 273 (1981–82), and C. G. Rattey, *Photopolymerization of Surface Coatings*, A. Wiley Interscience Pub. (1982).

The heat-curable group which can be used in the present invention includes functional groups described, for example, in Tsuyoshi Endo, *Netsukokasei Kobunshi no Seimitsuka*, C. M. C. (1986), Yuji Harasaki, *Saishin Binder Gijutsu Binran*, Chapter II-I, Sogo Gijutsu Center (1985), Takayuki Ohtsu, *Acryl Jushi no Gosei Sekkei to Shin-Yotokaihatsu*, Chubu Kei-ei Kaihatsu Center Shuppanbu (1985), and Eizo Ohmori, *Kinosei Acryl Kei Jushi*, Techno System (1985).

Specific examples of the heat-curable functional group which can be used include —COOH, —$PO_3H_2$, —$SO_2H$, —OH, —SH, —$NH_2$, —$NHR_A$ (wherein $R_A$ represents a hydrocarbon group, for example, an alkyl group having from 1 to 8 carbon atoms which may be substituted (e.g., methyl, ethyl, propyl, butyl, hexyl, octyl, 2-chloroethyl, 2-methoxyethyl, and 2-cyanoethyl)), a cyclic acid anhydride-containing group (the cyclic acid anhydride-containing group is a group containing at least one cyclic acid anhydride. The cyclic acid anhydride to be contained includes an aliphatic dicarboxylic acid anhydride and an aromatic dicarboxylic acid anhydride. Specific examples of the aliphatic dicarboxylic acid anhydrides include succinic anhydride ring, glutaconic anhydride ring, maleic anhydride ring, cyclopentane-1,2-dicarboxylic acid anhydride ring, cyclohexane-1,2-dicarboxylic acid anhydride ring, cyclohexene-1,2dicarboxylic acid anhydride ring, and 2,3-bicyclo-[2,2,2]octanedicarboxylic acid anhydride. These rings may be substituted with, for example, a halogen atom (e.g., chlorine and bromine) and an alkyl group (e.g., methyl, ethyl, butyl, and hexyl). Specific examples of the aromatic dicarboxylic acid anhydrides include phthalic anhydride ring, naphthalenedicarboxylic acid anhydride ring, pyridinedicarboxylic acid anhydride ring and thiophenedicarboxylic acid anhydride ring. These rings may be substituted with, for example, a halogen atom (e.g., chlorine and bromine), an alkyl group (e.g., methyl, ethyl, propyl, and butyl), a hydroxyl group, a cyano group, a nitro group, and an alkoxycarbonyl group (e.g., methoxy and ethoxy as the alkoxy group)), —N=C=O, a blocked isocyanate group (i.e., a functional group which is formed by an addition reaction of an isocyanate group with an active halogen compound and which generates an isocyanate group upon decomposition by heat. Specific examples of the active hydrogen compounds include 2,2,2-trifluoroethanol, 2,2,2,2',2', 2'-hexafluoroisopropyl alcohol, phenols (e.g., phenol, chlorophenol, cyanophenol, cresol, and methoxyphenol), active methylene compounds (e.g., acetyl acetone, acetoacetic esters, malonic diesters, and malonodinitrile), and cyclic nitrogen-containing compounds (e.g., imidazole, piperazine, and morpholine)), —$CONHCH_2OR_B$ (wherein $R_B$ represents a hydrogen atom or an alkyl group having from 1 to 8 carbon atoms (specifically, the same as those described for $R_A$ above)), a silane coupling group having at least one —OR (e.g., —$Si(OR)_3$, —$Si(OR)_2(R)$, and —$Si(OR)(R)_2$ wherein R represents a hydrocarbon group (specifically, the same as those described for $R_1$ in the general formula (II) above)), a titanate coupling group having at least one —OR, a sterically bulky cyclic functional group containing a hetero atom which is easily subjected to a ring-opening reaction (e.g.,

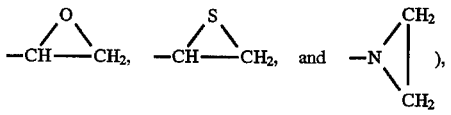

and —$Cd_1$—$CHd_2$ (wherein $d_1$ and $d_2$ each represents a hydrogen atom, a halogen atom (e.g., chlorine, and bromine) or an alkyl group having from 1 to 4 carbon atoms (e.g., methyl, and ethyl)).

Other examples of the functional group include polymerizable double bond groups, for example, $CH_2$=CH—, $CH_2$=CH—$CH_2$—,

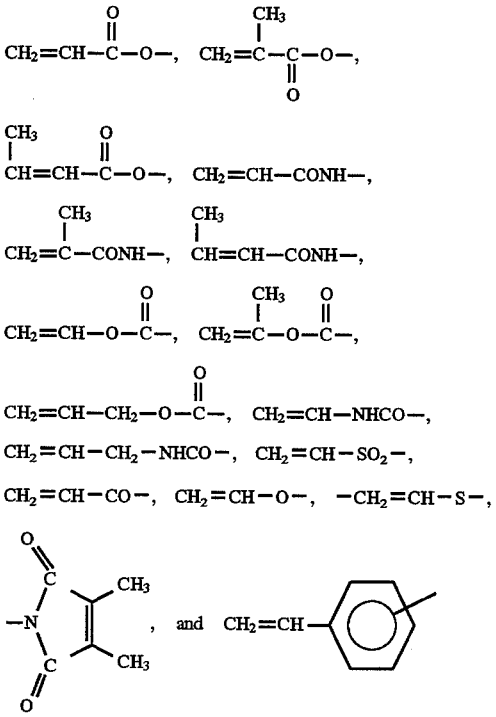

The polymer component containing the heat-and/or photo-curable group as described above is formed from a corresponding monomer copolymerizable with a monomer corresponding to the polymer component containing a functional group capable of forming a hydrophilic group as described hereinbefore. Preferred examples thereof include a polymer component represented by the following general formula (XI):

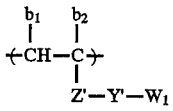

General Formula (XI)

wherein $b_1$, $b_2$, Z' and Y' each has the same meaning as defined in the general formula (X); and $W_1$ represents a heat- and/or photo-curable group.

In addition to the polymer component containing the hydrophilic group-forming functional group and the polymer component containing the photo- and/or heat-curable group, the resin (A) according to the present invention may further contain other polymer component(s). As such other polymer components, any monomers copolymerizable with the monomers corresponding to the polymer components described above may be used. Examples of suitable copolymerizable monomers are described, e.g., in Kobunshi Gakkai (ed.), *Kobunshi Data Handbook (Kisohen)*, Baifukan (1986) and J. Brandrup and E. H. Immergut, *Polymer Handbook*, John Wiley & Sons (1989).

Specific examples of the copolymerizable monomers include acrylic acid, an α- and/or β-substituted acrylic acid (e.g., α-acetoxyacrylic acid, α-acetoxymethylacrylic acid, α-(2-amino)methylacrylic acid, α-chloroacrylic acid, α-bromoacrylic acid, α-fluoroacrylic acid, α-tributylsilylacrylic acid, α-cyanoacrylic acid, β-chloroacrylic acid, β-bromoacrylic acid, α-chloro-β-methoxyacrylic acid, or α,β-dichloroacetic acid), methacrylic acid, itaconic acid, an itaconic half ester, an itaconic half amide, crotonic acid, a 2-alkenylcarboxylic acid (e.g., 2-pentenoic acid, 2-methyl-2-hexenoic acid, 2-octenoic acid, 4-methyl-2-hexenoic acid, or 4-ethyl-2-octenoic acid), maleic acid, a maleic half ester, a maleic half amide, vinylbenzenecarboxylic acid, vinylbenzenesulfonic acid, vinylsulfonic acid, vinylphosphonic acid, a dicarboxylic acid vinyl or allyl half ester, a methacrylic ester, an acrylic ester, a crotonic ester, an α-olefin, a vinyl or allyl ester of a carboxylic acid (examples of the carboxylic acid including e.g., acetic acid, propionic acid, butyric acid, valeric acid, benzoic acid, or naphthalenecarboxylic acid), acrylonitrile, methacrylonitrile, a vinyl ether, an itaconic ester (e.g., dimethyl itaconate or diethyl itaconate), an acrylamide, a methacrylamide, a styrene (e.g., styrene, vinyltoluene, chlorostyrene, hydroxystyrene, N,N-dimethylaminomethylstyrene, methoxycarbonylstyrene, methanesulfonyloxystyrene, or vinylnaphthalene), a vinyl sulfone-containing compound, a vinyl ketone-containing compound, and a heterocyclic vinyl compound (e.g., vinylpyrrolidone, vinylpyridine, vinylimidazole, vinylthiophene, vinylimidazoline, vinylpyrazole, vinyldioxane, vinylquinoline, vinyltetrazole, or vinyloxazine).

With respect to the content of each polymer component present in the resin (A) according to the present invention, the total amount of components containing the hydrophilic group-forming functional group (i.e., the total amount of the polymer component (a) and the polymer component (b)) is suitably from 60 to 95 parts by weight, preferably from 60 to 90 parts by weight based on 100 parts by weight of the total polymer components. A ratio of the polymer component (a)/the polymer component (b) is suitably from 5 to 90 parts by weight/from 95 to 10 parts by weight, preferably from 10 to 80 parts by weight/from 90 to 20 parts by weight based on 100 parts by weight of the total amont of the polymer component (a) and the polymer component (b). The content of the component containing the photoand/or heat-curable group (c) is suitably from 5 to 40% by weight, preferably from 10 to 30% by weight. The content of polymer components other than these polymer components is at most 35% by weight, When the content of each polymer component is out of the range described above, the effects of printing plate precursor according to the present invention may tend to decrease. Specifically, same disadvantages in that the prevention of background stain from the start of printing is deteriorated and in that a number of prints obtained decreases may be encountered. The range of each polymer component in the resin (A) described above is shown with respect to the resin (A) to be used at the preparation of a photoconductive layer.

Specific examples of the resin (A) are set forth below, but the present invention should not be construed as being limited thereto.

(A-1)

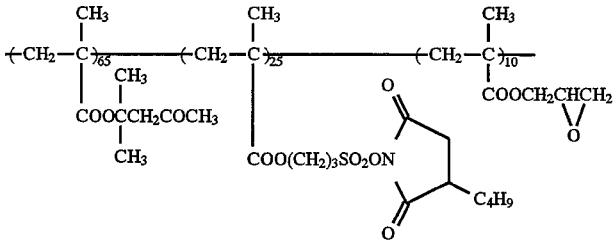

Weight average molecular weight (Mw) $4.5 \times 10^4$
(weight ratio, same as hereinafter)

(A-2)

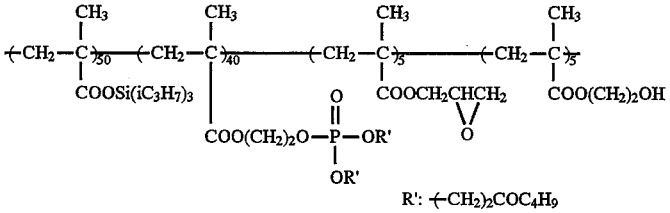

Weight average molecular weight (Mw) $5 \times 10^4$

TABLE B
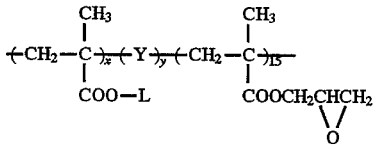
Mw was in a range of from $3 \times 10^4$ to $6 \times 10^4$.
| Resin (A) | −L | −Y− | x/y (weight ratio) |
|---|---|---|---|
| A-3 | 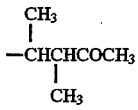 | 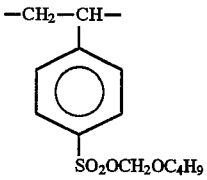 | 65/20 |
| A-4 | $\leftarrow CH_2)_2COC_4H_9$ | 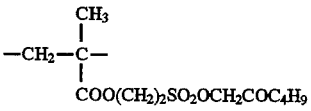 | 60/25 |
| A-5 | 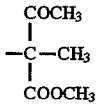 | 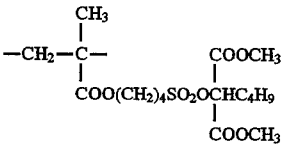 | 65/20 |
| A-6 | 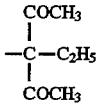 | 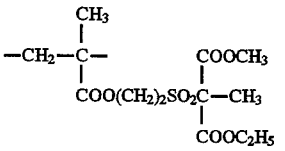 | 55/30 |
| A-7 | 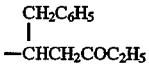 | 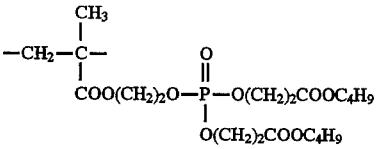 | 55/30 |
| A-8 | 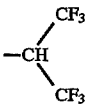 | 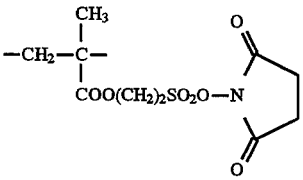 | 60/25 |
| A-9 | 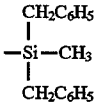 | 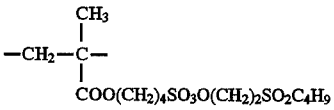 | 60/25 |
| A-10 | 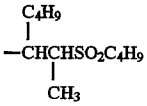 | 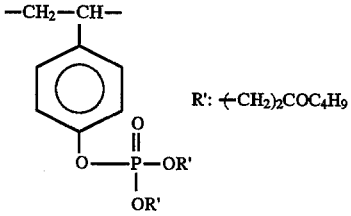 R': $\leftarrow CH_2)_2COC_4H_9$ | 65/20 |

TABLE B-continued
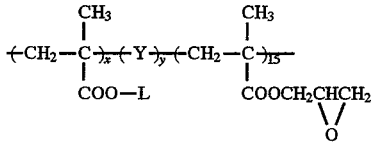
Mw was in a range of from $3 \times 10^4$ to $6 \times 10^4$.
| Resin (A) | −L | −Y− | x/y (weight ratio) |
|---|---|---|---|
| A-11 | 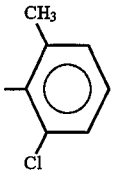 | 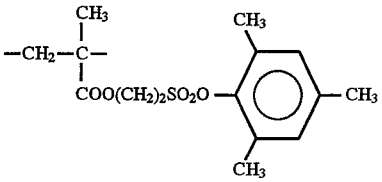 | 60/25 |
| A-12 | 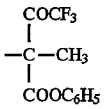 | 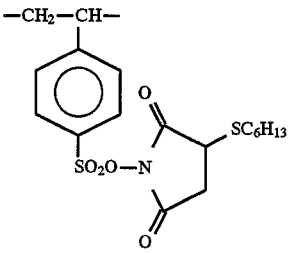 | 70/15 |
| A-13 | 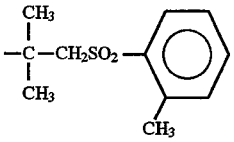 | 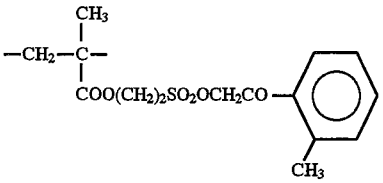 | 65/20 |
TABLE C
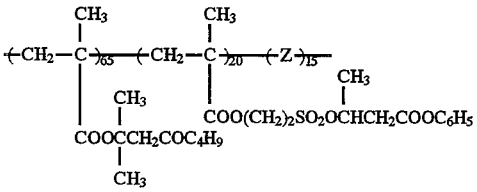
Mw was in a range of from $4 \times 10^4$ to $6 \times 10^4$.
| Resin (A) | Z |
|---|---|
| A-14 | 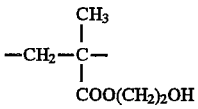 |
| A-15 | 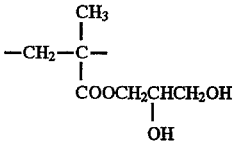 |
| A-16 | 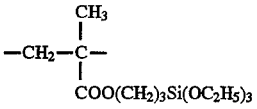 |

TABLE C-continued
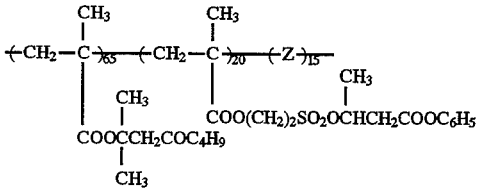
Mw was in a range of from $4 \times 10^4$ to $6 \times 10^4$.
| Resin (A) | Z |
|---|---|
| A-17 | 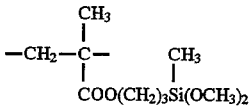 |
| A-18 | 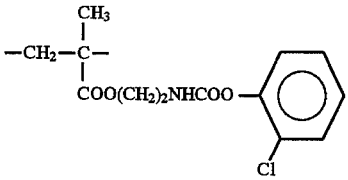 |
| A-19 | 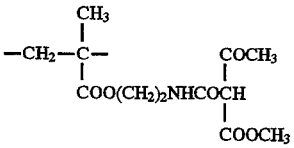 |
| A-20 | 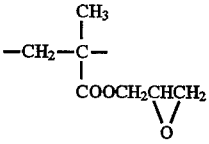 |
| A-21 | 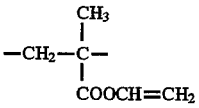 |
| A-22 | 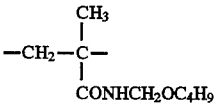 |
| A-23 | 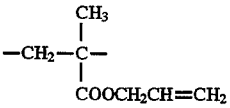 |
| A-24 | 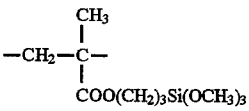 |
| (A-25) | 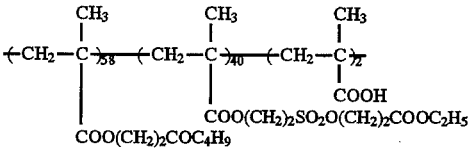 |
Weight average molecular weight $5 \times 10^4$ TABLE C-continued

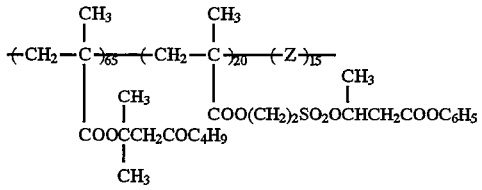

Mw was in a range of from $4 \times 10^4$ to $6 \times 10^4$.

| Resin (A) | Z |
|---|---|
| (A-26) | 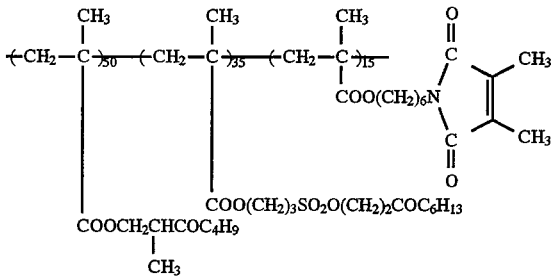 |

Weight average molecular weight $4.6 \times 10^4$

TABLE D

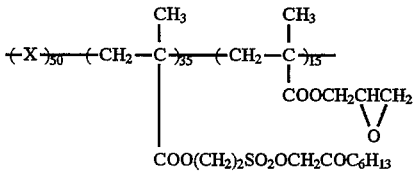

Mw was in a range of from $3 \times 10^4$ to $6 \times 10^4$.

| Resin (A) | X |
|---|---|
| A-27 | 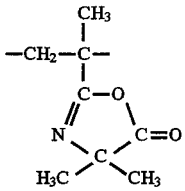 |
| A-28 | 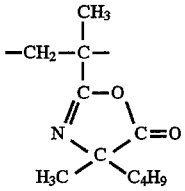 |
| A-29 | 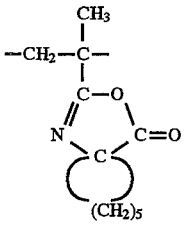 |

It should be noted that the resin (A) has the crosslinking structure based on the polymer component (c) upon function of photo- and/or heat during the preparation of a photoconductive layer in the resulting photoconductive layer of the electrophotographic lithographic printing plate precursor according to the present invention.

When the binder resin (B) is employed together with the resin (A) in the photoconductive layer of the lithographic printing plate according to the present invention, the electrostatic characteristics and reproducibility of duplicated image thereof are further improved. Specifically, it is believed that in the dispersion system wherein the low-molecular weight resin (B) containing the specified polar group is employed together with the resin (A), particles of photoconductive substance and, if desired, various sensitizers, the resin (B) has the important functions in that the resin is sufficiently adsorbed on the surface of particles of the photoconductive substance to disperse uniformly and to restrain the occurrence of aggregation due to its short polymer chain, in that the resin does not disturb the sufficient absorption of sensitizer compound such as a spectral sensitizing dye and a chemical sensitizer on the surface of particles of photoconductive substance and in that the resin is sufficiently absorbed to excessive active sites on the surface of the photoconductive substance to compensate the traps. As a result, the improved electrostatic characteristics and reproducibility of duplicated image (image forming performance) in practice can be obtained.

Moreover, when the resin (B) in which the polymer component of the general formula (I) is a methacrylate component having a specific substituent containing a benzene ring or a naphthalene ring represented by the general formula (Ia) or (Ib) shown below (hereinafter sometimes especially referred to as resin (BB)) is used, the electrophotographic characteristics, particularly, $V_{10}$, DRR and $E_{1/10}$ of the electrophotographic material can be furthermore improved. While the reason for this fact is not fully clear, it is believed that the polymer molecular chain of the resin is suitably arranged on the surface of particles of the photoconductive substance in the layer depending on the plane effect of the benzene ring or the naphthalene ring which is an ester component of the methacrylate. This effect is especially remarkable in a case wherein a polymethine dye or a phthalocyanine series pigment which are particularly effective as a spectral sensitizing dye for the region of near infrared to infrared light is used.

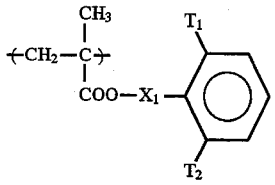

General Formula (Ia)

General Formula (Ib)

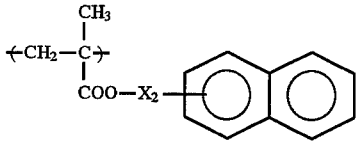

wherein $T_1$ and $T_2$ each represents a hydrogen atom, a hydrocarbon group having from 1 to 10 carbon atoms, a chlorine atom, a bromine atom, —$COQ_4$ or —$COOQ_5$ (wherein $Q_4$ and $Q_5$ each represents a hydrocarbon group having from 1 to 10 carbon atoms); and $X_1$ represents a mere bond or a linking group containing from 1 to 4 linking atoms, which connects —COO— and the benzene ring and $X_2$ represents a mere bond or a linking group which connects —COO— and the naphthalene ring.

Now, the resin (B) will be described in detail below.

While the resin (B) has the specific molecular weight and contains specific polymer components as described above, the structure thereof can be any of a linear type, a graft type formed from a macromonomer, and a starlike type. Also, each polymer component can be present at random or as a block in the resin.

Typical examples of the resin (B) which are preferably used in the present invention are described below.

Binder Resin (B1):

a random polymer containing a polymer component corresponding to the repeating unit represented by the general formula (I) and having the polar group in the polymer chain and/or bonded at one terminal of the polymer main chain.

Binder Resin (B2):

an AB or ABA block polymer comprising an A block containing a polymer component corresponding to the repeating unit represented by the general formula (I) and a B block containing a polymer component having the polar group.

Binder Resin (B3):

a graft copolymer formed from a monomer corresponding to the repeating unit represented by the general formula (I) and a monofunctional macromonomer ($M_1$) having a weight average molecular weight of not more than $1\times10^4$ and a polymerizable double bond group at one terminal of a polymer chain comprising a polymer component having the polar group.

Binder Resin (B4):

a graft copolymer formed from a monofunctional macromonomer ($M_2$) which is an AB block copolymer comprising an A block containing a polymer component having the polar group and a B block containing a polymer component corresponding to the repeating unit represented the the general formula (I) and which has a polymerizable double bond group at the terminal of the polymer main chain of the B block.

Binder Resin ($B_5$):

a starlike copolymer comprising an organic molecule having bonded thereto at least three polymer chains each containing at random a polymer component corresponding to the repeating unit represented by the general formula (I) and a polymer component having the polar group.

Binder Resin (B6):

a starlike copolymer comprising an organic molecule having bonded thereto at least three AB block polymer chains each comprising an A block containing a polymer component corresponding to the repeating unit represented by the general formula (I) and a B block containing a polymer component having the polar group.

Now, the binder resin ($B_1$) which is a random polymer containing a polymer component represented by the general formula (I) and having the specified polar group in the polymer main chain and/or bonded at one terminal of the polymer main chain according to the present invention will be described in more detail below.

The weight average molecular weight of the resin ($B_1$) is suitably from $1\times10^3$ to $2\times10^4$, preferably from $3\times10^3$ to $1\times10^4$ and the glass transition point of the resin ($B_1$) is preferably from −30° C. to 110° C., and more preferably from −20° C. to 90° C.

If the molecular weight of the resin ($B_1$) is less than $1\times10^3$ the film-forming ability thereof is undesirably reduced, whereby the photoconductive layer formed cannot keep a sufficient film strength. On the other hand, if the molecular weight thereof is larger than $2\times10^4$, the fluctuations of dark decay retention rate and photosensitivity of the photoconductive layer, particularly that containing a spectral sensitizing dye for sensitization in a range of from near infrared to infrared become somewhat large, and thus the effect for obtaining stable duplicated images according to the present invention is reduced under severe conditions of high-temperature and high-humidity or low-temperature and low-humidity.

In the resin ($B_1$), the content of the polymer component corresponding to the repeating unit represented by the general formula (I) is suitably not less than 30% by weight, preferably from 50 to 97% by weight, and the content of the polymer component containing the specified polar group is preferably from 0.05 to 15% by weight, more preferably from 1 to 10% by weight, as the total amount of the component bonded at one terminal of the main chain and the component contained in the main chain.

If the content of the polar group-containing polymer component in the resin ($B_1$) is less than 0.05% by weight, the resulting electrophotographic light-sensitive material has too low initial potential to provide a sufficient image density. If, on the other hand, it is more than 15% by weight, the dispersibility of the photoconductive substance tends to be reduced even though the resin has a low molecular weight resulting in decrease of the electrostatic characteristics.

Further, of the low-molecular weight resin ($B_1$), a resin (hereinafter sometimes referred to as resin ($BB_1$) containing a methacrylate component having the specified substituent selected from an unsubstituted benzene ring, an unsubstituted naphthalene ring and a benzene ring which has a specific substituent(s) at the 2-position or 2- and 6-positions thereof, represented by the general formula (Ia) or (Ib) described above and having the specified polar group bonded at one terminal is preferred.

The repeating unit represented by the general formula (I) described above, which is contained in an amount of not less than 30% by weight in the resin ($B_1$) will be further described below.

In the general formula (I), $a_1$ and $a_2$ each preferably represents a hydrogen atom, a cyano group, an alkyl group having from 1 to 4 carbon atoms (e.g., methyl, ethyl, propyl and butyl), —COO—$Q_8$ or —COO—$Q_8$ bonded via a hydrocarbon group (wherein $Q_8$ represents a hydrocarbon group, for example, an alkyl, alkenyl, aralkyl, alicyclic or aryl group which may be substituted, and specifically includes those as described for $Q_3$ hereinafter).

The hydrocarbon group in the above described —COO—$Q_8$ group bonded via a hydrocarbon group includes, for example, a methylene group, an ethylene group, and a propylene group.

$Q_3$ preferably represents an alkyl group having from 1 to 18 carbon atoms which may be substituted (e.g., methyl, ethyl, propyl, butyl, pentyl, hexyl, octyl, decyl, dodecyl, tridecyl, tetradecyl, 2-chloroethyl, 2-bromoethyl, 2-cyanoethyl, 2-hydroxyethyl, 2methoxyethyl, 2-ethoxyethyl, and 3-hydroxypropyl), an alkenyl group having from 2 to 18 carbon atoms which may be substituted (e.g., vinyl, allyl, isopropenyl, butenyl, hexenyl, heptenyl, and octenyl), an aralkyl group having from 7 to 12 carbon atoms which may be substituted (e.g., benzyl, phenethyl, naphthylmethyl, 2-naphthylethyl, methoxybenzyl, ethoxybenzyl, and methylbenzyl), a cycloalkyl group having from 5 to 8 carbon atoms which may be substituted (e.g., cyclopentyl, cyclohexyl, and cycloheptyl), or an aryl group which may be substituted (e.g., phenyl, tolyl, xylyl, mesityl, naphthyl, methoxyphenyl, ethoxyphenyl, fluorophenyl, difluorophenyl, bromophenyl, chlorophenyl, dichlorophenyl, iodophenyl, methoxycarbonylphenyl, ethoxycarbonylphenyl, and cyanophenyl).

More preferably, the polymer component corresponding to the repeating unit represented by the general formula (I) is a methacrylate component having the specific aryl group represented by the above described general formula (Ia) and/or (Ib) (resin ($BB_1$)).

In the general formula (Ia), $T_1$ and $T_2$ each preferably represents a hydrogen atom, a chlorine atom, a bromine atom, and a hydrocarbon group having 1 to 10 carbon atoms such as an alkyl group having from 1 to 4 carbon atoms (e.g., methyl, ethyl, propyl, and butyl), an aralkyl group having from 7 to 9 carbon atoms (e.g., benzyl, phenethyl, 3-phenylpropyl, chlorobenzyl, dichlorobenzyl, bromobenzyl, methylbenzyl, methoxybenzyl, and chloromethylbenzyl), an aryl group (e,g., phenyl, tolyl, xylyl, bromophenyl, methoxyphenyl, chlorophenyl, and dichlorophenyl), —$COQ_4$ or —$COOQ_5$ (wherein $Q_4$ and $Q_5$ each preferably represents any of the above-recited preferred hydrocarbon groups for $T_1$ and $T_2$).

In the general formula (Ia) or (Ib), $X_1$ and $X_2$ each represents a direct bond or linking group containing from 1 to 4 linking atoms which connects between —COO— and the benzene ring, e.g., $-(CH_2)_{n_1}-$ ($n_1$ represents an integer of from 1 to 3), —$CH_2OCO$—, —$CH_2CH_2OCO$—, $-(CH_2O)_{m_1}-$ ($m_1$ represents an integer of 1 or 2), and —$CH_2CH_2O$—, and preferably represents a direct bond or a linking group containing from 1 to 2 linking atoms.

Specific examples of the polymer component corresponding to the repeating unit represented by the general formula (Ia) or (Ib) which can be used in the resin ($B_1$) according to the present invention are set forth below, but the present invention should not be construed as being limited thereto. In the following formulae (a-1) to (a-20), n represents an integer of from 1 to 4; m represents an integer of from 0 to 3; p represents an integer of from 1 to 3; $R_9$ to $R_{12}$ each represents —$C_nH_{2n+1}$ or —$(CH_2)_m$—$C_6H_5$ (wherein n and m each has the same meaning as defined above); and $X_1$ and $X_2$, which may be the same or different, each represents a hydrogen atom, —Cl, —Br or —I.

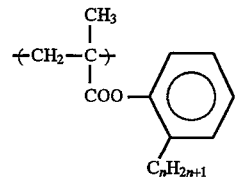
(a-1)

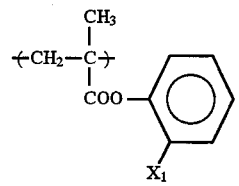
(a-2)

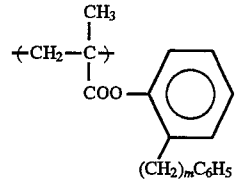
(a-3)

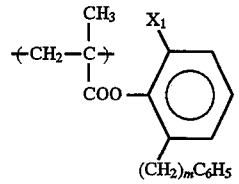
(a-4)

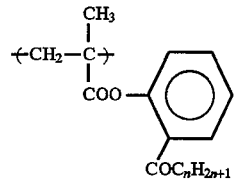
(a-5)

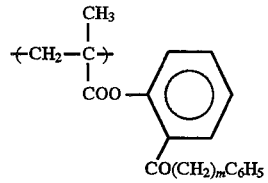
(a-6)

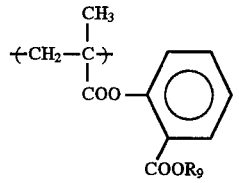
(a-7)

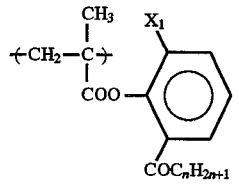
(a-8)

-continued (a-9)

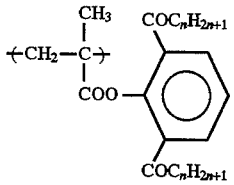

(a-10)

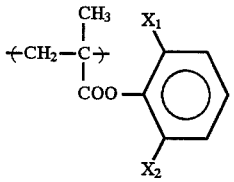

(a-11)

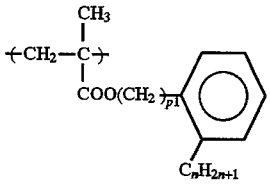

(a-12)

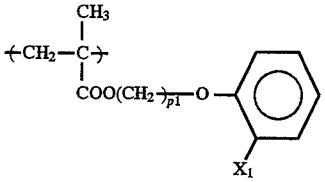

(a-13)

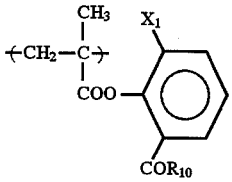

(a-14)

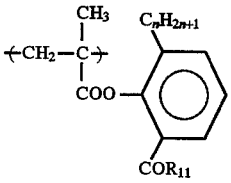

(a-15)

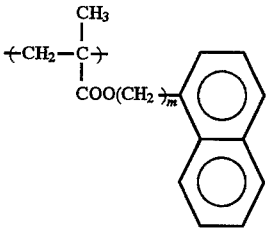

(a-16)

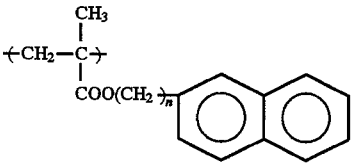

(a-17)

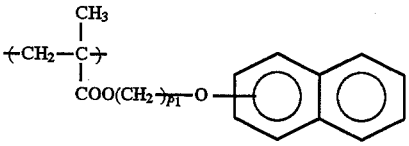

-continued (a-18)

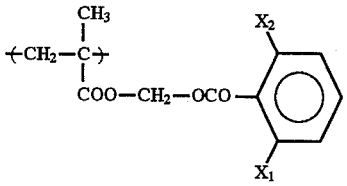

(a-19)

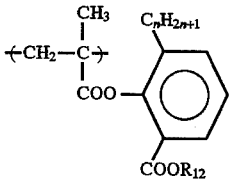

(a-20)

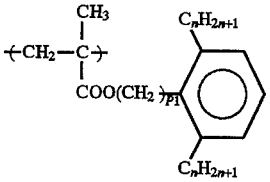

Now, the polymer component having the specified polar group present in the resin ($B_1$) will be described in detail below.

The polymer component having the specified polar group can exist either in the polymer chain (i.e., repeating unit) of the resin ($B_1$), at one terminal of the polymer chain or both of them.

The polar group included in the polar group-containing polymer component is selected from $—PO_3H_2$, $—SO_3H$, —COOH, $—P(=O)(OH)Q_1$, and a cyclic acid anhydride group, as described above. The $—P(=O)(OH)Q_1$ denotes a group-represented by the following formula:

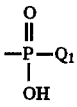

wherein $Q_1$ represents a hydrocarbon group or $—OQ_2$ (wherein $Q_2$ represents a hydrocarbon group). The hydrocarbon group represented by $Q_1$ preferably includes an aliphatic group having from 1 to 22 carbon atoms which may be substituted (e.g., methyl, ethyl, propyl, butyl, hexyl, octyl, decyl, dodecyl, octadecyl, 2-chloroethyl, 2-methoxyethyl, 3-ethoxypropyl, allyl, crotonyl, butenyl, cyclohexyl, benzyl, phenethyl, 3-phenylpropyl, methylbenzyl, chlorobenzyl, fluorobenzyl, and methoxybenzyl) and an aryl group which may be substituted (e.g., phenyl, tolyl, ethylphenyl, propylphenyl, chlorophenyl, fluorophenyl, bromophenyl, chloromethylphenyl, dichlorophenyl, methoxyphenyl, cyanophenyl, acetamidophenyl, acetylphenyl, and butoxyphenyl). $Q_2$ has the same meaning as defined for $Q_1$.

The cyclic acid anhydride group is a group containing at least one cyclic acid anhydride. The cyclic acid anhydride to be contained includes an aliphatic dicarboxylic acid anhydride and an aromatic dicarboxylic acid anhydride.

Specific examples of the aliphatic dicarboxylic acid anhydrides include succinic anhydride ring, glutaconic anhydride ring, maleic anhydride ring, cyclopentane-1,2-dicarboxylic acid anhydride ring, cyclohexane-1,2-dicarboxylic acid anhydride ring, cyclohexene-1,2-dicarboxylic acid anhydride ring, and 2,3-bicyclo[2,2,21]octanedicarboxylic acid anhydride. These rings may be substituted with, for example, a halogen atom (e.g., chlorine and bromine), and an alkyl group (e.g., methyl, ethyl, butyl and hexyl).

Specific examples of the aromatic dicarboxylic acid anhydrides include phthalic anhydride ring, naphthalenedicarboxylic acid anhydride ring, pyridine-dicarboxylic acid anhydride ring and thiophenedicarboxylic acid anhydride ring. These rings may be substituted with, for example, a halogen atom (e.g., chlorine and bromine), an alkyl group (e.g., methyl, ethyl, propyl, and butyl), a hydroxyl group, a cyano group, a nitro group, and an alkoxycarbonyl group (as the alkoxy group, e.g., methoxy and ethoxy).

In a case wherein the polar group is connected to the polymer chain of the resin ($B_1$), the polar group may be bonded to the polymer main chain either directly or via an appropriate linking group.

The linking group can be any group for connecting the polar group to the polymer main chain. Specific examples of suitable linking group include

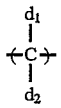

(wherein $d_1$ and $d_2$, which may be the same or different, each represents a hydrogen atom, a halogen atom (e.g., chlorine, and bromine), a hydroxyl group, a cyano group, an alkyl group (e.g., methyl, ethyl, 2-chloroethyl, 2-hydroxyethyl, propyl, butyl, and hexyl), an aralkyl group (e.g., benzyl, and phenethyl), a phenyl group),

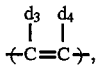

(wherein $d_3$ and $d_4$ each has the same meaning as defined for $d_1$ or $d_2$ above),

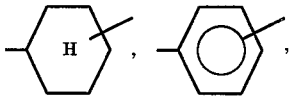

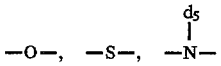

(wherein $d_5$ represents a hydrogen atom or a hydrocarbon group (preferably having from 1 to 12 carbon atoms (e.g., methyl, ethyl, propyl, butyl hexyl, octyl, decyl, dodecyl, 2-methoxyethyl, 2-chloroethyl, 2-cyanoethyl, benzyl, methylbenzyl, phenethyl, phenyl, tolyl, chlorophenyl, methoxyphenyl, and butylphenyl)), —CO—, —COO—, —OCO—,

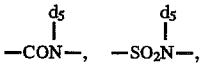

$—SO_2—$, —NHCONH—, —NHCOO—, $—NHSO_2—$, —CONHCOO—, —CONHCONH—, a heterocyclic ring (preferably a 5-membered or 6-membered ring containing at least one of an oxygen atom, a sulfur atom and a nitrogen atom as a hetero atom or a condensed ring thereof (e.g., thiophene, pyridine, furan, imidazole, piperidine, and morpholine)),

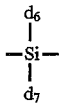

(wherein $d_6$ and $d_7$, which may be the same or different, each represents a hydrocarbon group or $—Od_8$ (wherein $d_8$ represents a hydrocarbon group)), and a combination thereof. Suitable examples of the hydrocarbon group represented by $d_6$, $d_7$ or $d_8$ include those described for $d_5$.

In the resin ($B_1$) according to the present invention, the ratio of the polar group present in the polymer chain to the polar group bonded to the terminal of the polymer main chain may be varied depending on the kinds and amounts of other binder resins, a resin grain, a spectral sensitizing dye, a chemical sensitizer and other additives which constitute the photoconductive layer according to the present invention, and can be appropriately controlled. What is important is that the total amount of the polar group-containing component present in the resin ($B_1$) is from 0.05 to 15% by weight.

The polymer component containing the polar group which can be used in the resin ($B_1$) may be derived from any of specified polar group-containing vinyl compounds copolymerizable with, for example, a monomer corresponding to the repeating unit represented by the general formula (I) (including that represented by the general formula (Ia) or (Ib)). Examples of such vinyl compounds are described, e.g., in Kobunshi Gakkai (ed.), *Kobunshi Data Handbook (Kisohen)*, Baifukan (1986). Specific examples of these vinyl monomers include acrylic acid, α- and/or β-substituted acrylic acids (e.g., α-acetoxy, α-acetoxymethyl, α-(2-amino)ethyl, α-chloro, α-bromo, α-fluoro, α-tributylsilyl, α-cyano, β-chloro, β-bromo, α-chloro-α-methoxy, and α,β-dichloro compounds), methacrylic acid, itaconic acid, itaconic half esters, itaconic half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic half esters, maleic half amides, vinylbenzenecarboxylic acid, vinylbenzenesulfonic acid, vinylsulfonic acid, vinylphosphonic acid, dicarboxylic acid vinyl or allyl half esters, and ester or amide derivatives of these carboxylic acids or sulfonic acids containing the specified polar group in the substituent thereof.

Specific examples of the polar group-containing polymer components are set forth below, but the present invention should not be construed as being limited thereto. In the following formulae, $e_1$ represents —H or $—CH_3$; $e_2$ represents —H, $—CH_3$ or $—CH_2COOCH_3$; $R_{14}$ represents an alkyl group having from 1 to 4 carbon atoms; $R_{15}$ represents an alkyl group having from 1 to 6 carbon atoms, a benzyl group or a phenyl group; c represents an integer of from 1 to 3; d represents an integer of from 2 to 11; e represents an integer of from 1 to 11; f represents an integer of from 2 to 4; and g represents an integer of from 2 to 10.

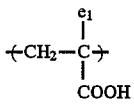

(b-1)

-continued
(b-2)
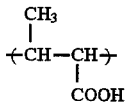
(b-3)
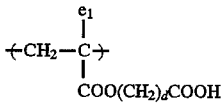
(b-4)
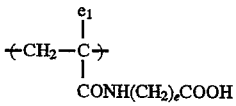
(b-5)
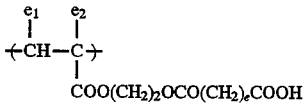
(b-6)
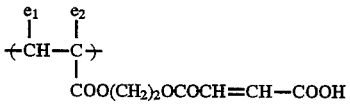
(b-7)
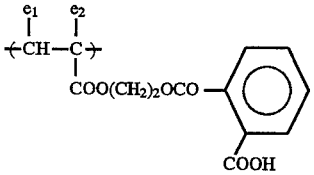
(b-8)
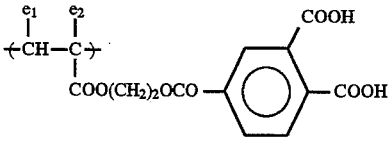
(b-9)
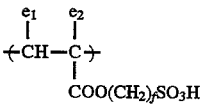
(b-10)
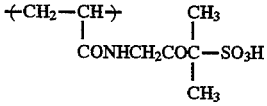
(b-11)
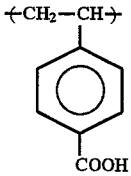
(b-12)
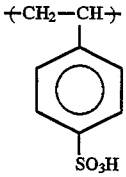
(b-13)
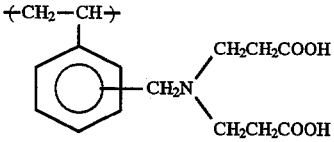
-continued
(b-14)
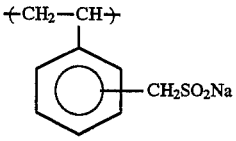
(b-15)
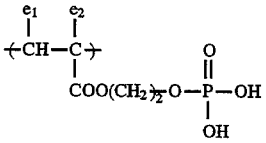
(b-16)
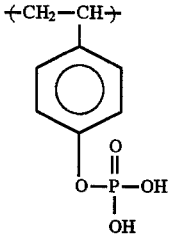
(b-17)
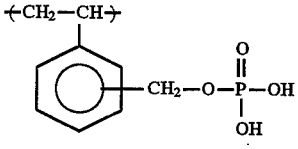
(b-18)
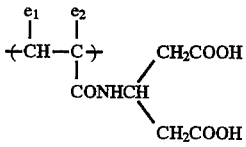
(b-19)
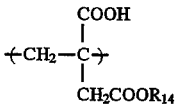
(b-20)
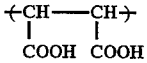
(b-21)
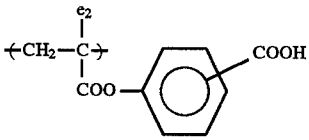
(b-22)
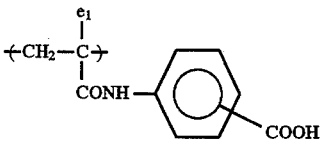
(b-23)
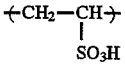
(b-24)
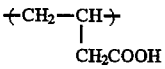
(b-25)
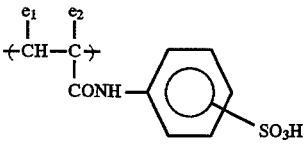

-continued
(b-26)
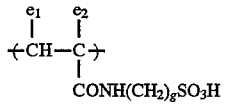
(b-27)
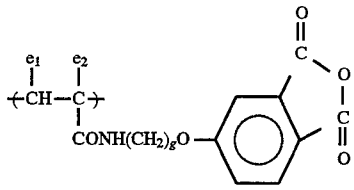
(b-28)
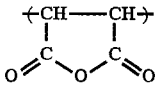
(b-29)
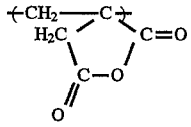
(b-30)
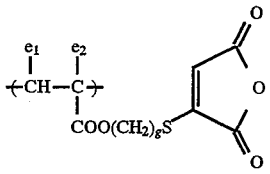
(b-31)
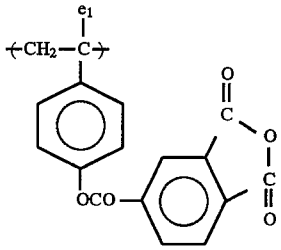
(b-32)
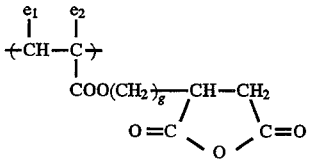
(b-33)
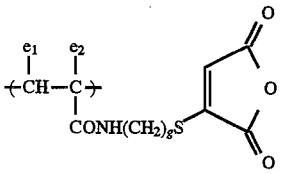
(b-34)
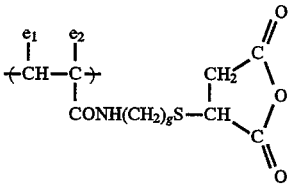
-continued
(b-35)
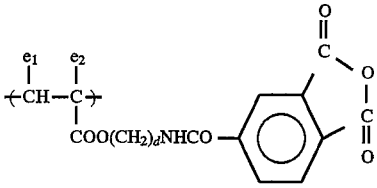
(b-36)
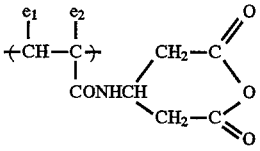
(b-37)
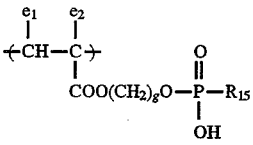
(b-38)
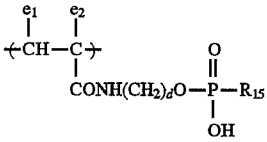
(b-39)
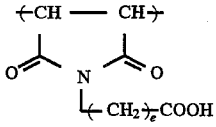
(b-40)
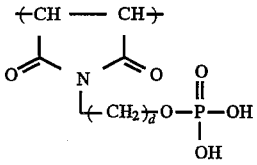
(b-41)
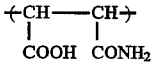
(b-42)
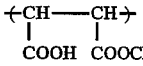
(b-43)
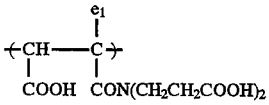
(b-44)
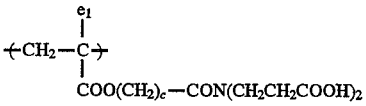
(b-45)
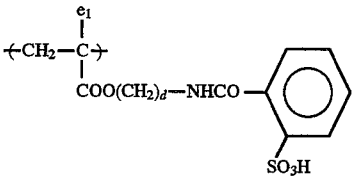

-continued (b-46)

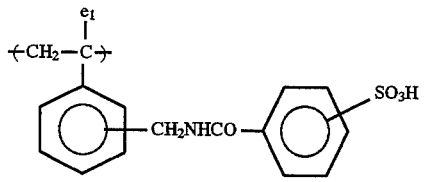

(b-47)

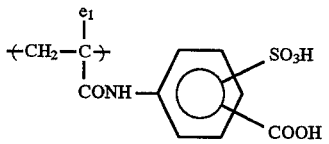

(b-48)

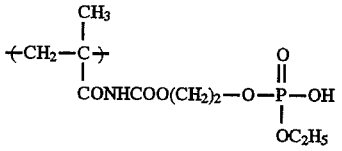

(b-49)

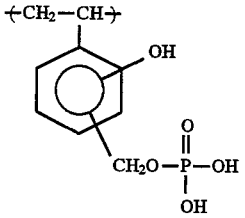

(b-50)

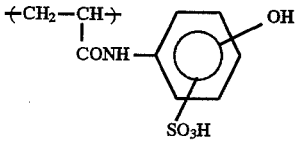

(b-51)

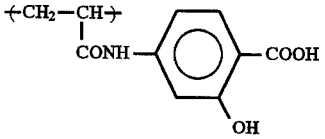

(b-52)

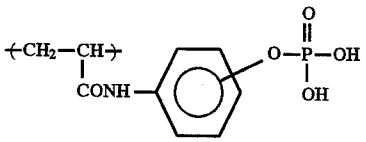

The resin ($B_1$) (including resin ($BB_1$)) may preferably contain a polymer component containing a photo- and/or heat-curable group in addition to the polymer component represented by the general formula (I), (Ia) and/or (Ib) and the polar group-containing component. The polymer components containing a photo-and/or heat-curable group which can be used are specifically same as those described for the resin (A).

The content of the curable group-containing polymer component in the resin ($B_1$) is not more than 20 parts by weight per 100 parts by weight of the total polymer components of the resin ($B_1$). If the content is too large, the electrophotographic characteristics of the light-sensitive material may tend to degradate.

Moreover, the resin ($B_1$) may further contain other polymer components. Examples of such other polymer components include, in addition to methacrylic acid esters, acrylic acid esters and crotonic acid esters containing substituents other than those described for the general formula (I), α-olefins, vinyl or allyl esters of carboxylic acids (including, e.g., acetic acid, propionic acid, butyric acid, valetic acid, benzoic acid, and naphthalenecarboxylic acid, as examples of the carboxylic acids), arylonitrile, methacrylonitrile, vinyl ethers, itaconic acid esters (e.g., dimethyl itaconate, and diethyl itaconate), acrylamides, methacrylamides, styrenes (e.g., styrene, vinyltoluene, chlorostyrene, hydroxystyrene, N,N-dimethylaminomethylstyrene, methoxycarbonylstyrene, methanesulfonyloxystyrene, and vinylnaphthalene), vinylsulfone-containing compounds, vinylketone-containing compounds, and heterocyclic vinyl compounds (e.g., vinylpyrrolidone, vinylpyridine, vinylimidazole, vinylthiophene, vinylimidazoline, vinylpyrazoles, vinyldioxane, vinylquinoline, vinyltetrazole, and vinyloxazine). It is desired that such other components do not exceed 30% by weight in the resin ($B_1$).

Introduction of the specified polar group into the terminal of the polymer main chain of the resin ($B_1$) can be easily conducted by an ion polymerization process, in which a various kind of reagents is reacted at the terminal of a living polymer obtained by conventionally known anion polymerization or cation polymerization; a radical polymerization process, in which radical polymerization is performed in the presence of a polymerization initiator and/or a chain transfer agent which contains the specified polar group in the molecule thereof; or a process, in which a polymer having a reactive group (for example, an amino group, a halogen atom, an epoxy group, and an acid halide group) at the terminal obtained by the above-described ion polymerization or radical polymerization is subjected to a polymer reaction to convert the terminal reactive group into the specified polar group.

More specifically, reference can be made, e.g., to P. Dreyfuss and R. P. Quirk, *Encycl. Polym. Sci. Eng.*, 7, 551 (1987), Yoshiki Nakajo and Yuya Yamashita, *Senryo to Yakuhin,* 30, 232 (1985), Akira Ueda and Susumu Nagai, *Kagaku to Kogyo,* 60, 57 (1986) and literature references cited therein.

Specific examples of chain transfer agents which can be used include mercapto compounds containing the polar group or the reactive group capable of being converted into the polar group (e.g., thioglycolic acid, thiomalic acid, thiosalicylic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoyl]propionic acid, 3-[N-(2-mercaptoethyl)amino]propionic acid, N-(3-mercaptopropionyl ) alanine, 2-mercaptoethanesulfonic acid, 2-mercaptoethanol, 3-mercapto-1,2-propanediol, 1-mercapto-2-propanol, 3-mercapto-2-butanol, mercaptophenol, 2-mercaptoethylamine, 2-mercaptoimidazole, 2-mercapto-3-pyridinol, 4-(2-mercaptoethyloxycarbonyl)phthalic acid anhydride, 2-mercaptoethylphosphonic acid, and monomethyl 2-mercaptoethylphosphonate), and alkyl iodide compounds containing the polar group or the polar group-forming reactive group (e.g., iodoacetic acid, iodopropionic acid, 2-iodoethanol, 2-iodoethanesulfonic acid, and 3-iodopropanesulfonic acid). Of these compounds mercapto compounds are preferred.

Specific examples of the polymerization initiators containing the polar group or the reactive group include 4,4'-azobis(4-cyanovaleric acid), 4,4'-azobis (4-cyanovaleric acid chloride), 2,2'-azobis(2-cyanopropanol), 2,2'-azobis(2-cyanopentanol), 2,2'-azobis[2-methyl-N-(2-hydroxyethyl) propionamide], 2,2'-azobis{2-methyl-N-[1,1-bis (hydroxymethyl)-2-hydroxyethyl]propionamide}, 2,2'-azobis{2-[1-(2-hydroxyethyl)-2-imidazolin-2-yl]propane}, 2,2'-azobis[2-(2-imidazolin-2-yl)propane], 2,2'-azobis[2-(4,5,6,7-tetrahydro-1H-1,3-diazepin-2-yl)propane], and derivatives thereof.

The chain transfer agent or polymerization initiator is preferably used in an amount of from 0.1 to 15 parts by weight, more preferably from 2 to 10 parts by weight, per 100 parts by weight of the total monomers used.

Now, the resin ($B_2$) according to the present invention which is an AB or ABA block polymer comprising an A block which contains a polymer component represented by the general formula (I) and does not contain the specified polar group-containing component and a B clock containing the specified polar group-containing component will be described in more detail below.

In the resin ($B_2$), the content of the specified polar group-containing polymer component present in the B block is suitably from 0.05 to 15 parts by weight, preferably from 0.1 to 10 parts by weight per 100 parts by weight of the resin ($B_2$).

If the content of the polar group-containing component in the resin ($B_2$) is less than 0.05 parts by weight, the initial potential is low and thus satisfactory image density can not be obtained. On the other hand, if the content of the polar group-containing component is larger than 15% parts by weight, various undesirable problems may occur, for example, the dispersibility is reduced, the film smoothness and the electrophotographic characteristics under high temperature and high humidity condition decrease, and further when the light-sensitive material is used as an offset master plate, the occurrence of background stains increases.

The weight average molecular weight of the resin ($B_2$) is from $1\times10^3$ to $2\times10^4$, and preferably from $3\times10^3$ to $1\times10^4$. If the weight average molecular weight of the resin ($B_2$) is less than $1\times10^3$ or if it is higher than $2\times10^4$, the effect of the resin ($B_2$) according to the present invention is reduced, whereby the electrophotographic characteristics thereof become almost the same as those of conventionally known resins.

The glass transition point of the resin ($B_2$) is preferably from −30° C. to 100° C., and more preferably from 0° C. to 90° C.

The polymer component which constitutes the A block of the AB or ABA block polymer (resin ($B_2$)) according to the present invention will be described in more detail below.

The A block contains the polymer component corresponding to the repeating unit represented by the general formula (I) described above and the content thereof in the A block is preferably from 30 to 100% by weight, more preferably from 50 to 100% by weight. The A block preferably does not contain the specified polar group-containing component which is contained in the B block.

The repeating unit represented by the general formula (I) used in the AB or ABA block polymer of resin ($B_2$) is same as that described in the resin ($B_1$) above.

Of the polymer components corresponding to the repeating unit represented by the general formula (I), those corresponding to the repeating unit represented by the general formula (Ia) or (Ib) are preferred same as in the resin ($B_1$) above.

Suitable examples of other polymer components which may be contained in the A block include those corresponding to the repeating unit represented by the following general formula (XII):

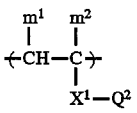

wherein $X^1$ represents

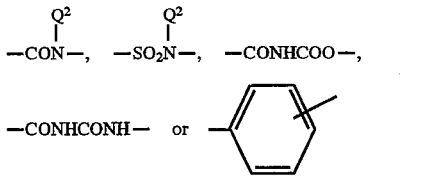

(wherein p represents an integer of from 1 to 3; and $Q^2$ represents a hydrogen atom or a hydrocarbon group); $Q^1$ represents a hydrocarbon group; and $m^1$ and $m^2$, which may be the same or different, each has the same meaning as $a_1$ or $a_2$ in the general formula (I).

Preferred examples of the hydrocarbon group represented by $Q^2$ include an alkyl group having from 1 to 18 carbon atoms which may be substituted (e.g., methyl, ethyl, propyl, butyl, heptyl, hexyl, octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methoxybenzyl, ethylbenzyl, methoxybenzyl, dimethylmethylbenzyl, and dimethoxybenzyl), an alicyclic group having from 5 to 8 carbon atoms which may be substituted (e.g., cyclohexyl, 2-cyclohexylethyl, and 2-cyclopentylethyl), and an aromatic group having from to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl).

When $X^1$ represents

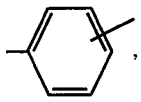

the benzene ring may be substituted. Suitable examples of the substituents include a halogen atom (e.g., chlorine, and bromine), an alkyl group (e.g., methyl, ethyl, propyl, butyl, chloromethyl, and methoxymethyl), and an alkoxy group (e.g., methoxy, ethoxy, propoxy, and butoxy).

Preferred examples of the hydrocarbon group represented by $Q^1$ include an alkyl group having from 1 to 22 carbon atoms which may be substituted (e.g., methyl, ethyl, propyl, butyl, heptyl, hexyl, octyl, decyl, dodecyl, tridecyl, tetradecyl, hexadecyl, octadecyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, and 4-methyl- 2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), an alicyclic group having from 5 to 8 carbon atoms which may be substituted (e.g., cyclohexyl, 2-cyclohexylethyl, and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl).

More preferably, in the general formula (XII), $X^1$ represents —COO—, —OCO—, —$CH_2$CO—, —$CH_2$COO—, —O—, —CONH—, —$SO_2$NH— or

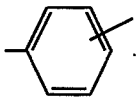

Moreover, the A block may further contain other polymer components corresponding to monomers copolymerizable with monomers corresponding to the polymer components represented by the general formula (XII).

Examples of such monomers include acrylonitrile, methacrylonitrile, and heterocyclic vinyl compounds (e.g., vinylpyridine, vinylimidazole, vinylpyrrolidone, vinylthiophene, vinylpyrazoles, vinyldioxane, and vinyloxazine). However, such other monomers are employed in an amount of not more than 20 parts by weight per 100 parts by weight of the total polymer components constituting the A block.

The polymer component which constitutes the B block of the AB block or ABA block polymer will be described in greater detail below.

The polar group-containing polymer component which constitutes the B block of the resin ($B_2$) is same as the polymer component corresponding to the repeating unit containing the polar group described in the resin ($B_1$) above.

Two or more kinds of the polymer components containing the specified polar group may be employed in the B block. In such a case, two or more kinds of the polar group-containing components may be contained in the B block in the form of a random copolymer or a block copolymer.

The B block may contain other polymer components than the polar group-containing polymer components described above. Preferred examples of such other polymer components include those corresponding to the repeating unit of the general formula (I) or (XII). Moreover, the B block may contain other polymer components. Examples of such other polymer components include other polymer components described in the resin ($B_1$) above. Such other monomers are employed in an amount of not more than 20 parts by weight per 100 parts by weight of the total polymer components constituting the B block.

The AB block or ABA block polymer of the resin ($B_2$) according to the present invention can be produced by a conventionally known polymerization reaction method. More specifically, it can be produced by a method comprising previously protecting the specified polar group of a monomer corresponding to the polymer component having the specified polar group to form a functional group, synthesizing a block copolymer by a so-called known living polymerization reaction, for example, an ion polymerization reaction with an organic metal compound (e.g., alkyl lithiums, lithium diisopropylamide, and alkylmagnesium halides) or a hydrogen iodide/iodine system, a photopolymerization reaction using a porphyrin metal complex as a catalyst, or a group transfer polymerization reaction, and then conducting a protection-removing reaction of the functional group which had been formed by protecting the polar group by a hydrolysis reaction, a hydrogenolysis reaction, an oxidative decomposition reaction, or a photodecomposition reaction to form the polar group. One example thereof is shown by the following reaction scheme (1):

Reaction Scheme (1)

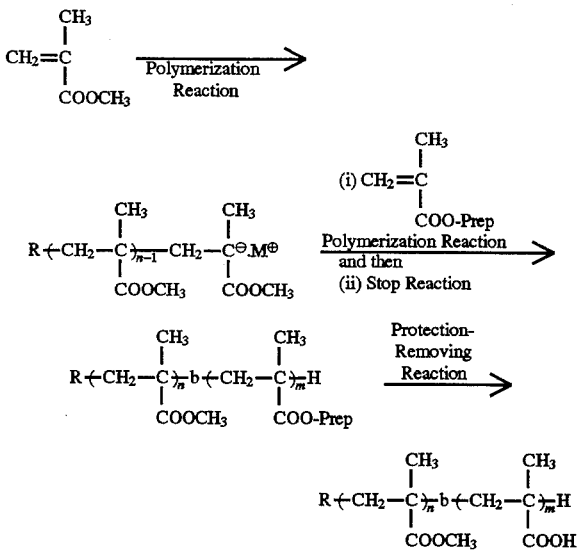

R: Alkyl group, porphyrin ring residue, etc.
Prep: Protective group (e.g., $-C(C_6H_5)_3$, $-Si(C_3H_7)_3$, etc.)
—b—: A bond connecting blocks Specifically, the block copolymer can be easily synthesized according to the synthesis methods described, e.g., in P. Lutz, P. Masson et al, *Polym. Bull.*, 12, 79 (1984), B. C. Anderson, G. D. Andrews et al, *Macromolecules*, 14, 1601 (1981), K. Hatada, K. Ute et al, *Polym. J.*, 17, 977 (1985), ibid., 18, 1037 (1986), Koichi Ute and Koichi Hatada, *Kobunshi Kako*, 36, 366 (1987), Toshinobu Higashimura and Mitsuo Sawamoto, *Kobunshi Ronbun Shu*, 46, 189 (1989), M. Kuroki and T. Aida, *J. Am. Chem. Soc.*, 109, 4737 (1989), Teizo Aida and Shohei Inoue, *Yuki Gosei KagakU*, 43, 300 (1985), and D. Y. Sogah, W. R. Hertler et al, *Macromolecules*, 20, 1473 (1987).

Further, the block copolymer of the resin ($B_2$) can be also synthesized by performing a polymerization reaction under light irradiation using a monomer having an unprotected polar group and also using a dithiocarbamate group-containing compound and/or xanthate group-containing compound as an initiator. For example, the block copolymer can be synthesized according to the synthesis methods described, e.g., in Takayuki Otsu, *Kobunshi*, 37, 248 (1988), Shunichi Himori and Ryuichi Otsu, *Polym. Rep. Jap.* 37, 3508 (1988), JP-A-64-111, JP-A-64-26619, Nobuyuki Higashi et al, *Polymer Preprints Japan*, 36, (6), 1511 (1987), and M. Niwa, N. Higashi et al, *J. Macromol. Sci. Chem.*, A24, (5), 567 (1987).

Also, the protection of the specific polar group by a protective group and the release of the protective group (a reaction for removing a protective group) with respect to the resin ($B_2$) can be easily conducted by utilizing conventionally known knowledges. More specifically, they can be performed by appropriately selecting methods described, e.g., in Yoshio Iwakura and Keisuke Kurita, *Hannosei Kobunshi*, Kodansha (1977), T. W. Greene, *Protective Groups in Organic Synthesis*, John Wiley & Sons (1981), and J. F. W. McOmie, *Protective Groups in Organic Chemistry*, Plenum Press, (1973), as well as the methods as described in the above references.

Moreover, the AB block copolymer can be synthesized by a method wherein an azobis compound containing either the A block portion or the B block portion (i.e., polymer azobis initiator) is synthesized and using the resulting polymer azobis initiator as an initiator, a radical polymerization reaction is conducted with corresponding monomers for forming another block. Specifically, the AB block copolymer can be synthesized by the methods described, for example, in Akira Ueda and Susumu Nagai, *Kobunshi Ronbun Shu*, 44, 469(1987), and Akira Ueda, *Osakashiritsu Kogyo Kenkyusho Hokoku*, 84, (1989).

In case of utilizing the above described synthesis method, a weight average molecular weight of the polymer azobis initiator is preferably not more than $2\times10^4$ in view of the easy synthesis of polymer azobis initiator and the regular polymerization reaction for the formation of block. On the other hand, it is preferred that the polymer chain of A block is longer than that of B block in the resin ($B_2$) according to the present invention. As a result, a polymer azobis initiator containing the B block portion is preferably employed when the AB block copolymer is synthesized according to the method. For example, the AB block copolymer is synthesized according to the following reaction scheme (2):

Reaction Scheme (2)

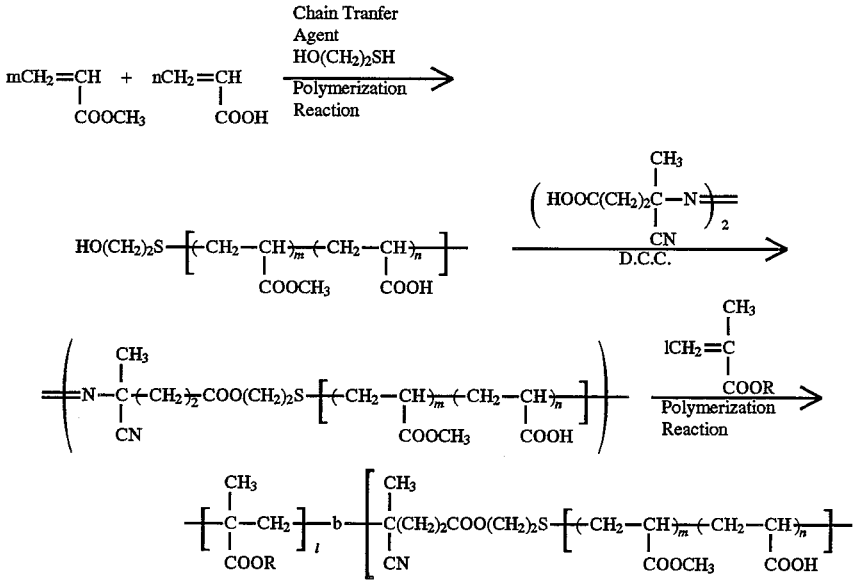

The glass transition point of the resin ($B_3$) is preferably not more than 120° C., and more preferably not more than 90° C.

If the weight average molecular weight of the resin ($B_3$) is less than $1\times10^3$ or higher than $2\times10^4$, the effect of the present invention disappears since the electrostatic characteristics decreases, even though the resin has the structure according to the present invention.

The macromonomer ($M_1$) used in the resin ($B_3$) contains the specified polar group-containing polymer component and the content of the specified polar group-containing component in the resin ($B_3$) is suitably from 0.05 to 15% by weight, preferably from 1 to 10% by weight.

If the content of the polar group-containing polymer component in the resin ($B_3$) is less than 0.05% by weight, the initial potential is low and thus satisfactory image density is hardly obtained. On the other hand, if the content of the polar group-containing component is larger than 15% by weight, the dispersibility of photoconductive substance is reduced, and further when the light-sensitive material is used as an offset master plate, the occurrence of background stains may increase even a low molecular weight resin.

The content of the polymer component corresponding to the repeating unit represented by the general formula (I) described above in the resin ($B_3$) is suitably not less than 30% by weight, and preferably from 50 to 97% by weight, and the content of the polymer component corresponding to the macromonomer ($M_1$) in the resin ($B_3$) is suitably from 3 to 50% by weight, and preferably from 3 to 40% by weight.

If the content of each component exceeds the above described range, the electrostatic characteristics (particularly, dark charge retention rate and photosensitivity) may be reduced, and further the effect of the present invention for obtaining stable duplicated images is reduced since fluctuations of dark charge retention rate and photosensitivity of the light-sensitive material, in particular, that containing a spectral sensitizing dye for sensitization in the range of from near-infrared to infrared become somewhat large under severe conditions of high temperature and high humidity or low temperature and low humidity.

Now, among the resin (B), the resin ($B_3$) which is a graft copolymer formed at least from a monomer corresponding to the repeating unit of the general formula (I) described above and a monofunctional macromonomer ($M_1$) containing the specified polar group will be described in more detail below.

The weight average molecular weight of the resin ($B_3$) is from $1\times10^3$ to $2\times10^4$, and preferably from $3\times10^3$ to $1\times10^4$.

In the resin ($B_3$), preferred examples of the repeating unit represented by the general formula (I) include also the repeating unit represented by the general formula (Ia) or the general formula (Ib) as described above.

Now, the monofunctional macromonomer ($M_1$) which is used in the resin ($B_3$) according to the present invention will be described in more detail below.

The monofunctional macromonomer ($M_1$) is a macromonomer having a weight average molecular weight of not more than $1\times10^4$ having a polymerizable double bond group bonded to only one terminal of its polymer main chain containing at least one polymer component having the specified polar group.

Preferred examples of the polymerizable double bond group used in the macromonomer ($M_1$) include those represented by the following general formula ($II^A$):

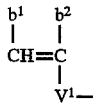

General Formula ($II^A$)

wherein $V^1$ represents —COO—, —OCO—, —$CH_2$OCO—, —$CH_2$COO—, —O—, —$SO_2$—, —CO—, —CONHCOO—, —CONHCONH—, —CONH$SO_2$—,

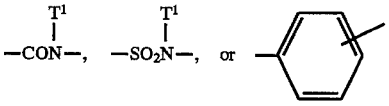

(wherein $T^1$ represents a hydrogen atom or a hydrocarbon group); and $b^1$ and $b^2$ each represents a hydrogen atom, a halogen atom, a cyano group, a hydrocarbon group, —COOZ" or —COOZ" bonded via a hydrocarbon group (wherein Z" represents a hydrogen atom or a hydrocarbon group).

Preferred examples of the hydrocarbon group represented by $T^1$ include those described for $Q^2$ of $X^1$ in the general formula (XII) with respect to the resin ($B_2$) above.

When $V^1$ represents

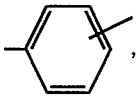

the benzene ring may further be substituted. Suitable examples of the substituents include a halogen atom (e.g., chlorine and bromine), an alkyl group (e.g., methyl, ethyl, propyl, butyl, chloromethyl and methoxymethyl) and an alkoxy group (e.g., methoxy, ethoxy, propoxy and butoxy).

In the general formula ($II^A$), $b^1$ and $b^2$, which may be the same or different, each preferably represents a hydrogen atom, a halogen atom (e.g., chlorine, and bromine), a cyano group, an alkyl group having from 1 to 4 carbon atoms (e.g., methyl, ethyl, propyl, and butyl), —COOZ" or —COOZ" bonded via a hydrocarbon group (wherein Z" preferably represents a hydrogen atom, an alkyl group having from 1 to 18 carbon atoms, an alkenyl group, an aralkyl group, an alicyclic group or an aryl group, each of which may be substituted). More specifically, the examples of the hydrocarbon groups are those described for $T^1$ above.

The hydrocarbon group via which —COOZ" is bonded includes, for example, a methylene group, an ethylene group, and a propylene group.

More preferably, in the general formula ($II^A$), $V^1$ represents —COO—, —OCO—, —$CH_2$OCO—, —$CH_2$COO—, —O—, —CONHCOO—, —CONHCONH—, —CONH—, —$SO_2$NH— or

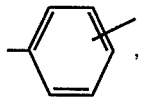

and $b^1$ and $b^2$, which may be the same or different, each represents a hydrogen atom, a methyl group, —COOZ", or —$CH_2$COOZ" (wherein Z" represents a hydrogen atom or an alkyl group having from 1 to 6 carbon atoms (e.g., methyl, ethyl, propyl, butyl and hexyl)). Further, more preferably, either one of $b^1$ and $b^2$ represents a hydrogen atom.

Specific examples of the polymerizable double bond group represented by the general formula ($II^A$) include

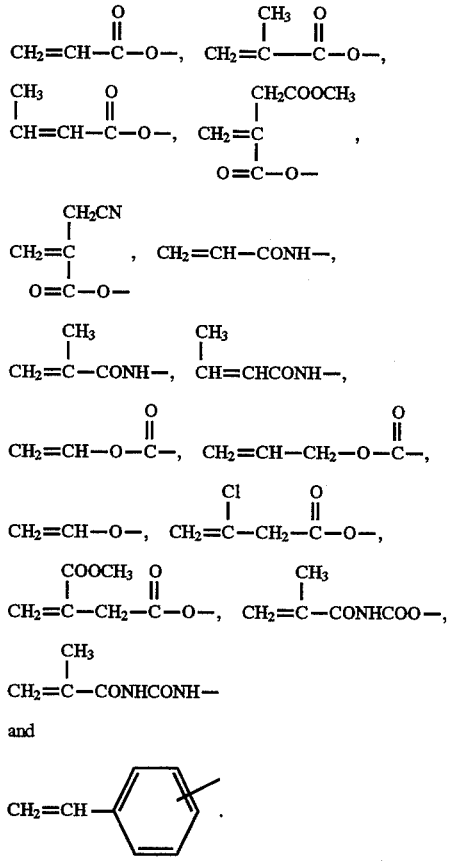

The macromonomer ($M_1$) according to the present invention contains a polymer component having the specified polar group as the polymer component constituting the polymer main chain. The polar group-containing polymer component used is same as that described with respect to the resin ($B_1$) above.

The macromonomer ($M_1$) used in the resin ($B_3$) according to the present invention may contain other polymer components in addition to the specified polar group-containing polymer component described above. Such other polymer components include a polymer component of a repeating unit represented by the following general formula ($III^A$):

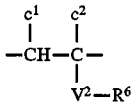

General Formula (III$^A$)

wherein $V^2$ has the same meaning as $V^1$ defined in the general formula (II$^A$) above. $R^6$ represents a hydrocarbon group, provided that when $V^2$ represents

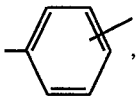

$R^6$ represents a hydrogen atom or a hydrocarbon group. Preferred examples of the hydrocarbon group represented by $R^6$ include those described for $Q^1$ in the general formula (XII) with repeat to the resin ($B_2$) above.

When $V^2$ represents

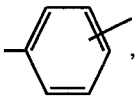

the benzene ring may further be substituted. Suitable examples of the substituents include a halogen atom (e.g., chlorine and bromine), an alkyl group (e.g., methyl, ethyl, propyl, butyl, chloromethyl and methoxymethyl) and an alkoxy group (e.g., methoxy, ethoxy, propoxy and butoxy).

In the general formula (III$^A$), $c^1$ and $c^2$, which may be the same or different, each has the same meaning as defined for $b^1$ or $b^2$ in the general formula (II$^A$) described above.

More preferably, in the general formula (III$^A$), $V^2$ represents —COO—, —OCO—, —$CH_2$OCO—, $CH_2$COO—, —O—, —CONH—, —$SO_2$NH—, or

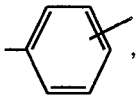

and $c^1$ and $c^2$, which may be the same or different, each represents a hydrogen atom, a methyl group, —$COOZ^3$, or —$CH_2COOZ^3$ (wherein $Z^3$ represents a hydrogen atom or an alkyl group having from 1 to 6 carbon atoms (e.g., methyl, ethyl, propyl, butyl and hexyl)). Further, more preferably, either one of $c^1$ and $c^2$ represents a hydrogen atom.

The content of such a polymer component is preferably from 50 to 99 parts by weight, and more preferably from 70 to 95 parts by weight per 100 parts by weight of the total polymer components constituting the macromonomer ($M_1$). Of the content of the polymer component exceeds the above described range, the electrostatic characteristics tends to decrease.

Further, the macromonomer ($M_1$) may contain, as a polymer component, one described as the other polymer component with respect to the resin ($B_1$) above. Such other components, however, are employed in a range of not more than 20 parts by weight per 100 parts by weight of the total polymer components constituting the resin ($B_3$).

The macromonomer ($M_1$) constituting the resin ($B_3$) according to the present invention can be produced by conventionally known synthesis methods. For instance, it can be produced by a method comprising previously protecting the specified polar group of a monomer corresponding to the polymer component having the specific polar group to form a functional group, synthesizing an AB block copolymer by a so-called known living polymerization reaction, for example, an ion polymerization reaction with an organic metal compound (e.g., alkyl lithiums, lithium diisopropylamide, and alkylmagnesium halides) or a hydrogen iodide/iodine system, a photopolymerization reaction using a porphyrin metal complex as a catalyst, or a group transfer polymerization reaction, introducing a polymerizable double bond group into the terminal of the resulting living polymer by a reaction with a various kind of reagent, and then conducting a protection-removing reaction of the functional group which has been formed by protecting the polar group by a hydrolysis reaction, a hydrogenolysis reaction, an oxidative decomposition reaction, or a photodecomposition reaction to generate the polar group.

An example thereof is shown by the following reaction scheme (3):

Reaction Scheme (3)

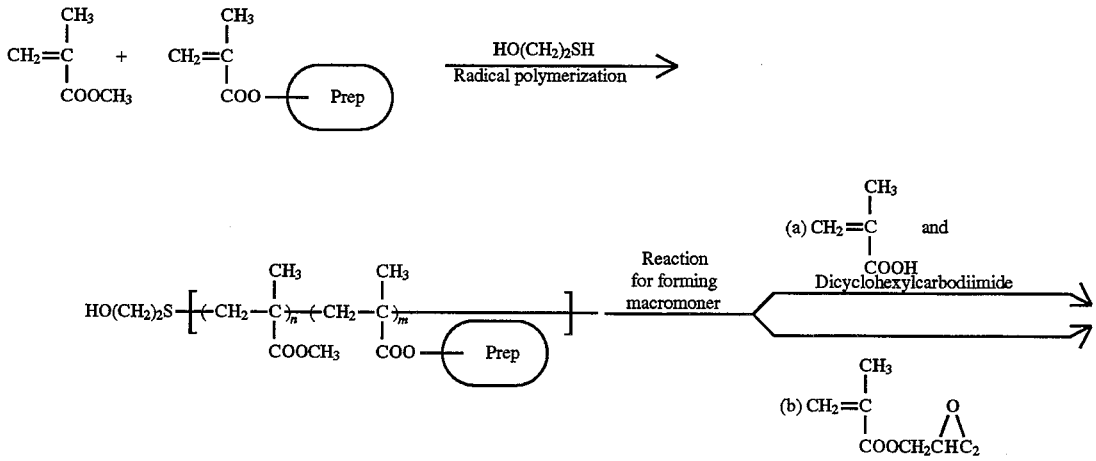

-continued

Reaction Scheme (3)

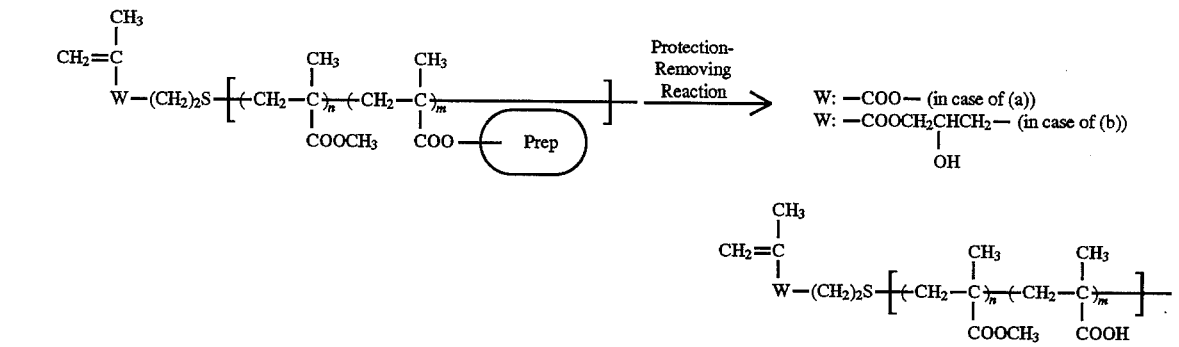

Prep : Protective group for —COOH n, m: Repeating unit

The living polymer can be easily synthesized according to synthesis methods as described, e.g., in P. Lutz, P. Masson et al, *Polym. Bull.,* 12, 79 (1984), B. C. Anderson, G. D. Andrews et al, *Macromolecules,* 14, 1601 (1981), K. Hatada, K. Ute et al, *Polym. J.,* 17, 977 (1985), ibid., 18, 1037 (1986), Koichi Ute and Koichi Hatada, *Kobunshi Kako,* 36, 366 (1987), Toshinobu Higashimura and Mitsuo Sawamoto, *Kobunshi Ronbun Shu,* 46, 189 (1989), M. Kuroki and T. Aida, *J. Am. Chem. Soc.,* 109, 4737 (1987), Teizo Aida and Shohei Inoue, *Yuki Gosei Kagaku,* 43, 300 (1985), and D. Y. Sogoh, W. R. Hertler et al, *Macromolecules,* 20, 1473 (1987).

In order to introduce a polymerizable double bond group into the terminal of the living polymer, a conventionally known synthesis method for macromonomer can be employed.

For details, reference can be made, for example, to P. Dreyfuss and R. P. Quirk, *Encycl. Polym. Sci. Eng.,* 7, 551 (1987), P. F. Rempp and E. Franta, *Adv. Polym. Sci.,* 58, 1 (1984), V. Percec, *Appl. Polym. Sci.,* 285, 95 (1984), R. Asami and M. Takari, *Makromol. Chem. Suppl.,* 12, 163 (1985), P. Rempp et al., *Makromol. Chem. Suppl.,* 8, 3 (1984), Yushi Kawakami, *Kogaku Kogyo,* 38, 56 (1987), Yuya Yamashita, *Kobunshi,* 31, 988 (1982), Shiro Kobayashi, *Kobunshi,* 30, 625 (1981), Toshinobu Higashimura, *Nippon Secchaku Kyokaishi,* 18, 536 (1982), Koichi Itoh, *Kobunshi Kako,* 35, 262 (1986), Kishiro Higashi and Takashi Tsuda, *Kino Zairyo,* 1987, No. 10, 5, and references cited in these literatures.

Also, the protection of the specified polar group and the release of the protective group (protection-removing reaction) in the preparation of the resin ($B_3$) according to the present invention can be easily conducted by utilizing conventionally known techniques. More specifically, they can be performed by appropriately selecting methods as described, e.g., in Yoshio Iwakura and Keisuke Kurita, *Hannosei Kobunshi,* Kodansha (1977), T. W. Greene, *Protective Groups in Organic Synthesis,* John Wiley & Sons (1981), and J. F. W. McOmie, *Protective Groups in Organic Chemistry,* Plenum Press, (1973), as well as methods as described in the above references.

Furthermore, the copolymer can also be synthesized by a photoinfeter polymerization method using a dithiocarbamate compound as an initiator. For example, the copolymer can be synthesized according to synthesis methods as described, e.g., in Takayuki Otsu, *Kobunshi,* 37, 248 (1988), Shunichi Himori and Ryuichi Ohtsu, *Polym. Rep. Jap.,* 37, 3508 (1988), JP-A-64-111, and JP-A-64-26619.

The macromonomer according to the present invention can be obtained by applying the above described synthesis method for macromonomer to the copolymer.

Now, among the resin (B), the resin ($B_4$) which is a graft copolymer formed at least from a monofunctional macromonomer ($M_2$) which is an AB block copolymer comprising an A block containing the polar group and a B block containing a polymer component represented by the general formula (I) described above and which has a polymerizable double bond group bonded at the terminal of the B block will be described in more detail below.

The weight average molecular weight of the resin ($B_4$) is from $1\times10^3$ to $2\times10^4$, and preferably from $3\times10^3$ to $1\times10^4$. The glass transition point of the resin ($B_4$) is preferably from −40° C. to 110° C., and more preferably from −20° C. to 90° C.

If the weight average molecular weight of the resin ($B_4$) is less than $1\times10^3$, the film-forming property of the resin is lowered, thereby a sufficient film strength cannot be maintained, and on the other hand, if the weight average molecular weight of the resin ($B_4$) is higher than $2\times10^4$, the effect of the present invention for obtaining stable duplicated images is reduced since fluctuations of electrophotographic characteristics (particularly, initial potential, dark charge retention rate and photosensitivity) of the photoconductive layer, in particular, that containing a spectral sensitizing dye for sensitization in the range of from near-infrared to infrared become somewhat large under severe conditions of high temperature and high humidity or low temperature and low humidity.

The content of the macromonomer ($M_2$) in the graft copolymer of resin ($B_4$) according to the present invention is suitably from 1 to 60% by weight, and preferably from 5 to 40% by weight.

If the content of the macromonomer ($M_2$) is less than 1% by weight in the resin ($B_4$), electrophotographic characteristics (particularly, dark charge retention rate and photosensitivity) may be reduced and the fluctuations of electrophotographic characteristics of the photoconductive layer, particularly that containing a spectral sensitizing dye for the sensitization in the range of from near-infrared to infrared become large depending on changes in ambient conditions. The reason therefor is considered that the construction of the polymer becomes similar to that of a conventional homopolymer or random polymer due to the presence of only a small amount of the macromonomer ($M_2$) which constitutes the graft portion. On the other hand, if the content of the macromonomer ($M_2$) in the resin ($B_4$) exceeds 60% by weight, the copolymerizability of the macromonomer ($M_2$) with other monomers corresponding to other copolymer components according to the present invention may become insufficient, and there is a tendency that the sufficient electrophotographic characteristics can not be obtained as the binder resin.

The content of the polar group-containing component present in the macromonomer ($M_2$) of the resin ($B_4$) according to the present invention is suitably from 0.05 to 15 parts by weight and preferably from 3 to 15 parts by weight per 100 parts by weight of the resin ($B_4$). The content of the polar group can be adjusted to the desired amount by controlling the composition rate of the A block in the macromonomer ($M_2$) and the copolymerization ratio of the macromonomer ($M_2$) in the resin ($B_4$).

If the content of the polar group-containing component in the resin ($B_4$) is less than 0.05% by weight, the initial potential is low and thus satisfactory image density is hardly obtained. On the other hand, if the content of the polar group-containing component is larger than 15% by weight, the dispersibility of photoconductive substance is reduced, and further when the light-sensitive material is used as an offset master plate, the occurrence of background stains may increase even a low molecular weight resin.

Now, the monofunctional macromonomer ($M_2$) used in the graft copolymer according to the present invention will be described in more detail below.

The copolymer component constituting the macromonomer ($M_2$) used in the resin ($B_4$) according to the present invention comprises the A block and the B block as described above, and a weight ratio of A block/B block is preferably 1/99 to 70/30 and more preferably 3/97 to 50/50.

The polar group-containing component present in the components constituting the A block of the macromonomer ($M_2$) is same as the polar group-containing component described with respect to the resin ($B_1$) above.

Two or more kinds of the polar group-containing components may be present in the A block, and in such a case, two or more kinds of these polar group-containing components may be contained in the form of a random copolymer or a block copolymer in the block A. The A block may further contain a component which does not contain the polar group (for example, a component represented by the general formula (I) described above) in addition to the polar group-containing component. The content of the polar group-containing component in the A block is preferably from 30 to 100% by weight.

The B block constituting a part of the macromonomer ($M_2$) may further contain a polymer component other than the polymer component represented by the general formula (I). Suitable examples of such other polymer components include acrylonitrile, methacrylonitrile, and heterocyclic vinyl compounds (e.g., vinylpyridine, vinylimidazole, vinylpyrrolidone, vinylthiophene, vinylpyrazole, vinyldioxane, and vinyloxazine. Such other monomers are employed in a range of not more than 20 parts by weight per 100 parts by weight of the total polymer components in the B block. Further, the B block preferably does not contain any specified polar group-containing polymer component which is a component constituting the A block. When two or more kinds of polymer components are present in the B block, two or more kinds of these polymer components may be contained in the B block in the form of a random copolymer or a block copolymer. However, it is preferred that they are present at random in view of simplicity in synthesis.

As described above, the macromonomer ($M_2$) to be used in the present invention has a structure of the AB block copolymer in which a polymerizable double bond group is bonded to one of the terminals of the B block composed of the polymer component represented by the general formula (I) described above and the other terminal thereof is connected to the A block composed of the polymer component containing the polar group described above. Now, the polymerizable double bond group will be described in detail below.

Suitable examples of the polymerizable double bond group include those represented by the general formula ($II^A$) described with respect to the resin ($B_3$) above.

The macromonomer ($M_2$) used in the present invention has a structure in which a polymerizable double bond group preferably represented by the general formula ($II^A$) is bonded to one of the terminals of the B block either directly or through an appropriate linking group. The linking group which can be used includes a carbon—carbon bond (either a single bond or a double bond), a carbon-hetero atom bond (the hetero atom includes, for example, an oxygen atom, a sulfur atom, a nitrogen atom, and a silicon atom), a hetero atom-hetero atom bond, and an appropriate combination thereof.

More specifically, the bond between the polymerizable double bond group and the terminal of the B block is a mere bond or a linking group selected from

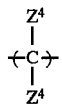

(wherein $Z^4$, which may be the same or different, each represents a hydrogen atom, a halogen atom (e.g., fluorine, chlorine, and bromine), a cyano group, a hydroxyl group, or an alkyl group (e.g., methyl, ethyl, and propyl),

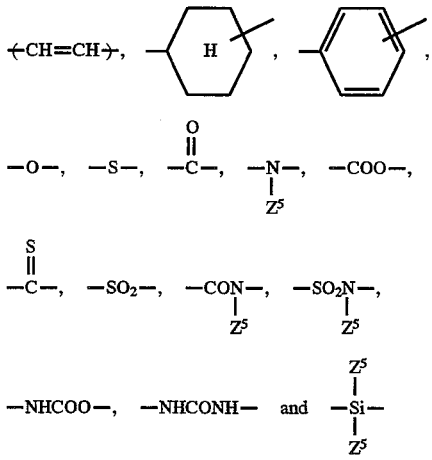

(wherein $Z^5$ each represents a hydrogen atom or a hydrocarbon group having the same meaning as defined for $Q^3$ in the general formula (I) described above), and an appropriate combination thereof.

If the weight average molecular weight of the macromonomer ($M_2$) exceeds $2\times10^4$, copolymerizability with other monomer (for example, monomer corresponding to the general formula (I) described above) is undesirably reduced. If, on the other hand, it is too low, the effect of improving electrophotographic characteristics of the light-sensitive layer would be small. Accordingly, the macromonomer ($M_2$) preferably has a weight average molecular weight of at least $1\times10^3$.

The macromonomer ($M_2$) used in the resin ($B_4$) according to the present invention can be produced by a conventionally known synthesis method. An example thereof is shown by the following reaction scheme (4):

Reaction Scheme (4)

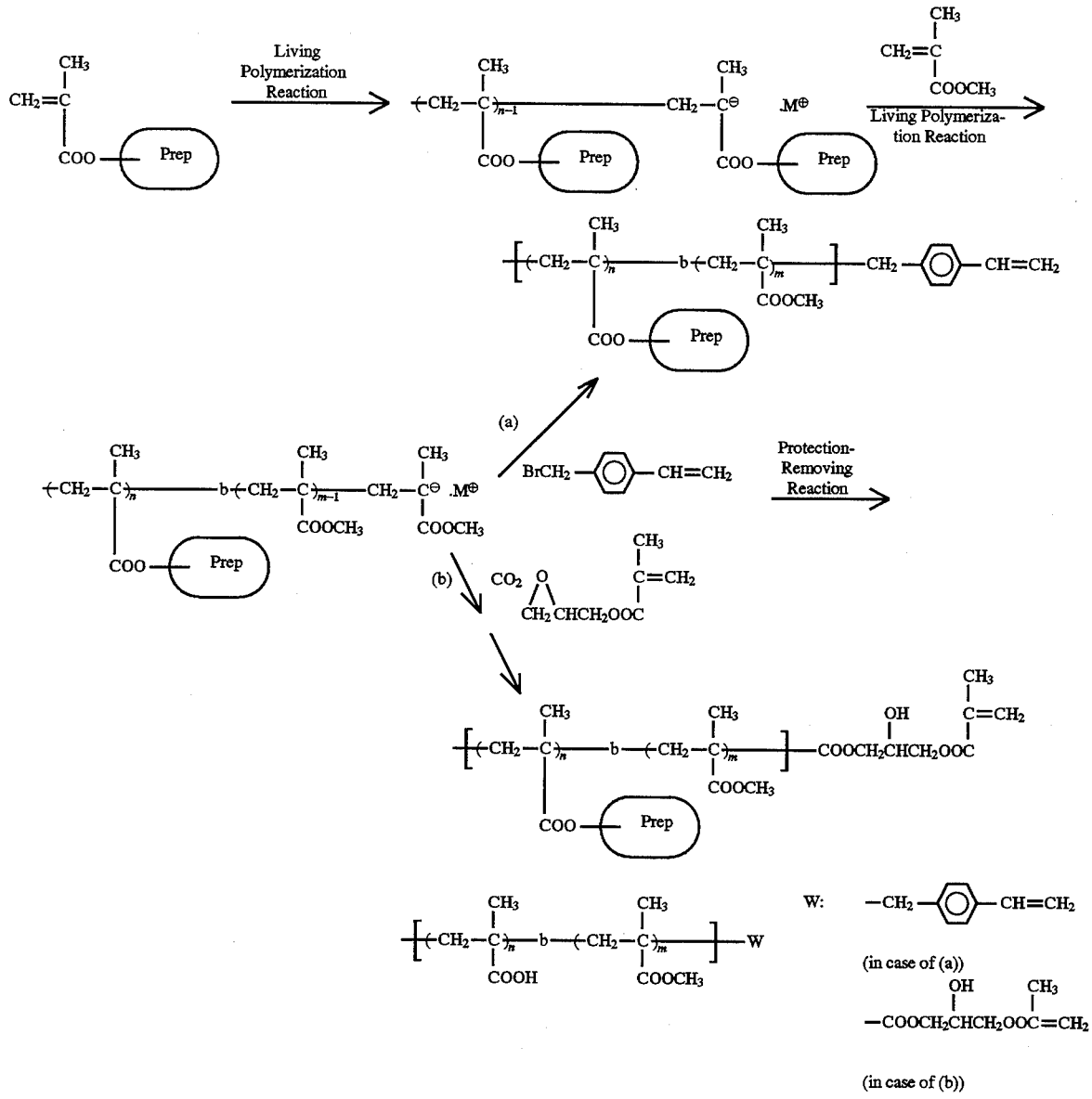

Prep : Protective group for —COOH

—b—: A bond connecting blocks n, m: Repeating unit

The method for synthesis of living polymer and the method for introducing a polymerizable double bond group into the terminal of the living polymer are same as those described with respect to the macromonomer ($M_1$) above.

Also, the protection of the specified polar group of the present invention and the release of the protective group (a reaction for removing a protective group) can be easily conducted by utilizing conventionally known techniques. More specifically, they can be performed in the same manner as described for the protection-removing reaction to the polar group in the resin ($B_3$) above.

Specific examples of the macromonomer ($M_2$) which can be used in the present invention are set forth below, but the present invention should not be construed as being limited thereto. In the following formulae, $p^3$, $p^4$ and $p^5$ each represents —H, —$CH_3$ or —$CH_2COOCH_3$; $p^6$ represents —H or —$CH_3$; $R^{11}$ represents —$C_pH_{2p+1}$ (wherein p represents an integer of from 1 to 18),

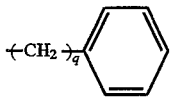
(wherein q represents an integer of from 1 to 3),
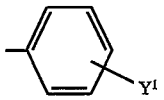
(wherein $Y^1$ represents —H, —Cl, —Br, —$CH_3$, —$OCH_3$ or —$COCH_3$) or
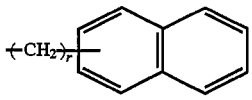
(wherein r represents an integer of from 0 to 3); $R^{12}$ represents —$C_sH_{2s+1}$ (wherein s represents an integer of from 1 to 8) or
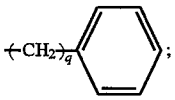
$Y^2$ represents —OH, —COOH, —$SO_3H$,
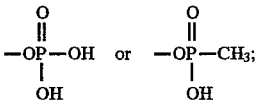
$Y^3$ represents —COOH,
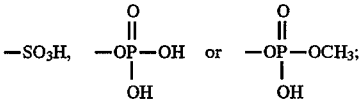
t represents an integer of from 2 to 12; and u represents an integer of from 2 to 6.
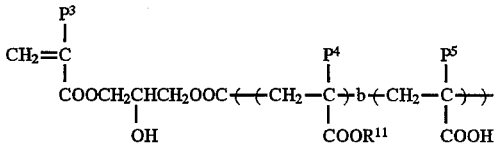
(M-1)
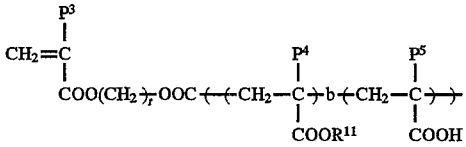
(M-2)
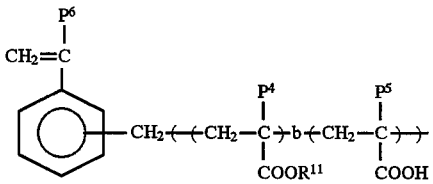
(M-3)
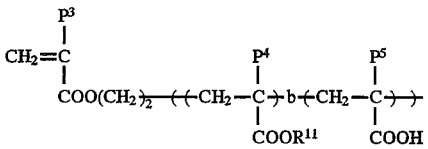
(M-4)
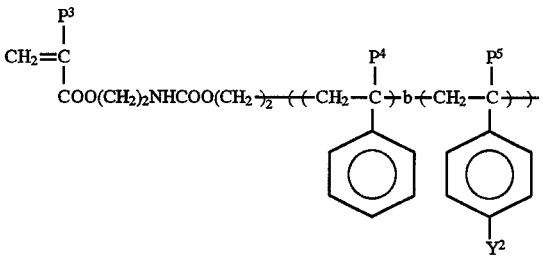
(M-5)

-continued
(M-6)
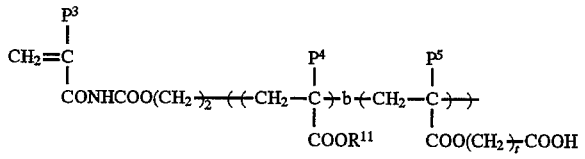
(M-7)
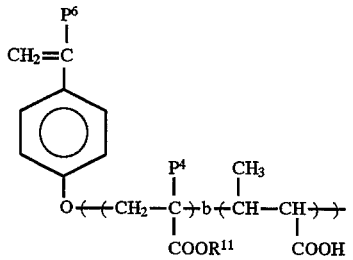
(M-8)
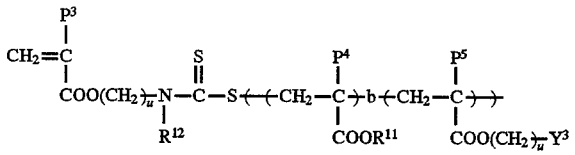
(M-9)
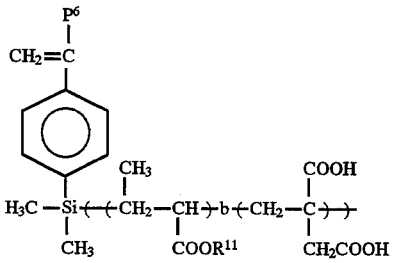
(M-10)
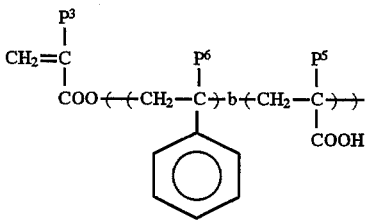
(M-11)
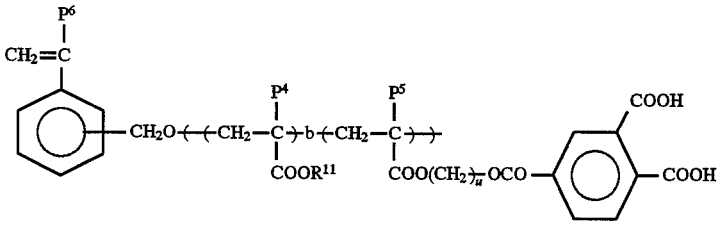
(M-12)
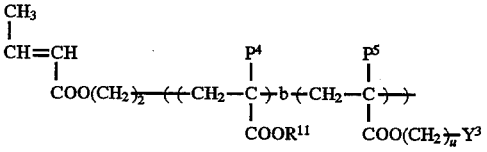
(M-13)
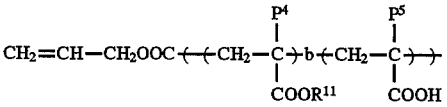

-continued

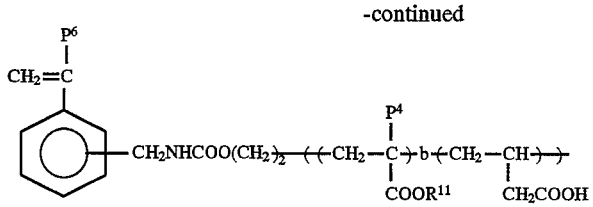

(M-14)

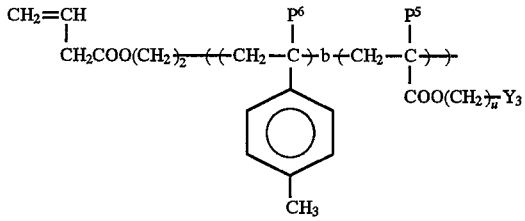

(M-15)

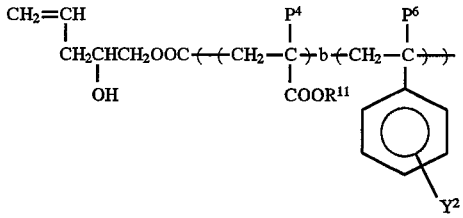

(M-16)

In the resin ($B_4$), the component represented by the general formula (I) described above is preferably used as a component copolymerizable with the macromonomer ($M_2$). It is preferred that the polymer main chain of the resin ($B_4$) does not contain a polymer component containing the polar group which is present in the A block of the macromonomer.

Of the repeating units represented by the general formula (I) used as the component of the resin ($B_4$), the methacrylate component represented by the general formula (Ia) or the general formula (Ib) as described with respect to the resin ($B_1$) above is preferred.

In the graft copolymer of the resin ($B_4$) according to the present invention, a polymer component copolymerizable with the macromonomer ($M_2$) may be one other than the component represented by the general formula (I), (Ia) or (Ib). Examples of such polymer components include the other polymer components containing substituents other than those defined for the general formula (I) as described with respect to the resin ($B_1$) above. Preferred examples include vinyl or allyl ester of alkanoic acids having from 1 to 3 carbon atoms, acrylonitrile, methacrylonitrile, styrene and styrene derivatives (e.g., vinyltoluene, butylstyrene, methoxystyrene, chlorostyrene, dichlorostyrene, bromostyrene, and ethoxystyrene).

The resin ($B_4$) according to the present invention can be produced by copolymerization of at least one compound each selected from the above described macromonomers ($M_2$) and other monomers (for example, those corresponding to the general formula (I)) in the desired ratio. The copolymerization can be performed using a known polymerization method, for example, solution polymerization, suspension polymerization, precipitation polymerization, and emulsion polymerization. More specifically, according to the solution polymerization monomers are added to a solvent such as benzene or toluene in the desired ratio and polymerized with an azobis compound, a peroxide compound or a radical polymerization initiator to prepare a copolymer solution. The solution is dried or added to a poor solvent whereby the desired copolymer can be obtained. In case of suspension polymerization, monomers are suspended in the presence of a dispersing agent such as polyvinyl alcohol or polyvinyl pyrrolidone and copolymerized with a radical polymerization initiator to obtain the desired copolymer.

Now, the starlike copolymer of the resin (B) according to the present invention will be described in more detail below.

The starlike copolymer of the resin (B) includes the resin ($B_5$) which is a starlike copolymer comprising an organic molecule having bonded thereto at least three polymer chains containing a polymer component (a) represented by the general formula (I) described above and a polymer component (b) containing the specified polar group, and the resin ($B_6$) which is a starlike copolymer comprising an organic molecule having bonded thereto at least three AB block polymer chains each containing an A block comprising at least a polymer component represented by the general formula (I) described above and a B block comprising at least a polymer component containing the specified polar group.

The resin ($B_5$) of the starlike copolymer comprising the polymer component (a) and the polymer component (b) can be schematically illustrated below.

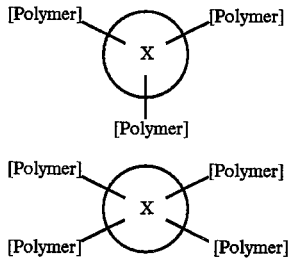

wherein X represents an organic molecule; and [Polymer] represents a polymer chain.

Three or more polymer chains which are bonded to the organic molecule may be the same as or different from each other and each contains at least the polymer component represented by the general formula (I) and the polar group-containing polymer component. The length of each polymer chain may be the same or different. A number of the polymer chains bonded to an organic molecule is at most 15, and usually about 10 or less.

In the resin ($B_6$) of the AB block starlike copolymer, the A block and the B block in the polymer chain can be arranged in any order. Specifically, the resin ($B_6$) can, for example, be schematically illustrated below.

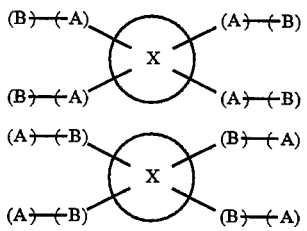

wherein X represents an organic molecule; (A) represents A block; (B) represents B block; and (A)–(B) represents a polymer chain. A number of the AB block polymer chains bonded to an organic molecule is at most 15, and usually about 10 or less.

The weight average molecular weight of the resins ($B_5$) and ($B_6$) is from $1\times10^3$ to $2\times10^4$, and preferably from $3\times10^3$ to $1\times10^4$. The glass transition point of the resins ($B_5$) and ($B_6$) is preferably from −40° C. to 110° C., and more preferably from −20° C. to 90° C.

If the weight average molecular weight of the resin ($B_5$) or ($B_6$) is less than $1\times10^3$, the film-forming property of the resin is lowered, thereby a sufficient film strength cannot be maintained, and on the other hand, if the weight average molecular weight of the resin ($B_5$) or ($B_6$) is higher than $2\times10^4$, the effect of the present invention for obtaining stable duplicated images is reduced since fluctuations of electrophotographic characteristics (particularly, initial potential, dark decay retention rate and photosensitivity) of the photoconductive layer, in particular, that containing a spectral sensitizing dye for sensitization in the range of from near-infrared to infrared become somewhat large under severe conditions of high temperature and high humidity or low temperature and low humidity.

The resin ($B_5$) used in the present invention has a structure of a starlike copolymer as described above, and the content of the polar group-containing polymer component (b) present in the polymer chains of the resin ($B_5$) is from 0.05 to 15 parts by weight, preferably from 3 to 15 parts by weight per 100 parts by weight of the resin ($B_5$).

If the content of the polar group-containing component in the resin ($B_5$) is less than 0.05% by weight, the initial potential is low and thus satisfactory image density can not be obtained. On the other hand, if the content of the polar group-containing component is larger than 15% by weight, the dispersibility is reduced, and further when the light-sensitive material is used as an offset master plate, the occurrence of background stains may increase even a low molecular weight resin. Two or more kinds of the polymer components containing the specified polar group may be present in the polymer chains of the resin ($B_5$).

The content of the polymer component corresponding to the repeating unit represented by the general formula (I) present in the polymer chains of the resin ($B_5$) comprising the polymer component (a) and the polymer component (b) is not less than 30 parts by weight, preferably from 30 to 99.95 parts by weight, more preferably from 50 to 99.5 parts by weight per 100 parts of the resin ($B_5$).

The content of the polar group-containing component present in the AB block starlike polymer of the resin ($B_6$) according to the present invention is from 0.05 to 15 parts by weight, preferably from 3 to 15 parts by weight per 100 parts by weight of the resin ($B_6$).

If the content of the polar group-containing component in the resin ($B_6$) is less than 0.05% by weight, the initial potential is low and thus satisfactory image density can not be obtained. On the other hand, if the content of the polar group-containing component is larger than 15% by weight, the dispersibility is reduced, and further when the light-sensitive material is used as an offset master plate, the occurrence of background stains may increase even a low molecular weight resin.

The content of the polymer component corresponding to a repeating unit represented by the general formula (I) in the A block of the resin ($B_6$) is preferably from 30 to 100% by weight, more preferably from 50 to 100% by weight. The A block preferably does not contain any specified polar group-containing component used in the B block.

The polymer components constituting the polymer chains of the starlike copolymer (resin ($B_5$) or ($B_6$)) according to the present invention will be described in detail below.

The repeating unit represented by the general formula (I) used in the starlike copolymer is same as that described with respect to the resin ($B_1$).

Of the repeating units represented by the general formula (I) in the starlike copolymer, those represented by the general formula (Ia) or (Ib) are preferred same as described with the resin ($B_1$) above.

The polar group-containing polymer component present in the polymer chain of the resin ($B_5$) or in the B block of the resin ($B_6$) is same as that described with respect to the resin ($B_1$) above.

Two or more kinds of the above-described polymer components containing the specified polar group may be employed in the polymer chain of the resin ($B_5$). The B block of the resin ($B_6$) may contain two or more kinds of the polymer components each having the specified polar group, and in this case, two or more kinds of these polar group-containing components may be contained in the B block in the form of a random copolymer or a block copolymer.

The polymer chain comprising the polymer components (a) and (b) of the resin ($B_5$) may contain other polymer components than the polar group-containing polymer components and the polymer components represented by the general formula (I). Also, the A block in the AB block starlike copolymer of the resin ($B_6$) may contain other polymer components than the polymer components represented by the general formula (I). Examples of such other polymer components include those represented by the general formula (XII) described with respect to the resin ($B_2$) above.

Moreover, the polymer chain of the resin ($B_5$) may further contain other polymer components corresponding to monomers copolymerizable with monomers corresponding to the polymer components represented by the general formula (XII), for example, the other copolymer components containing substituents other than those defined in the general formula (I) as described with respect to the resin ($B_1$) above. However, such other polymer components are preferably employed in an amount of not more than 20 parts by weight per 100 parts by weight of the total polymer components constituting the polymer chain.

The A block of the resin ($B_6$) may contain the above described polymer components represented by the general formula (XII) and, if desired, above described other polymer components corresponding to monomers copolymerizable with monomers corresponding to the polymer components represented by the general formula (XII), for example, components corresponding to acrylonitrile, methacrylonitrile and heterocyclic vinyl compounds (e.g., vinylpyridine, vinylimidazole, vinylpyrrolidone, vinylthiophene, vinylpyrazole, vinyldioxane, and vinyloxazine). However, such other polymer components are preferably employed in an amount of not more than 20 parts by weight per 100 parts by weight of the total polymer components of the A block.

The B block of the resin ($B_6$) may contain other polymer components than the above described polar group-containing polymer component. Preferred examples of such other polymer components include the above described polymer components corresponding to a repeating unit represented by the general formula (I) or (XII). Moreover, the B block may further contain other polymer components, for example, polymer components corresponding to monomers copolymerizable with monomers corresponding to the polymer components represented by the general formula (XII), such as those containing substituents other than those defined in the general formula (I) as described with respect to the resin ($B_1$) above.

The organic molecule to which at least three polymer chains are bonded and which is used in the starlike copolymer of the resin ($B_5$) or ($B_6$) according to the present invention is any organic molecule having a molecular weight of 1000 or less. Suitable examples of the organic molecules include those containing a trivalent or more hydrocarbon moiety shown below

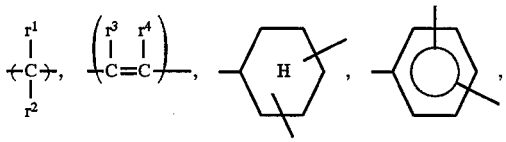

wherein ( ) represents a repeating unit; $r^1$, $r^2$, $r^3$ and $r^4$ each represents a hydrogen atom or a hydrocarbon group, provided that at least one of $r^1$ and $r^2$ or $r^3$ and $r^4$ is bonded to a polymer chain.

These organic moieties may be employed individually or as a combination thereof. In the latter case, the combination may further contain an appropriate linking unit, for example,

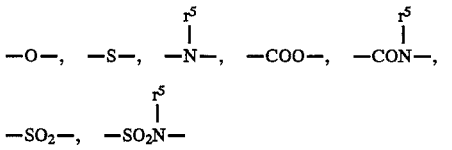

(wherein $r^5$ represents a hydrogen atom or a hydrocarbon group), —NHCOO—, —NHCONH— and a heterocyclic group containing at least one hetero atom such as oxygen, sulfur or nitrogen (e.g., thiophene, pyridine, pyran, imidazole, benzimidazole, furan, piperidine, pyrazine, pyrrole and piperazine, as the hetero ring).

Other examples of the organic molecules to which the polymer chains are bonded include those comprising a combination of

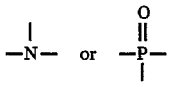

with a linking unit described above. However, the organic molecules which can be used in the present invention should not be construed as being limited to those described above.

The starlike copolymer according to the present invention can be prepared by utilizing conventionally known synthesis methods of starlike polymers using monomers containing a polar group and a polymerizable double-bond group. For instance, a method of polymerization reaction using a carboanion as an initiator can be employed. Such a method is specifically described in M. Morton, T. E. Helminiak et al, *J. Polym. Sci.*, 57, 471 (1962), B. Gordon III, M. Blumenthal, J. E. Loftus, et al *Polym. Bull.*, 11, 349 (1984), and R. B. Bates, W. A. Beavers, et al, *J. Org. Chem.*, 44, 3800 (1979). In case of using the reaction, it is required that the specified polar group according to the present invention be protected to form a functional group and the protective group be removed after polymerization.

The protection of the specified polar group of the present invention and the release of the protective group (a reaction for removing a protective group) can be easily conducted by utilizing conventionally known knowledges. More specifically, they can be performed by appropriately selecting methods described, e.g., in Yoshio Iwakura and Keisuke Kurita, *Hannosei Kobunshi*, Kodansha (1977), T. W. Greene, *Protective Groups in Organic Synthesis*, John Wiley & Sons (1981), and J. F. W. McOmie, *Protective Groups in Organic Chemistry*, Plenum Press, (1973), as well as methods as described in the above references.

Further, the copolymer can be synthesized by conducting a polymerization reaction under light irradiation using a monomer having the unprotected polar group and also using a dithiocarbamate group-containing compound and/or a xanthate group-containing compound as an initiator. For example, the copolymer can be synthesized according to the synthesis methods described, e.g., in Takayuki Otsu, *Kobunshi*, 37, 248 (1988), Shunichi Himori and Ryichi Otsu, *Polym. Rep. Jap.* 37, 3508 (1988), JP-A-64-111, JP-A-64-26619, Nobuyuki Higashi et al, *Polymer Preprints Japan*, 36 (6) 1511 (1987), and M. Niwa, N. Higashi et al, *J. Macromol. Sci. Chem.*, A24(5), 567 (1987).

The weight average molecular weight of the starlike copolymer of the resin ($B_5$) or ($B_6$) according to the present invention can be easily controlled in the desired range by appropriately selecting the kinds of monomers and polymerization initiator, the amounts of these components, the polymerization temperature, etc., as conventionally known in a polymerization reaction.

The amount of the binder resin (B) is preferably from 3 to 50 parts by weight, and more preferably from 5 to 20 parts by weight per 100 parts by weight of the total amount of the binder resin used in the photoconductive layer according to the present invention.

Now, a photo- and/or heat-curable compound which can be used together with the resin according to the present invention will be described in detail below.

The photo- and/or heat-curable compound includes any of low molecular weight compound, oligomer and polymer each having at least one photo- and/or heat-curable group. The photo- and/or heat-curable group means a group capable of inducing curing reaction of a resin on application of at least one of heat and light as described above. Specific examples of the photo-curable group and heat-curable group include those described for the functional group included in the polymer component (c) constituting the resin (A) above.

The photo- and/or heat-curable compounds include compounds commonly used as crosslinking agents, for example those described, e.g., in Shinzo Yamashita and Tosuke Kaneko (ed.), *Kakyozai Handbook*, Taiseisha (1981) and Kobunshi Gakkai (ed.), *Kobunshi Data Handbook (Kisohen)*, Baifukan (1986).

Specific examples of suitable curable compounds include organosilane compounds known as silane coupling agents (e.g., vinyltrimethoxysilane, vinyltributoxysilane, γ-glycidoxypropyltrimethoxysilane, γ-mercaptopropyltriethoxysilane, and γ-aminopropyltriethoxysilane), polyisocyanate compounds (e.g., toluylene diisocyanate, diphenylmethane diisocyanate, triphenylmethane triisocyanate, polymethylenepolyphenyl isocyanate, hexamethylene diisocyanate, isophorone diisocyanate, and polymeric polyisocyanates), blocked polyisocyanate compounds (examples of blocking agents including those described with respect to the polymer component (c) above), polycarboxylic acids and anhydrides thereof (e.g., phthalic acid, maleic acid, succinic acid, glutaric acid, itaconic acid, pyromellitic acid, benzene-1,2,4,5-tetracarboxylic acid, 3,3',4,4'-benzophenonetetracarboxylic acid, cyclohexanedicarboxylic acid, cyclohexenedicarboxylic acid, and anhydride thereof), polyol compounds (e.g., 1,4-butanediol, polyoxypropylene glycol, polyoxyethylene glycols, and 1,1,1-trimethylolpropane), polyamine compounds (e.g., ethylenediamine, γ-hydroxypropylated ethylenediamine, phenylenediamine, hexamethylenediamine, N-aminoethylpiperazine, and modified aliphatic polyamines), titanate coupling compounds (e.g., titanium tetrabutoxide, titanium tetrapropoxide, and isopropyltrisstearoyl titanate), aluminum coupling compounds (e.g., aluminum butylate, aluminum acetylacetate, aluminum oxide octate, and aluminum trisacetylacetate), polyepoxy group-containing compounds and epoxy resins (e.g., the compounds as described in Hiroshi Kakiuchi (ed.), *Shin-Epoxy Jushi,* Shokodo (1985) and Kuniyuki Hashimoto (ed.), *Epoxy Jushi,* Nikkan Kogyo Shinbunsha (1969)), melamine resins (e.g., the compounds as described in Ichiro Miwa and Hideo Matsunaga (ed.), *Urea•Melamine Jushi, Nikkan Kogyo Shinbunsha* (1969)), poly(meth)acrylate compounds (e.g., the compounds as described in Shin Okawara, Takeo Saegusa, and Toshinobu Higashimura (ed.), *Oligomer,* Kodansha (1976), Eizo Omori, *Kinosei Acryl-kei Jushi,* Techno System (1985)), styrene derivatives (e.g., divinylbenzene and trivinylbenzene); methacrylic, acrylic or crotonic acid esters, vinyl ethers, or allyl ethers of polyhydric alcohols (e.g., ethylene glycol, diethylene glycol, triethylene glycol, polyethylene glycol #200, #400 or #600, 1,3-butylene glycol, neopentyl glycol, dipropylene glycol, polypropylene glycol, trimethylolpropane, trimethylolethane, and pentaerythritol) or polyhydric phenols (e.g., hydroquinone, resorcin, catechol, and derivatives thereof); vinyl esters, allyl esters, vinyl amides, or allyl amides of dibasic acids (e.g., malonic acid, succinic acid, glutaric acid, adipic acid, pimelic acid, maleic acid, phthalic acid, and itaconic acid); condensation products of polyamines (e.g., ethylenediamine, 1,3-propylenediamine, and 1,4-butylenediamine) and vinyl group-containing carboxylic acids (e.g., methacrylic acid, acrylic acid, crotonic acid, and allylacetic acid); reaction products between vinyl group-containing carboxylic acids (e.g., methacrylic acid, acrylic acid, methacryloylacetic acid, acryloylacetic acid, methacryloylpropionic acid, acryloylpropionic acid, itaconyloylacetic acid, itaconyloylpropionic acid, and a carboxylic acid anhydride thereof) and alcohols or amines (e.g., allyloxycarbonylpropionic acid, allyloxycarbonylacetic acid, 2-allyloxycarbonylbenzoic acid, and allylaminocarbonylpropionic acid); vinyl group-containing ester derivatives or amide derivatives (e.g., vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, vinyloxycarbonylmethyloxycarbonylethylene acrylate, N-allylacrylamide, N-allylmethacrylamide, N-allylitaconamide, and methacryloylpropionic acid allylamide); and condensation products between amino alcohols (e.g., aminoethanol, 1-aminopropanol, 1-aminobutanol, 1-aminohexanol, and 2-aminobutanol) and vinyl-containing carboxylic acids.

Also, polymers containing the photo- and/or heat-curable group-containing polymer component which is included in the resin (A) described above may be employed. The weight average molecular weight of the photo- and/or heat-curable resin is suitably from $1\times10^3$ to $1\times10^6$, preferably from $3\times10^3$ to $1\times10^5$.

It is preferred that the binder resin and the curable compound, if desired, to be used in the photoconductive layer according to the present invention are so selected and combined that their functional groups easily undergo chemical bonding to each other between polymer chains. Combinations of functional groups which easily undergo a polymer reaction are well known. Specific examples of such combinations are shown in Table A° below, wherein a functional group selected from Group A can be combined with a functional group selected from Group B. However, the present invention should not be construed as being limited thereto.

TABLE A°

| Group A | Group B |
|---|---|
| —COOH, | 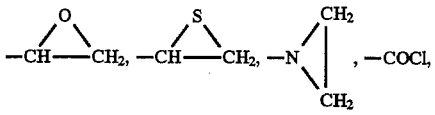 |
| $-PO_3H_2$, —OH, | |
| —SH, $-NH_2$, | $-SO_2Cl$, a cyclic acid anhydride group, |
| —NHR, $-SO_2H$ | —N=C=O, —N=C=S, |
| 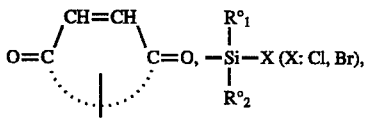 | |

TABLE A°-continued

| Group A | Group B |
|---|---|
| | $-\overset{R^\circ_3}{\underset{R^\circ_5}{\overset{\vert}{\underset{\vert}{Si}}}}-R^\circ_4$, a blocked isocyanate group, |
| | $-NHCOOR'$ (R': $-CH(CF_3)_2$, 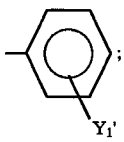 ; $Y_1'$: $-CH_3$, $-Cl$, $-OCH_3$), |
| | $-NHCOCH(B_1)(B_2)$ ($B_1$, $B_2$: an electron attracting group), |
| | 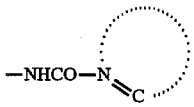 (e.g., an imidazole ring) |

In Table A°, $R^\circ_1$ and $R^\circ_2$ each represents an alkyl group; $R^\circ_3$, $R^\circ_4$, and $R^\circ_5$ each represents an alkyl group or an alkoxy group, provided that at least one of them is an alkoxy group.

If desired, a reaction accelerator may be added to the binder resin for accelerating the crosslinking reaction in the light-sensitive layer according to the present invention.

The reaction accelerators which may be used for the crosslinking reaction forming a chemical bond between functional groups include organic acids (e.g., acetic acid, propionic acid, butyric acid, benzenesulfonic acid, and p-toluenesulfonic acid), phenols (e.g., phenol, chlorophenol, nitrophenol, cyanophenol, bromophenol, naphthol, and dichlorophenol), organometallic compounds (e.g., zirconium acetylacetonate, zirconium acetylacetone, cobalt acetylacetonate, and dibutoxytin dilaurate), dithiocarbamic acid compounds (e.g., diethyldithiocarbamic acid salts), thiuram disulfide compounds (e.g., tetramethylthiuram disulfide), and carboxylic acid anhydrides (e.g., phthalic anhydride, maleic anhydride, succinic anhydride, butylsuccinic anhydride, benzophenone-3,3',4,4'-tetracarboxylic acid dianhydride, and trimellitic anhydride).

The reaction accelerators which may be used for the crosslinking reaction involving polymerization include polymerization initiators, such as peroxides and azobis compounds.

After a coating composition for the light-sensitive layer is coated, the binder resin constituting the main component thereof is cured by light and/or heat. Heat curing can be carried out by drying under severer conditions than those for the production of a conventional light-sensitive material. For example, elevating the drying temperature and/or increasing the drying time may be utilized. After drying the solvent of the coating composition, the film is preferably subjected to a further heat treatment, for example, at 60° to 150° C. for 5 to 120 minutes. The conditions of the heat treatment may be made milder by using the above-described reaction accelerator in combination.

Curing of the resin containing a photo-curable functional group can be carried out by incorporating a step of irradiation of actinic ray into the production line. The actinic rays to be used include visible light, ultraviolet light, far ultraviolet light, electron beam, X-ray, γ-ray, and α-ray, with ultraviolet light being preferred. Actinic rays having a wavelength range of from 310 to 500 nm are more preferred. In general, a low-, high- or ultrahigh-pressure mercury lamp or a halogen lamp is employed as a light source. Usually, the irradiation treatment can be sufficiently performed at a distance of from 5 to 50 cm for 10 seconds to 10 minutes.

The photoconductive layer may further contain other binder resins according to the present invention. The binder resins which can be used in the photoconductive layer according to the present invention include those used for conventionally known electrophotographic light-sensitive layers. Suitable examples of such resins are described, e.g., in Takaharu Shibata and Jiro Ishiwatari, *Kobunshi,* 17, 278 (1968), Harumi Miyamoto and Hidehiko Takei, *Imaging,* 1973, No. 8, Koichi Nakamura (ed.), *Kioku Zairyoyo Binder no Jissai Gijutsu,* Ch. 10, C.M.C. (1985), Denshishashin Gakkai (ed.), *Denshishashinyo Yukikankotai no Genjo Symposium* (preprint) (1985), Hiroshi Kokado (ed.), *Saikin no Kododen Zairyo to Kankotai no Kaihatsu•Jitsuyoka,* Nippon Kagaku Joho (1986), Denshishashin Gakkai (ed.), *Denshishashin Gijutsu no Kiso to Oyo,* Ch. 5, Corona (1988), D. Tatt and S. C. Heidecker, *Tappi,* 49, No. 10, 439 (1966), E. S. Baltazzi and R. G. Blanchlotte, et al., *Photo. Sci. Eng.,* 16, No. 5, 354 (1972), and Nguyen Chank Keh, Isamu Shimizu and Eiichi Inoue, *Denshi Shashin Gakkaishi,* 18, No. 2, 22 (1980).

Specific examples of these known binder resins used include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, butadiene-styrene copolymers, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy-modified silicone resins, polycarbonate resins, ketone resins, polyester resins, silicone resins, amide resins, hydroxy- or carboxy-modified polyester resins, butyral resins, polyvinyl acetal resins, cyclized rubber-methacrylic ester copolymers, cyclized rubber-acrylic ester copolymers, copolymers containing a heterocyclic ring containing no nitrogen atom (the heterocyclic ring including furan, tetrahydrofuran, thiophene, dioxane, dioxofuran, lactone, benzofuran, benzothiophene and 1,3-dioxetane rings), and epoxy resins.

Such other binder resins which may be present are employed in an amount which does not disturb the generation of water retentivity of the layer after the oil-desensitizing treatment of the light-sensitive material according to the present invention. Specifically, they are employed at most 30 parts by weight, preferably 20% by weight or less per 100 parts by weight of the total binder resins.

The photoconductive compounds used in the present invention may be inorganic compounds or organic compounds.

Inorganic photoconductive compounds used in the present invention include those conventionally known for example, zinc oxide, titanium oxide, zinc sulfide, cadmium sulfide, selenium, selenium-tellurium, lead sulfide. Znic oxide and titanium oxide are preferred in view of environmental pollution.

Where an inorganic photoconductive compound, e.g., zinc oxide or titanium oxide, is used, the binder resin is usually used in an amount of from 10 to 100 parts by weight, and preferably from 15 to 40 parts by weight, per 100 parts by weight of the inorganic photoconductive compound.

Organic photoconductive compounds used may be selected from conventionally known compounds. Suitable photoconductive layers containing an organic photoconductive compound include (i) a layer mainly comprising an organic photoconductive compound, a sensitizing dye, and a binder resin as described, e.g., in JP-B-37-17162, JP-B-62-51462, JP-A-52-2437, JP-A-54-19803, JP-A-56-107246, and JP-A-57-161863; and (ii) a layer mainly comprising a charge generating agent, a charge transporting agent, and a binder resin as described, e.g., in JP-A-56-146145, JP-A-60-17751, JP-A-60-17752, JP-A-60-17760, JP-A-60-254142, and JP-A-62-54266 and a double-layered structure containing a charge generating agent and a charge transporting agent in separate layers as described, e.g., in JP-A-60-230147, JP-A-60-230148, and JP-A-60-238853.

The photoconductive layer of the electrophotographic lithographic printing plate precursor according to the present invention may have any of the above-described structure.

The organic photoconductive compounds which may be used in the present invention include (a) triazole derivatives described, e.g., in U.S. Pat. No. 3,112,197, (b) oxadiazole derivatives described, e.g., in U.S. Pat. No. 3,189,447, (c) imidazole derivatives described in JP-B-37-16096, (d) polyarylalkane derivatives described, e.g., in U.S. Pat. Nos. 3,615,402, 3,820,989, and 3,542,544, JP-B-45-555, JP-B-51-10983, JP-A-51-93224, JP-A-55-108667, JP-A-55-156953, and JP-A-56-36656, (e) pyrazoline derivatives and pyrazolone derivatives described, e.g., in U.S. Pat. Nos. 3,180,729 and 4,278,746, JP-A-55-88064, JP-A-55-88065, JP-A-49-105537, JP-A-55-51086, JP-A-56-80051, JP-A-56-88141, JP-A-57-45545, JP-A-54-112637, and JP-A-55-74546, (f) phenylenediamine derivatives described, e.g., in U.S. Pat. No. 3,615,404, JP-B-51-10105, JP-B-46-3712, JP-B-47-28336, JP-A-54-83435, JP-A-54-110836, and JP-A-54-119925, (g) arylamine derivatives described, e.g., in U.S. Pat. Nos. 3,567,450, 3,180,703, 3,240,597, 3,658,520, 4,232,103, 4,175,961, and 4,012,376, JP-B-49-35702, West German Patent (DAS) 1,110,518, JP-B-39-27577, JP-A-55-144250, JP-A-56-119132, and JP-A-56-22437, (h) amino-substituted chalcone derivatives described, e.g., in U.S. Pat. No. 3,526,501, (i) N,N-bicarbazyl derivatives described, e.g., in U.S. Pat. No. 3,542,546, (j) oxazole derivatives described, e.g., in U.S. Pat. No. 3,257,203, (k) styrylanthracene derivatives described, e.g., in JP-A-56-46234, (l) fluorenone derivatives described, e.g., in JP-A-54-110837, (m) hydrazone derivatives described, e.g., in U.S. Pat. No. 3,717,462, JP-A-54-59143 (corresponding to U.S. Pat. No. 4,150,987), JP-A-55-52063, JP-A-55-52064, JP-A-55-46760, JP-A-55-85495, JP-A-57-11350, JP-A-57-148749, and JP-A-57-104144, (n) benzidine derivatives described, e.g., in U.S. Pat. Nos. 4,047,948, 4,047,949, 4,265,990, 4,273,846, 4,299,897, and 4,306,008, (o) stilbene derivatives described, e.g., in JP-A-58-190953, JP-A-59-95540, JP-A-59-97148, JP-A-59-195658, and JP-A-62-36674, (p) polyvinylcarbazole and derivatives thereof described in JP-B-34-10966, (q) vinyl polymers, such as polyvinylpyrene, polyvinylanthracene, poly-2-vinyl-4-(4'-dimethylaminophenyl)-5-phenyloxazole, and poly-3-vinyl-N-ethylcarbazole, described in JP-B-43-18674 and JP-B-43-19192, (r) polymers, such as polyacenaphthylene, polyindene, and an acenaphthylene-styrene copolymer, described in JP-B-43-19193, (s) condensed resins, such as pyrene-formaldehyde resin, bromopyrene-formaldehyde resin, and ethylcarbazole-formaldehyde resin, described, e.g., in JP-B-56-13940, and (t) triphenylmethane polymers described in JP-A-56-90833 and JP-A-56-161550.

The organic photoconductive compounds which can be used in the present invention are not limited to the above-described compounds (a) to (t), and any of known organic photoconductive compounds may be employed in the present invention. The organic photoconductive compounds may be used either individually or in combination of two or more thereof.

The sensitizing dyes which can be used in the photoconductive layer of (i) include those conventionally known as described, e.g., in *Denshishashin,* 12, 9 (1973) and *Yuki Gosei Kagaku,* 24, No. 11, 1010 (1966). Specific examples of suitable sensitizing dyes include pyrylium dyes described, e.g., in U.S. Pat. Nos. 3,141,770 and 4,283,475, JP-A-48-25658, and JP-A-62-71965; triarylmethane dyes described, e.g., in *Applied Optics Supplement,* 3, 50 (1969) and JP-A-50-39548; cyanine dyes described, e.g., in U.S. Pat. No. 3,597,196; and styryl dyes described, e.g., in JP-A-60-163047, JP-A-59-164588, and JP-A-60-252517.

The charge generating agents which can be used in the photoconductive layer of (ii) include various conventionally known charge generating agents, either organic or inorganic, such as selenium, selenium-tellurium, cadmium sulfide, zinc oxide, and organic pigments, for example, (1) azo pigments (including monoazo, bisazo, and trisazo pigments) described, e.g., in U.S. Pat. Nos. 4,436,800 and 4,439,506, JP-A-47-37543, JP-A-58-123541, JP-A-58-192042, JP-A-58-219263, JP-A-59-78356, JP-A-60-179746, JP-A-61-148453, JP-A-61-238063, JP-B-60-5941, and JP-B-60-45664, (2) metal-free or metallized phthalocyanine pigments described, e.g., in U.S. Pat. Nos. 3,397,086 and 4,666,802, JP-A-51-90827, and JP-A-52-55643, (3) perylene pigments described, e.g., in U.S. Pat. No. 3,371,884 and JP-A-47-30330, (4) indigo or thioindigo derivatives described, e.g., in British Patent 2,237,680 and JP-A-47-30331, (5) quinacridone pigments described, e.g., in British Patent 2,237,679 and JP-A-47-30332, (6) polycyclic quinone dyes described, e.g., in British Patent 2,237,678, JP-A-59-184348, JP-A-62-28738, and JP-A-47-18544, (7) bisbenzimidazole pigments described, e.g., in JP-A-47-30331 and JP-A-47-18543, (8) squarylium salt pigments described, e.g., in U.S. Pat. Nos. 4,396,610 and 4,644,082, and (9) azulenium salt pigments described, e.g., in JP-A-59-53850 and JP-A-61-212542.

These organic pigments may be used either individually or in combination of two or more thereof.

A mixing ratio of the organic photoconductive compound and a binder resin, particularly the upper limit of the organic photoconductive compound is determined depending on the compatibility between these materials. The organic photoconductive compound, if added in an amount over the upper limit, may undergo undesirable crystallization. The lower the content of the organic photoconductive compound, the lower the electrophotographic sensitivity. Accordingly, it is desirable to use the organic photoconductive compound in an amount as much as possible within such a range that crystallization does not occur.

In the electrophotographic lithographic printing plate precursor according to the present invention, the binder resin is used suitably in an amount of from 10 to 100 parts by weight, preferably from 15 to 50 parts by weight per 100 parts by weight of the photoconductive compound.

Depending on the kind of a light source for exposure, for example, visible light or semiconductor laser beam, various dyes may be used as spectral sensitizers in the present invention. The sensitizing dyes used include carbonium dyes, diphenylmethane dyes, triphenylmethane dyes, xanthene dyes, phthalein dyes, polymethine dyes (including oxonol dyes, merocyanine dyes, cyanine dyes, rhodacyanine dyes, and styryl dyes), and phthalocyanine dyes (including metallized dyes), as described e.g., in Harumi Miyamoto and Hidehiko Takei, *Imaging,* 1973, No. 8, 12, C. J. Young et al., *RCA Review,* 15, 469 (1954), Kohei Kiyota et al., *Denkitsushin Gakkai Ronbunshi,* J 63-C, No. 2, 97 (1980), Yuji Harasaki et al., *Kogyo Kagaku Zasshi,* 66, 78 and 188 (1963), and Tadaaki Tani, *Nihon Shashin Gakkaishi,* 35, 208 (1972).

Specific examples of carbonium dyes, triphenylmethane dyes, xanthene dyes, and phthalein dyes are described, e.g., in JP-B-51-452, JP-A-50-90334, JP-A-50-114227, JP-A-53-39130, JP-A-53-82353, U.S. Pat. Nos. 3,052,540 and 4,054,450, and JP-A-57-16456.

Usable polymethine dyes, such as oxonol dyes, merocyanine dyes, cyanine dyes, and rhodacyanine dyes, are described in F. M. Hamer, *The Cyanine Dyes and Related Compounds.* Specific examples of these dyes are described, e.g., in U.S. Pat. Nos. 3,047,384, 3,110,591, 3,121,008, 3,125,447, 3,128,179, 3,132,942, and 3,622,317, British Patents 1,226,892, 1,309,274, and 1,405,898, JP-B-48-7814, and JP-B-55-18892.

Further, polymethine dyes capable of performing spectral sensitization in the near infrared to infrared region of 700 nm or more include those described, e.g., in JP-A-47-840, JP-A-47-44180, JP-B-51-41061, JP-A-49-5034, JP-A-49-45122, JP-A-57-46245, JP-A-56-35141, JP-A-57-157254, JP-A-61-26044, JP-A-61-27551, U.S. Pat. Nos. 3,619,154 and 4,175,956, and *Research Disclosure,* No. 216, 117–118 (1982).

The light-sensitive material of the present invention is excellent in that the characteristics thereof hardly vary with the combined use of various sensitizing dyes.

If desired, the light-sensitive element may further contain various additives conventionally known for electrophotographic light-sensitive elements. The additives include chemical sensitizers for increasing electrophotographic sensitivity and plasticizers or surface active agents for improving film properties.

Suitable examples of the chemical sensitizers include electron attracting compounds such as a halogen, benzoquinone, chloranil, fluoranil, bromanil, dinitrobenzene, anthraquinone, 2,5-dichlorobenzoquinone, nitrophenol, tetrachlorophthalic anhydride, 2,3-dichloro-5,6-dicyanobenzoquinone, dinitrofluorenone, trinitrofluorenone, and tetracyanoethylene; and polyarylalkane compounds, hindered phenol compounds and p-phenylenediamine compounds as described in the literature references cited in Hiroshi Kokado, et al., *Saikin no Kododen Zairyo to Kankotai no Kaihatsu•Jitsuyoka,* Chs. 4 to 6, Nippon Kagaku Joho (1986). In addition, the compounds as described in JP-A-58-65439, JP-A-58-102239, JP-A-58-129439, and JP-A-62-71965 may also be used.

Suitable examples of the plasticizers, which may be added for improving flexibility of a photoconductive layer, include dimethyl phthalate, dibutyl phthalate, dioctyl phthalate, diphenyl phthalate, triphenyl phosphate, diisobutyl adipate, dimethyl sebacate, dibutyl sebacate, butyl laurate, methylphthalylethyl glycolate, and dimethyl glycol phthalate. The plasticizer can be added in an amount that does not impair electrostatic characteristics of the photoconductive layer.

The amount of the additive to be added is not particularly limited, but ordinarily ranges from 0.001 to 2.0 parts by weight per 100 parts by weight of the photoconductive substance.

The photoconductive layer usually has a thickness of from 1 to 100 μm, and preferably from 10 to 50 μm.

Where a photoconductive layer functions as a charge generating layer of a laminated type light-sensitive element composed of a charge generating layer and a charge transporting layer, the charge generating layer has a thickness of from 0.01 to 1 μm, and preferably from 0.05 to 0.5 μm.

The photoconductive layer of the present invention can be provided on a conventionally known support. In general, a support for an electrophotographic light-sensitive layer is preferably electrically conductive. The electrically conductive support which can be used includes a substrate (e.g., a metal plate, paper, or a plastic sheet) having been rendered conductive by impregnation with a low-resistant substance, a substrate whose back side (opposite to the light-sensitive layer side) is rendered conductive and further having coated thereon at least one layer for, for example, curling prevention, the above-described substrate having formed on the surface thereof a water-resistant adhesive layer, the above-described substrate having on the surface thereof at least one precoat layer, and a paper substrate laminated with a plastic film on which aluminum, etc. has been vacuum deposited.

Specific examples of the conductive substrate and materials for rendering non-conductive substrates electrically conductive are described, for example, in Yukio Sakamoto, *Denshishashin,* 14, No. 1, 2–11 (1975), Hiroyuki Moriga, *Nyumon Tokushushi no Kagaku,* Kobunshi Kankokai (1975), and M. F. Hoover, *J. Macromol. Sci. Chem.,* A-4, No. 6, 1327–1417 (1970).

In order to produce a printing plate using the electrophotographic lithographic printing plate precursor of the present invention, a known method can be utilized. Duplicated images are formed on the electrophotographic printing plate precursor according to the present invention and then non-image areas are subjected to an oil-desensitizing treatment in a conventional manner to produce a printing plate. More specifically, the electrophotographic lithographic printing plate precursor is electrostatically charged substantially uniformly in a dark place and imagewise exposed to form an electrostatic latent image. The exposing method includes, for example, scanning exposure using a semiconductor laser, He—Ne laser, etc., reflection imagewise exposure using a xenon lamp, tungsten lamp, fluorescent lamp, etc. as a light source or contact exposure through a transparent positive film. The resulting electrostatic latent image is then developed with a toner. The development can be conducted by any of various conventionally known developing methods, for example, cascade development, magnetic brush development, powder cloud development, liquid development, etc. Among them, the liquid development method capable of forming a fine image is particularly suitable for making a printing plate. The toner image thus formed can be fixed by a known fixing method, for example, heating fixation, pressure fixation, solvent fixation, etc.

The developers which can be used in the present invention include conventionally known developers for electrostatic photography, either dry type or liquid type. For example, specific examples of the developer are described, e.g., in *Denshishashin Gijutsu no Kiso to Oyo,* supra, 497–505, Koichi Nakamura (ed.), *Toner Zairyo no Kaihatsu•Jitsuyoka,* Ch. 3, Nippon Kagaku Joho (1985), Gen Machida, *Kirokuyo Zairyo to Kankosei Jushi,* 107–127 (1983), and Denshishasin Gakkai (ed.), *Imaging,* Nos. 2–5, "Denshishashin no Genzo•Teichaku•Taiden•Tensha", Gakkai Shuppan Center.

Dry developers practically used include one-component magnetic toners, two-component toners, one-component non-magnetic toners, and capsule toners. Any of these dry developers may be employed in the present invention.

Particularly, a combination of a scanning exposure system using a laser beam based on digital information and a development system using a liquid developer is an advantageously effective process since highly accurate images can be formed.

The typical liquid developer is basically composed of an electrically insulating organic solvent, for example, an isoparaffinic aliphatic hydrocarbon (e.g., Isopar H or Isopar G (manúfactured by Esso Chemical Co.), Shellsol 70 or Shellsol 71 (manufactured by Shell Oil Co. ) or IP-Solvent 1620 (manufactured by Idemitsu petro-Chemical Co., Ltd.) ) as a dispersion medium, having dispersed therein a colorant (e.g., an organic or inorganic dye or pigment) and a resin for imparting dispersion stability, fixability, and chargeability to the developer (e.g., an alkyd resin, an acrylic resin, a polyester resin, a styrene-butadiene resin, and rosin). If desired, the liquid developer can contain various additives for enhancing charging characteristics or improving image characteristics.

The colorant is appropriately selected from known dyes and pigments, for example, benzidine type, azo type, azomethine type, xanthene type, anthraquinone type, phthalocyanine type (including metallized type), titanium white, nigrosine, aniline black, and carbon black.

Other additives include, for example, those described in Yuji Harasaki, *Denshishashin,* 16, No. 2, 44, such as di-2-ethylhexylsufosuccinic acid metal salts, naphthenic acid metal salts, higher fatty acid metal salts, alkylbenzenesulfonic acid metal salts, alkylphosphoric acid metal salts, lecithin, polyvinylpyrrolidone, copolymers containing a maleic acid monoamido component, coumarone-indene resins, higher alcohols, polyethers, polysiloxanes, and waxes.

With respect to the content of each of the main components of the liquid developer, toner particles mainly comprising a resin (and, if desired, a colorant) are preferably present in an amount of from 0.5 to 50 parts by weight per 1000 parts by weight of a carrier liquid. If the toner content is less than 0.5 part by weight, the image density is insufficient, and if it exceeds 50 parts by weight, the occurrence of fog in the non-image areas may be tended to.

If desired, the above-described resin for dispersion stabilization which is soluble in the carrier liquid is added in an amount of from about 0.5 to about 100 parts by weight per 1000 parts by weight of the carrier liquid. The above-described charge control agent can be preferably added in an amount of from 0.001 to 1.0 part by weight per 1000 parts by weight of the carrier liquid. Other additives may be added to the liquid developer, if desired. The upper limit of the total amount of other additives is determined, depending on electrical resistance of the liquid developer. Specifically, the amount of each additive should be controlled so that the liquid developer exclusive of toner particles has an electrical resistivity of not less than $10^9$ Ωcm. If the resistivity is less than $10^9$ Ωcm, a continuous gradation image of good quality can hardly be obtained.

The liquid developer can be prepared, for example, by mechanically dispersing a colorant and a resin in a dispersing machine, e.g., a sand mill, a ball mill, a jet mill, or an attritor, to produce colored particles, as described, for example, in JP-B-35-5511, JP-B-35-13424, JP-B-50-40017, JP-B-49-98634, JP-B-58-129438, and JP-A-61-180248.

The colored particles may also be obtained by a method comprising preparing dispersed resin grains having a fine grain size and good monodispersity in accordance with a non-aqueous dispersion polymerization method and coloring the resulting resin grains. In such a case, the dispersed grains prepared can be colored by dyeing with an appropriate dye as described, e.g., in JP-A-57-48738, or by chemical bonding of the dispersed grains with a dye as described, e.g., in JP-A-53-54029. It is also effective to polymerize a monomer already containing a dye at the polymerization granulation to obtain a dye-containing copolymer as described, e.g., in JP-B-44-22955.

The lithographic printing plate precursor having thereon the toner image thus formed is then subjected to an oil-desensitizing treatment for rendering hydrophilic the non-image areas to produce a printing plate.

The oil-desensitizing treatment according to the present invention is performed for the purpose of causing the chemical reaction of the protected hydrophilic group described above by a processing solution to generate hydrophilicity. Specifically, an alkaline processing solution, preferably an aqueous processing solution having a pH of from 8 to 14 can be employed. As a compound which makes a processing solution alkaline, there can be used any of conventionally known inorganic or organic compounds, for example, carbonates, sodium hydroxide, potassium hydroxide, potassium silicate, sodium silicate and organic amine compounds, either individually or in combination thereof.

The processing solution may further contain a hydrophilic compound which contains a substituent having a Pearson's nucleophilic constant n (refer to R. G. Pearson and H. Sobel, *J. Amer. Chem. Soc.,* 90, 319 (1968)) of not less than 5.5 and has a solubility of at least 1 part by weight in 100 parts by weight of distilled water, in order to accelerate the reaction for rendering hydrophilic.

Suitable examples of such hydrophilic compounds include hydrazines, hydroxylamines, sulfites (e.g., ammonium sulfite, sodium sulfite, potassium sulfite or zinc sulfite), thiosulfates, and mercapto compounds, hydrazide compounds, sulfinic acid compounds and primary or secondary amine compounds each containing at least one polar group selected from a hydroxyl group, a carboxyl group, a sulfo group, a phosphono group and an amino group in the molecule thereof.

Specific examples of the polar group-containing mercapto compounds include 2-mercaptoethanol, 2-mercaptoethylamine, N-methyl-2-mercaptoethylamine, N-(2-hydroxyethyl)-2-mercaptoethylamine, thioglycolic acid, thiomalic acid, thiosalicylic acid, mercaptobenzenecarboxylic acid, 2-mercaptoethanesulfonic acid, 2-mercaptoethylphosphonic acid, mercaptobenzenesulfonic acid, 2-mercaptopropionylaminoacetic acid, 2-mercapto-1-aminoacetic acid, 1-mercaptopropionylaminoacetic acid, 1,2-dimercaptopropionylaminoacetic acid, 2,3-dihydroxypropylmercaptan, and 2-methyl-2-mercapto-1-aminoacetic acid. Specific examples of the polar group-containing sulfinic acid compounds include 2-hydroxyethylsulfinic acid, 3-hydroxypropanesulfinic acid, 4-hydroxybutanesulfinic acid, carboxybenzenesulfinic acid, and dicarboxybenzenesulfinic acid. Specific examples of the polar group-containing hydrazide compounds include 2-hydrazinoethanolsulfonic acid, 4-hydrazinobutanesulfonic acid, hydrazinobenzenesulfonic acid, hydrazinobenzenesulfonic acid, hydrazinobenzoic acid, and hydrazinobenzenecarboxylic acid. Specific examples of the polar group-containing primary or secondary amine compounds include N-(2-hydroxyethyl)amine, N,N-di(2-hydroxyethyl)amine, N,N-di(2-hydroxyethyl) ethylenediamine, tri(2-hydroxyethyl)ethylenediamine, N-(2,3-dihydroxypropyl)amine, N,N-di(2,3-dihydroxypropyl) amine, 2-aminopropionic acid, aminobenzoic acid, aminopyridine, aminobenzenedicarboxylic acid, 2-hydroxyethylmorpholine, 2-carboxyethylmorpholine, and 3-carboxypiperazine.

The amount of the nucleophilic compound present in the processing solution is preferably from 0.05 to 10 mol/l, and more preferably from 0.1 to 5 mol/l.

With respect to the conditions of the treatment, a temperature of from 15° to 60° C., and an immersion time of from 10 seconds to 5 minutes are preferred.

The processing solution may contain other compounds in addition to the pH control agent and nucleophilic compound described above. For example, a water-soluble organic solvent may be used in a range of from 1 to 50 parts by weight per 100 parts by weight of water. Suitable examples of the water-soluble organic solvent include alcohols (e.g., methanol, ethanol, propanol, propargyl alcohol, benzyl alcohol, and phenethyl alcohol), ketones (e.g., acetone, methyl ethyl ketone, cyclohexanone and acetophenone), ethers (e.g., dioxane, trioxane, tetrahydrofuran, ethylene glycol propylene glycol, ethylene glycol monomethyl ether, propylene glycol monomethyl ether, and tetrahydropyran), amides (e.g., dimethylformamide and dimethylacetamide), esters (e.g., methyl acetate, ethyl acetate, and ethyl formate). These organic solvents may be used either individually or in combination of two or more thereof.

The processing solution may contain a surface active agent in an amount ranging from 0.1 to 20 parts by weight per 100 parts of weight of the processing solution. Suitable examples of the surface active agent include conventionally known anionic, cationic or nonionic surface active agents, such as the compounds as described, for example, in Hiroshi Horiguchi, *Shin Kaimen Kasseizai,* Sankyo Shuppan (1975) and Ryohei Oda and Kazuhiro Teramura, *Kaimen Kasseizai no Gosei to Sono Oyo,* Maki Shoten (1980).

Moreover, the same effect upon the treatment for providing hydrophilicity using the nucleophilic compound can be obtained by incorporating the nucleophilic compound into dampening water used at the time of printing.

BEST MODE FOR CONDUCTING THE INVENTION

The present invention is illustrated in greater detail with reference to the following examples, but the present invention is not to be construed as being limited thereto.

Synthesis of Resin ($B_1$)

SYNTHESIS EXAMPLE 1 OF RESIN ($B_1$): ($B_1$-1)

A mixed solution of 95 g of 2-chlorophenyl methacrylate, 5 g of methacrylic acid, and 200 g of toluene was heated to a temperature of 90° C. under nitrogen gas stream, and 7.0 g of 2,2'-azobisisobutyronitrile (abbreviated as AIBN) was added thereto to effect reaction for 4 hours. To the reaction mixture was further added 2 g of AIBN, followed by reacting for 2 hours. The resulting resin ($B_1$-1) had a weight average molecular weight of $7.7\times10^3$.

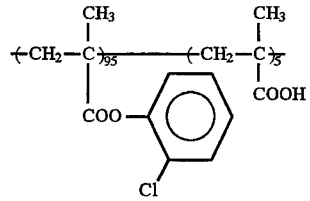

SYNTHESIS EXAMPLE 2 OF RESIN ($B_1$): ($B_1$-2)

A mixed solution of 96 g of 2,6-dichlorophenyl methacrylate, 4 g of acrylic acid, 2 g of n-dodecylmercaptan, and 200 g of toluene was heated to a temperature of 75° C. under nitrogen gas stream, and 1 g of AIBN was added thereto to effect reaction for 4 hours. Then, 0.5 g of AIBN was added thereto, followed by reacting for 2 hours, and thereafter 0.5 g of AIBN was added thereto, followed by reacting for 3 hours. After cooling, the reaction mixture was poured into 2 liters of a solvent mixture of methanol and water (9:1) to reprecipitate, and the precipitate was collected by decantation and dried under reduced pressure to obtain 78 g of the copolymer in the wax form having a weight average molecular weight of $6.0\times10^3$.

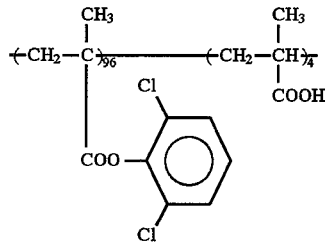

SYNTHESIS EXAMPLES 3 TO 16 OF RESIN ($B_1$): ($B_1$-3) TO ($B_1$-16)

Resins ($B_1$-3) to ($B_1$-16) shown in Table E below were synthesized under the same polymerization conditions as described in Synthesis Example 1 of Resin ($B_1$), respectively. A weight average molecular weight of each of the resin ($B_1$) was in a range of from $5.0\times10^3$ to $9.0\times10^3$.

TABLE E
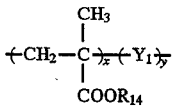
| Synthesis Example of Resin ($B_1$) | Resin ($B_1$) | $R_{14}$ | $-Y_1-$ | x/y (weight ratio) |
|---|---|---|---|---|
| 3 | $B_1$-3 | $-CH_2C_6H_5$ | 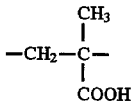 | 94/6 |
| 4 | $B_1$-4 | 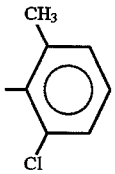 | 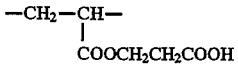 | 95/5 |
| 5 | $B_1$-5 | $-CH_2C_6H_5$ | 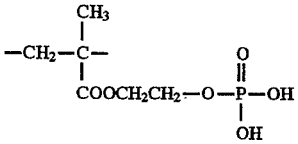 | 97/3 |
| 6 | $B_1$-6 | 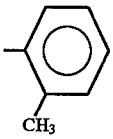 | 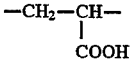 | 95/5 |
| 7 | $B_1$-7 | 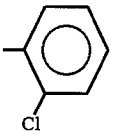 | 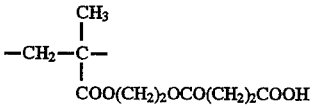 | 94/6 |
| 8 | $B_1$-8 | 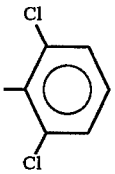 | 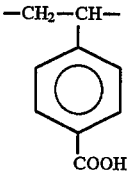 | 95/5 |
| 9 | $B_1$-9 | 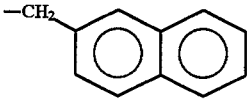 | 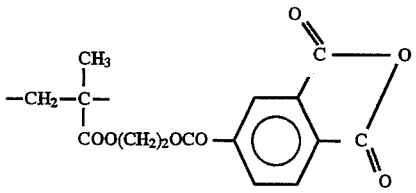 | 93/7 |
| 10 | $B_1$-10 | 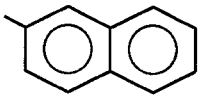 | 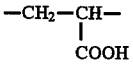 | 95/5 |
| 11 | $B_1$-11 | 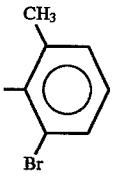 | 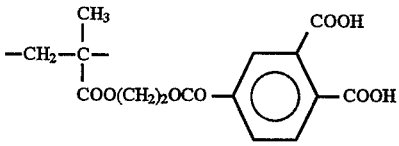 | 96/4 |

TABLE E-continued

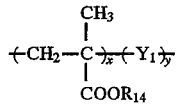

| Synthesis Example of Resin ($B_1$) | Resin ($B_1$) | $R_{14}$ | $-Y_1-$ | x/y (weight ratio) |
|---|---|---|---|---|
| 12 | $B_1$-12 | 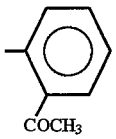 | 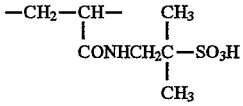 | 98/2 |
| 13 | $B_1$-13 | 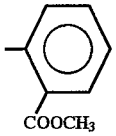 | 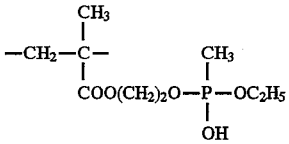 | 97/3 |
| 14 | $B_1$-14 | 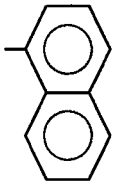 | 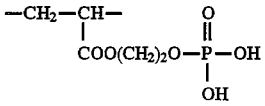 | 97/3 |
| 15 | $B_1$-15 | 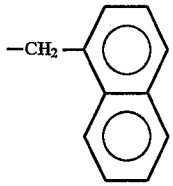 | 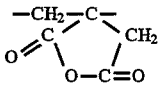 | 95/5 |
| 16 | $B_1$-16 | 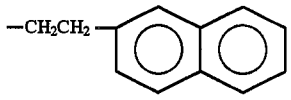 | 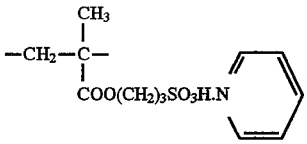 | 98/2 |

SYNTHESIS EXAMPLE 17 OF RESIN ($B_1$): ($B_1$-17)

A mixed solution of 100 g of benzyl methacrylate, 4 g of thiosalicylic acid, 160 g of toluene and 40 g of ethanol was heated to a temperature 75° C. under nitrogen gas stream, and 1.0 g of 2,2'-azobisisobutyronitrile (abbreviated as AIBN) was added thereto to effect reaction for 4 hours. To the reaction mixture was further added 0.4 g of AIBN, followed by reacting for 2 hours, and thereafter 0.2 g of AIBN was added thereto, followed by reacting for 3 hours with stirring. The resulting resin ($B_1$-17) had a weight average molecular weight of $6.8\times10^3$.

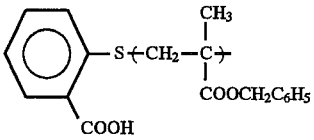

SYNTHESIS EXAMPLES 18 TO 27 OF RESIN ($B_1$): ($B_1$-18) TO ($B_1$-27)

Resins ($B_1$-18) to ($B_1$-27) were synthesized under the same reaction conditions as described in Synthesis Example 17 of Resin ($B_1$), except for using the methacrylates and mercapto compounds described in Table F below in place of 100 g of benzyl methacrylate and 4 g of thiosalicylic acid, respectively. A weight average molecular weight of each of the resins ($B_1$) was in a range of from $5\times10^3$ to $8\times10^3$.

TABLE F
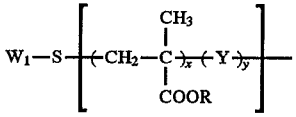
| Synthesis Examples of Resin ($B_1$) | Resin ($B_1$) | $W_1$— | Amount | —R | —Y— | x/y (weight ratio) |
|---|---|---|---|---|---|---|
| 18 | $B_1$-18 | $HOOC(CH_2)_2$— | 4 g | $-C_6H_5$ | 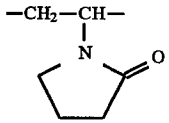 | 97.5/2.5 |
| 19 | $B_1$-19 | HOOC—$CH_2$— | 5 g | 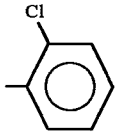 | —$CH_2$—CH(—$OCOCH_3$)— | 90/10 |
| 20 | $B_1$-20 | HOOC—CH(—$CH_2$—COOH)— | 5 g | 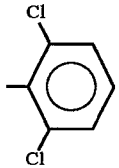 | —$CH_2$—C($CH_3$)(COOH)— | 97.5/2.5 |
| 21 | $B_1$-21 | HO—P(=O)(OH)—$O(CH_2)_2$— | 3 g | 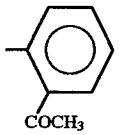 | —$CH_2$—C($CH_3$)($COO(CH_2)_2O$—P(=O)(OH)—OH)— | 98.5/1.5 |
| 22 | $B_1$-22 | 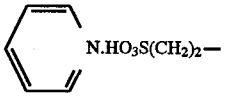 $N.HO_3S(CH_2)_2$— | 3 g | $-CH_2C_6H_5$ | —$CH_2$—C($CH_3$)($COO(CH_2)_2OCH_3$)— | 96/4 |

TABLE F-continued
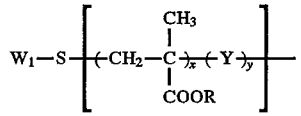
| Synthesis Examples of Resin ($B_1$) | Resin ($B_1$) | $W_1$— | Amount | —R | —Y— | x/y (weight ratio) |
|---|---|---|---|---|---|---|
| 23 | $B_1$-23 | 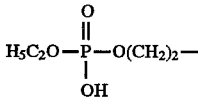 | 4.5 g | 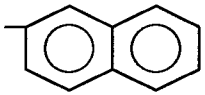 | 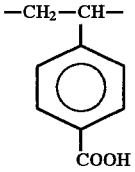 | 97/3 |
| 24 | $B_1$-24 | 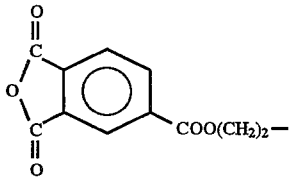 | 4 g | $-CH_3$ | 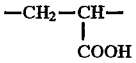 | 97.5/2.5 |
| 25 | $B_1$-25 | 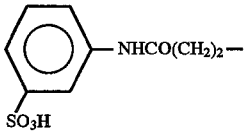 | 3 g | 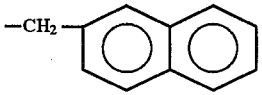 | 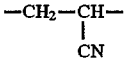 | 95/5 |
| 26 | $B_1$-26 | 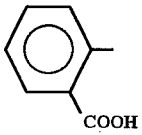 | 3 g | $-CH_2C_6H_5$ | 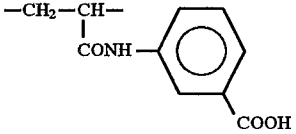 | 97/3 |
| 27 | $B_1$-27 | $HOOC(CH_2)_3-$ | 4 g | 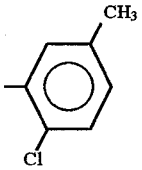 | 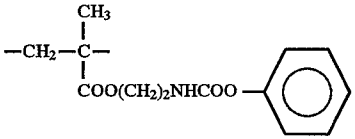 | 90/10 |

SYNTHESIS EXAMPLES 28 TO 35 OF RESIN ($B_1$): ($B_1$-28) TO ($B_1$-35)

A mixed solution of the monomers described in Table G below in the total amount of 100 g, 3 g of thiosalicylic acid, 160 g of toluene and 40 g of methanol was heated to a temperature of 60° C. under nitrogen gas stream, and 2 g of asobisisovaleronitrile (abbreviated as AIVN) was added thereto to effect reaction for 4 hours. To the reaction mixture was further added 0.8 g of AIVN, followed by reacting for 4 hours to prepare each of the resins ($B_1$). A weight average molecular weight of each of the resulting resins was in a range of from $5\times10^3$ to $8\times10^3$.

TABLE G
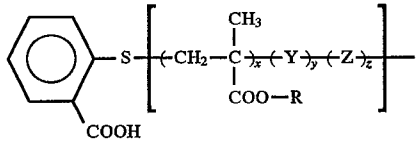
| Synthesis Examples of Resin ($B_1$) | Resin ($B_1$) | −R | −Y− | −Z− | x/y/z (weight ratio) |
|---|---|---|---|---|---|
| 28 | $B_1$-28 | $-CH_2C_6H_5$ | $-CH_2-CH(COOH)-$ | $-CH_2-C(CH_3)(COO(CH_2)_2NHCOOCH_3)(CF_3)_2$ | 92/3/5 |
| 29 | $B_1$-29 | $-CH_3$ | $-CH_2-C(CH_3)(COOH)-$ | $-CH_2-CH(COOCH_3)-$ | 83/2/15 |
| 30 | $B_1$-30 | 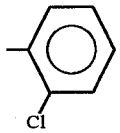 | $-CH_2-CH(CONH-C_6H_4-COOH)-$ | $-CH_2-CH(CON(CH_3)_2)-$ | 94/3/3 |
| 31 | $B_1$-31 | 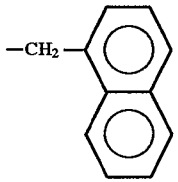 | $-CH_2-C(CH_3)(COO(CH_2)_2O-P(=O)(OH)-OH)-$ | $-CH_2-C(CH_3)(COO(CH_2)_2NHCONHC_4H_9)-$ | 93.5/1.5/5 |
| 32 | $B_1$-32 | $-CH_2C_6H_5$ | $-CH_2-C(CH_3)(CONH(CH_2)_2COOH)-$ | $-CH_2-C(CH_3)(COOCH_2CHCH_2)-$ (epoxide) | 87/3/10 |

TABLE G-continued
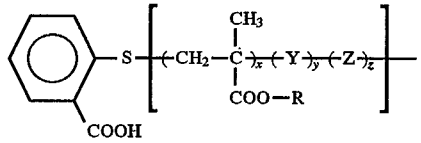
| Synthesis Examples of Resin ($B_1$) | Resin ($B_1$) | −R | −Y− | −Z− | x/y/z (weight ratio) |
|---|---|---|---|---|---|
| 33 | $B_1$-33 | " | $-CH_2-C(CH_3)(COOH)-$ | $-CH_2-C(CH_3)(COO(CH_2)_3Si(OC_2H_5)_3)-$ | 82/2/15 |
| 34 | $B_1$-34 | 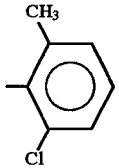 | $-CH_2-CH(COO(CH_2)_2COOH)-$ | $-CH_2-C(CH_3)(COO(CH_2)_2NHCOCH(COCH_3)(COOCH_3))-$ | 87.5/2.5/10 |
| 35 | $B_1$-35 | 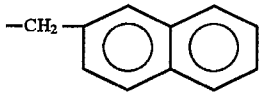 | $-CH_2-C(COOH)(CH_2COOH)-$ | $-CH_2-C(CH_3)(COO(CH_2)_2OH)-$ | 84/1.0/15 |

SYNTHESIS EXAMPLE 36 OF RESIN ($B_1$): ($B_1$-36)

A mixed solution of 99.5 g of 1-naphthyl methacrylate, 0.5 g of methacrylic acid, 150 g of toluene and 50 g of isopropanol was heated to a temperature of 80° C. under nitrogen gas stream, and 5.0 g of 4,4'-azobis(4-cyanovaleric acid) (abbreviated as ACV) was added thereto, followed by reacting with stirring for 5 hours. Then, 1 g of ACV was added thereto, followed by reacting with stirring for 3 hours. The resulting polymer had a weight average molecular weight of $7.5\times10^3$.

Resin ($B_1$-36)

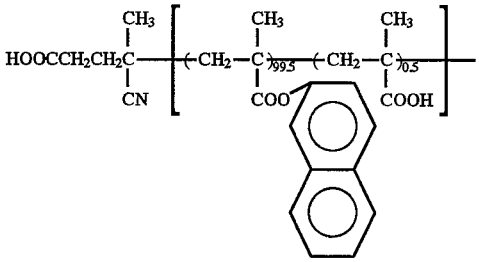

SYNTHESIS EXAMPLE 37 OF RESIN ($B_1$): ($B_1$-37)

A mixed solution of 50 g of methyl methacrylate and 150 g of methylene chloride was cooled to −20° C. under nitrogen gas stream, and 1.0 g of a 10% hexane solution of 1,1-diphenylhexyl lithium prepared just before was added thereto, followed by stirring for 5 hours. Carbon dioxide was passed through the mixture at a flow rate of 10 ml/cc for 10 minutes with stirring, the cooling was discontinued, and the reaction mixture was allowed to stand to room temperature with stirring. Then, the reaction mixture was added to a solution of 50 ml of 1N hydrochloric acid in 1 liter of methanol to precipitate, and the white powder was collected by filtration. The powder was washed with water until the washings became neutral, and dried under reduced pressure to obtain 18 g of the polymer having a weight average molecular weight of $6.5\times10^3$.

Resin ($B_1$-37)

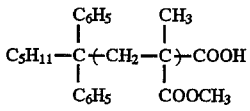

SYNTHESIS EXAMPLE 38 OF RESIN ($B_1$): ($B_1$-38)

A mixed solution of 96 g of benzyl methacrylate, 4 g of thioglycolic acid, and 200 g of toluene was heated to a temperature of 75° C. under nitrogen gas stream, and 1.0 g of ACV was added thereto to effect reaction for 6 hours. Then, 0.4 g of ACV was added thereto, followed by reacting for 3 hours. The resulting polymer had a weight average molecular weight of $7.8\times10^3$.

Resin ($B_1$-38)

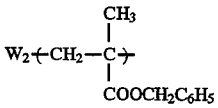

-continued

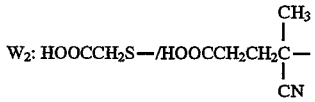

Synthesis of Resin ($B_2$)

SYNTHESIS EXAMPLE 1 OF RESIN ($B_2$): ($B_2$-1)

A mixed solution of 100 g of benzyl methacrylate and 200 g of tetrahydrofuran was sufficiently degassed under nitrogen gas stream and cooled to −78° C. Then, 3.2 g of 1,1-diphenylbutyl lithium was added to the mixture, and the reaction was conducted for 12 hours. Furthermore, a mixed solution of 60 g of methyl methacrylate, 6 g of triphenylmethyl methacrylate and 5 g of tetrahydrofuran was sufficiently degassed under nitrogen gas stream, and, after adding the mixed solution to the above described mixture, the reaction was further conducted for 8 hours. The reaction mixture was adjusted to 0° C. and after adding thereto 10 ml of methanol, the reaction was conducted for 30 minutes and the polymerization was terminated. The temperature of the polymer solution obtained was adjusted at 30° C. under stirring and, after adding thereto 3 ml of an ethanol solution of 30% hydrogen chloride, the resulting mixture was stirred for one hour. Then, the solvent of the reaction mixture was distilled off under reduced pressure until the whole volume was reduced to a half, and then the mixture was reprecipitated from one liter of petroleum ether.

The precipitates formed were collected and dried under reduced pressure to obtain 72 g of the polymer having a weight average molecular weight (Mw) of $9\times10^3$.

($B_2$-1)

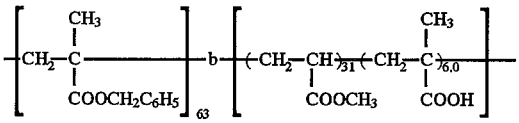

(weight ratio)

b: A bond connecting blocks (hereinafter the same)

SYNTHESIS EXAMPLE 2 OF RESIN ($B_2$): ($B_2$-2)

A mixed solution of 70 g of methyl methacrylate, 30 g of methyl acrylate, 3.5 g of (tetraphenyl prophynato) aluminum methyl, and 80 g of methylene chloride was raised to a temperature of 30° C. under nitrogen gas stream. The mixture was irradiated with light from a xenon lamp of 300 W at a distance of 25 cm through a glass filter, and the reaction was conducted for 30 hours. To the mixture were further added 60 g of methyl acrylate and 3.2 g of benzyl methacrylate, and, after light-irradiating in the same manner as above for 8 hours, 3 g of methanol was added to the reaction mixture followed by stirring for 30 minutes, and the reaction was terminated. Then, Pd—C was added to the reaction mixture, and a catalytic reduction reaction was conducted for one hour at 25° C.

After removing insoluble substances from the reaction mixture by filtration, the reaction mixture was reprecipitated from 500 ml of petroleum ether and the precipitates formed were collected and dried to obtain 95 g of the polymer having an Mw of $9.5\times10^3$.

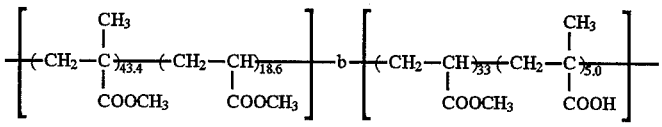

($B_2$-2)

SYNTHESIS EXAMPLE 3 OF RESIN ($B_2$): ($B_2$-3)

A mixed solution of 100 g of phenyl methacrylate and 200 g of toluene was sufficiently degassed under nitrogen gas stream-and cooled to −78° C. Then, 5.0 g of 1,1-diphenyl-3-methylpentyl lithium was added to the mixture followed by stirring for 8 hours. Further, 60 g of benzyl methacrylate and 4.6 g of 4-vinylphenyloxytrimethylsilane were added to the mixture and, after stirring the mixture for 8 hours, 3 g of methanol was added to the mixture followed by stirring for 30 minutes.

Then, to the reaction mixture was added 10 g of an ethanol solution of 30% hydrogen chloride and, after stirring the mixture at 25° C. for one hour, the mixture was reprecipitated from one liter of methanol. The precipitates thus formed were collected, washed twice with 300 ml of methanol and dried to obtain 100 g of the polymer having an Mw of $1.0\times10^4$.

($B_2$-3)

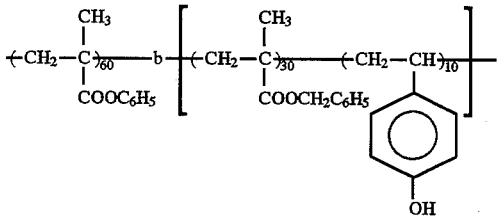

SYNTHESIS EXAMPLE 4 OF RESIN ($B_2$): ($B_3$-4)

A mixture of 67 g of 2-chlorophenyl methacrylate and 9.6 g of benzyl N,N-diethyldithiocarbamate was placed in a vessel under nitrogen gas stream followed by closing the vessel and heated to a temperature of 50° C. The mixture was irradiated with light from a high-pressure mercury lamp of 400 W at a distance of 10 cm through a glass filter for 8 hours to conduct photo-polymerization.

Then, 28 g of methyl methacrylate, 5 g of acrylic acid and 180 g of methyl ethyl ketone were added to the mixture and, after replacing the gas in the vessel with nitrogen, the mixture was light-irradiated again for 10 hours. The reaction mixture was reprecipitated from one liter of a solvent mixture of hexane and ethanol (3:1 by volume) and the precipitates formed were collected and dried to obtain 73 g of the polymer having an Mw of $8\times10^3$.

($B_2$-4)

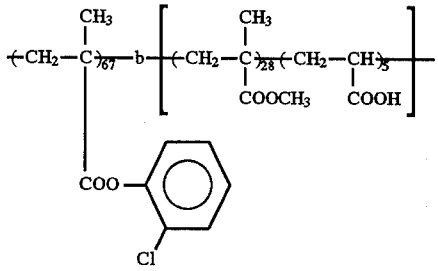

SYNTHESIS EXAMPLE 5 OF RESIN ($B_2$): ($B_2$-5)

A mixture of 75 g of 2,6-dichlorophenyl methacrylate, 6.5 g of benzyl isopropylxanthate and 150 g of tetrahydrofuran was placed in a vessel under nitrogen gas stream followed by closing the vessel and heated to a temperature of 50° C. The mixture was irradiated with light from a high-pressure mercury lamp of 400 W at a distance of 10 cm through a glass filter for 8 hours to conduct photopolymerization. To the polymerization product was added 22 g of methyl acrylate, after replacing the gas in the vessel with nitrogen, the mixture was light-irradiated again for 10 hours.

Then, 3 g of 2-(2'-carboxyethyl)carbonyloxyethyl methacrylate was added to the mixture and, after replacing the gas in the vessel with nitrogen, the mixture was light-irradiated again for 8 hours. The reaction mixture was reprecipitated from 2 liters of methanol and the powder collected was dried to obtain 63 g of the polymer having an Mw of $8\times10^3$.

($B_2$-5)

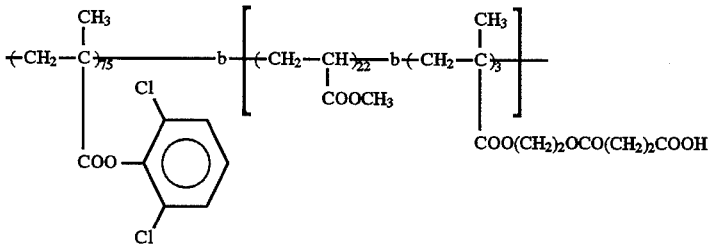

SYNTHESIS EXAMPLE 6 OF RESIN ($B_2$): ($B_2$-6)

A mixed solution of 80 g of ethyl acrylate, 20 g of methacrylic acid, 5 g of 2-mercaptoethanol and 200 g of tetrahydrofuran was heated to a temperature of 60° C. under nitrogen gas stream with stirring, and 1.0 g of 2,2'-azobisisovaleronitrile (abbreviated as AIVN) was added thereto to effect a reaction for 4 hours. To the reaction mixture was further added 0.5 g of AIVN, followed by reacting for 4 hours. The temperature of the reaction mixture was adjusted at 20° C., then a mixed solution of 22 g of 4,4'-azobis(4-cyanovaleric acid), 12 g of dicyclohexylcarbodiimide, 0.2 g of 4-(N,N-dimethylamino) pyridine and 30 g of tetrahydrofuran was added dropwise thereto over a period of one hour. After further stirring for 2 hours, 5 g of a 85% aqueous formic acid solution was added thereto, followed by stirring for 30 minutes. The crystals thus-deposited were removed by filtration, the filtrate was distilled under reduced pressure at a temperature of 25° C. to remove the solvent. The resulting polymer (polymer initiator) having the structure shown below had an Mw of $3.5\times10^3$.

Polymer Initiator

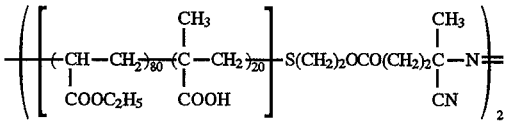

A mixed solution of 70 g of 2-chloro-6-methylphenyl methacrylate and 170 g of toluene was heated to a temperature of 85° C. under nitrogen gas stream with stirring. A solution prepared by dissolving 30 g of the above described polymer initiator in 30 g of toluene and replacing the gas in the vessel with nitrogen was added to the above mixed solution, followed by reacting for 8 hours. The polymer formed was reprecipitated from 2 liters of methanol and the powder collected was dried to obtain 65 g of the polymer having an Mw of $8\times10^3$.

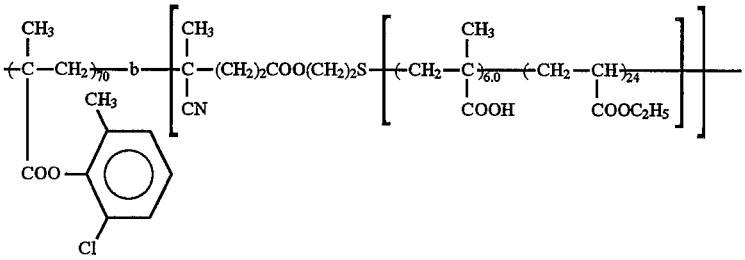

($B_2$-6)

SYNTHESIS EXAMPLES 7 TO 16 OF RESIN ($B_2$): ($B_2$-7) TO ($B_2$-16)

Each of the resins ($B_2$) shown in Table H below was synthesized in the same reaction procedure as described in Synthesis Example 4 of Resin ($B_2$). An Mw of each of the polymers obtained was in a range of from $7\times10^3$ to $9\times10^3$.

TABLE H
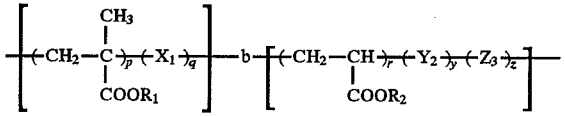
| Resin ($B_2$) | $R_1$ | $-X_1-$ | $R_2$ | $-Y_2-$ | $-Z_3-$ | p/q/r/y/z (weight ratio) |
|---|---|---|---|---|---|---|
| $B_2$-7 | 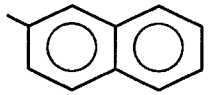 | — | $-CH_3$ | — | $-CH_2-CH(COO(CH_2)_2COOH)-$ | 65/0/32/0/3 |
| $B_2$-8 | 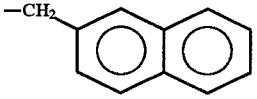 | — | $-C_2H_5$ | — | 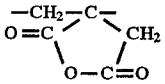 | 72/0/25/0/3 |
| $B_2$-9 | 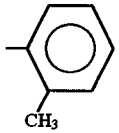 | $-CH_2-CH(COOCH_3)-$ | $-CH_3$ | 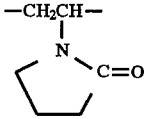 | $-CH_2-C(CH_3)(COOH)-$ | 66/10/20/3/1 |
| $B_2$-10 | 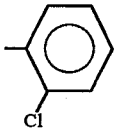 | $-CH_2-CH(COOCH_2C_6H_5)-$ | $-CH_3$ | — | $-CH_2-CH(COO(CH_2)_3SO_3H)-$ | 74.2/10/15/0/0.8 |
| $B_2$-11 | $-C_3H_7$ | 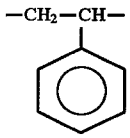 | $-CH_3$ | $-CH_2CH(COOCH_2CH_2OCH_3)-$ | $-CH_2-C(COOH)(CH_2COOH)-$ | 61/10/20/8/1.0 |
| $B_2$-12 | 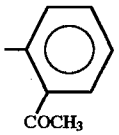 | $-CH_2-CH(COOC_2H_5)-$ | $-CH_3$ | $-CH_2CH(COCH_3)-$ | 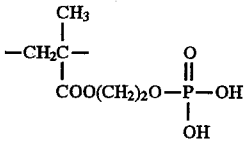 | 59/10/20/10/1.0 |

TABLE H-continued
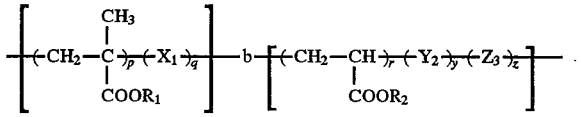
| Resin ($B_2$) | $R_1$ | $-X_1-$ | $R_2$ | $-Y_2-$ | $-Z_3-$ | p/q/r/y/z (weight ratio) |
|---|---|---|---|---|---|---|
| $B_2$-13 | 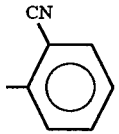 | — | $-C_2H_5$ | — | 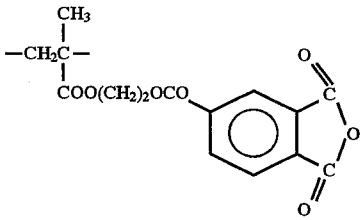 | 81/0/15/0/4 |
| $B_2$-14 | $-C_6H_5$ | 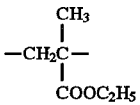 | $-CH_3$ | 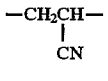 | 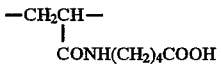 | 30/20/45/3/2 |
| $B_2$-15 | $-CH_2C_6H_5$ | — | $-CH_3$ |  |  | 75/0/15/6.5/3.5 |
| $B_2$-16 | $-(CH_2)_2-C_6H_5$ | — | $-C_2H_5$ | 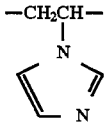 | 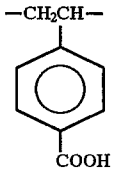 | 80/0/14/4/2 |

SYNTHESIS EXAMPLE 17 OF RESIN ($B_2$): ($B_2$-17)

A mixed solution of 90 g of methyl acrylate, 10 g of acrylic acid and 26.8 g of Initiator (I-10) having the structure shown below was heated to a temperature of 40° C. under nitrogen gas stream.

Initiator (I-10)

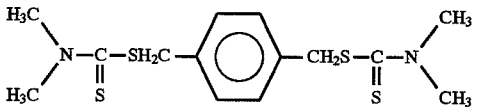

The solution was irradiated with light from a high-pressure mercury lamp of 400 W at a distance of 10 cm through a glass filter for 10 hours to conduct photopolymerization. The reaction mixture obtained was reprecipitated in one liter of methanol, and the precipitates formed were collected and dried to obtain 75 g of the polymer having a weight average molecular weight (Mw) of $4\times10^3$.

The molecular weight (Mw) of resin (B) is a value measured by a gas permeation chromotograph (GPC) method calculated in terms of polystylene.

A mixed solution of 40 g of the above described polymer, 60 g of benzyl methacrylate and 100 g of tetrahydrofuran was heated to a temperature of 50° C. under nitrogen gas stream and irradiated with light under the same condition as above for 15 hours. The reaction mixture was reprecipitated from 1.5 liters of methanol and the precipitates thus formed were collected and dried to obtain 75 g of the polymer having an Mw of $9\times10^3$.

SYNTHESIS EXAMPLE 18 OF RESIN ($B_2$): ($B_2$-18)

A reaction procedure was conducted under the same condition as Synthesis Example 17 of Resin ($B_2$) except for using 43.6 g of Initiator (I-11) having the structure shown below in place of 26.8 g of Initiator (I-10) used in Synthesis Example 17 of Resin ($B_2$) to obtain 70 g of the polymer having an Mw of $8.5\times10^3$.

Initiator (I-11)

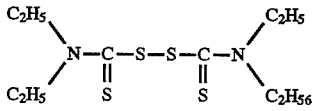

Resin ($B_2$-18)

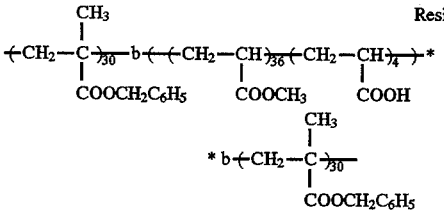

SYNTHESIS EXAMPLE 19 OF RESIN ($B_2$): ($B_2$-19)

A mixed solution of 80 g of methyl methacrylate, 20 g of ethyl acrylate, 39.0 g of Initiator (I-12) having the structure shown below and 150 g of tetrahydrofuran was heated at a temperature of 50° C. under nitrogen gas stream.

Initiator (I-12)

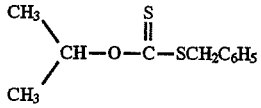

The mixture was irradiated with light under the same condition as described in Synthesis Example 17 of Resin ($B_2$) for 8 hours. The reaction mixture obtained was reprecipitated from one liter of methanol and the precipitates thus formed were collected by filtration and dried to obtain the polymer.

A mixed solution of 60 g of the above described polymer, 30 g of methyl methacrylate, 10 g of methacrylic acid and 100 g of tetrahydrofuran was heated to a temperature of 50° C. under nitrogen gas stream and subjected to light irradiation in the same manner as above for 10 hours. The reaction mixture obtained was reprecipitated from one liter of methanol, and the precipitates formed were collected and dried to obtain 73 g of the polymer as a powder. A mixed solution of 60 g of the polymer thus obtained, 30 g of ethyl methacrylate, 10 g of methyl acrylate and 100 g of tetrahydrofuran was heated to a temperature of 50° C. under nitrogen gas stream and subjected to light irradiation in the same manner as above for 10 hours. The reaction mixture obtained was reprecipitated from 1.5 liters of methanol and the precipitates formed were collected and dried to obtain 76 g of he polymer having an Mw of $1.2\times10^4$.

($B_2$-17)

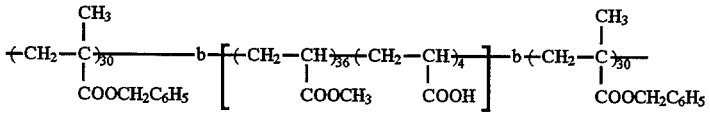

SYNTHESIS EXAMPLE 20 OF RESIN ($B_2$): ($B_2$-20)

A mixed solution of 50 g of methyl methacrylate and 100 g of tetrahydrofuran was sufficiently degassed under nitrogen gas stream and cooled to −78° C. Then, 7.2 g of 1,1-diphenylpentyl lithium was added to the mixture, and the reaction was conducted for 12 hours. Separately, a mixed solution of 28 g of methyl acrylate, 6 g of triphenylmethyl methacrylate and 50 g of tetrahydrofuran was sufficiently degassed under nitrogen gas stream and the resulting mixed solution was added to the above described mixture, and then reaction was further conducted for 8 hours. Separately, a mixed solution of 50 g of methyl methacrylate and 50 g of tetrahydrofuran was sufficiently degassed under nitrogen gas stream, and the resulting mixed solution was added to the above described mixture, and then reaction was further Resin (B-19)

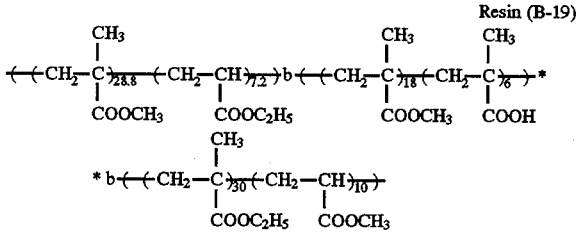

conducted for 10 hours. The temperature of the reaction mixture was adjusted to 0° C., 10 ml of methanol was added thereto, followed by reacting for 30 minutes, and the polymerization reaction was terminated. The temperature of the polymer solution obtained was adjusted to 30° C. with stirring, 3 ml of an ethanol solution of 30% hydrogen chloride was added thereto and the mixture was stirred for one hour. Then, the solvent of the reaction mixture was distilled off under reduced pressure until the whole volume was reduced to a half, and the mixture was reprecipitated from one liter of methanol. The precipitates thus formed were collected and dried under reduced pressure to obtain 65 g of the polymer having an Mw of $8\times10^3$.

Resin ($B_2$-20)

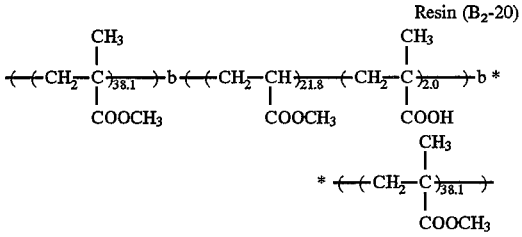

SYNTHESIS EXAMPLE 21 OF RESIN ($B_2$): ($B_2$-21)

A mixed solution of 100 g of phenyl methacrylate, 1.5 g of (tetraphenyl porphinato) aluminum methyl and 200 g of methylene chloride was raised to a temperature of 30° C. under nitrogen gas stream. The mixture was irradiated with light from a xenon lamp of 300 W at a distance of 25 cm through a glass filter, and the reaction was conducted for 12 hours. To the mixture were further added 40 g of ethyl acrylate and 9.2 g of benzyl methacrylate, followed by reacting for 10 hours with light irradiation in the same manner as above. Further, 100 g of phenyl methacrylate was added to the mixture, followed by reacting for 12 hours with light irradiation in the same manner as above. Then, 3 g of methanol was added to the reaction mixture, followed by stirring for 30 minutes, and the reaction was terminated. Then, Pd—C was added to the reaction mixture, and a catalytic reduction reaction was conducted for one hour at a temperature of 25° C. After removing the insoluble substances from the reaction mixture by filtration, the reaction mixture was reprecipitated from 2 liters of methanol, and the precipitates thus formed were collected by filtration and dried to obtain 160 g of the polymer having an Mw of $9.5\times10^3$.

Resin ($B_2$-21)

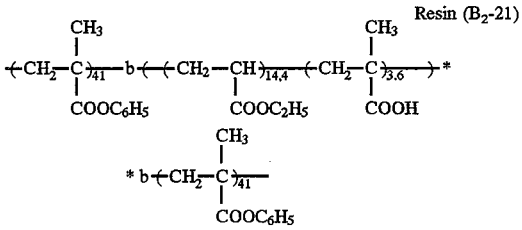

SYNTHESIS EXAMPLES 22 TO 31 OF RESIN ($B_2$): ($B_2$-22) TO ($B_2$-31)

Each of the resins ($B_2$) shown in Table I below was synthesized in the same reaction procedure as described in Synthesis Example 18 of Resin ($B_2$). The Mw of each of the polymers obtained was in a range of from $8\times10^3$ to $1\times10^4$.

TABLE I
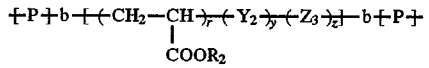
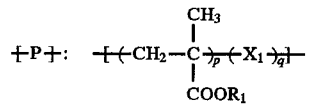
| Resin ($B_2$) | $R_1$ | $-X_1-$ | $R_2$ | $-Y_2-$ | $-Z_3-$ | p/q/r/y/z (weight ratio) |
|---|---|---|---|---|---|---|
| $B_2$-22 | 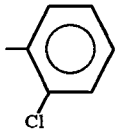 | — | $-CH_3$ | — | $-CH_2-CH(COO(CH_2)_2COOH)-$ | 32.5/0/32/0/3 |
| $B_2$-23 | 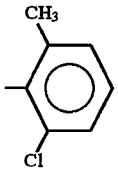 | — | $-C_2H_5$ | — | 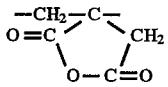 | 36/0/25/0/3 |
| $B_2$-24 | 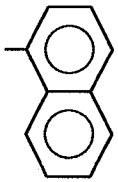 | $-CH_2-CH(COOCH_3)-$ | $-CH_3$ | 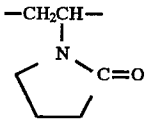 | 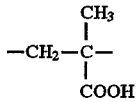 | 33/5/17/3/4 |
| $B_2$-25 | $-CH_2C_6H_5$ | $-CH_2-CH(COOCH_2C_6H_5)-$ | $-CH_3$ | — | $-CH_2-CH(COO(CH_2)_3SO_3H)-$ | 37.5/5/13/0/2 |
| $B_2$-26 | $-(CH_2)_2-C_6H_5$ | $-CH_2-CH-$ 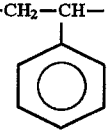 | $-CH_3$ | $-CH_2CH(COOCH_2CH_2OCH_3)-$ | 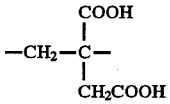 | 30.5/5/20/7/2.0 |

TABLE I-continued
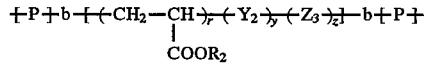
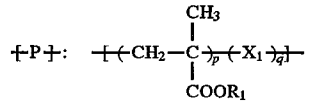
| Resin ($B_2$) | $R_1$ | $-X_1-$ | $R_2$ | $-Y_2-$ | $-Z_3-$ | p/q/r/y/z (weight ratio) |
|---|---|---|---|---|---|---|
| $B_2$-27 | 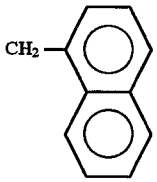 | — | $-CH_3$ | $-CH_2CH(COCH_3)-$ | 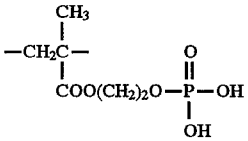 | 35.5/0/19/7.0/3.0 |
| $B_2$-28 | 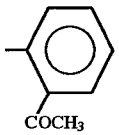 | 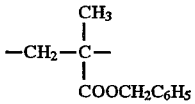 | $-C_2H_5$ | — | 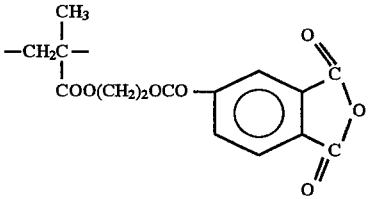 | 30.5/10/15/0/4 |
| $B_2$-29 | $-C_6H_5$ | 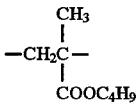 | $-CH_3$ | $-CH_2CH(CN)-$ | $-CH_2CH(CONH(CH_2)_4COOH)-$ | 20/5/42/3/5 |
| $B_2$-30 | $-CH_2C_6H_5$ | — | $-CH_3$ | $-CH_2CH(OCOCH_3)-$ | $-CH_2CH(COO(CH_2)_2OCO(CH_2)_2-COOH)-$ | 37.5/0/15/6.5/3.5 |
| $B_2$-31 | 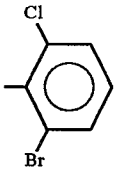 | — | $-C_2H_5$ | 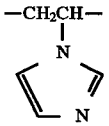 | 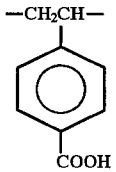 | 40/0/13/2/5 |

SYNTHESIS EXAMPLES 32 TO 35 OF RESIN ($B_2$): ($B_2$-32) TO ($B_2$-35)

Each of the polymers having the same composition as that of the resin ($B_2$-17) was synthesized in the same procedure as described in Synthesis Example 17 of Resin ($B_2$) except for using $1.5\times10^{-1}$ moles of each of the initiators shown in Table J below in place of 26.8 g of Initiator (I-10) used in Synthesis Example 17 of Resin ($B_2$). The Mw of each of the polymers was in a range of from $6\times10^3$ to $9\times10^3$.

The mixture was reacted under the same light-irradiation condition as described in Synthesis Example 17 of Resin ($B_2$) for 5 hours. The polymer obtained was dissolved in 200 g-of tetrahydrofuran, reprecipitated from 1.0 liter of methanol, and the precipitates formed were collected by filtration and dried.

A mixed solution of 20 g of the polymer thus obtained, a monomer corresponding to each of the polymer components shown in Table K below and 100 g of tetrahydrofuran was reacted with light irradiation in the same manner as above for 15 hours. The polymer obtained was reprecipitated from 1.5 liters of methanol and the precipitates formed were collected by filtration and dried. The yield of each polymer was in a range of from 60 to 70 g and the Mw thereof was in a range of from $8\times10^3$ to $1\times10^4$.

TABLE J

| Synthesis Examples of Resin ($B_2$) | Resin ($B_2$) | Initiator (I) |
|---|---|---|
| 32 | $B_2$-32 | 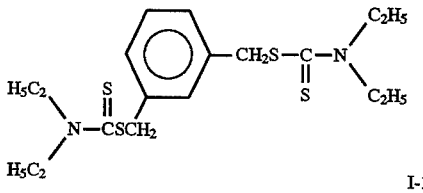 I-13 |
| 33 | $B_2$-33 | 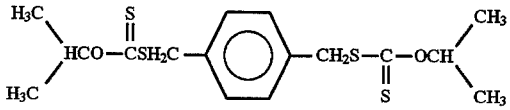 I-14 |
| 34 | $B_2$-34 | 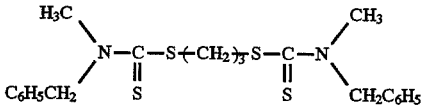 I-15 |
| 35 | $B_2$-35 | 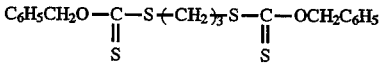 I-16 |

SYNTHESIS EXAMPLES 36 TO 42 OF RESIN ($B_2$): ($B_2$-36) TO ($B_2$-42)

A mixed solution of 80 g of benzyl methacrylate, 20 g of acrylic acid and 22.6 g of Initiator (I-17) having the structure shown below was heated to a temperature of 40° C. under nitrogen gas stream.

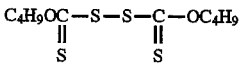

Initiator (I-17)

TABLE K

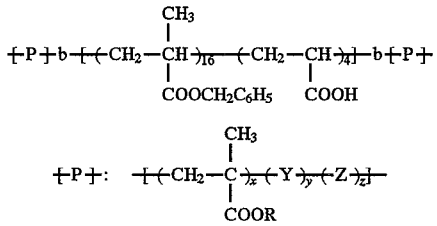

| Synthesis Example of Resin ($B_2$) | Resin ($B_2$) | −R | −Y− | −Z− | x/y/z (weight ratio) |
|---|---|---|---|---|---|
| 36 | $B_2$-36 | $-CH_3$ | — | — | 40/0/0 |
| 37 | $B_2$-37 | $-CH_2C_6H_5$ | $-CH_2-CH(CN)-$ | — | 38/2/0 |
| 38 | $B_2$-38 | 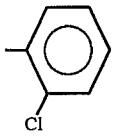 | $-CH_2-CH(COOCH_3)-$ | $-CH_2-CH(CN)-$ | 29/10/1 |
| 39 | $B_2$-39 | 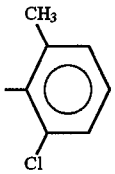 | $-CH_2-CH(COO(CH_2)_2OCH_3)-$ | — | 37/3/0 |
| 40 | $B_2$-40 | $-CH_2C_6H_5$ | 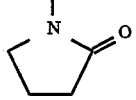 | — | 39/1.0/0 |
| 41 | $B_2$-41 | 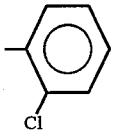 | — | — | 40/0/0 |
| 42 | $B_2$-42 | 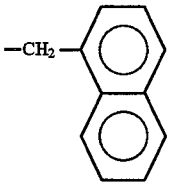 | 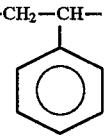 | 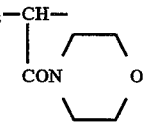 | 30/7.5/2.5 |

Synthesis of Resin ($B_3$)

SYNTHESIS EXAMPLE 1 OF RESIN ($B_3$): ($B_3$-1)

A mixed solution of 80 g of benzyl methacrylate, 20 g of a macromonomer (weight average molecular weight (Mw) of $6\times10^3$) corresponding to the repeating unit having the structure shown below, and 100 g of toluene was heated to a temperature of 80° C. under nitrogen gas stream, and 6 g of 2,2'-azobis(valeronitrile) (abbreviated as AIVN) was added thereto to effect a reaction for 3 hours. To the reaction mixture was further added 1 g of AIVN, followed by reacting for 4 hours. The resulting polymer had an Mw of $9.5\times10^3$.

($B_3$-1)

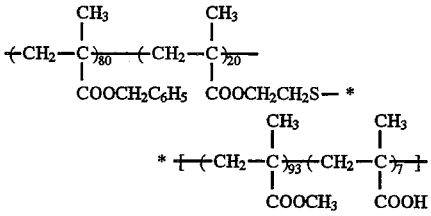

SYNTHESIS EXAMPLE 2 OF RESIN ($B_3$): ($B_3$-2)

A mixed solution of 60 g of methyl methacrylate, 25 g of a macromonomer (Mw of $5\times10^3$) corresponding to the repeating unit having the structure shown below, 15 g of methyl acrylate, 130 g of toluene, and 20 g of ethanol was heated to a temperature of 80° C. under nitrogen gas stream. After adding thereto 7 g of 4,4'-azobis(4-cyanovaleric acid) (abbreviated as ACV), the reaction was carried out for 4 hours and, after further adding thereto 1 g of ACV, the reaction was carried out for 4 hours. The resulting copolymer had an Mw of $1\times10^4$.

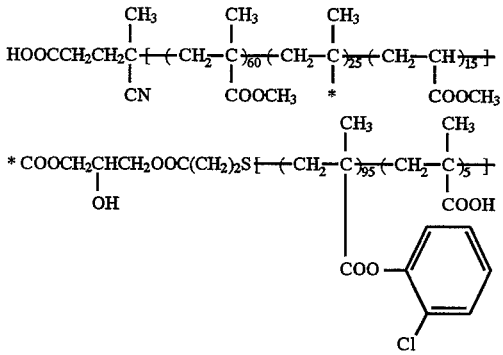

(B₃-2)

SYNTHESIS EXAMPLE 3 OF RESIN ($B_3$): ($B_3$-3)

A mixed solution of 70 g of 2-chlorophenyl methacrylate, 30 g of a macromonomer (Mw of $6.5\times10^3$) corresponding to a repeating unit having the structure shown below, 2 g of thioglycolic acid, and 150 g of toluene- was heated to a temperature of 75° C. under nitrogen gas stream. After adding thereto 1 g of 2,2'-azobis(isobutyronitrile) (abbreviated as AIBN), the reaction was carried out for 4 hours. Then, 0.8 g of AIBN was added thereto, followed by reacting for 3 hours, and thereafter 0.5 g of AIBN was added thereto, followed by reacting for 3 hours. The resulting copolymer had an Mw of $7.8\times10^3$.

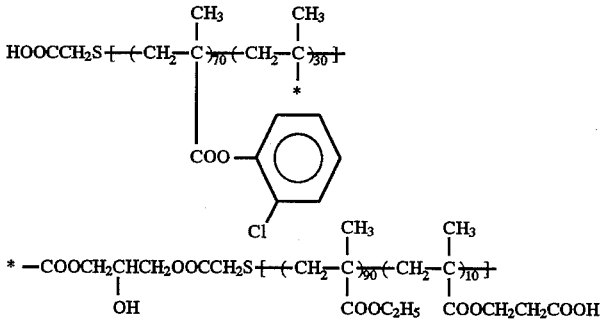

($B_3$-3)

SYNTHESIS EXAMPLES 4 TO 11 OF RESIN ($B_3$): ($B_3$-4) TO ($B_3$-11)

Each of the resin ($B_3$) shown in Table L below was synthesized in the same procedure as described in Synthesis Example 1 of Resin ($B_3$) except for using each of methacrylates and macromonomers corresponding to the polymer components shown in Table L below. The Mw of each of the macromonomers used was in a range of from $5\times10^3$ to $7\times10^3$.

The Mw of each of the resin ($B_3$) was in a range of from $7\times10^3$ to $1\times10^4$.

TABLE L

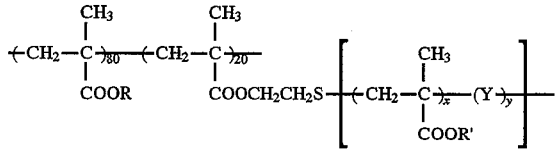

| Synthesis Example of Resin ($B_3$) | Resin ($B_3$) | −R | R' | x/y (weight ratio) | −Y− |
|---|---|---|---|---|---|
| 4 | $B_3$-4 | $-C_2H_5$ | 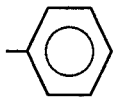 | 95/5 | $-CH_2-CH(COOH)-$ |
| 5 | $B_3$-5 | $-C_3H_7$ | 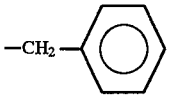 | 90/10 | $-CH_2-C(CH_3)(COO(CH_2)_2OCO(CH_2)_3COOH)-$ |
| 6 | $B_3$-6 | $-C_4H_9$ | 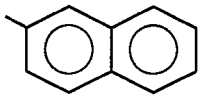 | 95/5 | $-CH_2-C(CH_3)(COO(CH_2)_2O-P(=O)(OH)-OH)-$ |
| 7 | $B_3$-7 | 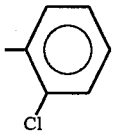 | $-CH_3$ | 94/6 | $-CH_2-CH(COOH_2CH_2COOH)-$ |
| 8 | $B_3$-8 | 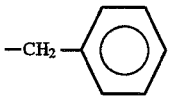 | $-C_2H_5$ | 94/6 | $-CH_2-CH-$ 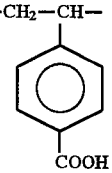 |
| 9 | $B_3$-9 | 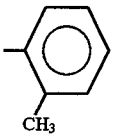 | $-CH_3$ | 96/4 | $-CH_2-C(CH_3)(COO(CH_2)_3SO_3H)-$ |
| 10 | $B_3$-10 | $-CH_3$ | 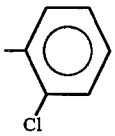 | 96/4 | $-CH_2-C(COOH)(CH_2COOH)-$ |
| 11 | $B_3$-11 | $-CH_3$ | $-C_2H_5$ | 92/8 | $-CH_2-C(CH_3)(COO(CH_2)_2O-P(=O)(OH)-OCH_3)-$ |

SYNTHESIS EXAMPLES 12 TO 19 OF RESIN ($B_3$): ($B_3$-12) TO ($B_3$-19)

Each of the resin ($B_3$) shown in Table M below was synthesized in the same manner as described in Synthesis Example 2 of Resin ($B_3$) except for using each of methacrylates, macromonomers and azobis compounds, corresponding to the components shown in Table M below. The Mw of each of the resin ($B_3$) was in a range of from $5\times10^3$ to $1\times10^4$. The Mw of each of the macromonomers used was in a range of from $3\times10^3$ to $6\times10^3$.

TABLE M
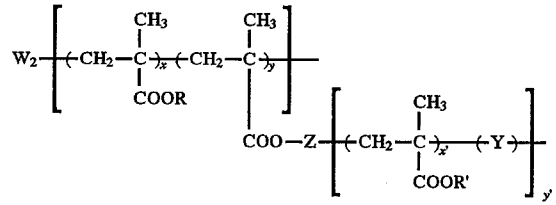
| Synthesis Example of Resin ($B_3$) | Resin ($B_3$) | $W_2$— | R | x/y (weight ratio) | —Z— | R' | —Y— | x'/y' (weight ratio) |
|---|---|---|---|---|---|---|---|---|
| 12 | $B_3$-12 | $HOOC(CH_2)_2C(CH_3)(CN)$— | $-C_2H_5$ | 70/30 | $-CH_2-CHOH-CH_2OOCH_2S-$ | 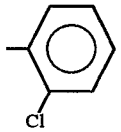 | $-CH_2-C(CH_3)(COOCH_2CH_2COOH)-$ | 92/8 |
| 13 | $B_3$-13 | " | $-C_3H_7$ | 75/25 | " | $-CH_2C_6H_5$ | $-CH_2-CH(CONH(CH_2)_4COOH)-$ | 90/10 |
| 14 | $B_3$-14 | " | $-C_2H_5$ | 90/10 | $-(CH_2)_2OOC(CH_2)_2S$ | 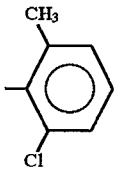 | $-CH_2-CH(COOH)-$ | 94/6 |
| 15 | $B_3$-15 | $HOOC(CH_2)_2C(CH_3)(CN)$— | $-CH_5C_6H_5$ | 85/15 | $-(CH_2)_2S-$ | $-C_2H_5$ | $-CH_2-CH(COO(CH_2)_2COOH)-$ | 92/8 |
| 16 | $B_3$-16 | $HO_3S(CH_2)_2NHOC(CH_2)_2C(CH_3)(CN)$— | 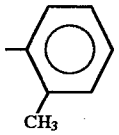 | 88/12 | $-(CH_2)_2S-$ | $-C_4H_9$ | $-CH_2-CH-$ 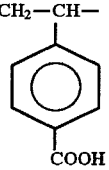 | 90/10 |

TABLE M-continued
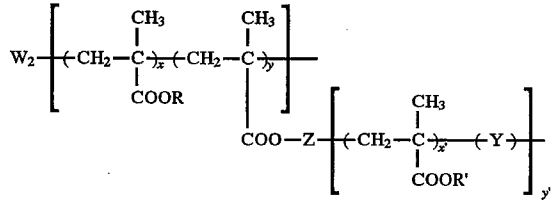
| Synthesis Example of Resin ($B_3$) | Resin ($B_3$) | $W_2$— | R | x/y (weight ratio) | —Z— | R' | —Y— | x'/y' (weight ratio) |
|---|---|---|---|---|---|---|---|---|
| 17 | $B_3$-17 | 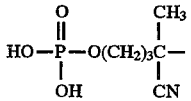 | $-C_2H_5$ | 85/15 | " | 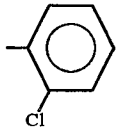 | 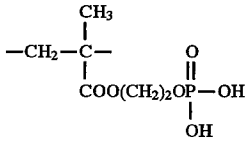 | 95/5 |
| 18 | $B_3$-18 | 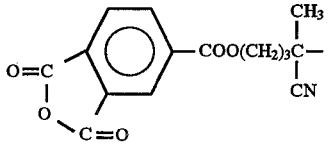 | $-C_3H_7$ | 80/20 | 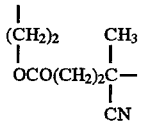 | 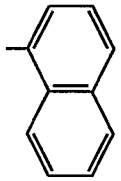 | 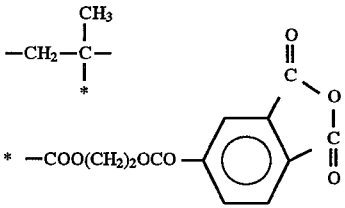 | 90/10 |
| 19 | $B_3$-19 | 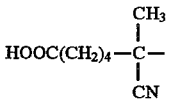 | $-CH_2C_6H_5$ | 85/15 | 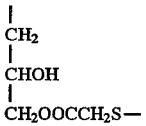 | 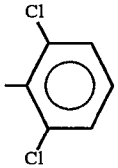 | 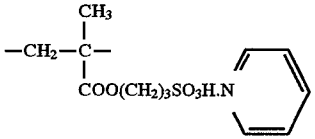 | 93/7 |

SYNTHESIS EXAMPLES 20 TO 27 OF RESIN ($B_3$): ($B_3$-20) TO ($B_3$-27)

Each of the resin ($B_3$) shown in Table N below was synthesized in the same manner as described in Synthesis Example 3 of Resin ($B_3$) using each of methacrylates, macromonomers and mercapto compounds corresponding to the components shown in Table N below. The Mw of each of the resin ($B_3$) was in a range of from $7\times10^3$ to $1\times10^4$. The Mw of each of the macromonomers used was in a range of from $3\times10^3$ to $6\times10^3$.

TABLE N
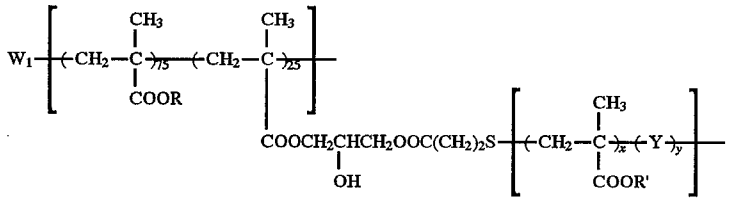
| Synthesis Example of Resin ($B_3$) | Resin ($B_3$) | $W_1$— | R | R' | x/y (weight ratio) | —Y— |
|---|---|---|---|---|---|---|
| 20 | $B_3$-20 | HOOC—$H_2C$—S— | 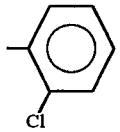 | —$C_2H_5$ | 96/4 | 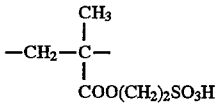 |
| 21 | $B_3$-21 | 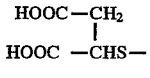 | 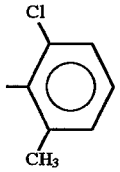 | 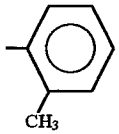 | 95/5 | 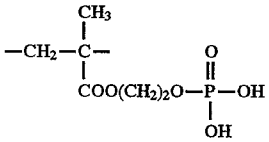 |
| 22 | $B_3$-22 | 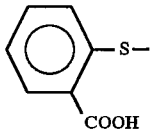 | —$CH_3$ | 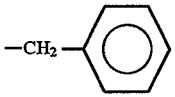 | 90/10 | 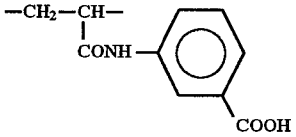 |
| 23 | $B_3$-23 | 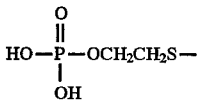 | —$C_2H_5$ | 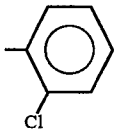 | 92/8 | 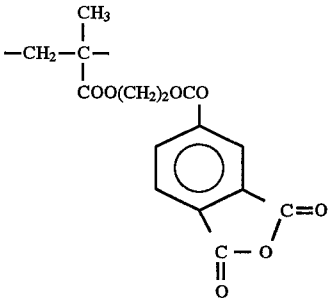 |

TABLE N-continued
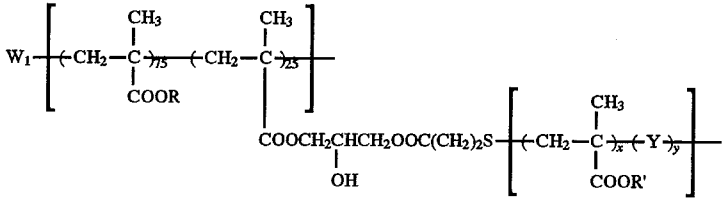
| Synthesis Example of Resin ($B_3$) | Resin ($B_3$) | $W_1$— | R | R' | x/y (weight ratio) | —Y— |
|---|---|---|---|---|---|---|
| 24 | $B_3$-24 | $(C_2H_5)_3N.$ $HO_3SCH_2CH_2S$— | 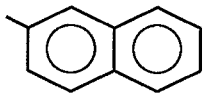 | $-C_4H_9$ | 90/10 | 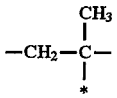 * $COO(CH_2)_2OCO(CH_2)_2COOH$ |
| 25 | $B_3$-25 | 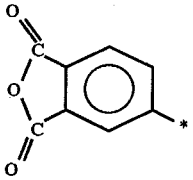 * $CONH(CH_2)_2S$— | 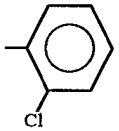 | $-C_2H_5$ | 93/7 | 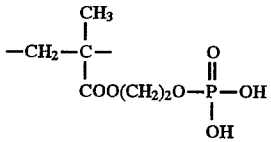 |
| 26 | $B_3$-26 | $HOOC-(CH_2)_2S-$ | 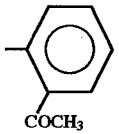 | $-C_3H_7$ | 95/5 | 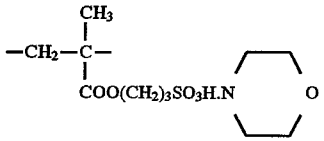 |
| 27 | $B_3$-27 | 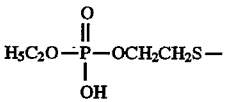 | 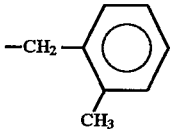 | 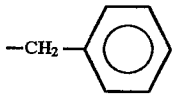 | 85/15 | 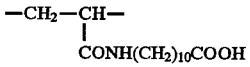 |

SYNTHESIS EXAMPLES 28 TO 35 OF RESIN ($B_3$): ($B_3$-28) TO ($B_3$-35)

A mixed solution of 20 g of a macromonomer (Mw of $4\times10^3$) corresponding to the repeating unit shown in Table O below, 2 g of thiosalicylic acid, 80 g of a monomer corresponding to the repeating unit shown in Table O below, 130 g of toluene and 20 g of ethanol was subjected to a polymerization reaction in the same manner as described in Synthesis Example 3 of Resin ($B_3$) to prepare the resins ($B_3$) shown in Table 0 below, respectively. The Mw of each of the resins ($B_3$) was in a range of from $6\times10^3$ to $8.5\times10^3$.

Synthesis of Resin ($B_4$)
Synthesis of Macromonomer

SYNTHESIS EXAMPLE 1 OF MACROMONOMER ($M_1$): ($M_1$-1)

A mixed solution of 30 g of triphenylmethyl methacrylate and 100 g of toluene was sufficiently degassed under nitrogen gas stream and cooled to −20° C. Then, 1.0 g of 1,1-diphenylbutyl lithium was added to the mixture, and the reaction was conducted for 10 hours. Separately, a mixed solution of 70 g of ethyl methacrylate and 100 g of toluene was sufficiently degassed under nitrogen gas stream, and the resulting mixed solution was added to the above described mixture, and then reaction was further conducted for 10

TABLE O

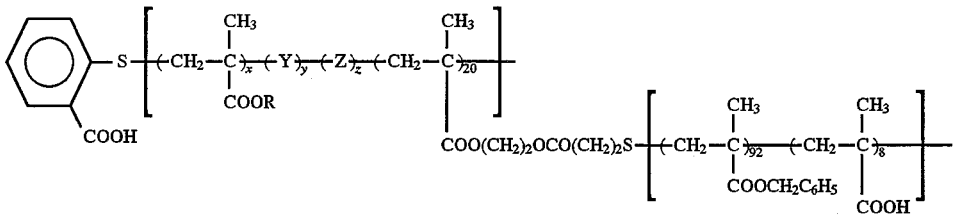

| Synthesis Example of Resin ($B_3$) | Resin ($B_3$) | −R | Y | −Z− | x/y/z |
|---|---|---|---|---|---|
| 28 | $B_3$-28 | $-CH_3$ | $-CH_2CH(COOCH_3)-$ | — | 60/20/0 |
| 29 | $B_3$-29 | $-CH_3$ | $-CH_2CH(COOCH_3)-$ | $-CH_2CH-$ (N, O) | 57.5/20/2.5 |
| 30 | $B_3$-30 | $-CH_3$ | $-CH_2C(CH_3)(COOC_4H_9)-$ | $-CH_2C(CH_3)(COOCH_2CHCH_2)-$ (O) | 55/15/10 |
| 31 | $B_3$-31 | $-CH_2C_6H_5$ | $-CH_2CH(COOCH_2C_6H_5)-$ | $-CH_2CH(CON(CH_3)_2)-$ | 63/15/2 |
| 32 | $B_3$-32 | $-C_2H_5$ | $-CH_2CH(C_6H_5)-$ | — | 70/10/0 |
| 33 | $B_3$-33 | $-C_4H_9$ | $-CH_2C(CH_3)(COO(CH_2)_2OCH_3)-$ | — | 75/5/0 |
| 34 | $B_3$-34 | $-(CH_2)_2C_6H_5$ | $-CH_2C(CH_3)(COOCH_2C_6H_5)-$ | $-CH_2CH(OCOCH_3)-$ | 30/40/10 |
| 35 | $B_3$-35 | $-C_6H_5$ | $-CH_2CH(COOC_2H_5)-$ | $-CH_2C(CH_3)(COO(CH_2)_2NHCOOC_2H_5)-$ | 67/10/3 |

hours. The reaction mixture was adjusted to 0° C., and carbon dioxide gas was passed through the mixture in a flow rate of 60 ml/min for 30 minutes, then the polymerization reaction was terminated.

The temperature of the reaction solution obtained was raised to 25° C. under stirring, 6 g of 2-hydroxyethyl methacrylate was added thereto, then a mixed solution of 12 g of dicyclohexylcarbodiimide, 1.0 g of 4-N,N-dimethylaminopyridine and 20 g of methylene chloride was added dropwise thereto over a period of 30 minutes, and the mixture was stirred for 3 hours.

After removing the precipitated insoluble substances from the reaction mixture by filtration, 10 ml of an ethanol solution of 30% by weight hydrogen chloride was added to the filtrate, and the mixture was stirred for one hour. Then, the solvent of the reaction mixture was distilled off under reduced pressure until the whole volume was reduced to a half, and the mixture was reprecipitated from one liter of petroleum ether. The precipitates thus formed were collected and dried under reduced pressure to obtain 56 g of the macromonomer having a weight average molecular weight (Mw) of $6.5\times10^3$.

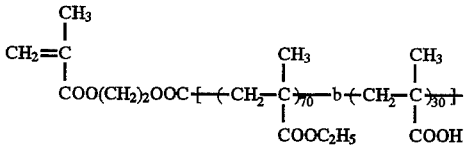

($M_1$-1)

SYNTHESIS EXAMPLE 2 OF MACROMONOMER ($M_1$): ($M_1$-2)

A mixed solution of 5 g of benzyl methacrylate, 0.1 g of (tetraphenyl porphynato) aluminum methyl and 60 g of methylene chloride was raised to a temperature of 30° C. under nitrogen gas stream. The mixture was irradiated with light from a xenon lamp of 300 W at a distance of 25 cm through a glass filter, and the reaction was conducted for 12 hours. To the mixture was further added 45 g of butyl methacrylate, after similarly light-irradiating for 8 hours, 10 g of 4-bromomethylstyrene was added to the reaction mixture followed by stirring for 30 minutes, then the reaction was terminated. Then, Pd-C was added to the reaction mixture, and a catalytic reduction reaction was conducted for one hour at a temperature of 25° C.

After removing insoluble substances from the reaction mixture by filtration, the reaction mixture was reprecipitated from 500 ml of petroleum ether and the precipitates thus formed were collected and dried to obtain 33 g of the macromonomer having an Mw of $7\times10^3$.

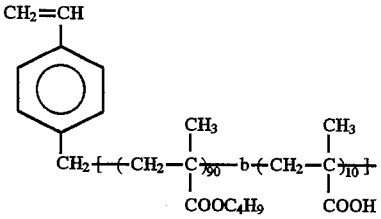

($M_1$-2)

SYNTHESIS EXAMPLE 3 OF MACROMONOMER ($M_1$): ($M_1$-3)

A mixed solution of 20 g of 4-vinylphenyloxytrimethylsilane and 100 g of toluene was sufficiently degassed under nitrogen gas stream and cooled to 0° C. Then, 2 g of 1,1-diphenyl-3-methylpentyl lithium was added to the mixture followed by stirring for 6 hours. Separately, a mixed solution of 80 g of 2-chloro-6-methylphenyl methacrylate and 100 g of toluene was sufficiently degassed under nitrogen gas stream and the resulting mixed solution was added to the above described mixture, and then reaction was further conducted for 8 hours. After introducing ethylene oxide at a flow rate of 30 ml/min into the reaction mixture for 30 minutes with vigorously stirring, the mixture was cooled to a temperature of 15° C., and 12 g of methacrylic acid chloride was added dropwise thereto over a period of 30 minutes, followed by stirring for 3 hours.

Then, to the reaction mixture was added 10 g of an ethanol solution of 30% by weight hydrogen chloride and, after stirring the mixture for one hour at 25° C., the mixture was reprecipitated from one liter of petroleum ether. The precipitates thus formed were collected, washed twice with 300 ml of diethyl ether and dried to obtain 55 g of the macromonomer having an Mw of $7.8\times10^3$.

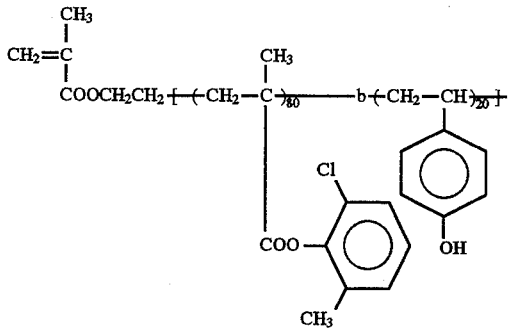

($M_1$-3)

SYNTHESIS EXAMPLE 4 OF MACROMONOMER ($M_1$): ($M_1$-4)

A mixed solution of 40 g of triphenylmethyl acrylate and 100 g of toluene was sufficiently degassed under nitrogen gas stream and cooled to −20° C. Then, g of sec-butyl lithium was added to the mixture, and the reaction was conducted for 10 hours. Separately, a mixed solution of 60 g of styrene and 100 g of toluene was sufficiently degassed under nitrogen gas stream and the resulting mixed solution was added to the above described mixture, and then reaction was further conducted for 12 hours. The reaction mixture was adjusted to 0° C., 11 g of benzyl bromide was added thereto, and the reaction was conducted for one hour, followed by reacting at a temperature of 25° C. for 2 hours.

Then, to the reaction mixture was added 10 g of an ethanol solution of 30% by weight hydrogen chloride, followed by stirring for 2 hours. After removing the insoluble substances from the reaction mixture by filtration, the mixture was reprecipitated from one liter of n-hexane. The precipitates thus formed were collected and dried under reduced pressure to obtain 58 g of the macromonomer having an Mw of $4.5\times10^3$.

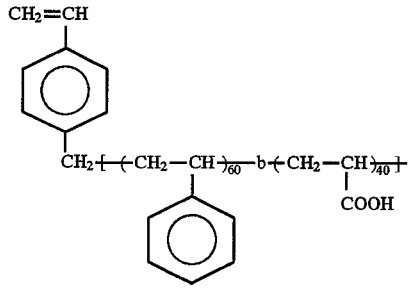

($M_1$-4)

SYNTHESIS EXAMPLE 5 OF MACROMONOMER ($M_1$): ($M_1$-5)

A mixed solution of 70 g of phenyl methacrylate and 4.8 g of benzyl N-hydroxyethyl-N-ethyldithiocarbamate was placed in a vessel under nitrogen gas stream followed by closing the vessel and heated to a temperature of 60° C. The mixture was irradiated with light from a high-pressure mercury lamp for 400 W at a distance of 10 cm through a glass filter for 10 hours to conduct a photopolymerization reaction. Then, 30 g of acrylic acid and 180 g of methyl ethyl ketone were added to the mixture and, after replacing the gas in the vessel with nitrogen, the mixture was light-irradiated again for 10 hours.

To the resulting reaction mixture was added dropwise 12 g of 2-isocyanatoethyl methacrylate at a temperature of 30° C. over a period of one hour and the mixture was stirred for 2 hours. The reaction mixture obtained was reprecipitated from 1.5 liters of hexane and the precipitates thus formed were collected and dried to obtain 68 g of the macromonomer having an Mw of $6.0\times10^3$.

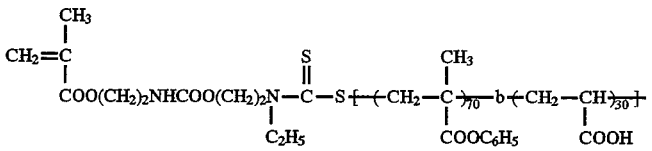

($M_1$-5)

SYNTHESIS EXAMPLE 1 OF RESIN ($B_4$): ($B_4$-1)

A mixed solution of 80 g of ethyl methacrylate, 20 g of Macromonomer ($M_1$-1) and 150 g of toluene was heated at a temperature of 95° C. under nitrogen gas stream, and 6 g of 2,2'-azobis(isobutyronitrile) (abbreviated as AIBN) was added thereto to effect reaction for 3 hours. Then, 2 g of AIBN was further added thereto, followed by reacting for 2 hours, and thereafter 2 g of AIBN was added thereto, followed by reacting for 2 hours. The resulting copolymer had an Mw of $9\times10^3$.

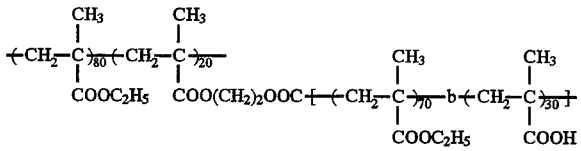

Resin ($B_4$-1)

SYNTHESIS EXAMPLE 2 OF RESIN ($B_4$): ($B_4$-2)

A mixed solution of 70 g of 2-chlorophenyl methacrylate, 30 g of Macromonomer ($M_1$-2), 2 g of n-dodecylmercaptan and 100 g of toluene was heated at a temperature of 80° C. under nitrogen gas stream, and 3 g of 2,2'-azobis (isovaleronitrile) (abbreviated as AIVN) was added thereto to effect reaction for 3 hours. Then, 1 g of AIVN was further added, followed by reacting for 2 hours, and thereafter 1 g of AIVN was added thereto, followed by heating to a temperature of 90° C. and reacting for 3 hours. The resulting copolymer had an Mw of $7.6\times10^3$.

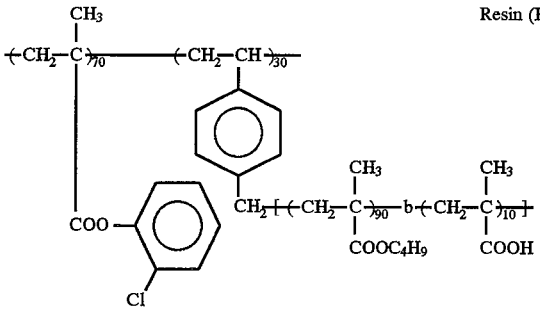

Resin ($B_4$-2)

SYNTHESIS EXAMPLES 3 TO 18 OF RESIN ($B_4$): ($B_4$-3) TO ($B_4$-18)

The copolymers shown in Table P below were synthesized under the same polymerization conditions as described in Synthesis Example 1 of Resin ($B_4$ ) except for using the monomers shown in Table P below in place of the ethyl methacrylate, respectively. The Mw of each of the copolymers obtained was in a range of from $5\times10^3$ to $9\times10^3$.

TABLE P
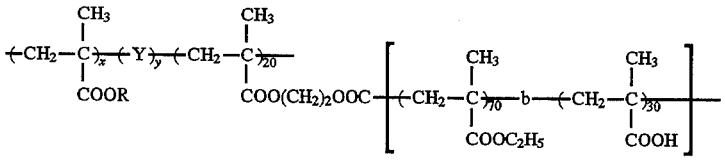
x + y + 20 = 100 (weight ratio)
| Synthesis Example of Resin ($B_4$) | Resin ($B_4$) | —R | —Y— | x/y |
|---|---|---|---|---|
| 3 | $B_4$-3 | $-C_4H_9$ | — | 80/0 |
| 4 | $B_4$-4 | $-CH_2C_6H_5$ | — | 80/0 |
| 5 | $B_4$-5 | $-C_6H_5$ | — | 80/0 |
| 6 | $B_4$-6 | $-C_4H_9$ | $-CH_2-CH-$ 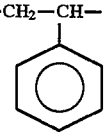 | 65/15 |
| 7 | $B_4$-7 | $-CH_2C_6H_5$ | $-CH_2-CH-$ (COOCH$_3$) | 70/10 |
| 8 | $B_4$-8 | 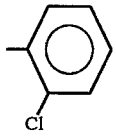 | — | 80/0 |
| 9 | $B_4$-9 | 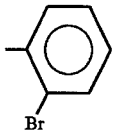 | — | 80/0 |
| 10 | $B_4$-10 | 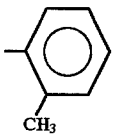 | — | 80/0 |
| 11 | $B_4$-11 | 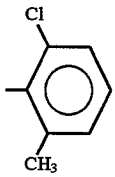 | — | 80/0 |
| 12 | $B_4$-12 | 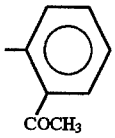 | — | 80/0 |
| 13 | $B_4$-13 | 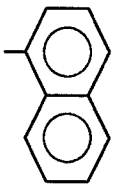 | $-CH_2-CH-$ (COOC$_2$H$_5$) | 70/10 |

TABLE P-continued

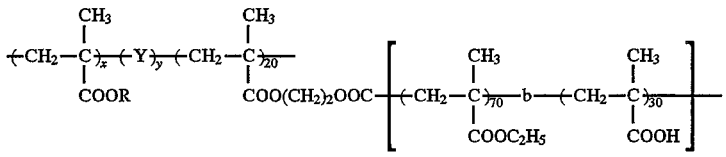

x + y + 20 = 100 (weight ratio)

| Synthesis Example of Resin ($B_4$) | Resin ($B_4$) | —R | —Y— | x/y |
|---|---|---|---|---|
| 14 | $B_4$-14 | —$CH_2$ 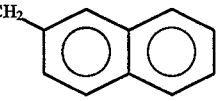 | — | 80/0 |
| 15 | $B_4$-15 | —$CH_3$ | —$CH_2$—C(CH$_3$)(COOC$_4$H$_9$)— | 40/40 |
| 16 | $B_4$-16 | —$CH_2C_6H_5$ | —$CH_2$—C(CH$_3$)(COO(CH$_2$)$_2$CN)— | 65/15 |
| 17 | $B_4$-17 | —$C_6H_5$ | —$CH_2$—CH(CONH$_2$)— | 72/8 |
| 18 | $B_4$-18 | 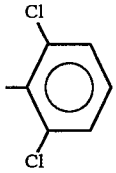 | — | 80/0 |

SYNTHESIS EXAMPLES 19 TO 35 OF RESIN ($B_4$): ($B_4$-19) TO ($B_4$-35)

The copolymers shown in Table Q below were synthesized under the same polymerization conditions as described in Synthesis Example 2 of Resin ($B_4$) except for using the macromonomers ($M_1$) shown in Table Q below in place of Macromonomer ($M_1$-2), respectively. The Mw of each of the copolymers obtained was in a range of from $2\times10^3$ to $1\times10^4$.

TABLE Q
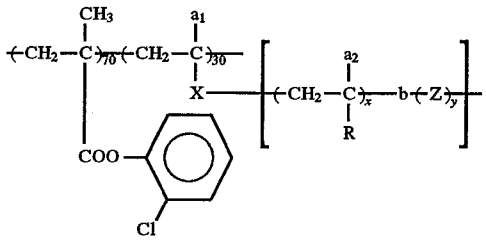
(weight ratio)
| Synthesis Example of Resin ($B_4$) | Resin ($B_4$) | −X− | $a_1/a_2$ | −R | −Z− | x/y |
|---|---|---|---|---|---|---|
| 19 | $B_4$-19 | $-COO(CH_2)_2OOC-$ | $-H/-CH_3$ | $-COOCH_3$ | $-CH_2-CH(COOH)-$ | 70/30 |
| 20 | $B_4$-20 | $-COOCH_2CH(OH)CH_2OOC-$ | $-CH_3/-CH_3$ | $-COOCH_2C_6H_5$ | 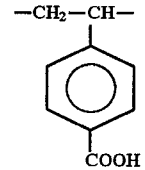 | 60/40 |
| 21 | $B_4$-21 | 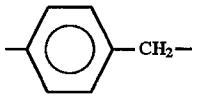 | $-H/-CH_3$ | $-COOC_6H_5$ | $-CH_2-C(CH_3)(COO(CH_2)_2COOH)-$ | 65/35 |
| 22 | $B_4$-22 | $-COO(CH_2)_2OCO(CH_2)_2-$ $-COO(CH_2)_2-$ | $-CH_3/-CH_3$ | $-COOC_2H_5$ | $-CH_2-C(CH_3)(COOH)-$ | 80/20 |
| 23 | $B_4$-23 | $-COOCH_2CH_2-$ | $-CH_3/-H$ | $-C_6H_5$ | 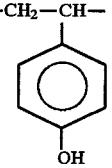 | 50/50 |

TABLE Q-continued
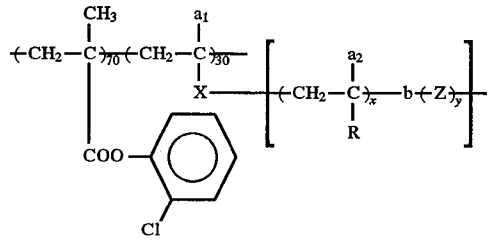
(weight ratio)
| Synthesis Example of Resin ($B_4$) | Resin ($B_4$) | −X− | $a_1/a_2$ | −R | −Z− | x/y |
|---|---|---|---|---|---|---|
| 24 | $B_4$-24 | $-COOCH_2CH(OH)CH_2OOC-$ | $-CH_3/-CH_3$ | $-COOC_2H_5$ | $-CH_2-C(CH_3)(COO(CH_2)_3SO_3H)-$ | 90/10 |
| 25 | $B_4$-25 | 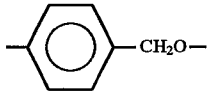 | $-H/-CH_3$ | $-COOC_3H_7$ | $-CH_2-C(CH_3)(COO(CH_2)_2O-P(=O)(OH)-CH_3)-$ | 80/20 |
| 26 | $B_4$-26 | $-COO(CH_2)_2N(C_2H_5)-C(=S)-S-$ | $-CH_3/-CH_3$ | $-COOC_2H_5$ | $-CH_2-CH-$ 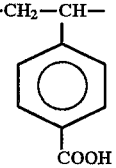 | 65/35 |
| 27 | $B_4$-27 | " | $-CH_3/-H$ | $-COOC_6H_5$ | $-CH(CH_3)-CH(COOH)-$ | 70/30 |
| 28 | $B_4$-28 | $-COO(CH_2)_2NHCOO-(CH_2)_2-$ | $-CH_3/-CH_3$ | " | $-CH_2-CH(COOH)-$ | 75/25 |

TABLE Q-continued
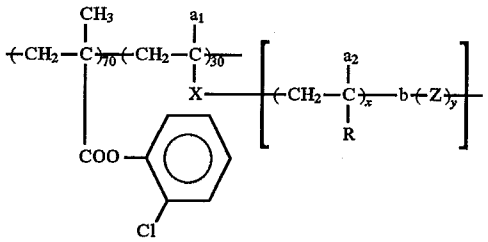
(weight ratio)
| Synthesis Example of Resin ($B_4$) | Resin ($B_4$) | −X− | $a_1/a_2$ | −R | −Z− | x/y |
|---|---|---|---|---|---|---|
| 29 | $B_4$-29 | $-COOCH_2CH_2-$ | $-CH_3/-H$ | $-C_6H_5$ | 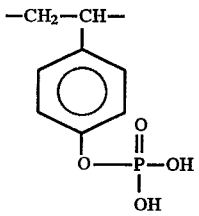 | 90/10 |
| 30 | $B_4$-30 | $\vert$ $CONHCOOCH_2CH_2-$ | $-CH_3/-CH_3$ | $-COOCH_2C_6H_5$ | 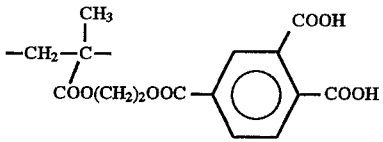 | 70/30 |
| 31 | $B_4$-31 | 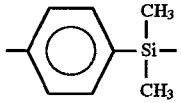 | $-H/-CH_3$ | $-COOC_4H_9$ | 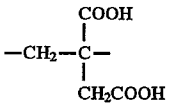 | 80/20 |
| 32 | $B_4$-32 | $-COO-$ | $-CH_3/-CH_3$ | $-COOCH_3$ | 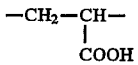 | 70/30 |

TABLE Q-continued
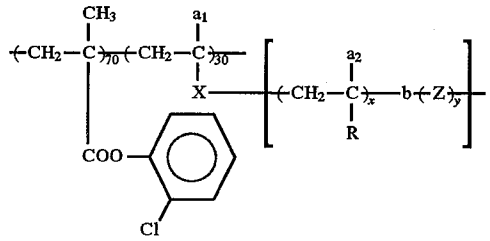
(weight ratio)
| Synthesis Example of Resin ($B_4$) | Resin ($B_4$) | −X− | $a_1/a_2$ | −R | −Z− | x/y |
|---|---|---|---|---|---|---|
| 33 | $B_4$-33 | $-COO(CH_2)_4OOC-$ | $-CH_3/-CH_3$ | 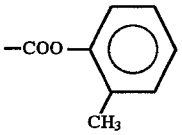 | 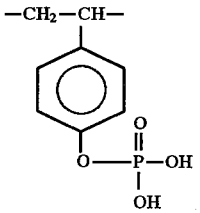 | 75/25 |
| 34 | $B_4$-34 | 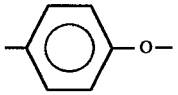 | −H/−H | $-C_6H_5$ | 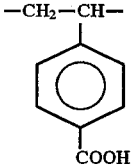 | 70/30 |
| 35 | $B_4$-35 | 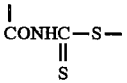 | $-H/-CH_3$ | $-COOCH_2C_6H_5$ | 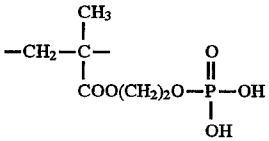 | 85/15 |

Synthesis of Resin ($B_5$)

SYNTHESIS EXAMPLE 1 OF RESIN ($B_5$): ($B_5$-1)

A mixed solution of 66 g of methyl methacrylate, 30 g of methyl acrylate, 4 g of acrylic acid, 28 g of Initiator (I-1) having the structure shown below and 150 g of tetrahydrofuran was heated to a temperature of 50° C. under nitrogen gas stream.

Initiator (I-1)

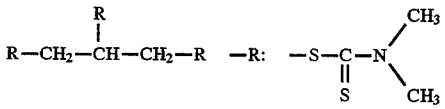

The solution was irradiated with light from a high-pressure mercury lamp of 400 W at a distance of 10 cm through a glass filter, and a photopolymerization reaction was conducted for 10 hours. The reaction mixture obtained was reprecipitated in one liter of methanol, and the precipitates formed were collected and dried to obtain 72 g of the polymer having a weight average molecular weight (which was a value measured by a GPC method and calculated in terms of polystyrene) (herein simply referred to as Mw) of $8\times10^3$.

Resin ($B_5$-1)

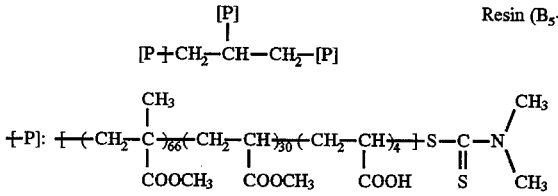

SYNTHESIS EXAMPLE 2 OF RESIN ($B_5$): ($B_5$-2)

Resin ($B_5$-2) was synthesized under the same condition as described in Synthesis Example 1 of Resin ($B_5$) except for using 36.3 g of Initiator (I-2) having the structure shown below in place of 28 g of Initiator (I-1). The yield of the resulting polymer was 75 g and the Mw was $7.5\times10^3$.

Initiator (I-2)

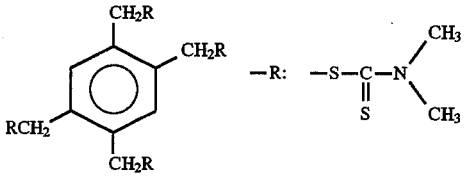

Resin ($B_5$-2)

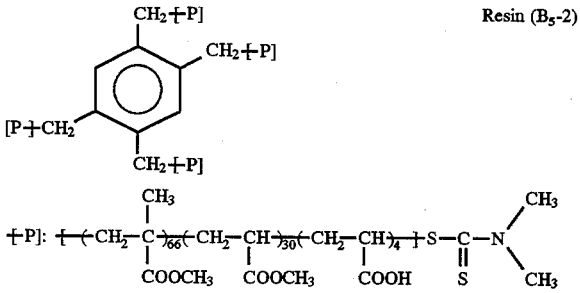

SYNTHESIS EXAMPLES 3 TO 9 OF RESIN ($B_5$): ($B_5$-3) TO ($B_5$-9)

Each of resins ($B_5$) shown in Table R below was synthesized under the same condition as described in Synthesis Example 1 of Resin ($B_5$) except for using a mixed solution of 95 g of 2-chlorophenyl methacrylate, 5 g of methacrylic acid, 0.10 mole of Initiator shown in Table R below and 100 g of tetrahydrofuran. The Mw of each of the resulting resins ($B_5$) was in a range of from $6\times10^3$ to $8\times10^3$.

TABLE R

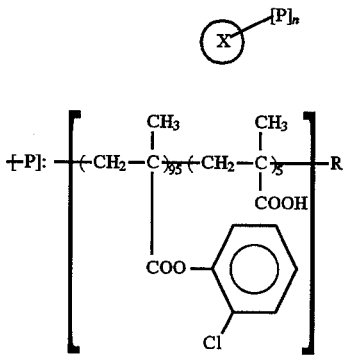

| Synthesis Example of Resin ($B_5$) | Initiator (I) | —R | X |
|---|---|---|---|
| 3 | 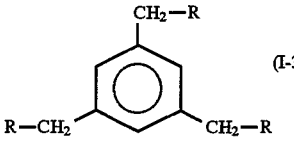 (I-3) | 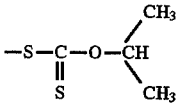 | 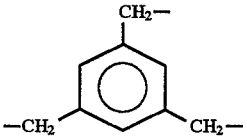 |
| 4 | 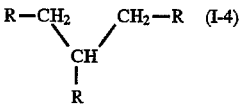 (I-4) | 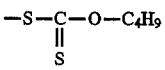 | 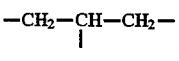 |

TABLE R-continued

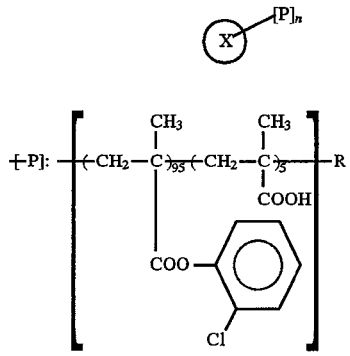

| Synthesis Example of Resin ($B_5$) | Initiator (I) | —R | 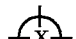 |
|---|---|---|---|
| 5 | 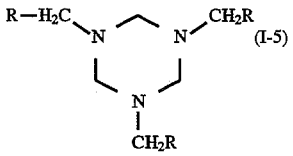 (I-5) | 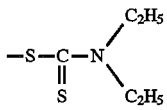 | 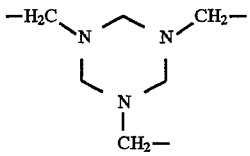 |
| 6 | 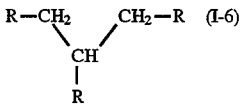 (I-6) | 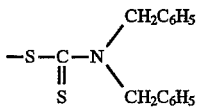 | 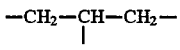 |
| 7 | 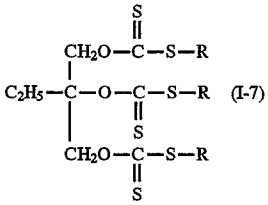 (I-7) | $-CH_2C_6H_5$ | 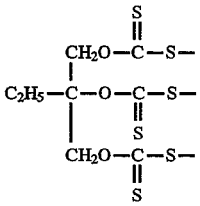 |
| 8 | 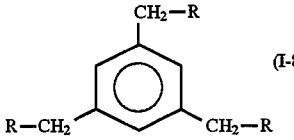 (I-8) | 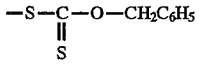 | 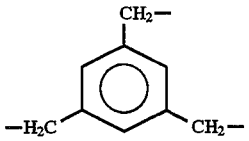 |
| 9 | 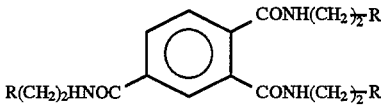 (I-9) | 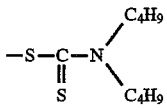 | 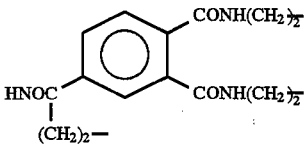 |

SYNTHESIS EXAMPLES 10 TO 25 OF RESIN ($B_5$): ($B_5$-10) TO ($B_5$-25)

Each of the resins ($B_5$) shown in Table S below was synthesized under the same condition as described in Synthesis Example 1 of Resin ($B_5$) except for using each of monomers corresponding to the polymer components shown in Table S below in place of methyl methacrylate, methyl acrylate and acrylic acid. The Mw of each of the resulting resins ($B_5$) was in a range of from $6\times10^3$ to $9\times10^3$.

TABLE S
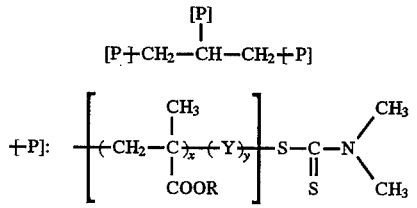
| Synthesis Example of Resin ($B_5$) | ($B_5$) | −R | −Y− | x/y (weight ratio) |
|---|---|---|---|---|
| 10 | $B_5$-10 | $-CH_2C_6H_5$ | $-CH_2-CH(COOH)-$ | 95/5 |
| 11 | $B_5$-11 | $-CH_2C_6H_5$ | 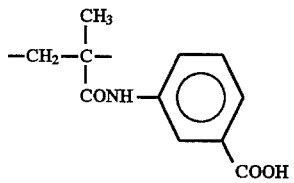 | 94/6 |
| 12 | $B_5$-12 | 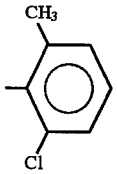 | $-CH_2-CH(COOH)-$ | 95/5 |
| 13 | $B_5$-13 | 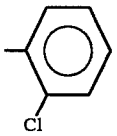 | 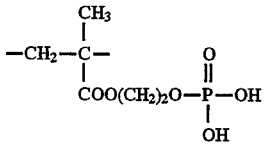 | 94/6 |
| 14 | $B_5$-14 | 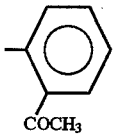 | 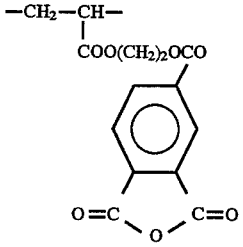 | 93/7 |
| 15 | $B_5$-15 | 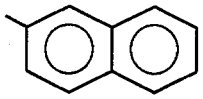 | 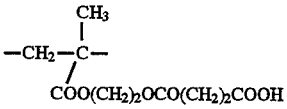 | 95/5 |
| 16 | $B_5$-16 | 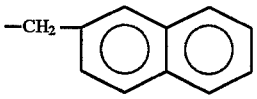 | 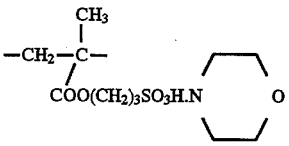 | 96/4 |
| 17 | $B_5$-17 | $-CH_3$ | 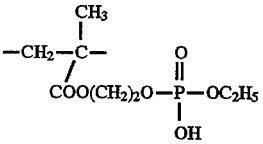 | 94/6 |

TABLE S-continued
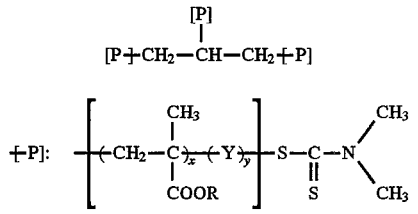
| Synthesis Example of Resin ($B_5$) | ($B_5$) | −R | −Y− | x/y (weight ratio) |
|---|---|---|---|---|
| 18 | $B_5$-18 | 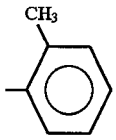 | 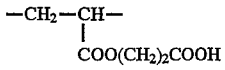 | 95/5 |
| 19 | $B_5$-19 | $-CH_2C_6H_5$ | 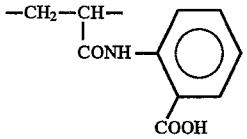 | 94/6 |
| 20 | $B_5$-20 | 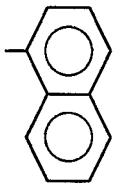 | 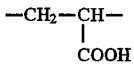 | 95/5 |
| 21 | $B_5$-21 | 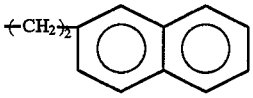 | 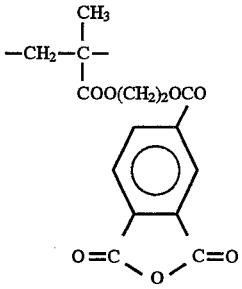 | 94/6 |
| 22 | $B_5$-22 | $-C_2H_5$ | 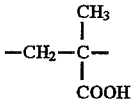 | 94/6 |
| 23 | $B_5$-23 | $-C_6H_5$ | 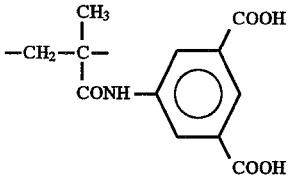 | 97/3 |
| 24 | $B_5$-24 | 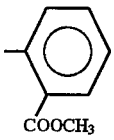 | 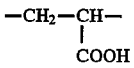 | 95/5 |

TABLE S-continued

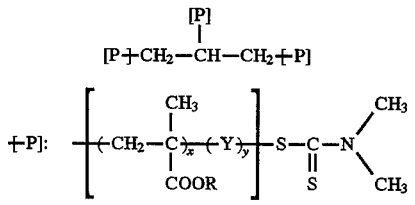

| Synthesis Example of Resin ($B_5$) | ($B_5$) | −R | −Y− | x/y (weight ratio) |
|---|---|---|---|---|
| 25 | $B_5$-25 | $-CH_2C_6H_5$ | $-CH_2-CH-$ 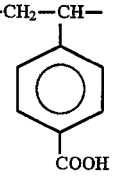 | 96/4 |

SYNTHESIS EXAMPLES 26 TO 30 OF RESIN ($B_5$): ($B_5$-26) TO ($B_5$-30)

A mixture of 33.9 g of Initiator (I-2) described above and monomers corresponding to the polymer components shown in Table T below was heated to 40° C. under nitrogen gas stream, followed by light irradiation for polymerization in the same manner as described in Synthesis Example 1 of Resin ($B_5$). The solid material obtained was collected, dissolved in 250 ml of tetrahydrofuran, reprecipitated in 1.5 liters of methanol, and the precipitates formed were collected by filtration and dried. The yield of each of the resulting polymers was in a range of from 60 to 75 g and the Mw thereof was in a range of from $6\times10^3$ to $8\times10^3$.

TABLE T

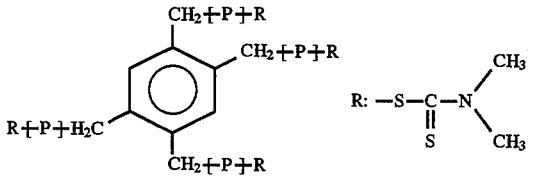

| Synthesis Example of Resin ($B_5$) | ($B_5$) | Component of (P) (weight ratio) |
|---|---|---|
| 26 | $B_5$-26 | 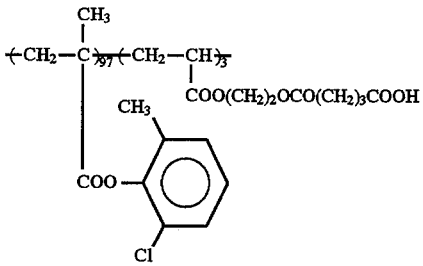 |
| 27 | $B_5$-27 | 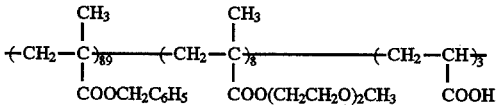 |
| 28 | $B_5$-28 | 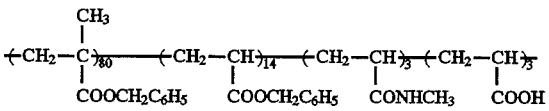 |

TABLE T-continued

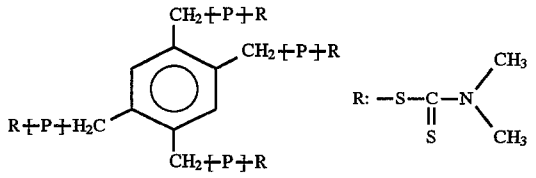

| Synthesis Example of Resin ($B_5$) | ($B_5$) | Component of (P) (weight ratio) |
|---|---|---|
| 29 | $B_5$-29 | 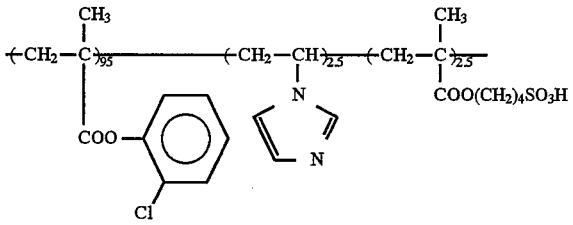 |
| 30 | $B_5$-30 | 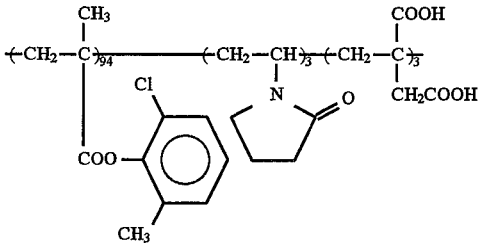 |

Synthesis of Resin ($B_6$)

SYNTHESIS EXAMPLE 1 OF RESIN ($B_6$): ($B_6$-1)

A mixture of 47.5 g of benzyl methacrylate, 24.8 g of Initiator (I-1) shown below and 70 g of tetrahydrofuran was heated to a temperature of 40° C. under nitrogen gas stream.

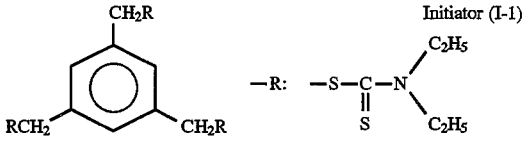

Initiator (I-1)

The solution was irradiated with light from a high-pressure mercury lamp of 400 W at a distance of 10 cm through a glass filter, and a photopolymerization reaction was conducted for 10 hours. To the reaction mixture was added a mixed solution of 2.5 g of methacrylic acid and 5 g of tetrahydrofuran, and the mixture was further irradiated with light in the same manner as above for 10 hours at a temperature of 40° C. under nitrogen gas stream. The reaction mixture was reprecipitated in 800 ml of a solvent mixture of water and methanol (2:1 by volume), and the precipitates formed were collected and dried. The yield of the resulting polymer was 38 g and the Mw was $8.5\times10^3$.

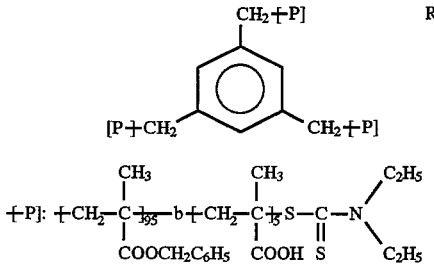

Resin ($B_6$-1)

In the above formula, -b- represents a bond connecting blocks (hereinafter the same).

SYNTHESIS EXAMPLES 2 TO 10 OF RESIN ($B_6$): ($B_6$-2) TO ($B_6$-10)

Each of resins ($B_6$) shown in Table U shown below was synthesized under the same condition as described in Synthesis Example 1 of Resin ($B_6$) except for using each of monomers corresponding to the polymer components shown in Table U below in place of 47.5 g of benzyl methacrylate and 2.5 g of methacrylic acid. The Mw of each of the resulting resins ($B_6$) was in a range of from $7\times10^3$ to $1\times10^4$.

TABLE U
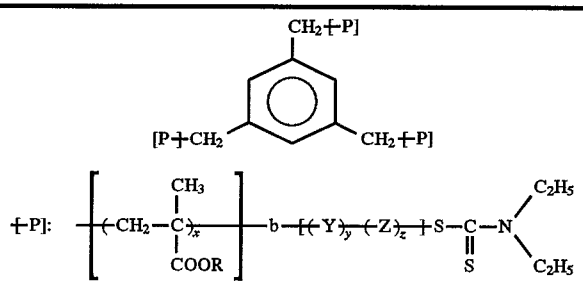
| Synthesis Example of Resin ($B_6$) | ($B_6$) | −R | −Y− | −Z− | x/y/z |
|---|---|---|---|---|---|
| 2 | $B_6$-2 | 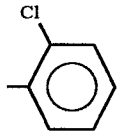 | — | $-CH_2-CH(COOH)-$ | 95/0/5 |
| 3 | $B_6$-3 | 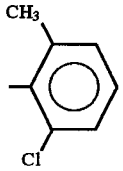 | — | $-CH_2-C(CH_3)(COOH)-$ | 94/0/6 |
| 4 | $B_6$-4 | 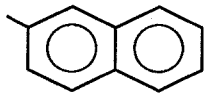 | — | $-CH_2-CH(COO(CH_2)_2COOH)-$ | 93/0/7 |
| 5 | $B_6$-5 | 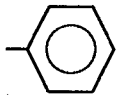 | $-CH_2-CH(COOCH_2C_6H_5)-$ | $-CH_2-CH(COOH)-$ | 87/10/3 |
| 6 | $B_6$-6 | 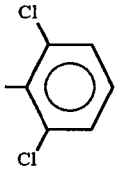 | 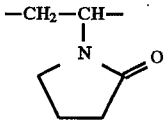 | $-CH_2-C(CH_3)(COOH)-$ | 93/3/4 |

TABLE U-continued
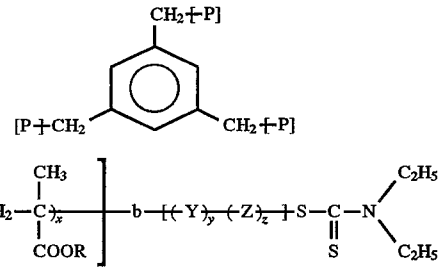
| Synthesis Example of Resin ($B_6$) | ($B_6$) | −R | −Y− | −Z− | x/y/z |
|---|---|---|---|---|---|
| 7 | $B_6$-7 | 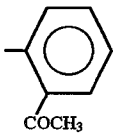 | — | 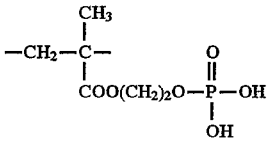 | 94/0/6 |
| 8 | $B_6$-8 | 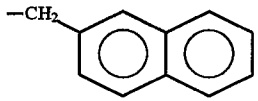 | 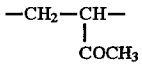 | 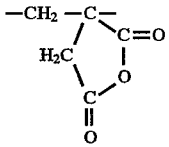 | 89/5/6 |
| 9 | $B_6$-9 | 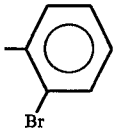 | — | 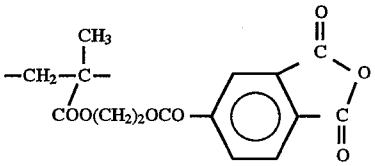 | 92/0/8 |
| 10 | $B_6$-10 | $-CH_2C_6H_5$ | 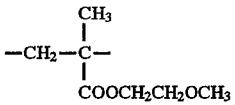 | 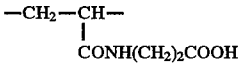 | 87/8/5 |

SYNTHESIS EXAMPLES 11 TO 16 OF RESIN ($B_6$): ($B_6$-11) TO ($B_6$-16)

A mixed solution of 40 g of 2-chlorophenyl methacrylate, 0.02 moles of Initiator shown in Table V below and 50 g of tetrahydrofuran was subjected to light irradiation for 8 hours in the same manner as described in Synthesis Example 1 of Resin ($B_6$). To the reaction mixture was added a mixed solution of 7.5 g of benzyl methacrylate, 2.5 g of methacrylic acid and 10 g of tetrahydrofuran, followed by reacting in the same manner as described in Synthesis Example 1 of Resin ($B_6$). The Mw of each of the resulting resin ($B_6$) was in a range of from $5\times10^3$ to $9\times10^3$.

TABLE V
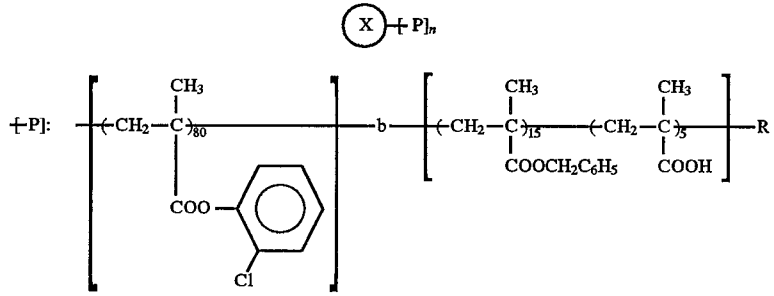
| Synthesis Example of Resin ($B_6$) | Resin ($B_6$) | Initiator (I) | —R | X—[P]n |
|---|---|---|---|---|
| 11 | $B_6$-11 | 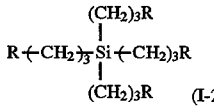 (I-2) | 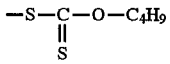 | 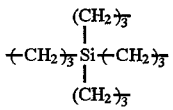 |
| 12 | $B_6$-12 | 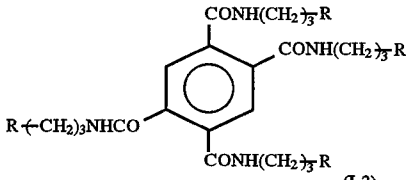 (I-3) | 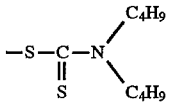 | 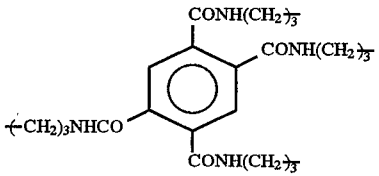 |
| 13 | $B_6$-13 | 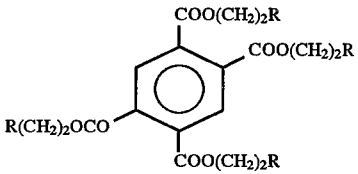 (I-4) | 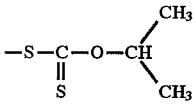 | 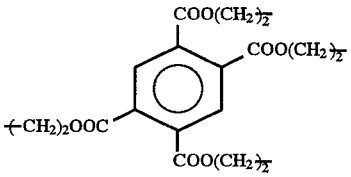 |
| 14 | $B_6$-14 | 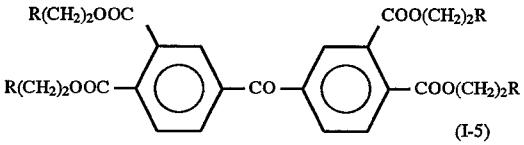 (I-5) | 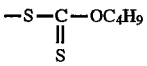 | 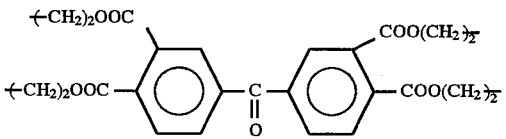 |

TABLE V-continued
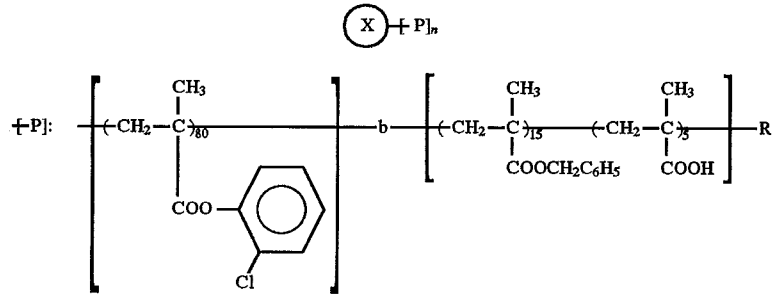
| Synthesis Example of Resin ($B_6$) | Resin ($B_6$) | Initiator (I) | —R | X—[P]n |
|---|---|---|---|---|
| 15 | $B_6$-15 | 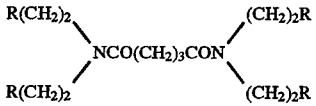 (I-6) | 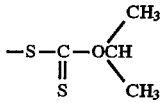 | 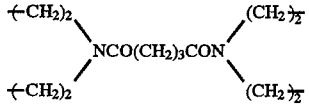 |
| 16 | $B_6$-16 | 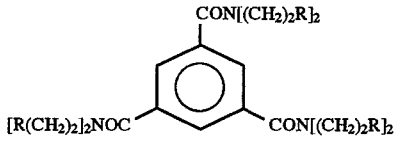 (I-7) | 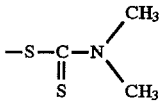 | 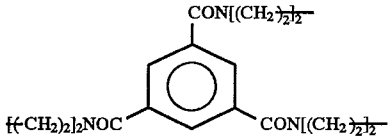 |

SYNTHESIS EXAMPLES 17 TO 25 OF RESIN ($B_6$): ($B_6$-17) TO ($B_6$-25)

A mixed solution of 52.5 g of methyl methacrylate, 17.5 g of methyl acrylate, 44 g of Initiator (I-8) shown below and 75 g of tetrahydrofuran was irradiated with light for 15 hours in the same manner as described in Synthesis Example 1 of Resin ($B_6$) at a temperature of 50° C. under nitrogen gas stream.

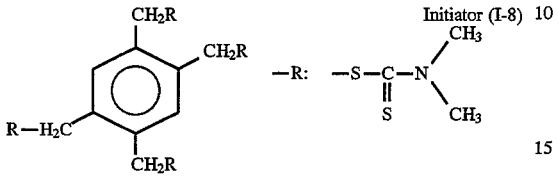

To the reaction mixture was added a mixture of monomers corresponding to the polymer components shown in Table W below and 25 g of tetrahydrofuran, and the mixture was further irradiated with light for 15 hours in the same manner as described above. The Mw of each of the resulting resin ($B_6$) was in a range of from $5\times10^3$ to $8\times10^3$.

TABLE W

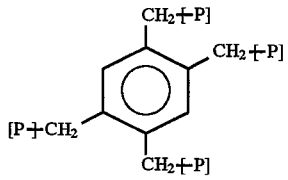

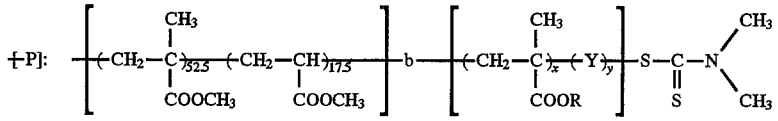

| Synthesis Example of Resin ($B_6$) | ($B_6$) | —R | —Y— | x/y |
|---|---|---|---|---|
| 17 | $B_6$-17 | 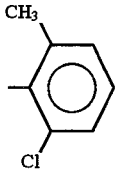 | 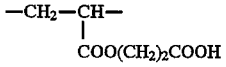 | 28/2 |
| 18 | $B_6$-18 | 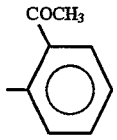 | 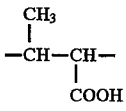 | 28.5/1.5 |
| 19 | $B_6$-19 | 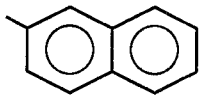 | 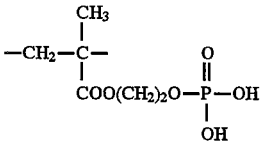 | 27/3 |
| 20 | $B_6$-20 | 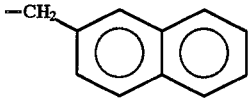 | 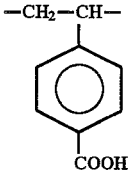 | 27.5/2.5 |

TABLE W-continued

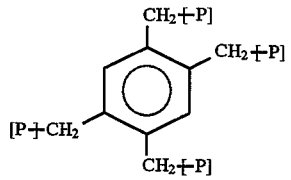

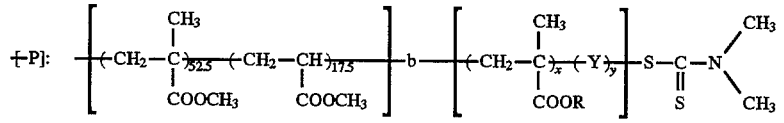

| Synthesis Example of Resin ($B_6$) | ($B_6$) | −R | −Y− | x/y |
|---|---|---|---|---|
| 21 | $B_6$-21 | 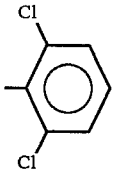 | 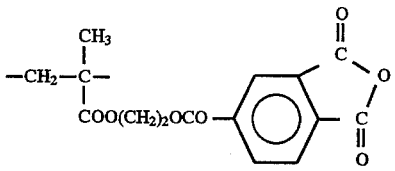 | 26/4 |
| 22 | $B_6$-22 | $-C_6H_5$ | 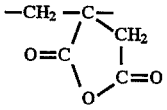 | 27/3 |
| 23 | $B_6$-23 | 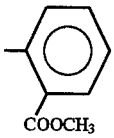 | 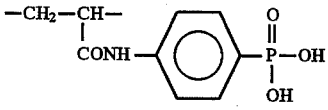 | 27.5/2.5 |
| 24 | $B_6$-24 | 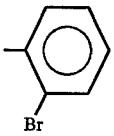 | 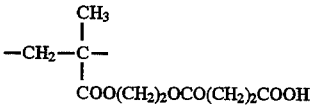 | 26.5/3.5 |
| 25 | $B_6$-25 | 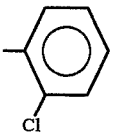 | 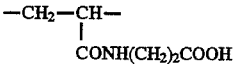 | 27.5/2.5 |

SYNTHESIS EXAMPLES 26 TO 31 OF RESIN ($B_6$): ($B_6$-26) TO ($B_6$-31)

Each of resins ($B_6$) shown in Table X below was synthesized in the same manner as described in Synthesis Example 1 of Resin ($B_6$) except for using monomers corresponding to the polymer components shown in Table X below and 0.03 moles of Initiator (I-9) shown below. The Mw of each of the resulting resin ($B_6$) was in a range of from $4\times10^3$ to $9\times10^3$.

Initiator (I-9)

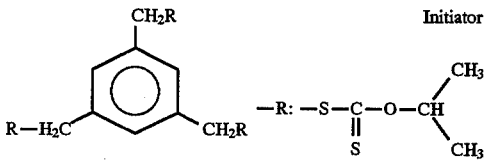

TABLE X

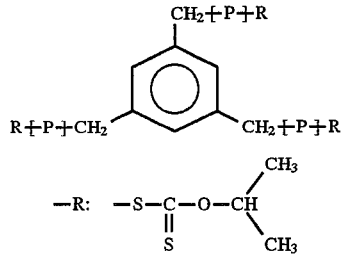

| Synthesis Example of Resin ($B_6$) | ($B_6$) | ⊣P⊢ (weight ratio) |
|---|---|---|
| 26 | $B_6$-26 | 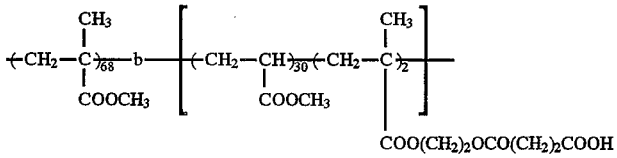 |
| 27 | $B_6$-27 | 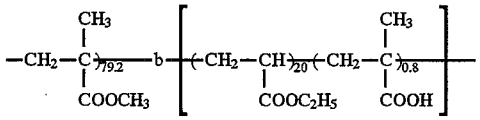 |
| 28 | $B_6$-28 | 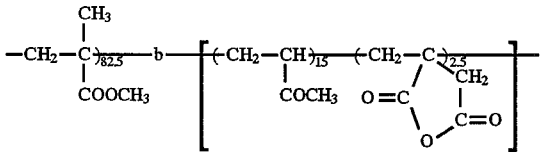 |
| 29 | $B_6$-29 | 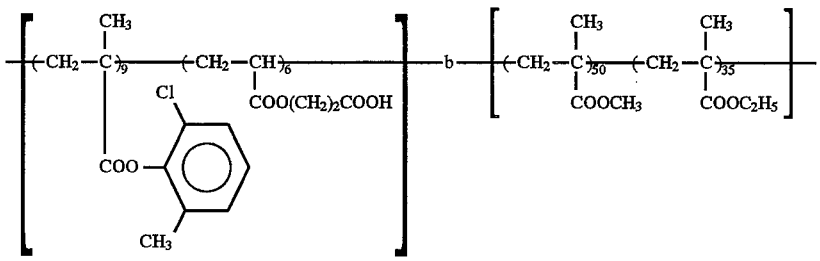 |
| 30 | $B_6$-30 | 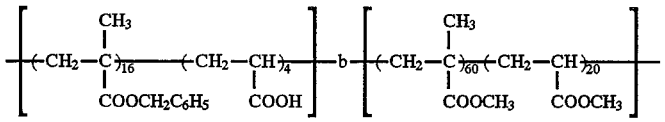 |
| 31 | $B_6$-31 | 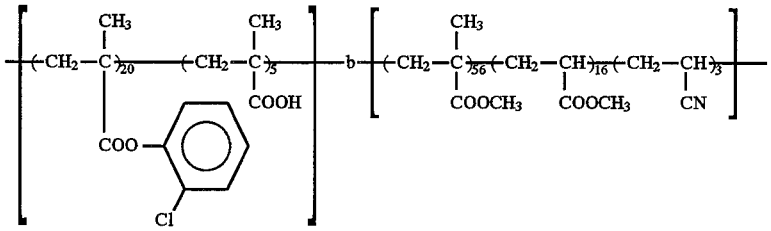 |

EXAMPLE 1-1

A mixture of 30 g of Resin (A-1), 10 g of Resin (P-1) having the structure shown below, 200 g of photoconductive zinc oxide, 0.02 g of uranine, 0.04 g of Rose Bengal, 0.03 g of bromophenol blue, 0.15 g of salicylic acid and 300 g of toluene was dispersed by a homogenizer (manufactured by Nippon Seiki K.K.) at a rotation of $7\times10^3$ r.p.m. for 8 minutes. To the dispersion were added 0.1 g of phthalic anhydride and 0.02 g of o-chlorophenol, and the mixture was dispersed by a homogenizer at a rotation of $1\times10^3$ r.p.m. for 1 minute. The resulting coating composition for a light-sensitive layer was coated on paper, which had been subjected to electrically conductive treatment, by a wire bar at a dry coverage of 25 g/m$^2$ dried at 100° C. for 30 seconds and then heating at 140° C. for 1 hour. The coated material was then allowed to stand in a dark place at 20° C. and 65%

RH for 24 hours to prepare an electrophotographic light-sensitive material.

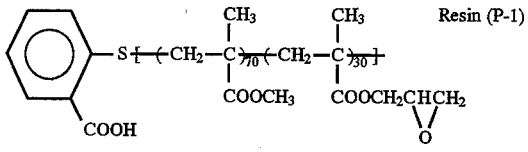

Weight average molecular weight: $4 \times 10^3$

COMPARATIVE EXAMPLE A-1

An electrophotographic light-sensitive material was prepared in the same manner as in Example 1-1, except for using 30 g of Resin (R-1) having the structure shown below in place of 30 g of Resin (A-1) used in Example 1-1.

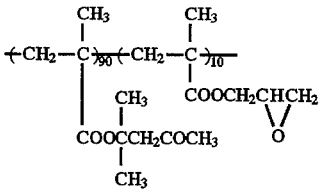

Weight average molecular weight: $4 \times 10^4$

COMPARATIVE EXAMPLE B-1

An electrophotographic light-sensitive material was prepared in the same manner as in Example 1-1, except for using 30 g of Resin (R-2) having the structure shown below in place of 30 g of Resin (A-1) used in Example 1-1.

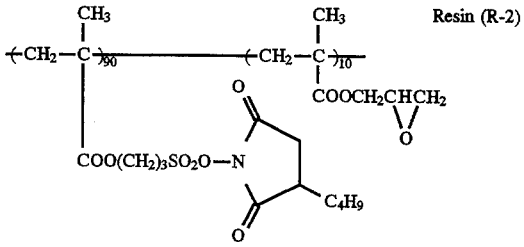

Weight average molecular weight: $3.5 \times 10^4$

COMPARATIVE EXAMPLE C-1

An electrophotographic light-sensitive material was prepared in the same manner as in Example 1-1, except for using 21.6 g of Resin (R-1) and 8.4 g of Resin (R-2) (weight ratio of Resin (R-1)/Resin (R-2)=72/28) in place of 30 g of Resin (A-1) used in Example 1-1.

With each of the light-sensitive material thus prepared, various characteristics shown in Table Y below were evaluated.

TABLE Y

| | Example 1-1 | Comparative Example A-1 | Comparative Example B-1 | Comparative Example C-1 |
|---|---|---|---|---|
| Smoothness of Photo-[1] conductive Layer (sec/cc) | 330 | 350 | 300 | 350 |
| Electrostatic[2] Characteristics | | | | |
| $V_{10}$(−V) | 500 | 510 | 520 | 505 |
| D.R.R. (%) | 85 | 83 | 83 | 84 |
| $E_{1/10}$ (lux · sec) | 13.8 | 14.0 | 14.5 | 14.1 |
| Image Forming[3] Performance | ○ good | ○ good | ○ good | ○ good |
| Water Retentivity at[4] the Start of Printing | | | | |
| I Molton Type | ○ good | ○ good | Δ–○ slight occurrence of background stain | ○ good |
| II Syn-Flow Type | ○ good | × occurrence of background stain | Δ slight occurrence of background stain | × occurrence of background stain |
| Printing Durability[5] | 10,000 prints | 5,000 prints | 2,000 prints | 2,000 prints |

The characteristic items described in Table Y were evaluated as follows:

1) Smoothness of Photoconductive Layer

The resulting light-sensitive material was subjected to measurement of its smoothness (sec/cc) under an air volume condition of 1 cc using a Beck smoothness test machine (manufactured by Kumagaya Riko KK).

2) Electrostatic Characteristics

The light-sensitive material was subjected to corona discharge at a voltage of −6 kV for 20 seconds in a dark room at 20° C. and 65% RH using a paper analyzer (Paper Analyzer SP-428 manufactured by Kawaguchi Denki KK) and after allowed to stand for 10 seconds, the surface potential $V_{10}$ was measured. Then, the sample was further allowed to stand in the dark room for 60 seconds to measure the surface potential $V_{70}$, thus obtaining the retention of potential after the dark decay for 60 seconds, i.e., dark decay retention ratio (D.R.R. (%)) represented by $(V_{70}/V_{10})\times 100$ (%). Moreover, the surface of the photoconductive layer was charged to −400 V by corona discharge, then irradiated by visible light of the illuminance of 2.0 lux and the time required for decay of the surface potential $V_{10}$ to 1/10 was measured, and the exposure amount $E_{1/10}$ (lux·sec) was calculated therefrom.

3) Image Forming Performance

The light-sensitive material and a full-automatic plate making machine ELP-404V (manufactured by Fuji Photo Film Co., Ltd.) were allowed to stand for a whole day and night under condition of normal temperature and normal humidity (20° C. and 65% RH), and a duplicated image was formed by plate making using the material and machine. The duplicated image formed on the printing plate precursor was subjected to visual evaluation of the fog and image quality.

4) Water Retentivity at the Start of Printing

The light-sensitive material (without plate making, i.e., a raw plate) was immersed in Oil-Desensitizing Solution E-1 having the composition shown below at 40° C. for 3 minutes.

Oil-Desensitizing Solution E-1

Monoethanolamine 60 g

Neosoap 8 g (manufactured by Matsumoto Yushi KK)

Benzyl alcohol 100 g

These components were dissolved in distilled water to make a total volume of 1.0 liter, and a pH thereof was adjusted with potassium hydroxide to 13.5.

Then, the resulting plate was subjected to printing using a printing machine and Dampening Water F-1 each described below, and a 50th print from the start of printing was visually evaluated on background stain thereof.

Dampening Water F-1

Aqueous solution made by diluting 200-folds dampening water for PS plate (Alky A manufactured by Toyo Ink Mfg. Co., Ltd.) with distilled water (pH: 9.5)

Water Retentivity at the Start of Printing I

Ryobi 3200 CD manufactured by Ryobi Ltd. was used as a printing machine of molton type.

Water Retentivity at the Start of Printing II

Ryobi 3200 MCD manufactured by Ryobi Ltd. was used as a printing machine of syn-flow type.

5) Printing Durability

The light-sensitive material was subjected to plate making under the same conditions as in the above described item 3), immersed in Oil-Desensitizing Solution E-1 described in the item 4) above for 3 minutes. The resulting printing plate was subjected to printing using Dampening Water F-1 described in the item 4) above as dampening water, neutral paper as printing paper and a printing machine of large size capable of printing paper of Kikuzen-size (1003×800 mm) (Oliver 94 manufactured by Sakurai Seisakusho K.K.) as a printing machine. A number of prints having clear images which could be obtained without the occurrence of background stain was determined in a case wherein a printing pressure on an offset printing machine was increased.

As shown in Table Y, each of the light-sensitive materials exhibited good results with respect to the smoothness of photoconductive layer, electrophotographic characteristics and image forming performance.

Concerning the water retentivity at the start of printing, the printing plate according to the present invention provided excellent water retentivity and adhesion of ink to the non-image area thereof was not observed at all irrespective of the type of printing machine. On the contrary, a plate according to Comparative Example A-1 wherein only carboxy group had been formed exhibited a large difference in the occurrence of background stain on print at the start of printing depending on a system of supplying damping water and ink. Specifically, in a case of using a printing machine of syn-flow type in which the supply of dampening water is less sufficient than in a printing machine of molton type, adhesion of ink occurred in the non-image area on print and the formation of background stain was observed at the start of printing. It is presumed in the plate of Comparative Example A-1 that although the surface of the photoconductive layer thereof which had been rendered hydrophilic had sufficiently good wettability with water, a super-thin layer of water (weak boundary layer abbreviated as WBL hereinafter) which had been formed on the surface of the plate could not be maintained, since the amount of water which was held in the whole photoconductive layer (amount of water retained in the layer) was insufficient, when the balance of amount of dampening water supplied was lost at the start of printing.

On the other hand, with a plate according to Comparative Example B-1 wherein only sulfo group had been formed, adhesion of ink was restrained as compared with the plate of Comparative Example A-1 in a case of using a printing machine of syn-flow type. However, it is presumed that the formation of WBL was insufficient in a case of using a printing machine of molton type since the amount of water retained in the layer was large.

Further, with Comparative Example C-1 wherein the resins used in Comparative Example A-1 and B-1 were mixed the faults of both resins could not be covered up and provided the same results as Comparative Example A-1.

As a result of the evaluation on printing durability using a printing machine of large size, more than 10,000 prints of clear image were obtained. On the contrary, the printing durability in each of Comparative Examples A-1, B-1 and C-1 was around 2,000 prints or 5,000 prints. The reason for the low printing durability in Comparative Example A-1 is considered to be based on the fact that the formation of WBL on the surface of the plate or the amount of water retained in the layer became poor with the progress of printing. Also, in case of Comparative Examples B-1 and C-1, it is presumed that a film strength of the layer was insufficient and the layer was broken, resulting in the low printing durability because of the large amount of water retained in the layer formed from the resin having sulfo group and crosslinking structure.

From these results it can be seen that only the light-sensitive material according to the present invention produces a printing plate which can provide a large number of prints having good quality even when the conditions are fluctuated at the printing.

EXAMPLE 1-2

A mixture of 32 g of Resin (A-2), 8 g of Resin (P-2) having the structure shown below, 200 g of photoconductive zinc oxide, 0.02 g of uranine, 0,015 g of Dye (I) having the structure shown below, 0.012 g of Dye (II) having the structure shown below, 0.18 g of N-hydroxyphthalimide and 300 g of toluene was dispersed by a homogenizer (manufactured by Nippon Seiki K.K.) at a rotation of $7\times10^3$ r.p.m. for 8 minutes. To the dispersion were added 0.1 g of phthalic anhydride and 0.002 g of zirconium acetylacetone, and the mixture was dispersed by a homogenizer at a rotation of $1\times10^3$ r.p.m. for 1 minute. The resulting coating composition for a light-sensitive layer was coated on paper, which had been subjected to electrically conductive treatment, by a wire bar at a dry coverage of 25 g/m$^2$, followed by drying at 100° C. for 30 seconds and then heating at 140° C. for 1 hour. The coated material was allowed to stand in a dark place at 20° C. and 65% RH for 24 hours to prepare an electrophotographic light-sensitive material.

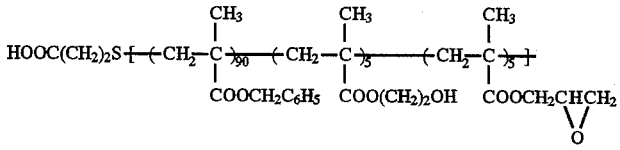

Resin (P-2)

Weight average molecular weight: $4.5 \times 10^3$

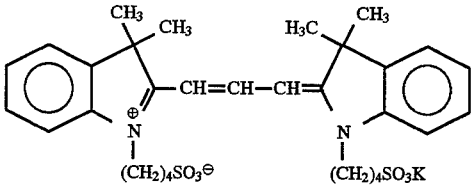

Dye (1)

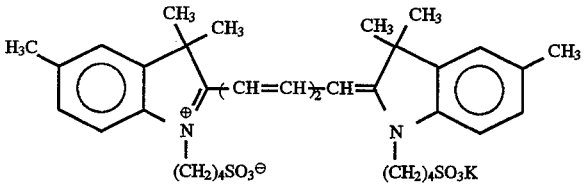

Dye (II)

COMPARATIVE EXAMPLE D-1

An electrophotographic light-sensitive material was prepared in the same manner as in Example 1-2, except for using 32 g of Resin (R-3) having the structure shown below in place of 32 g of Resin (A-2) used in Example 1-2.

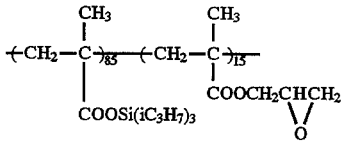

Resin (R-3)

Weight average molecular weight: $4 \times 10^4$

COMPARATIVE EXAMPLE E-1

An electrophotographic light-sensitive material was prepared in the same manner as in Example 1-2, except for using 32 g of Resin (R-4) having the structure shown below in place of 32 g of Resin (A-2) used in Example 1-2.

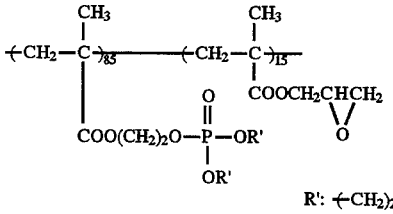

Resin (R-4)

Weight average molecular weight: $4.6 \times 10^4$

COMPARATIVE EXAMPLE F-1

An electrophotographic light-sensitive material was prepared in the same manner as in Example 1-2, except for using 18.8 g of Resin (R-3) and 13.2 g of Resin (R-4) (weight ratio of Resin (R-3)/Resin (R-4)=58.8/41.2) in place of 32 g of Resin (A-2) used in Example 1-2.

With each of the light-sensitive materials thus-prepared, the smoothness of photoconductive layer, electrostatic characteristics, image forming performance and water retentivity at the start of printing were evaluated in the same manner as in Example 1-1. Further, using dampening water each having a different pH value (i.e., pH 4.5, pH 7.0 and pH 9.5), influence on print was evaluated.

The results obtained are shown in Table Z below.

TABLE Z

| | Example 1-2 | Comparative Example D-1 | Comparative Example E-1 | Comparative Example F-1 |
|---|---|---|---|---|
| Smoothness of Photoconductive Layer (sec/cc) | 350 | 380 | 310 | 360 |
| Electrostatic Characteristics | | | | |
| $V_{10}$(−V) | 550 | 560 | 500 | 555 |
| D.R.R. (%) | 86 | 87 | 84 | 85 |
| $E_{1/10}$ (lux · sec) | 13.5 | 13.0 | 14.3 | 13.8 |
| Image Forming Performance | ○ good | ○ good | ○ good | ○ good |
| Water Retentivity at the Start of Printing | | | | |
| I Molton Type | ○ good | ○ good | Δ–○ occurrence of slight background stain | ○ good |
| II Syn-Flow Type | ○ good | × occurrence of background stain | Δ occurrence of slight background stain | × occurrence of background stain |
| Dependency[6] on Dampening Water | | | | |
| I | 10,000 prints | background stain from the start of printing | slight background stain from the start of printing | background stain from the start of printing |
| II | 10,000 prints | slight background stain from the start of printing | slight background stain from the start of printing | slight background stain from the start of printing |
| III | 10,000 prints | 10,000 prints | slight background stain from the start of printing | 10,000 prints |

6) Dependency on Dampening Water

The production of printing plate and printing were conducted in the same manner as described in the item 5) above, except for using the solution shown below as dampening water at the printing.

I: an aqueous solution (pH: 4.5) prepared by diluting 100-folds dampening water for PS plate (EU-3 manufactured by Fuji Photo Film Co., Ltd.) with distilled water.

II: an aqueous solution (pH: 7.0) prepared by diluting 130-folds dampening water for PS plate (SG-23 manufactured by Tokyo Ink K.K.) with distilled water.

III: an aqueous solution (pH: 9.5) prepared by diluting 200-folds dampening water for PS plate (Alky A manufactured by Toyo Ink Mfg. Co., Ltd.) with distilled water.

As shown in Table Z, the smoothness of photoconductive layer, electrostatic characteristics and image forming performance with all of Example 1-2 and Comparative Examples D-1 to F-1 were good.

With respect to the water retentivity at the start of printing, the plate according to the present invention was good, although the water retentivity of the plates of Comparative Examples D-1 to F-1 was poor in a case of using a printing machine of syn-flow type. The reason for poor water retentivity obtained in Comparative Example E-1 by the syn-flow type printing machine is presumed that although the $PO_3H_2$ group formed in Resin (R-4) upon the oil-desensitizing treatment acted for keeping sufficient amount of water retained in the layer, the wettability of the surface of the layer with water was insufficient at the printing since the hydrophilic group was bonded to the polymer main chain through a hydrophobic linking group.

As a result of the evaluation on printing durability using three kinds of dampening water, the plate according to the present invention provided 10,000 prints of good quality irrespective of the kind of dampening water. On the contrary, the plates of Comparative Examples D-1 to F-1 exhibited good results only when Dampening Water III was used, and in case of using other dampening water, background stain due to adhesion of ink occurred at the start of printing while the degree thereof was different from each other and the background stain could not be removed by conducting further printing.

It is believed that the large influence of pH of dampening water is related to a dissociation constant of the hydrophilic group formed. More specifically, with Comparative Example D-1 wherein the influence of pH is dominative, the COOH group formed in Resin (R-3) is present as a dissociated form of $COO^-$ and has good compatibility with water under a high pH condition, but the amount of dissociated group decreases under a low pH condition, resulting in reduction of the water compatibility. It has been found that the water retentivity is widely varied depending on the kind of dampening water when a hydrophilic group having a small value of dissociation constant (pKa) is not formed simultaneously.

Since the printing plate according to the present invention is capable of conducting printing using dampening water for PS plate in a large size printing machine as described above, it can be easily used in common with other printing plates without cleaning and inspection of the printing machine.

EXAMPLES 1-3 TO 1-13

Each electrophotographic light-sensitive material was prepared in the same manner as described in Example 1-1, except for using each of the resins (A) shown in Table a below in place of Resin (A-1) used in Example 1-1.

TABLE a

| Example | Resin (A) |
|---|---|
| 1-3 | A-3 |
| 1-4 | A-4 |
| 1-5 | A-5 |
| 1-6 | A-6 |
| 1-7 | A-7 |
| 1-8 | A-8 |
| 1-9 | A-9 |
| 1-10 | A-10 |
| 1-11 | A-11 |
| 1-12 | A-12 |
| 1-13 | A-13 |

With each of the light-sensitive materials thus prepared, various characteristics were evaluated in the same manner as in Example 1-1. Each of the light-sensitive materials exhibited good electrostatic characteristics and image forming performance similar to those obtained in the light-sensitive material of Example 1-1. When they were used as printing plates, they exhibited good water retentivity at the start of printing on both printing machines of molton type and syn-flow type and the printing durability thereof was more than 10,000 prints.

EXAMPLES 1-14 TO 1-25

Each electrophotographic light-sensitive material was prepared in the same manner as described in Example 1-1, except for using each of the compounds shown in Table b below in place of Resin (A-1), Resin (P-1) and phthalic anhydride and o-chlorophenol as crosslinking compounds used in Example 1-1.

TABLE b

Resin (P)

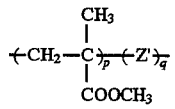

| Example | Resin (A) | Z' in Resin (P) | p/q | Crosslinking Compound |
|---|---|---|---|---|
| 1-14 | (A-14) | 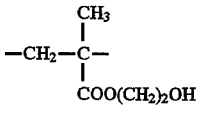 (P-3) | 85/15 | $R'OOCNH(CH_2)_6NHCOOR'$<br>R': 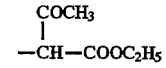 <br>Dibutyltin dilaurate |
| 1-15 | (A-15) | 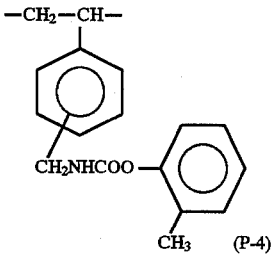 (P-4) | 90/10 | Tetrabutoxy titanate |
| 1-16 | (A-16) | 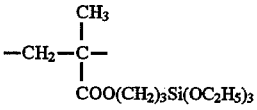 (P-5) | 70/30 | Gluconic acid |
| 1-17 | (A-17) | 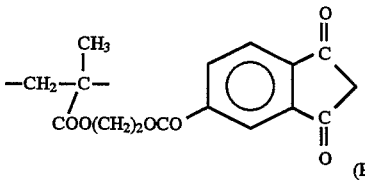 (P-6) | 92/8 | 3-Glycidoxy propyl trimethoxy silane |
| 1-18 | (A-18) | 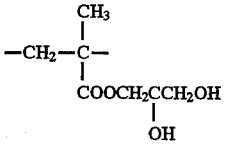 (P-7) | 92/8 | — |

TABLE b-continued

Resin (P)

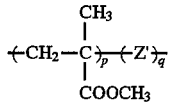

| Example | Resin (A) | Z' in Resin (P) | p/q | Crosslinking Compound |
|---|---|---|---|---|
| 1-19 | (A-19) | $-CH_2-CH-$ (CONH(CH2)6OH) (P-8) | 85/15 | Propylene glycol Tetrabutoxy titanate |
| 1-20 | (A-20) | $-CH_2-C-$ (CH3; COO(CH2)2NHCON) (P-9) | 90/10 | N,N-Dimethylpropylamine |
| 1-21 | (A-21) | $-CH_2-C-$ (CH3; COOCH=CH2) (P-10) | 85/15 | Divinyl adipate Benzoyl peroxide |
| 1-22 | (A-22) | — | — | — |
| 1-23 | (A-16) | (P-11) | 90/10 | Phthalic anhydride o-Chlorophenol |
| 1-24 | (A-23) | $-CH_2-C-$ (CH3; COO(CH2)2OOCC=CH2; CH3) (P-12) | 90/10 | Allyl methacrylate Benzoyl peroxide |
| 1-25 | (A-24) | — | — | 3-Aminopropyl trimethoxy silane |

With each of the light-sensitive materials thus prepared, various characteristics were evaluated in the same manner as in Example 1-1. Each of the light-sensitive materials exhibited good electrostatic characteristics and image forming performance similar to those obtained in the light-sensitive material of Example 1-1. When they were used as printing plates, they exhibited good water retentivity at the start of printing on both printing machines of molton type and syn-flow type and the printing durability thereof was more than 10,000 prints.

EXAMPLE 1-26

A mixture of 1 g of X-form metal-free phthalocyanine (manufactured by Dainippon Ink and Chemicals, Inc.), 10 g of Resin (A-25), 0.3 g of Resin (P-1) and 80 g of tetrahydrofuran was put in a 500 ml-volume glass container together with glass beads and dispersed in a paint shaker (manufactured by Toyo Seiki Seisakusho Co.) for 60 minutes. To the dispersion was added 0.3 g of ethylene glycol diglycidyl ether, followed by further dispersing for 2 minutes. The glass beads were separated by filtration to prepare a dispersion for a light-sensitive layer.

The dispersion was coated on base paper for a paper master having a thickness of 0.2 mm, which had been subjected to electrically conductive treatment and solvent-resistant treatment, by a wire bar, set to touch, heated in a circulating oven at 110° C. for 20 seconds, and then further heated at 140° C. for 1 hour to form a light-sensitive layer having a thickness of 8 μm.

The resulting light-sensitive material was subjected to the evaluations of electrostatic characteristics and image forming performance in the same manner as described in Example 1-1, and good results shown below were obtained.

| Electrostatic Characteristics | |
|---|---|
| $V_{10}$ | −500 V |
| D.R.R. | 85% |
| $E_{1/10}$ | 33 erg/cm$^2$ |
| Image Forming Performance | ○ good |

Of the evaluations, the D.R.R., $E_{1/10}$ and image forming performance were conducted according to the following methods.

D.R.R. and $E_{1/10}$

The light-sensitive material was charged with a corona discharge to a voltage of −6 kV for 20 seconds in a dark room at a temperature of 20° C. and 65% RH using a paper analyzer ("Paper Analyzer SP-428" manufactured by Kawaguchi Denki K.K.). Ten seconds after the corona discharge, the surface potential $V_{10}$ was measured. The sample was then allowed to stand in the dark for an additional 90 seconds, and the potential $V_{100}$ was measured. The dark charge retention rate, i.e., percent retention of potential after dark decay for 90 seconds, was calculated from the following equation:

$$DRR\ (\%)=(V_{100}/V_{10})\times 100$$

Separately, the surface of photoconductive layer was charged to −500 V with a corona discharge and then exposed to monochromatic light of 780 nm, and the time required for decay of the surface potential $V_{10}$ to one-tenth was measured, and the exposure amount $E_{1/10}$ (erg/cm$^2$) was calculated therefrom.

Image Forming Performance

After the light-sensitive material was allowed to stand for a whole day and night under the condition of 20° C. and 65% RH, the light-sensitive material was charged to −6 kV and exposed to light emitted from a gallium-aluminum-arsenic semi-conductor laser (oscillation wavelength: 780 nm; output: 2.8 mW) at an exposure amount of 64 erg/cm$^2$ (on the surface of the photoconductive layer) at a pitch of 25 μm and a scanning speed of 300 m/sec. The thus formed electrostatic latent image was developed with a liquid developer ELP-T (manufactured by Fuji Photo Film CO., Ltd.), washed with a rinse solution of isoparaffinic solvent Isopar G (manufactured by Esso Chemical K.K.) and fixed. The duplicated image thus obtained was visually evaluated for fog and image quality.

Further, the light-sensitive material was subjected to the plate making in the same manner as described above and then the oil desensitizing treatment and printing were conducted under the same conditions as described in Example 1-1.

As a result, it was found that both of the water retentivities (I) and (II) at the start of printing were good. With respect to the printing durability, more than 10,000 prints of cleat prints were obtained.

EXAMPLE 1-27

An electrophotographic light-sensitive material was prepared in the same manner as described in Example 1-26 except that 10.3 g of Resin (A-26) was used alone in place of 10 g of Resin (A-25), 0.3 g of Resin (P-1), and 0.3 g of ethylene glycol diglycidyl ether used in Example 1-26. The crosslinking of layer was conducted by irradiating the layer using a high-pressure mercury lamp at a distance of 30 cm for 3 minutes in place of the heating at 140° C. for 1 hour.

The electrostatic characteristics and printing properties of the light-sensitive material thus obtained were evaluated in the same manner as described in Example 1-26. The good results similar to those obtained with respect to the light-sensitive material of Example 1-26 were obtained.

EXAMPLES 1-28 TO 1-30

Each electrophotographic light-sensitive material was prepared in the same manner as in Example 1-1, except for using 30 g of each of the resins (A) shown in Table c below in place of 30 g of Resin (A-1) used in Example 1-1.

TABLE c

| Example | Resin (A) |
|---|---|
| 1-28 | A-27 |
| 1-29 | A-28 |
| 1-30 | A-29 |

With each of the light-sensitive materials thus prepared, the electrostatic characteristics and printing properties were evaluated in the same manner as in Example 1-1. The good results similar to those of the light-sensitive material in Example 1-1 were obtained.

EXAMPLES 1-31 TO 1-42

An offset printing plate was prepared by subjecting some of the light-sensitive materials used in Examples described above to electrophotographic processings for forming a toner image, followed by the oil-desensitizing treatment described below. Specifically, to 0.2 mol of each of the nucleophilic compound shown in Table d below, 100 g of each of the organic solvent shown in Table d below, and 2 g of Newcol B4SN (manufactured by Nippon Nyukazai K.K.) was added distilled water to make 1 l, and the solution was adjusted to a pH of 13.5. Each light-sensitive material was immersed in the resulting treating solution at a temperature of 35° C. for 3 minutes to conduct the oil-desensitizing treatment.

Printing was carried out using the resulting printing plate under the same conditions as in the respective basis Example. Each plate exhibited good characteristics similar to those of the respective basis Example.

TABLE d

| Example | Basis Example of Light-sensitive Material | Nucleophilic Compound | Organic Solvent |
|---|---|---|---|
| 1-31 | Example 1-5 | Sodium sulfite | Benzyl alcohol |
| 1-32 | Example 1-20 | Monoethanolamine | Benzyl alcohol |
| 1-33 | Example 1-7 | Diethanolamine | Methyl ethyl ketone |
| 1-34 | Example 1-6 | Thiomalic acid | Ethylene glycol |
| 1-35 | Example 1-8 | Thiosalicylic acid | Benzyl alcohol |
| 1-36 | Example 1-9 | Taurine | Isopropyl alcohol |
| 1-37 | Example 1-3 | 4-Sulfobenzenesulfinic acid | Benzyl alcohol |
| 1-38 | Example 1-11 | Thioglycolic acid | Ethanol |
| 1-39 | Example 1-26 | 2-Mercaptoethylphosphonic acid | Dioxane |

TABLE d-continued

| Example | Basis Example of Light-sensitive Material | Nucleophilic Compound | Organic Solvent |
|---|---|---|---|
| 1-40 | Example 1-12 | Serine | Ethylene glycol |
| 1-41 | Example 1-12 | Sodium thiosulfate | Methyl ethyl ketone |
| 1-42 | Example 1-26 | Ammonium sulfite | Benzyl alcohol |

EXAMPLE 2-1

A mixture of 32 g of Resin (A-1), 8 g of Resin ($B_1$-26), 200 g of photoconductive zinc oxide, 0.02 g of uranine, 0.04 g of Rose Bengal, 0.03 g of bromophenol blue, 0.15 g of salicylic acid and 300 g of toluene was dispersed by a homogenizer (manufactured by Nippon Seiki K.K.) at a rotation of $7\times10^3$ r.p.m. for 8 minutes. To the dispersion were added 5 g of Resin (2P-1) having the structure shown below, 0.2 g of phthalic anhydride and 0.02 g of o-chlorophenol, and the mixture was dispersed by a homogenizer at a rotation of $1\times10^3$ r.p.m. for 1 minute. The resulting coating composition for a light-sensitive layer was coated on paper, which had been subjected to electrically conductive treatment, by a wire bar at a dry coverage of 25 g/m$^2$, dried at 100° C. for 30 seconds and then heating at 140° C. for 1 hour. The coated material was then allowed to stand in a dark place at 20° C. and 65% RH for 24 hours to prepare an electrophotographic light-sensitive material.

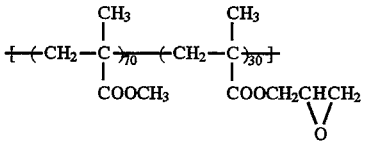

Resin (2P-1)

(weight ratio)

Weight average molecular weight: $4\times10^3$

COMPARATIVE EXAMPLE A-2

An electrophotographic light-sensitive material was prepared in the same manner as in Example 2-1, except for using 32 g of Resin (R-1) described in Comparative Example A-1 in place of 32 g of Resin (A-1) used in Example 2-1.

COMPARATIVE EXAMPLE B-2

An electrophotographic light-sensitive material was prepared in the same manner as in Example 2-1, except for using 32 g of Resin (R-2) described in Comparative Example B-1 in place of 32 g of Resin (A-1) used in Example 2-1.

COMPARATIVE EXAMPLE C-2

An electrophotographic light-sensitive material was prepared in the same manner as in Example 2-1, except for using 23 g of Resin (R-1) and 9 g of Resin (R-2) (weight ratio of Resin (R-1)/Resin (R-2)=72/28) in place of 32 g of Resin (A-1) used in Example 2-1.

COMPARATIVE EXAMPLE D-2

An electrophotographic light-sensitive material was prepared in the same manner as in Example 2-1, except for using only 40 g of Resin (A-1) in place of 32 g of Resin (A-1) and 8 g of Resin ($B_1$-26) used in Example 2-1.

With each of the light-sensitive material thus prepared, various characteristics shown in Table e below were evaluated.

TABLE e

| | | Example 2-1 | Comparative Example A-2 | Comparative Example B-2 | Comparative Example C-2 | Comparative Example D-2 |
|---|---|---|---|---|---|---|
| Smoothness of Photo-[1] conductive Layer (sec/cc) | | 350 | 355 | 350 | 360 | 360 |
| Electrostatic[2] Characteristics | | | | | | |
| $V_{10}$(−V) | I | 760 | 745 | 760 | 740 | 585 |
| | II | 740 | 725 | 745 | 715 | 560 |
| D.R.R. (%) | I | 90 | 91 | 89 | 88 | 83 |
| | II | 85 | 85 | 85 | 83 | 74 |
| $E_{1/10}$ (lux · sec) | I | 9.0 | 9.8 | 9.5 | 10.0 | 13.5 |
| | II | 9.8 | 10.2 | 10.2 | 11.0 | 15.5 |
| Image Forming[3] Performance | | | | | | |
| | I | ○ good | ○ good | ○ good | ○ good | ○ good |
| | II | ○ good | ○ good | ○ good | ○ good | × low density, occurrence of unevenness of fine lines, occurrence of background fog |
| Water Retentivity at[4] | | | | | | |

TABLE e-continued

| | Example 2-1 | Comparative Example A-2 | Comparative Example B-2 | Comparative Example C-2 | Comparative Example D-2 |
|---|---|---|---|---|---|
| the Start of Printing | | | | | |
| I Molton Type | ○ good | ○ good | Δ occurrence of background stain | Δ occurrence of background stain | ○ good |
| II Syn-Flow Type | ○ good | × occurrence of severe background stain | ×~Δ occurrence of background stain | × occurrence of background stain | ○ good |
| Printing Durability[5)] | 10,000 prints | 2,000 prints | 4,000 prints | 3,000 prints | occurrence of background stain from the start of printing |

The characteristic items described in Table e were evaluated as follows:

1) Smoothness of Photoconductive Layer

The resulting light-sensitive material was subjected to measurement of its smoothness (sec/cc) under an air volume condition of 1 cc using a Beck smoothness test machine (manufactured by Kumagaya Riko KK).

2) Electrostatic Characteristics

The light-sensitive material was subjected to corona discharge at a voltage of −6 kV for 20 seconds in a dark room at 20° C. and 65% RH using a paper analyzer (Paper Analyzer SP-428 manufactured by Kawaguchi Denki KK) and after allowed to stand for 10 seconds, the surface potential $V_{10}$ was measured. Then, the sample was further allowed to stand in the dark room for 60 seconds to measure the surface potential $V_{70}$, thus obtaining the retention of potential after the dark decay for 60 seconds, i.e., dark decay retention ratio (D.R.R. (%)) represented by $(V_{70}/V_{10})\times 100$ (%). Moreover, the surface of the photoconductive layer was charged to −400 V by corona discharge, then irradiated by visible light of the illuminance of 2.0 lux and the time required for decay of the surface potential $V_{10}$ to 1/10 was measured, and the exposure amount $E_{1/10}$ (lux-sec) was calculated therefrom.

Further, the same procedure was conducted under the ambient condition of 30° C. and 80% RH. The ambient condition of 20° C. and 65% RH is denoted as I and that of 30° C. and 80% RH is denoted as II.

3) Image Forming Performance

The light-sensitive material and a full-automatic plate making machine ELP-404V (manufactured by Fuji Photo Film Co., Ltd.) were allowed to stand for a whole day and night under condition of normal temperature and normal humidity (20° C. and 65% RH) (I), and a duplicated image was formed by plate making using the material and machine. The duplicated image formed on the printing plate precursor was subjected to visual evaluation of the fog and image quality. For the plate making Liquid Developer LD-2 described below was employed. Further, the same procedure was conducted under high temperature and high humidity condition (30° C. and 80% RH) (II), followed by evaluating the resulting image.

Preparation of Liquid Developer LD-2

(1) Synthesis of Toner Particles:

A mixed solution of 60 g of methyl methacrylate, 40 g of methyl acrylate, 20 g of a dispersion polymer having the structure shown below, and 680 g of Isopar H was heated to 65° C. under nitrogen gas stream with stirring. To the solution was added 1.2 g of 2,2'-azobis(isovaleronitrile) (AIVN), followed by allowing the mixture to react for 2 hours. To the reaction mixture was further added 0.5 g of AIVN, and the reaction was continued for 2 hours. To the reaction mixture was further added 0.5 g of AIVN, and the reaction was continued for 2 hours. The temperature was raised up to 90° C., and the mixture was stirred under reduced pressure of 30 mm Hg for 1 hour to remove any unreacted monomers. After cooling to room temperature, the reaction mixture was filtered through a nylon cloth of 200 mesh to obtain a white dispersion. The reaction rate of the monomers was 95% by weight, and the resulting dispersion had an average grain diameter of resin grain of 0.25 μm (grain diameter being measured by CAPA-500 manufactured by Horiba, Ltd.) and good monodispersity.

Chemical Structure of Dispersion Polymer

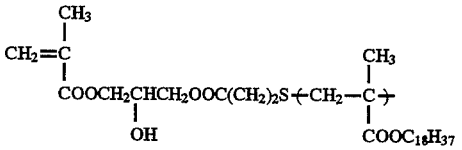

Weight average molecular weight: $1.8\times 10^4$ (2) Preparation of Colored Particles:

Ten grams of a tetradecyl methacrylate/methacrylic acid copolymer (95/5 ratio by weight), 10 g of nigrosine, and 30 g of Isopar G were put in a paint shaker (manufactured by Tokyo Seiki Seisakusho KK) together with glass beads and dispersed for 4 hours to prepare a fine dispersion of nigrosine.

(3) Preparation of Liquid Developer:

A mixture of 45 g of the above-described toner particle dispersion, 25 g of the above-described nigrosine dispersion, 0.06 g of a hexadecene/maleic acid mono-octadecylamide copolymer, and 15 g of FOC 1800 was diluted with 1 l of Isopar G to prepare a liquid developer for electrophotography.

4) Water Retentivity at the Start of Printing

The light-sensitive material (without plate making, i.e., a raw plate) was immersed in Oil-Desensitizing Solution E-2 having the composition shown below at 40° C. for 3 minutes.

Oil-Desensitizing Solution E-2

Monoethanolamine 60 g

Neosoap 8 g (manufactured by Matsumoto Yushi KK)

Benzyl alcohol 100 g

These components were dissolved in distilled water to make a total volume of 1.0 liter, and a pH thereof was adjusted with potassium hydroxide to 13.5.

Then, the resulting plate was subjected to printing using a printing machine and Dampening Water F-2 each described below, and a 50th print from the start of printing was visually evaluated on background stain thereof.

Dampening Water F-2

Aqueous solution made by diluting 200-folds, dampening water for PS plate (Alky A manufactured by Toyo Ink Mfg. Co., Ltd.) with distilled water (pH: 9.5)

Water Retentivity at the Start of Printing I

Ryobi 3200 CD manufactured by Ryobi Ltd. was used as a printing machine of molton type.

Water Retentivity at the Start of Printing II

Ryobi 3200 MCD manufactured by Ryobi Ltd. was used as a printing machine of syn-flow type.

5) Printing Durability

The light-sensitive material was subjected to plate making under the same conditions as in the above described item 3), immersed in Oil-Desensitizing Solution E-2 described in the item 4) above for 3 minutes. The resulting printing plate was subjected to printing using Dampening Water F-2 described in the item 4) above as dampening water, neutral paper as printing paper and a printing machine of large size capable of printing paper of Kikuzen-size (1003×800 mm) (Oliver 94 manufactured by Sakurai Seisakusho K.K.) as a printing machine. A number of prints having clear images which could be obtained without the occurrence of background stain was determined in a case wherein a printing pressure on an offset printing machine was increased.

As shown in Table e, each of the light-sensitive materials had good smoothness of photoconductive layer. The electrostatic characteristics under the condition of normal temperature and normal humidity were in a range of practically no problem although they were somewhat low in Comparative Example D-2 wherein the resin ($B_1$) was not used. However, under the severe condition of high temperature and high humidity, the electrostatic characteristics (particularly, D.R.R. and $E_{1/10}$) of Comparative Example D-2 were remarkably decreased. On the contrary, with other light-sensitive materials, the change of the electrostatic characteristics was controlled small and they were maintained in a range of practical use. With respect to the image forming performance, the occurrence of background fog in non-image areas and degradation of image quality (i.e., decrease in density, cutting of fine lines and letters, etc.) were observed under the high temperature and high humidity condition. Other light-sensitive materials provided good duplicated images.

Concerning the water retentivity at the start of printing, the printing plates according to Example 2-1 and Comparative Example D-2 provided excellent water retentivity and adhesion of ink to the non-image area thereof was not observed at all irrespective of the type of printing machine. On the contrary, a plate according to Comparative Example A-2 wherein only carboxy group had been formed exhibited a large difference in the occurrence of background stain on print at the start of printing depending on a system of supplying damping water and ink. Specifically, in a case of using a printing machine of syn-flow type in which the supply of dampening water is less sufficient than in a printing machine of molton type, adhesion of ink occurred in the non-image area on print and the formation of background stain was observed at the start of printing. It is presumed in the plate of Comparative Example A-2 that although the surface of the photoconductive layer thereof which had been rendered hydrophilic had sufficiently good wettability with water, a super-thin layer of water (weak boundary layer abbreviated as WBL hereinafter) which had been formed on the surface of the plate could not be maintained, since the amount of water which was held in the whole photoconductive layer (amount of water retained in the layer) was insufficient, when the balance of amount of dampening water supplied was lost at the start of printing.

On the other hand, with a plate according to Comparative Example B-2 wherein only sulfo group had been formed, adhesion of ink was restrained as compared with the plate of Comparative Example A-2 in a case of using a printing machine of syn-flow type. However, it is presumed that the formation of WBL was insufficient in a case of using a printing machine of molton type since the amount of water retained in the layer was large.

Further, with Comparative Example C-2 wherein the resins used in Comparative Examples A-2 and B-2 were mixed the faults of both resins could not be covered up and provided the same results as Comparative Example A-2.

As a result of the evaluation on printing durability using a printing machine of large size, more than 10,000 prints of clear image were obtained. With Comparative Example D-2 which exhibited good water retentivity at the start of printing in case of using the raw plate, the image on prints were poor from the start of printing when the plate formed by practical plate-making was employed. On the contrary, the printing durability in each of Comparative Examples A-2, B-2 and C-2 was around 2,000 prints to 4,000 prints. The reason for the low printing durability in Comparative Example A-2 is considered to be based on the fact that the formation of WBL on the surface of the plate or the amount of water retained in the layer became poor with the progress of printing. Also, in case of Comparative Examples B-2 and C-2, it is presumed that a film strength of the layer was insufficient and the layer was broken, resulting in the low printing durability because of the large amount of water retained in the layer formed from the resin having sulfo group and crosslinking structure.

From these results it can be seen that only the light-sensitive material according to the present invention produces a printing plate which can provide a large number of prints having good quality even when the ambient conditions at the image formation and conditions at the printing are fluctuated.

EXAMPLE 2-2

A mixture of 35 g of Resin (A-2), 10 g of Resin ($B_1$-1), 4 g of Resin (P-2) described in Example 1-2, 200 g of photoconductive zinc oxide, 0.02 g of uranine, 0.015 g of Dye (I) described in Example 1-2, 0.012 g of Dye (II) described in Example 1-2, 0.18 g of N-hydroxyphthalimide and 300 g of toluene was dispersed by a homogenizer (manufactured by Nippon Seiki K.K.) at a rotation of $7\times10^3$ r.p.m. for 8 minutes. To the dispersion were added 0.1 g of phthalic anhydride and 0.002 g of zirconium acetylacetone, and the mixture was dispersed by a homogenizer at a rotation of $1\times10^3$ r.p.m. for 1 minute. The resulting coating composition for a light-sensitive layer was coated on paper, which had been subjected to electrically conductive treatment, by a wire bar at a dry coverage of 25 g/m$^2$, followed by drying at 100° C. for 30 seconds and then heating at 140° C. for 1 hour. The coated material was allowed to stand in a dark place at 20° C. and 65% RH for 24 hours to prepare an electrophotographic light-sensitive material.

COMPARATIVE EXAMPLE E-2

An electrophotographic light-sensitive material was prepared in the same manner as in Example 2-2, except for using 35 g of Resin (2R-3) having the structure shown below in place of 35 g of Resin (A-2) used in Example 2-2.

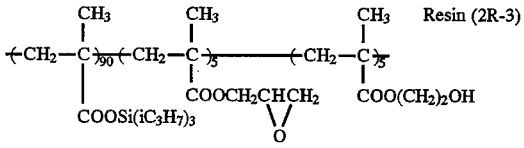

Weight average molecular weight: $4 \times 10^4$

COMPARATIVE EXAMPLE F-2

An electrophotographic light-sensitive material was prepared in the same manner as in Example 2-2, except for using 35 g of Resin (2R-4) having the structure shown below in place of 35 g of Resin (A-2) used in Example 2-2.

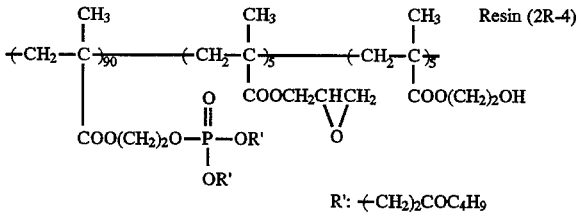

Weight average molecular weight: $4.5 \times 10^4$

COMPARATIVE EXAMPLE G-2

An electrophotographic light-sensitive material was prepared in the same manner as in Example 2-2, except for using 20.6 g of Resin (2R-3) and 14.4 g of Resin (2R-4) (weight ratio of Resin (2R-3)/Resin (2R-4)=58.8/41.2) in place of 35 g of Resin (A-2) used in Example 2-2.

COMPARATIVE EXAMPLE H-2

An electrophotographic light-sensitive material was prepared in the same manner as in Example 2-2, except for using only 45 g of Resin (A-2) in place of 35 g of Resin (A-2) and 10 g of Resin ($B_1$-1) used in Example 2-2.

With each of the light-sensitive materials thus-prepared, the smoothness of photoconductive layer, electrostatic characteristics, image forming performance and water retentivity at the start of printing were evaluated in the same manner as in Example 2-1. Further, using dampening water each having a different pH value (i.e., pH 4.5, pH 7.0 and pH 9.5), influence on print was evaluated.

The results obtained are shown in Table f below.

TABLE f

| | | Example 2-2 | Comparative Example E-2 | Comparative Example F-2 | Comparative Example G-2 | Comparative Example H-2 |
|---|---|---|---|---|---|---|
| Smoothness of Photoconductive Layer (sec/cc) | | 365 | 355 | 350 | 360 | 350 |
| Electrostatic Characteristics | | | | | | |
| $V_{10}$(−V) | I | 780 | 770 | 750 | 750 | 565 |
| | II | 765 | 750 | 730 | 735 | 540 |
| D.R.R. (%) | I | 88 | 87 | 85 | 86 | 83 |
| | II | 84 | 84 | 82 | 82 | 73 |
| $E_{1/10}$ (lux · sec) | I | 11.2 | 11.5 | 11.8 | 11.7 | 12.8 |
| | II | 12.1 | 12.5 | 12.7 | 12.7 | 15.0 |
| Image Forming Performance | | | | | | |
| | I | ○ good | ○ good | ○ good | ○ good | ○ good |
| | II | ○ good | ○ good | ○ good | ○ good | × low density, occurrence of background fog, occurrence of cutting of fine lines and letters |
| Water Retentivity at the Start of Printing | | | | | | |
| I Molton Type | | ○ good | ○ good | ○~Δ occurrence of very slight background stain | ○ good | ○ good |
| II Syn-Flow Type | | ○ | × | Δ~○ | × | ○ |

TABLE f-continued

| | Example 2-2 | Comparative Example E-2 | Comparative Example F-2 | Comparative Example G-2 | Comparative Example H-2 |
|---|---|---|---|---|---|
| | good | occurrence of severe background stain | occurrence of slight background stain | occurrence of severe background stain | good |
| Dependency on[6] Dampening Water | | | | | |
| I | 10,000 prints | severe background stain at the start of printing | background stain at the start of printing | severe background stain at the start of printing | severe background stain from the start of printing, occurrence of cutting of fine lines and letters |
| II | 10,000 prints | severe background stain at the start of printing | background stain at the start of printing | background stain at the start of printing | severe background stain from the start of printing, occurrence of cutting of fine lines and letters |
| III | 10,000 prints | 2,000 prints | 3,000 prints | 2,000 prints | severe background stain from the start of printing, occurrence of cutting of fine lines and letters |

6) Dependency on Dampening Water

The production of printing plate and printing were conducted in the same manner as described in the item 5) above, except for using the solution shown below as dampening water at the printing.

I: an aqueous solution (pH: 4.5) prepared by diluting 100-folds dampening water for PS plate (EU-3 manufactured by Fuji Photo Film Co., Ltd.) with distilled water.

II: an aqueous solution (pH: 7.0) prepared by diluting 130-folds dampening water for PS plate (SG-23 manufactured by Tokyo Ink K.K.) with distilled water.

III: an aqueous solution (pH: 9.5) prepared by diluting 200-folds dampening water for PS plate (Alky A manufactured by Toyo Ink Mfg. Co., Ltd.) with distilled water.

As shown above, the smoothness of photoconductive layer of each light-sensitive material was good. Example 2-2 and Comparative Examples E-2 to G-2 exhibited good electrostatic characteristics and image forming performance regardless of ambient condition. However, with Comparative Example H-2 wherein the resin ($B_1$) was not used, the electrostatic characteristics were decreased and the occurrence of background fog and degradation of image (i.e., decrease in density, cutting of fine lines and letters, etc.) were observed on the image forming performance under the severe condition of high temperature and high humidity.

With respect to the water retentivity at the start of printing, the plate according to the present invention was good, although the water retentivity of the plates of Comparative Examples E-2 to G-2 was poor in a case of using a printing machine of syn-flow type. The reason for poor water retentivity obtained in Comparative Example F-2 by the syn-flow type printing machine is presumed that although the $PO_3H_2$ group formed in Resin (2R-4) upon the oil-desensitizing treatment acted for keeping sufficient amount of water retained in the layer, the wettability of the surface of the layer with water was insufficient at the printing since the hydrophilic group was bonded to the polymer main chain through a hydrophobic linking group.

As a result of the evaluation on printing durability using three kinds of dampening water, the plate according to the present invention provided 10,000 prints of good quality irrespective of the kind of dampening water. On the contrary, the plates of Comparative Examples E-2 to G-2 exhibited good results only when Dampening Water III was used, and in case of using Other dampening water, background stain due to adhesion of ink occurred at the start of printing while the degree thereof was different from each other and the background stain could not be removed by conducting further printing. The plate of Comparative Example H-2 could not provide prints of satisfactory image quality from the start of printing since the performance of printing plate precursor was poor due to poor image quality and background fog at the plate making.

It is believed that the large influence of pH of dampening water is related to a dissociation constant of the hydrophilic group formed. More specifically, with Comparative Example E-2 wherein the influence of pH is dominative, the COOH group formed in Resin (2R-3) is present as a dissociated form of $COO^-$ and has good compatibility with water under a high pH condition, but the amount of dissociated group decreases under a low pH condition, resulting in reduction of the water compatibility. It has been found that the water retentivity is widely varied depending on the kind of dampening water when a hydrophilic group having a small value of dissociation constant (pKa) is not formed simultaneously.

Since the printing plate according to the present invention is capable of conducting printing using dampening water for PS plate in a large size printing machine as described above, it can be easily used in common with other printing plates without cleaning and inspection of the printing machine.

EXAMPLES 2-3 TO 2-13

Each electrophotographic light-sensitive material was prepared in the same manner as described in Example 2-1, except for using 32 g of each of the resins (A) and 8 g of each of the resins ($B_1$) shown in Table g below in place of 32 g of Resin (A-1) and 8 g of Resin ($B_1$-26) used in Example 2-1.

TABLE q

| Example | Resin (A) | Resin ($B_1$) |
|---|---|---|
| 2-3 | A-3 | $B_1$-2 |
| 2-4 | A-4 | $B_1$-4 |
| 2-5 | A-5 | $B_1$-5 |
| 2-6 | A-6 | $B_1$-9 |
| 2-7 | A-7 | $B_1$-17 |
| 2-8 | A-8 | $B_1$-19 |
| 2-9 | A-9 | $B_1$-21 |
| 2-10 | A-10 | $B_1$-23 |
| 2-11 | A-11 | $B_1$-24 |
| 2-12 | A-12 | $B_1$-25 |
| 2-13 | A-13 | $B_1$-28 |

With each of the light-sensitive materials thus prepared, various characteristics were evaluated in the same manner as in Example 2-1. Each of the light-sensitive materials exhibited good electrostatic characteristics and image forming performance similar to those obtained in the light-sensitive material of Example 2-1, even when the ambient condition was varied. When they were used as printing plates, they exhibited good water retentivity at the start of printing on both printing machines of molton type and syn-flow type and the printing durability thereof was more than 10,000 prints.

EXAMPLES 2-14 TO 2-25

Each electrophotographic light-sensitive material was prepared in the same manner as described in Example 2-1, except for using each of the compounds shown in Table h below in place of Resin (A-1), Resin ($B_1$-26), Resin (2P-1) and phthalic anhydride and o-chlorophenol as crosslinking compounds used in Example 2-1. Resins (P-3) to (P-12) used are described in Examples 1-14 to 1-25 respectively.

TABLE h

| Example | Resin (A) | Resin ($B_1$) | Resin (P) | Crosslinking Compound |
|---|---|---|---|---|
| 2-14 | (A-14) | ($B_1$-34) | (P-3) | R'OOCNH$(CH_2)_6$NHCOOR'<br>R': $-CH(COCH_3)-COOC_2H_5$<br>Dibutyltin dilaurate |
| 2-15 | (A-15) | ($B_1$-35) | (P-4) | Tetrabutoxy titanate |
| 2-16 | (A-16) | ($B_1$-33) | (P-5) | Gluconic acid |
| 2-17 | (A-17) | ($B_1$-32) | (P-6) | 3-Glycidoxy propyl trimethoxy silane |
| 2-18 | (A-18) | ($B_1$-36) | (P-7) | — |
| 2-19 | (A-19) | ($B_1$-18) | (P-8) | Propylene glycol Tetrabutoxy titanate |
| 2-20 | (A-20) | ($B_1$-27) | (P-9) | N,N-Dimethylpropylamine |
| 2-21 | (A-21) | ($B_1$-28) | (P-10) | Divinyl adipate Benzoyl peroxide |
| 2-22 | (A-22) | ($B_1$-30) | — | — |
| 2-23 | (A-16) | ($B_1$-15) | (P-11) | Phthalic anhydride o-Chlorophenol |
| 2-24 | (A-23) | ($B_1$-12) | (P-12) | Allyl methacrylate Benzoyl peroxide |
| 2-25 | (A-24) | ($B_1$-30) | — | 3-Aminopropyl trimethoxy silane |

With each of the light-sensitive materials thus prepared, various characteristics were evaluated in the same manner as in Example 2-1. Each of the light-sensitive materials exhibited good electrostatic characteristics and image forming performance similar to those obtained in the light-sensitive material of Example 2-1, even when the ambient condition was varied. When they were used as printing plates, they exhibited good water retentivity at the start of printing on both printing machines of molton type and syn-flow type and the printing durability thereof was more than 10,000 prints.

EXAMPLE 2-26

A mixture of 1 g of X-form metal-free phthalocyanine (manufactured by Dainippon Ink and Chemicals, Inc.), 8 g of Resin (A-25), 2 g of Resin ($B_1$-17), 0.3 g of Resin (2P-1) and 80 g of tetrahydrofuran was put in a 500 ml-volume glass container together with glass beads and dispersed in a paint shaker (manufactured by Toyo Seiki Seisakusho Co.) for 60 minutes. To the dispersion was added 0.3 g of ethylene glycol diglycidyl ether, followed by further dispersing for 2 minutes. The glass beads were separated by filtration to prepare a dispersion for a light-sensitive layer.

The dispersion was coated on base paper for a paper master having a thickness of 0.2 mm, which had been subjected to electrically conductive treatment and solvent-resistant treatment, by a wire bar, set to touch, heated in a circulating oven at 110° C. for 20 seconds, and then further heated at 140° C. for 1 hour to form a light-sensitive layer having a thickness of 8 μm.

The resulting light-sensitive material was subjected to the evaluations of electrostatic characteristics and image forming performance in the same manner as described in Example 2-1, and good results shown below were obtained.

TABLE i

| Electrostatic Characteristics | 20° C., 65% RH | 30° C., 80% RH |
|---|---|---|
| $V_{10}$ (−V) | 550 | 540 |
| D.R.R. (%) | 85 | 83 |
| $E_{1/10}$ (erg/cm$^2$) | 30 | 28 |
| Image Forming Performance | ○ good | ○ good |

Of the evaluations, the D.R.R., $E_{1/10}$ and image forming performance were conducted according to the following methods.

D.R.R. and $E_{1/10}$

The light-sensitive material was charged with a corona discharge to a voltage of −6 kV for 20 seconds in a dark room at a temperature of 20° C. and 65% RH using a paper analyzer ("Paper Analyzer SP-428" manufactured by Kawaguchi Denki K.K.). Ten seconds after the corona discharge, the surface potential $V_{10}$ was measured. The sample was then allowed to stand in the dark for an additional 90 seconds, and the potential V100 was measured. The dark charge retention rate, i.e., percent retention of potential after dark decay for 90 seconds, was calculated from the following equation:

$$DRR\ (\%)=(V_{100}/V_{10})\times 100$$

Separately, the surface of photoconductive layer was charged to −500 V with a corona discharge and then exposed to monochromatic light of 780 nm, and the time required for decay of the surface potential $V_{10}$ to one-tenth was measured, and the exposure amount $E_{1/10}$ (erg/cm$^2$) was calculated therefrom.

This is denoted as Condition (I).

Further, the same procedure was conducted under the ambient condition of 30° C. and 80% RH. This is denoted as Condition (II).

Image Forming Performance

After the light-sensitive material was allowed to stand for a whole day and night under the condition of 20° C. and 65% RH, the light-sensitive material was charged to −6 kV and exposed to light emitted from a gallium-aluminum-arsenic semi-conductor laser (oscillation. wavelength: 780 nm; output: 2.8 mW) at an exposure amount of 64 erg/cm$^2$ (on the surface of the photo-conductive layer) at a pitch of 25 μm and a scanning speed of 300 m/sec. The thus formed electrostatic latent image was developed with Liquid Developer LD-2 prepared by dispersing 5 g of polymethyl methacrylate particles having a particle size of 0.3 μm in 1 l of Isopar H (manufactured by Esso Standard Co.), and adding 0.01 g of soybean oil lecithin thereto as a charge control agent, washed with a rinse solution of isoparaffinic solvent Isopar G (manufactured by Esso Chemical K.K.) and fixed. The duplicated image thus obtained was visually evaluated for fog and image quality.

This is denoted as Condition (I).

Further, the same procedure was conducted under the ambient condition of 30° C. and 80% RH. This is denoted as Condition (II).

Further, the light-sensitive material was subjected to the plate making in the same manner as described above and then the oil desensitizing treatment and printing were conducted under the same conditions as described in Example 2-1.

As a result, it was found that both of the water retentivities (I) and (II) at the start of printing were good. With respect to the printing durability, more than 10,000 prints of cleat prints were obtained.

EXAMPLE 2-27

An electrophotographic light-sensitive material was prepared in the same manner as described in Example 2-26 except that 10.3 g of Resin (A-26) was used alone in place of 8 g of Resin (A-25), 2 g of Resin ($B_1$-17), 0.3 g of Resin (2P-1), and 0.3 g of ethylene glycol diglycidyl ether used in Example 2-26. Further, the crosslinking of layer was conducted in the method described below in place of the heating at 140° C. for 1 hour.

Curing Method

The light-sensitive material was irradiated with light from a super high-pressure mercury lamp of 2 Kw as a light source at a distance of 50 cm for 1.5 minutes.

The electrostatic characteristics and printing properties of the light-sensitive material thus obtained were evaluated in the same manner as described in Example 2-26. The good results similar to those obtained with respect to the light-sensitive material of Example 2-26 were obtained.

EXAMPLES 2-28 TO 2-30

Each electrophotographic light-sensitive material was prepared in the same manner as in Example 2-1, except for using 32 g of each of the resins (A) and 8 g of each of the resins ($B_1$) shown in Table j below in place of 32 g of Resin (A-i) and 8 g of Resin ($B_1$-26) used in Example 2-1.

TABLE j

| Example | Resin (A) | Resin ($B_1$) |
|---|---|---|
| 2-28 | A-27 | $B_1$-3 |
| 2-29 | A-28 | $B_1$-10 |
| 2-30 | A-29 | $B_1$-16 |

With each of the light-sensitive materials thus prepared, the electrostatic characteristics and printing properties were evaluated in the same manner as in Example.2-1. The good results similar to those of the light-sensitive material in Example 2-1 were obtained.

EXAMPLE 2-31

A mixture of 40 g (solid basis) of Resin (A-30) having the structure below, 10 g (solid basis) of Resin ($B_1$-30), 200 g of photo-conductive zinc oxide, 0.018 g of Cyanine Dye (I-2) having the structure shown below, 0.20 g of phthalic anhydride and 300 g of toluene was dispersed by a homogenizer (manufactured by Nippon Seiki K.K.) at a rotation of 6×10$^3$ r.p.m. for 10 minutes. To the dispersion was added 2.5 g of a crosslinking compound having the structure shown below, and the mixture was dispersed by a homogenizer at a rotation of 1×10$^3$ r.p.m. for 1 minute to prepare a coating composition for a light-sensitive layer. The coating composition was coated on paper, which had been subjected to electrically conductive treatment, by a wire bar at a dry coverage of 22 g/m$^2$, followed by drying at 110° C. for 10 seconds and allowed to stand in a dark place at 50° C. and 80% RH for 1 week. Then the coated material was allowed to stand in a dark place at 20° C. and 65% RH for 24 hours to prepare an electrophotographic light-sensitive material.

Resin (A-30)

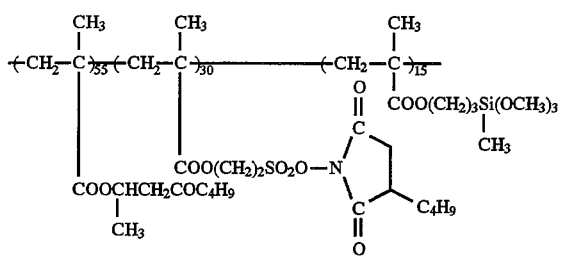

weight average molecular weight: 4.5 × 10$^4$

-continued

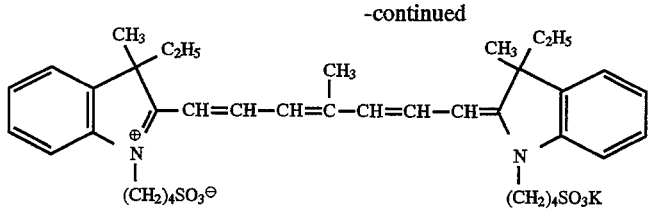

Cyanine Dye (I-2)

Crosslinking Compound
(CH3O)3Si(CH2)3Si(OCH3)3

COMPARATIVE EXAMPLE I-2

An electrophotographic light-sensitive material was prepared in the same manner as described in Example 2-31 except that 50 g of Resin (A-30) was used alone in place of 40 g of Resin (A-30) and 10 g of Resin (B1-30) used in Example 2-31.

With each of the light-sensitive materials thus prepared, the electrostatic characteristics and image forming performance were evaluated in the same manner as in Example 2-26, and other characteristic items were evaluated in the same manner as in Example 2-1.

TABLE k

| | | Example 2-31 | Comparative Example I-2 |
|---|---|---|---|
| Smoothness of Photoconductive Layer (sec/cc) | | 300 | 285 |
| Electrostatic Characteristics | | | |
| $V_{10}$(−V) | I (20° C., 65% RH) | 680 | 545 |
| | II (30° C., 80% RH) | 665 | 500 |
| D.R.R. (%) | I | 84 | 78 |
| | II | 79 | 50 |
| $E_{1/10}$ (erg/cm$^2$) | I | 38 | 85 |
| | II | 45 | 120 |
| Image Forming Performance | | | |
| | I | ○ good | ○ good |
| | II | ○ good | × low density, cutting of fine lines and letters, severe fog |
| Water Retentivity at the Start of Printing | | | |
| I Molton Type | | ○ good | ○ good |
| II Syn-Flow Type | | ○ good | ○ good |
| Printing Durability | | 10,000 prints | severe background stain from the start of printing |

As shown above, the smoothness of photoconductive layer was good with each light-sensitive material.

The electrostatic characteristics of the light-sensitive material according to the present invention were good not only at normal temperature and normal humidity but also at high temperature and high humidity. On the contrary, with the light-sensitive material of Comparative Example I-2, D.R.R. and $E_{1/10}$ were low even at normal temperature and normal humidity and they further degraded at high temperature and high humidity. With respect to image forming performance, the material according to the present invention provided good duplicated images irrespective of the ambient condition. On the contrary, with the material of Comparative Example I-2, although duplicated images formed at normal temperature and normal humidity were practically usable, duplicated images formed at high temperature and high humidity could not be used in practice because of occurrence of severe background stain and degradation of image (e.g., decrease in density, cutting of fine lines and letters).

Further, as a result of printing using the printing plates prepared therefrom, the printing plate according to the present invention provided 10,000 good prints from the start of printing irrespective of the kind of printing machine. The printing plate of Comparative Example I-2 prepared under Condition II provided prints of poor image from the start of printing.

EXAMPLES 2-32 TO 2-43

Each light-sensitive material was prepared in the same manner as in Example 2-31, except for using g of each of the resins ($B_1$) shown in Table 1 below in place of 10 g of Resin ($B_1$-30) used in Example 2-31.

TABLE l

| Example | Resin ($B_1$) |
|---|---|
| 2-32 | $B_1$-19 |
| 2-33 | $B_1$-21 |
| 2-34 | $B_1$-25 |
| 2-35 | $B_1$-4 |
| 2-36 | $B_1$-9 |
| 2-37 | $B_1$-14 |
| 2-38 | $B_1$-15 |
| 2-39 | $B_1$-36 |
| 2-40 | $B_1$-38 |
| 2-41 | $B_1$-31 |
| 2-42 | $B_1$-27 |
| 2-43 | $B_1$-10 |

With each of the light-sensitive materials thus prepared, the various characteristics were evaluated in the same manner as in Example 2-31. The good results similar to those of Example 2-31 were obtained.

EXAMPLES 2-44 TO 2-55

An offset printing plate was prepared by subjecting some of the light-sensitive materials used in Examples described above to electrophotographic processings for forming a toner image, followed by the oil-desensitizing treatment described below. Specifically, to 0.2 mol of each of the nucleophilic compounds shown in Table m below, 100 g of each of the organic solvents shown in Table m below, and 2 g of Newcol $B_4SN$ (manufactured by Nippon Nyukazai K.K.) was added distilled water to make 1 Z, and the solution was adjusted to a pH of 13.5. Each light-sensitive material was immersed in the resulting treating solution at a temperature of 35° C. for 3 minutes to conduct the oil-desensitizing treatment.

Printing was carried out using the resulting printing plate under the same conditions as in the respective basis Example. Each plate exhibited good characteristics similar to those of the respective basis Example.

rotation of $7\times10^3$ r.p.m. for 6 minutes. To the dispersion were added 5 g of Resin (2P-1) described in Example 2-1, 0.2 g of phthalic anhydride and 0.02 g of o-chlorophenol, and the mixture was dispersed by a homogenizer at a rotation of $1\times10^3$ r.p.m. for 1 minute. The resulting coating composition for a light-sensitive layer was coated on paper, which had been subjected to electrically conductive treatment, by a wire bar at a dry coverage of 28 g/m$^2$, dried at 100° C. for 30 seconds and then heating at 140° C. for 1 hour. The coated material was then allowed to stand in a dark place at 20° C. and 65% RH for 24 hours to prepare an electrophotographic light-sensitive material.

COMPARATIVE EXAMPLE A-3

An electrophotographic light-sensitive material was prepared in the same manner as in Example 3-1, except for using 32 g of Resin (R-1) described in Comparative Example A-1 in place of 32 g of Resin (A-1) used in Example 3-1.

COMPARATIVE EXAMPLE B-3

An electrophotographic light-sensitive material was prepared in the same manner as in Example 3-1, except for using 32 g of Resin (R-2) described in Comparative Example B-1 in place of 32 g of Resin (A-1) used in Example 3-1.

COMPARATIVE EXAMPLE C-3

An electrophotographic light-sensitive material was prepared in the same manner as in Example 3-1, except for using 23 g of Resin (R-1) and 9 g of Resin (R-2) (weight ratio of Resin (R-1)/Resin (R-2)=72/28) in place of 32 g of Resin (A-1) used in Example 3-1.

COMPARATIVE EXAMPLE D-3

An electrophotographic light-sensitive material was prepared in the same manner as in Example 3-1, except for using only 40 g of Resin (A-1) in place of 32 g of Resin (A-1) and 8 g of Resin ($B_2$-1) used in Example 3-1.

TABLE m

| Example | Basis Example of Light-sensitive Material | Nucleophilic Compound | Organic Solvent |
|---|---|---|---|
| 2-44 | Example 2-6 | Sodium sulfite | Benzyl alcohol |
| 2-45 | Example 2-8 | Monoethanolamine | Benzyl alcohol |
| 2-46 | Example 2-2 | Diethanolamine | Methyl ethyl ketone |
| 2-47 | Example 2-5 | Thiomalic acid | Ethylene glycol |
| 2-48 | Example 2-11 | Thiosalicylic acid | Benzyl alcohol |
| 2-49 | Example 2-9 | Taurine | Isopropyl alcohol |
| 2-50 | Example 2-13 | 4-Sulfobenzenesulfinic acid | Benzyl alcohol |
| 2-51 | Example 2-5 | Thioglycolic acid | Ethanol |
| 2-52 | Example 2-10 | 2-Mercaptoethylphosphonic acid | Dioxane |
| 2-53 | Example 2-30 | Serine | N,N-Dimethylamino ethanol |
| 2-54 | Example 2-12 | Sodium thiosulfate | N,N-Dimethylacetamide |
| 2-55 | Example 2-29 | Ammonium sulfite | Benzyl alcohol |

EXAMPLE 3-1

A mixture of 32 g of Resin (A-i), 8 g of Resin ($B_2$-1), 200 g of photoconductive zinc oxide, 0.02 g of uranine, 0.04 g of Rose Bengal, 0.03 g of bromophenol blue, 0.15 g of salicylic acid and 300 g of toluene was dispersed by a homogenizer (manufactured by Nippon Seiki K.K.) at a With each of the light-sensitive material thus prepared, various characteristics shown in Table n below were evaluated.

TABLE n

| | | Example 3-1 | Comparative Example A-3 | Comparative Example B-3 | Comparative Example C-3 | Comparative Example D-3 |
|---|---|---|---|---|---|---|
| Smoothness of Photo-[1] conductive Layer (sec/cc) | | 220 | 200 | 230 | 205 | 210 |
| Electrostatic[2] Characteristics | | | | | | |
| $V_{10}$(−V) | I | 605 | 580 | 600 | 585 | 570 |
| | II | 590 | 560 | 585 | 565 | 550 |
| D.R.R. (%) | I | 88 | 86 | 87 | 86 | 83 |
| | II | 84 | 82 | 83 | 83 | 72 |
| $E_{1/10}$ (lux · sec) | I | 12.8 | 13.0 | 12.8 | 13.1 | 14.0 |
| | II | 13.5 | 13.9 | 13.8 | 14.0 | 15.8 |
| Image Forming[3] Performance | | | | | | |
| | I | ○ good | ○ good | ○ good | ○ good | ○ good |
| | II | ○ good | Δ low density | ○ good | Δ low density | × low density, occurrence of unevenness of fine lines, occurrence of background fog |
| Water Retentivity at[4] the Start of Printing | | | | | | |
| I Molton Type | | ○ good | ○ good | Δ occurrence of background stain | Δ occurrence of background stain | ○ good |
| II Syn-Flow Type | | ○ good | × occurrence of severe back-ground stain | ×~Δ occurrence of background stain | × occurrence of background stain | ○ good |
| Printing Durability[5] | | 10,000 prints | 2,000 prints | 4,000 prints | 3,000 prints | occurrence of background stain from the start of printing |

The characteristic items described in Table n were evaluated as follows:

1) Smoothness of Photoconductive Layer

The resulting light-sensitive material was subjected to measurement of its smoothness (sec/cc) under an air volume condition of 1 cc using a Beck smoothness test machine (manufactured by Kumagaya Riko KK).

2) Electrostatic Characteristics

The light-sensitive material was subjected to corona discharge at a voltage of −6 kV for 20 seconds in a dark room at 20° C. and 65% RH using a paper analyzer (Paper Analyzer SP-428 manufactured by Kawaguchi Denki KK) and after allowed to stand for 10 seconds, the surface potential V10 was measured. Then, the sample was further allowed to stand in the dark room for 60 seconds to measure the surface potential V70, thus obtaining the retention of potential after the dark decay for 60 seconds, i.e., dark decay retention ratio (D.R.R. (%)) represented by $(V_{70}/V_{10})\times 100$ (%). Moreover, the surface of the photoconductive layer was charged to −400 V by corona discharge, then irradiated by visible light of the illuminance of 2.0 lux and the time required for decay of the surface potential $V_{10}$ to 1/10 was measured, and the exposure amount $E_{1/10}$ (lux·sec) was calculated therefrom.

Further, the same procedure was conducted under the ambient condition of 30° C. and 80% RH. The ambient condition of 20° C. and 65% RH is denoted as I and that of 30° C. and 80% RH is denoted as II.

3) Image Forming Performance

The light-sensitive material and a full-automatic plate making machine ELP-404V (manufactured by Fuji Photo Film Co., Ltd.) were allowed to stand for a whole day and night under condition of normal temperature and normal humidity (20° C. and 65% RH) (I), and a duplicated image was formed by plate making using the material and machine. The duplicated image formed on the printing plate precursor was subjected to visual evaluation of the fog and image quality. For the plate making Liquid Developer LD-3 described below was employed. Further, the same procedure was conducted under high temperature and high humidity condition (30° C. and 80% RH) (II), followed by evaluating the resulting image.

Preparation of Liquid Developer LD-3

(1) Synthesis of Toner Particles:

A mixed solution of 60 g of methyl methacrylate, 40 g of methyl acrylate, 20 g of the dispersion polymer described in Example 2-1, and 680 g of Isopar H was heated to 65° C. under nitrogen gas stream with stirring. To the solution was added 1.2 g of 2,2'-azobis(isovaleronitrile) (AIVN), followed by allowing the mixture to react for 2 hours. To the reaction mixture was further added 0.5 g of AIVN, and the reaction was continued for 2 hours. To the reaction mixture was further added 0.5 g of AIVN, and the reaction was continued for 2 hours. The temperature was raised up to 90° C., and the mixture was stirred under reduced pressure of 30 mm Hg for 1 hour to remove any unreacted monomers. After cooling to room temperature, the reaction mixture was filtered through a nylon cloth of 200 mesh to obtain a white dispersion. The reaction rate of the monomers was 95% by weight, and the resulting dispersion had an average grain diameter of resin grain of 0.25 μm (grain diameter being measured by CAPA-500 manufactured by Horiba, Ltd.) and good monodispersity.

(2) Preparation of Colored Particles:

Ten grams of a tetradecyl methacrylate/methacrylic acid copolymer (95/5 ratio by weight), 10 g of nigrosine, and 30 g of Isopar G were put in a paint shaker (manufactured by Tokyo Seiki Seisakusho KK) together with glass beads and dispersed for 4 hours to prepare a fine dispersion of nigrosine.

(3) Preparation of Liquid Developer:

A mixture of 45 g of the above-described toner particle dispersion, 25 g of the above-described nigrosine dispersion, 0.06 g of a hexadecene/maleic acid mono-octadecylamide copolymer, and 15 g of FOC 1800 was diluted with 1 l of Isopar G to prepare a liquid developer for electrophotography.

4) Water Retentivity at the Start of Printing

The light-sensitive material (without plate making, i.e., a raw plate) was immersed in Oil-Desensitizing Solution E-3 having the composition shown below at 40° C. for 3 minutes.

Oil-Desensitizing Solution E-3

Monoethanolamine 60 g

Neosoap 8 g (manufactured by Matsumoto Yushi KK)

Benzyl alcohol 100 g

These components were dissolved in distilled water to make a total volume of 1.0 liter, and a pH thereof was adjusted with potassium hydroxide to 13.5.

Then, the resulting plate was subjected to printing using a printing machine and Dampening Water F-3 each described below, and a 50th print from the start of printing was visually evaluated on background stain thereof.

Dampening Water F-3

Aqueous solution made by diluting 200-folds dampening water for PS plate (Alky A manufactured by Toyo Ink Mfg. Co., Ltd.) with distilled water (pH: 9.5)

Water Retentivity at the Start of Printing I

Ryobi 3200 CD manufactured by Ryobi Ltd. was used as a printing machine of molton type.

Water Retentivity at the Start of Printing II

Ryobi 3200 MCD manufactured by Ryobi Ltd. was used as a printing machine of syn-flow type.

5) Printing Durability

The light-sensitive material was subjected to plate making under the same conditions as in the above described item 3), immersed in Oil-Desensitizing Solution E-3 described in the item 4) above for 3 minutes. The resulting printing plate was subjected to printing using Dampening Water F-3 described in the item 4) above as dampening water, neutral paper as printing paper and a printing machine of large size capable of printing paper of Kikuzen-size (1003×800 mm) (Oliver 94 manufactured by Sakurai Seisakusho K.K.) as a printing machine. A number of prints having clear images which could be obtained without the occurrence of background stain was determined in a case wherein a printing pressure on an offset printing machine was increased.

As shown in Table n, each of the light-sensitive materials had good smoothness of photoconductive layer. The electrostatic characteristics under the condition of normal temperature and normal humidity were in a range of practically no problem although they were somewhat low in Comparative Example D-3 wherein the resin ($B_2$) was not used. However, under the severe condition of high temperature and high humidity, the electrostatic characteristics (particularly, D.R.R. and $E_{1/10}$) of Comparative Example D-3 were remarkably decreased. On the-contrary, with other light-sensitive materials, the change of the electrostatic characteristics was controlled small and they were maintained in a range of practical use. With respect to the image forming performance, the occurrence of background fog in non-image areas and degradation of image quality (i.e., decrease in density, cutting of fine lines and letters, etc.) were observed under the high temperature and high humidity condition. Other light-sensitive materials provided good duplicated images.

Concerning the water retentivity at the start of printing, the printing plates according to Example 3-1 and Comparative Example D-3 provided excellent water retentivity and adhesion of ink to the non-image area thereof was not observed at all irrespective of the type of printing machine. On the contrary, a plate according to Comparative Example A-3 wherein only carboxy group had been formed exhibited a large difference in the occurrence of background stain on print at the start of printing depending on a system of supplying damping water and ink. Specifically, in a case of using a printing machine of syn-flow type in which the supply of dampening water is less sufficient than in a printing machine of molton type, adhesion of ink occurred in the non-image area on print and the formation of background stain was observed at the start of printing. It is presumed in the plate of Comparative Example A-3 that although the surface of the photoconductive layer thereof which had been rendered hydrophilic had sufficiently good wettability with water, a super-thin layer of water (weak boundary layer abbreviated as WBL hereinafter) which had been formed on the surface of the plate could not be maintained, since the amount of water which was held in the whole photoconductive layer (amount of water retained in the layer) was insufficient, when the balance of amount of dampening water supplied was lost at the start of printing.

On the other hand, with a plate according to Comparative Example B-3 wherein only sulfo group had been formed, adhesion of ink was restrained as compared with the plate of Comparative Example A-3 in a case of using a printing machine of syn-flow type. However, it is presumed that the formation of WBL was insufficient in a case of using a printing machine of molton type since the amount of water retained in the layer was large.

Further, with Comparative Example C-3 wherein the resins used in Comparative Examples A-3 and B-3 were mixed the faults of both resins could not be covered up and provided the same results as Comparative Example A-3.

As a result of the evaluation on printing durability using a printing machine of large size, more than 10,000 prints of clear image were obtained. With Comparative Example D-3 which exhibited good water retentivity at the start of printing in case of using the raw plate, the image on prints were poor from the start of printing when the plate formed by practical plate-making was employed. On the contrary, the printing durability in each of Comparative Examples A-3, B-3 and C-3 was around 2,000 prints to 4,000 prints. The reason for the low printing durability in Comparative Example A-3 is considered to be based on the fact that the formation of WBL on the surface of the plate or the amount of water retained in the layer became poor with the progress of printing. Also, in case of Comparative Examples B-3 and C-3, it is presumed that a film strength of the layer was insufficient and the layer was broken, resulting in the low printing durability because of the large amount of water retained in the layer formed from the resin having sulfo group and crosslinking structure.

From these results it can be seen that only the light-sensitive material according to the present invention produces a printing plate which can provide a large number of prints having good quality even when the ambient conditions at the image formation and conditions at the printing are fluctuated.

EXAMPLE 3-2

A mixture of 35 g of Resin (A-2), 11 g of Resin ($B_2$-22), 4 g of Resin (P-2) described in Example 1-2, 200 g of photoconductive zinc oxide, 0.02 g of uranine, 0.015 g of Dye (I) described in Example 1-2, 0.012 g of Dye (II) described in Example 1-2, 0.18 g of N-hydroxyphthalimide and 300 g of toluene was dispersed by a homogenizer (manufactured by Nippon Seiki K.K.) at a rotation of $7\times10^3$ r.p.m. for 5 minutes. To the dispersion were added 0.1 g of phthalic anhydride and 0.002 g of zirconium acetylacetone, and the mixture was dispersed by a homogenizer at a rotation of $1\times10^3$ r.p.m. for 1 minute. The resulting coating composition for a light-sensitive layer was coated on paper, which had been subjected to electrically conductive treatment, by a wire bar at a dry coverage of 25 g/m$^2$, followed by drying at 100° C. for 30 seconds and then heating at 140° C. for 1 hour. The coated material was allowed to stand in a dark place at 20° C. and 65% RH for 24 hours to prepare an electrophotographic light-sensitive material.

COMPARATIVE EXAMPLE E-3

An electrophotographic light-sensitive material was prepared in the same manner as in Example 3-2, except for using 35 g of Resin (2R-3) described in Comparative Example E-2 in place of 35 g of Resin (A-2) used in Example 3-2.

COMPARATIVE EXAMPLE F-3

An electrophotographic light-sensitive material was prepared in the same manner as in Example 3-2, except for using 35 g of Resin (2R-4) described in Comparative Example F-2 in place of 35 g of Resin (A-2) used in Example 3-2.

COMPARATIVE EXAMPLE G-3

An electrophotographic light-sensitive material was prepared in the same manner as in Example 3-2, except for using 20.6 g of Resin (2R-3) and 14.4 g of Resin (2R-4) (weight ratio of Resin (2R-3)/Resin (2R- 4)=58.8/41.2) in place of 35 g of Resin (A-2) used in Example 3-2.

COMPARATIVE EXAMPLE H-3

An electrophotographic light-sensitive material was prepared in the same manner as in Example 3-2, except for using only 46 g of Resin (A-2) in place of 35 g of Resin (A-2) and 11 g of Resin ($B_2$-22) used in Example 3-2.

With each of the light-sensitive materials thus-prepared, the smoothness of photoconductive layer, electrostatic characteristics, image forming performance and water retentivity at the start of printing were evaluated in the same manner as in Example 3-1. Further, using dampening water each having a different pH value (i.e., pH 4.5, pH 7.0 and pH 9.5), influence on print was evaluated.

The results obtained are shown in Table o below.

TABLE o

| | | Example 3-2 | Comparative Example E-3 | Comparative Example F-3 | Comparative Example G-3 | Comparative Example H-3 |
|---|---|---|---|---|---|---|
| Smoothness of Photo-conductive Layer (sec/cc) | | 230 | 205 | 200 | 215 | 210 |
| Electrostatic Characteristics | | | | | | |
| $V_{10}$(−V) | I | 585 | 595 | 555 | 580 | 530 |
| | II | 565 | 580 | 530 | 560 | 510 |
| D.R.R. (%) | I | 88 | 89 | 83 | 86 | 83 |
| | II | 83 | 86 | 79 | 82 | 70 |
| $E_{1/10}$ (lux · sec) | I | 12.5 | 12.1 | 13.0 | 12.9 | 13.8 |
| | II | 13.3 | 13.1 | 14.2 | 13.6 | 14.9 |
| Image Forming Performance | | | | | | |
| | I | ○ good | ○ good | ○ good | ○ good | ○ good |
| | II | ○ good | ○ good | ○ good | ○ good | × low density, occurrence of background fog, occurrence of cutting of fine lines and letters |
| Water Retentivity at the Start of Printing | | | | | | |
| I Molton Type | | ○ good | ○ good | ○Δ occurrence of very slight background stain | ○ good | ○ good |
| II Syn-Flow Type | | ○ good | × occurrence of severe back- | ○~Δ occurrence of slight back- | × occurrence of severe back- | ○ good |

TABLE o-continued

| | Example 3-2 | Comparative Example E-3 | Comparative Example F-3 | Comparative Example G-3 | Comparative Example H-3 |
|---|---|---|---|---|---|
| | | ground stain | ground stain | ground stain | |
| Dependency on[6] Dampening Water | | | | | |
| I | 10,000 prints | severe background stain at the start of printing | background stain at the start of printing | severe background stain at the start of printing | severe background stain from the start of printing, occurrence of cutting of fine lines and letters |
| II | 10,000 prints | severe background stain at the start of printing | background stain at the start of printing | background stain at the start of printing | severe background stain from the start of printing, occurrence of cutting of fine lines and letters |
| III | 10,000 prints | 2,000 prints | 3,000 prints | 2,000 prints | severe background stain from the start of printing, occurrence of cutting of fine lines and letters |

6) Dependency on Dampening Water

The production of printing plate and printing were conducted in the same manner as described in the item 5) above, except for using the solution shown below as dampening water at the printing.

I: an aqueous solution (pH: 4.5) prepared by diluting 100-folds dampening water for PS plate (EU-3 manufactured by Fuji Photo Film Co., Ltd.) with distilled water.

II: an aqueous solution (pH: 7.0) prepared by diluting 130-folds dampening water for PS plate (SG-23 manufactured by Tokyo Ink K.K.) with distilled water.

III: an aqueous solution (pH: 9.5) prepared by diluting 200-folds dampening water for PS plate (Alky A manufactured by Toyo Ink Mfg. Co., Ltd.) with distilled water.

As shown above, the smoothness of photoconductive layer of each light-sensitive material was good. Example 3-2 and Comparative Examples E-3 to G-3 exhibited good electrostatic characteristics and image forming performance regardless of ambient condition. However, with Comparative Example H-3 wherein the resin ($B_2$) was not used, the electrostatic characteristics were decreased and the occurrence of background fog and degradation of image (i.e., decrease in density, cutting of fine lines and letters, etc.) were observed on the image forming performance under the severe condition of high temperature and high humidity.

With respect to the water retentivity at the start of printing, the plate according to the present invention was good, although the water retentivity of the plates of Comparative Examples E-3 to G-3 was poor in a case of using a printing machine of syn-flow type. The reason for poor water retentivity obtained in Comparative Example F-3 by the syn-flow type printing machine is presumed that although the $PO_3H_2$ group formed in Resin (2R-4) upon the oil-desensitizing treatment acted for keeping sufficient amount of water retained in the layer, the wettability of the surface of the layer with water was insufficient at the printing since the hydrophilic group was bonded to the polymer main chain through a hydrophobic linking group.

As a result of the evaluation on printing durability using three kinds of dampening water, the plate according to the present invention provided 10,000 prints of good quality irrespective of the kind of dampening water. On the contrary, the plates of Comparative Examples E-3 to G-3 exhibited good results only when Dampening Water III was used, and in case of using other dampening water, background stain due to adhesion of ink occurred at the start of printing while the degree thereof was different from each other and the background stain could not be removed by conducting further printing. The plate of Comparative Example H-3 could not provide prints of satisfactory image quality from the start of printing since the performance of printing plate precursor was poor due to poor image quality and background fog at the plate making.

It is believed that the large influence of pH of dampening water is related to a dissociation constant of the hydrophilic group formed. More specifically, with Comparative Example E-3 wherein the influence of pH is dominative, the COOH group formed in Resin (2R-3) is present as a dissociated form of $COO^-$ and has good compatibility with water under a high pH condition, but the amount of dissociated group decreases under a low pH condition, resulting in reduction of the water compatibility. It has been found that the water retentivity is widely varied depending on the kind of dampening water when a hydrophilic group having a small value of dissociation constant (pKa) is not formed simultaneously.

Since the printing plate according to the present invention is capable of conducting printing using dampening water for PS plate in a large size printing machine as described above, it can be easily used in common with other printing plates without cleaning and inspection of the printing machine.

EXAMPLES 3-3 TO 3-13

Each electrophotographic light-sensitive material was prepared in the same manner as described in Example 3-1, except for using 32 g of each of the resins (A) and 8 g of each of the resins ($B_2$) shown in Table p below in place of 32 g of Resin (A-1) and 8 g of Resin ($B_2$-1) used in Example 3-1.

TABLE p

| Example | Resin (A) | Resin ($B_2$) |
|---|---|---|
| 3-3 | A-3 | $B_2$-2 |
| 3-4 | A-4 | $B_2$-4 |
| 3-5 | A-5 | $B_2$-5 |
| 3-6 | A-6 | $B_2$-6 |
| 3-7 | A-7 | $B_2$-7 |
| 3-8 | A-8 | $B_2$-8 |
| 3-9 | A-9 | $B_2$-10 |
| 3-10 | A-10 | $B_2$-12 |
| 3-11 | A-11 | $B_2$-16 |
| 3-12 | A-12 | $B_2$-17 |
| 3-13 | A-13 | $B_2$-24 |

With each of the light-sensitive materials thus prepared, various characteristics were evaluated in the same manner as in Example 3-1. Each of the light-sensitive materials exhibited good electrostatic characteristics and image forming performance similar to those obtained in the light-sensitive material of Example 3-1, even when the ambient condition was varied. When they were used as printing plates, they exhibited good water retentivity at the start of printing on both printing machines of molton type and syn-flow type and the printing durability thereof was more than 10,000 prints.

EXAMPLES 3-14 TO 3-25

Each electrophotographic light-sensitive material was prepared in the same manner as described in Example 3-1, except for using each of the compounds shown in Table q below in place of Resin (A-1), Resin ($B_2$-1), Resin (2P-1) and phthalic anhydride and o-chlorophenol as crosslinking compounds used in Example 3-1. Resins (P-3) to (P-12) used are described in Examples 1-14 to 1-25 respectively.

TABLE q

| Example | Resin (A) | Resin ($B_2$) | Resin (P) | Crosslinking Compound |
|---|---|---|---|---|
| 3-14 | (A-14) | ($B_2$-2) | (P-3) | $R'OOCNH(CH_2)_6NHCOOR'$<br>R': $-CH(COCH_3)-COOC_2H_5$<br>Dibutyltin dilaurate |
| 3-15 | (A-15) | ($B_2$-9) | (P-4) | Tetrabutoxy titanate |
| 3-16 | (A-16) | ($B_2$-11) | (P-5) | Gluconic acid |
| 3-17 | (A-17) | ($B_2$-13) | (P-6) | 3-Glycidoxy propyl trimethoxy silane |
| 3-18 | (A-18) | ($B_2$-14) | (P-7) | — |
| 3-19 | (A-19) | ($B_2$-15) | (P-8) | Propylene glycol<br>Tetrabutoxy titanate |
| 3-20 | (A-20) | ($B_2$-18) | (P-9) | N,N-Dimethylpropylamine |
| 3-21 | (A-21) | ($B_2$-19) | (P-10) | Divinyl adipate<br>Benzoyl peroxide |
| 3-22 | (A-22) | ($B_2$-20) | — | — |
| 3-23 | (A-16) | ($B_2$-21) | (P-11) | Phthalic anhydride<br>o-Chlorophenol |
| 3-24 | (A-23) | ($B_2$-25) | (P-12) | Allyl methacrylate<br>Benzoyl peroxide |
| 3-25 | (A-24) | ($B_2$-28) | — | 3-Aminopropyl trimethoxy silane |

With each of the light-sensitive materials thus prepared, various characteristics were evaluated in the same manner as in Example 3-1. Each of the light-sensitive materials exhibited good electrostatic characteristics and image forming performance similar to those obtained in the light-sensitive material of Example 3-1, even when the ambient condition was varied. When they were used as printing plates, they exhibited good water retentivity at the start of printing on both printing machines of molton type and syn-flow type and the printing durability thereof was more than 10,000 prints.

EXAMPLE 3-26

A mixture of 1 g of X-form metal-free phthalocyanine (manufactured by Dainippon Ink and Chemicals, Inc.), 8 g of Resin (A-25), 1.7 g of Resin ($B_2$-29), 0.3 g of Resin (2P-1) and 80 g of tetrahydrofuran was put in a 500 ml-volume glass container together with glass beads and dispersed in a paint shaker (manufactured by Toyo Seiki Seisakusho Co.) for 60 minutes. To the dispersion was added 0.3 g of ethylene glycol diglycidyl ether, followed by further dispersing for 2 minutes. The glass beads were separated by filtration to prepare a dispersion for a light-sensitive layer.

The dispersion was coated on base paper for a paper master having a thickness of 0.2 mm, which had been subjected to electrically conductive treatment and solvent-resistant treatment, by a wire bar, set to touch, heated in a circulating oven at 110° C. for 20 seconds, and then further heated at 140° C. for 1 hour to form a light-sensitive layer having a thickness of 8 μm.

The resulting light-sensitive material was subjected to the evaluations of electrostatic characteristics and image forming performance in the same manner as described in Example 3-1, and good results shown below were obtained.

TABLE i

| Electrostatic Characteristics | 20° C., 65% RH | 30° C., 80% RH |
|---|---|---|
| $V_{10}$ (−V) | 530 | 515 |
| D.R.R. (%) | 88 | 84 |
| $E_{1/10}$ (erg/cm$^2$) | 32 | 29 |
| Image Forming Performance | ○<br>good | ○<br>good |

Of the evaluations, the D.R.R., $E_{1/10}$ and image forming performance were conducted according to the following methods.

D.R.R. and $E_{1/10}$

The light-sensitive material was charged with a corona discharge to a voltage of −6 kV for 20 seconds in a dark room at a temperature of 20° C. and 65% RH using a paper analyzer ("Paper Analyzer SP-428" manufactured by Kawaguchi Denki K.K.). Ten seconds after the corona discharge, the surface potential $V_{10}$ was measured. The sample was then allowed to stand in the dark for an additional 90 seconds, and the potential $V_{100}$ was measured. The dark charge retention rate, i.e., percent retention of potential after dark decay for 90 seconds, was calculated from the following equation:

$$DRR\ (\%)=(V_{100}/V_{10})\times 100$$

Separately, the surface of photoconductive layer was charged to −500 V with a corona discharge and then exposed to monochromatic light of 780 nm, and the time required for decay of the surface potential $V_{10}$ to one-tenth was measured, and the exposure amount $E_{1/10}$ (erg/cm$^2$) was calculated therefrom.

This is denoted as Condition (I).

Further, the same procedure was conducted under the ambient condition of 30° C. and 80% RH. This is denoted as Condition (II).

Image Forming Performance

After the light-sensitive material was allowed to stand for a whole day and night under the condition of 20° C. and 65% RH, the light-sensitive material was charged to −6 kV and exposed to light emitted from a gallium-aluminum-arsenic semi-conductor laser (oscillation wavelength: 780 nm; output: 2.8 mW) at an exposure amount of 64 erg/cm$^2$ (on the surface of the photoconductive layer) at a pitch of 25 μm and a scanning speed of 300 m/sec. The thus formed electrostatic latent image was developed with Liquid Developer LD-2 prepared by dispersing 5 g of polymethyl methacrylate particles having a particle size of 0.3 μm in 1 l of Isopar H (manufactured by Esso Standard Co.), and adding 0.01 g of soybean oil lecithin thereto as a charge control agent, washed with a rinse solution of isoparaffinic solvent Isopar G (manufactured by Esso Chemical K.K.) and fixed. The duplicated image thus obtained was visually evaluated for fog and image quality.

This is denoted as Condition (I).

Further, the same procedure was conducted under the ambient condition of 30° C. and 80% RH. This is denoted as Condition (II).

Further, the light-sensitive material was subjected to the plate making in the same manner as described above and then the oil desensitizing treatment and printing were conducted under the same conditions as described in Example 3-1.

As a result, it was found that both of the water retentivities (I) and (II) at the start of printing were good. With respect to the printing durability, more than 10,000 prints of cleat prints were obtained.

EXAMPLE 3-27

An electrophotographic light-sensitive material was prepared in the same manner as described in Example 3-26 except that 10.3 g of Resin (A-26) was used alone in place of 8 g of Resin (A-25), 1.7 g of Resin ($B_2$-29), 0.3 g of Resin ( 2P-1), and 0.3 g of ethylene glycol diglycidyl ether used in Example 3-26. Further, the crosslinking of layer was conducted in the method described below in place of the heating at 140° C. for 1 hour.

Curing Method

The light-sensitive material was irradiated with light from a super high-pressure mercury lamp of 2 Kw as a light source at a distance of 50 cm for 1.5 minutes.

The electrostatic characteristics and printing properties of the light-sensitive material thus obtained were evaluated in the same manner as described in Example 3-26. The good results similar to those obtained with respect to the light-sensitive material of Example 3-26 were obtained.

EXAMPLES 3-28 TO 3-30

Each electrophotographic light-sensitive material was prepared in the same manner as in Example 3-1, except for using 32 g of each of the resins (A) and 8 g of each of the resins ($B_2$) shown in Table r below in place of 32 g of Resin (A-I) and 8 g of Resin ($B_2$-1) used in Example 3-1.

TABLE r

| Example | Resin (A) | Resin ($B_2$) |
|---|---|---|
| 3-28 | A-27 | $B_2$-31 |
| 3-29 | A-28 | $B_2$-30 |
| 3-30 | A-29 | $B_2$-29 |

With each of the light-sensitive materials thus prepared, the electrostatic characteristics and printing properties were evaluated in the same manner as in Example 3-1. The good results similar to those of the light-sensitive material in Example 3-1 were obtained.

EXAMPLE 3-31

A mixture of 40 g (solid basis) of Resin (A-30), 10 g (solid basis) of Resin ($B_2$-38), 200 g of photoconductive zinc oxide, 0.018 g of Cyanine Dye (I-2) described in Example 2-31, 0.20 g of phthalic anhydride and 300 g of toluene was dispersed by a homogenizer (manufactured by Nippon Seiki K.K.) at a rotation of $6\times10^3$ r.p.m. for 7 minutes. To the dispersion was added 2.5 g of the crosslinking compound described in Example 2-31, and the mixture was dispersed by a homogenizer at a rotation of $1\times10^3$ r.p.m. for 1 minute to prepare a coating composition for a light-sensitive layer. The coating composition was coated on paper, which had been subjected to electrically conductive treatment, by a wire bar at a dry coverage of 22 g/m$^2$, followed by drying at 110° C. for 10 seconds and allowed to stand in a dark place at 50° C. and 80% RH for 1 week. Then the coated material was allowed to stand in a dark place at 20° C. and 65% RH for 24 hours to prepare an electrophotographic light-sensitive material.

COMPARATIVE EXAMPLE I-3

An electrophotographic light-sensitive material was prepared in the same manner as described in Example 3-31 except that 50 g of Resin (A-30) was used alone in place of 40 g of Resin (A-30) and 10 g of Resin ($B_2$-38) used in Example 3-31.

With each of the light-sensitive materials thus prepared, the electrostatic characteristics and image forming performance were evaluated in the same manner as in Example 3-26, and other characteristic items were evaluated in the same manner as in Example 3-1.

TABLE s

| | | Example 3-31 | Comparative Example I-3 |
|---|---|---|---|
| Smoothness of Photo-conductive Layer (sec/cc) | | 260 | 230 |
| Electrostatic Characteristics | | | |
| $V_{10}$(−V) | I (20° C., 65% RH) | 585 | 570 |
| | II (30° C., 80% RH) | 570 | 545 |
| D.R.R. (%) | I | 86 | 80 |
| | II | 82 | 70 |
| $E_{1/10}$ (erg/cm$^2$) | I | 33 | 83 |
| | II | 38 | 95 |
| Image Forming Performance | | | |
| | I | ○ good | Δ occurrence of scratch of fine lines and letters |
| | II | ○ good | × low density, cutting of fine lines and letters, severe fog |
| Water Retentivity at the Start of Printing | | | |
| I Molton Type | | ○ good | ○ good |
| II Syn-Flow Type | | ○ good | ○ good |
| Printing Durability | | 10,000 prints | severe background stain from the start of printing |

As shown above, the smoothness of photoconductive layer was good with each light-sensitive material.

The electrostatic characteristics of the light-sensitive material according to the present invention were good not only at normal temperature and normal humidity but also at high temperature and high humidity. On the contrary, with the light-sensitive material of Comparative Example I-3, D.R.R. and $E_{1/10}$ were low even at normal temperature and normal humidity and they further degraded at high temperature and high humidity. With respect to image forming performance, the material according to the present invention provided good duplicated images irrespective of the ambient condition. On the contrary, with the material of Comparative Example I-3, although duplicated images formed at normal temperature and normal humidity were practically usable, duplicated images formed at high temperature and high humidity could not be used in practice because of occurrence of severe background stain and degradation of image (e.g., decrease in density, cutting of fine lines and letters).

Further, as a result of printing using the printing plates prepared therefrom, the printing plate according to the present invention provided 10,000 good prints from the start of printing irrespective of the kind of printing machine. The printing plate of Comparative Example I-3 prepared under Condition II provided prints of poor image from the start of printing.

EXAMPLES 3-32 TO 3-43

Each light-sensitive material was prepared in the same manner as in Example 3-31, except for using 10 g of each of the resins ($B_2$) shown in Table t below in place of 10 g of Resin ($B_2$-38) used in Example 3-31.

TABLE t

| Example | Resin ($B_2$) |
|---|---|
| 3-32 | $B_2$-1 |
| 3-33 | $B_2$-4 |
| 3-34 | $B_2$-5 |
| 3-35 | $B_2$-23 |
| 3-36 | $B_2$-27 |
| 3-37 | $B_2$-28 |
| 3-38 | $B_2$-35 |
| 3-39 | $B_2$-39 |
| 3-40 | $B_2$-37 |
| 3-41 | $B_2$-40 |
| 3-42 | $B_2$-41 |
| 3-43 | $B_2$-42 |

With each of the light-sensitive materials thus prepared, the various characteristics were evaluated in the same manner as in Example 3-31. The good results similar to those of Example 3-31 were obtained.

EXAMPLES 3-44 TO 3-55

An offset printing plate was prepared by subjecting some of the light-sensitive materials used in Examples described above to electrophotographic processings for forming a toner image, followed by the oil-desensitizing treatment described above. Specifically, to 0.2 mol of each of the nucleophilic compounds shown in Table u below, 100 g of each of the organic solvents shown in Table u below, and 2 g of Newcol $B_4$SN (manufactured by Nippon Nyukazai K.K.) was added distilled water to make 1 l, and the solution was adjusted to a pH of 13.5. Each light-sensitive material was immersed in the resulting treating solution at a temperature of 35° C. for 3 minutes to conduct the oil-desensitizing treatment.

Printing was carried out using the resulting printing plate under the same conditions as in the respective basis Example. Each plate exhibited good characteristics similar to those of the respective basis Example.

TABLE u

| Example | Basis Example of Light-sensitive Material | Nucleophilic Compound | Organic Solvent |
|---|---|---|---|
| 3-44 | Example 3-6 | Sodium sulfite | N,N-Dimethylacetamide |
| 3-45 | Example 3-8 | Monoethanolamine | Tetrahydrofuran |
| 3-46 | Example 3-2 | Diethanolamine | Methyl ethyl ketone |
| 3-47 | Example 3-5 | Thiomalic acid | Ethylene glycol dimethyl ether |
| 3-48 | Example 3-11 | Thiosalicylic acid | N-Methylpyrrolidone |
| 3-49 | Example 3-9 | Taurine | Sulfolane |
| 3-50 | Example 3-13 | 4-Sulfobenzenesulfinic acid | Benzyl alcohol |
| 3-51 | Example 3-5 | Thioglycolic acid | Tetramethylurea |
| 3-52 | Example 3-10 | 2-Mercaptoethylphosphonic acid | Dioxane |
| 3-53 | Example 3-30 | Serine | N,N-Dimethylamino ethanol |
| 3-54 | Example 3-12 | Sodium thiosulfate | N-Methylacetamide |
| 3-55 | Example 3-29 | Ammonium sulfite | Ethylene glycol monomethyl ether |

EXAMPLE 4-1

A mixture of 32 g of Resin (A-1), 8 g of Resin ($B_3$-26), 200 g of photoconductive zinc oxide, 0.02 g of uranine, 0.04 g of Rose Bengal, 0.03 g of bromophenol blue, 0.15 g of salicylic acid and 300 g of toluene was dispersed by a homogenizer (manufactured by Nippon Seiki K.K.) at a rotation of $7\times10^3$ r.p.m. for 8 minutes. To the dispersion were added 5 g of Resin (2P-1) described in Example 2-1, 0.2 g of phthalic anhydride and 0.02 g of o-chlorophenol, and the mixture was dispersed by a homogenizer at a rotation of $1\times10^3$ r.p.m. for 1 minute. The resulting coating composition for a light-sensitive layer was coated on paper, which had been subjected to electrically conductive treatment, by a wire bar at a dry coverage of 25 g/m$^2$ dried at 100° C. for 30 seconds and then heating at 140° C. for 1 hour. The coated material was then allowed to stand in a dark place at 20° C. and 65% RH for 24 hours to prepare an electrophotographic light-sensitive material.

COMPARATIVE EXAMPLE A-4

An electrophotographic light-sensitive material was prepared in the same manner as in Example 4-1, except for using 32 g of Resin (R-1) described in Comparative Example A-1 in place of 32 g of Resin (A-1) used in Example 4-1.

COMPARATIVE EXAMPLE B-4

An electrophotographic light-sensitive material was prepared in the same manner as in Example 4-1, except for using 32 g of Resin (R-2) described in Comparative Example B-1 in place of 32 g of Resin (A-1) used in Example 4-1.

COMPARATIVE EXAMPLE C-4

An electrophotographic light-sensitive material was prepared in the same manner as in Example 4-1, except for using 23 g of Resin (R-1) and 9 g of Resin (R-2) (weight ratio of Resin (R-1)/Resin (R-2)=72/28) in place of 32 g of Resin (A-1) used in Example 4-1.

COMPARATIVE EXAMPLE D-4

An electrophotographic light-sensitive material was prepared in the same manner as in Example 4-1, except for using only 40 g of Resin (A-1) in place of 32 g of Resin (A-1) and 8 g of Resin ($B_3$-26) used in Example 4-1.

With each of the light-sensitive material thus prepared, various characteristics shown in Table v below were evaluated.

TABLE v

| | | Example 4-1 | Comparative Example A-4 | Comparative Example B-4 | Comparative Example C-4 | Comparative Example D-4 |
|---|---|---|---|---|---|---|
| Smoothness of Photo-[1] conductive Layer (sec/cc) | | 350 | 355 | 350 | 360 | 360 |
| Electrostatic[2] Characteristics | | | | | | |
| $V_{10}$(−V) | I | 760 | 745 | 760 | 740 | 585 |
| | II | 740 | 725 | 745 | 715 | 560 |
| D.R.R. (%) | I | 90 | 91 | 89 | 88 | 83 |
| | II | 85 | 85 | 85 | 83 | 74 |
| $E_{1/10}$ (lux · sec) | I | 9.0 | 9.8 | 9.5 | 10.0 | 13.5 |
| | II | 9.8 | 10.2 | 10.2 | 11.0 | 15.5 |

TABLE v-continued

| | | Example 4-1 | Comparative Example A-4 | Comparative Example B-4 | Comparative Example C-4 | Comparative Example D-4 |
|---|---|---|---|---|---|---|
| Image Forming[3] Performance | | | | | | |
| | I | ○ good | ○ good | ○ good | ○ good | ○ good |
| | II | ○ good | ○ good | ○ good | ○ good | × low density, occurrence of unevenness of fine lines, occurrence of background fog |
| Water Retentivity at[4] the Start of Printing | | | | | | |
| I Molton Type | | ○ good | ○ good | Δ occurrence of background stain | Δ occurrence of background stain | ○ good |
| II Syn-Flow Type | | ○ good | × occurrence of severe back-ground stain | ×~Δ occurrence of background stain | × occurrence of background stain | ○ good |
| Printing Durability[5] | | 10,000 prints | 2,000 prints | 4,000 prints | 3,000 prints | occurrence of background stain from the start of printing |

The characteristic items described in Table v were evaluated as follows:

1) Smoothness of Photoconductive Layer

The resulting light-sensitive material was subjected to measurement of its smoothness (sec/cc) under an air volume condition of 1 cc using a Beck smoothness test machine (manufactured by Kumagaya Riko KK).

2) Electrostatic Characteristics

The light-sensitive material was subjected to corona discharge at a voltage of −6 kV for 20 seconds in a dark room at 20° C. and 65% RH using a paper analyzer (Paper Analyzer SP-428 manufactured by Kawaguchi Denki KK) and after allowed to stand for 10 seconds, the surface potential $V_{10}$ was measured. Then, the sample was further allowed to stand in the dark room for 60 seconds to measure the surface potential V70, thus obtaining the retention of potential after the dark decay for 60 seconds, i.e., dark decay retention ratio (D.R.R. (%)) represented by $(V_{70}/V_{10})\times 100$ (%). Moreover, the surface of the photoconductive layer was charged to −400 V by corona discharge, then irradiated by visible light of the illuminance of 2.0 lux and the time required for decay of the surface potential $V_{10}$ to 1/10 was measured, and the exposure amount $E_{1/10}$ (lux·sec) was calculated therefrom.

Further, the same procedure was conducted under the ambient condition of 30° C. and 80% RH. The ambient condition of 20° C. and 65% RH is denoted as I and that of 30° C. and 80% RH is denoted as II.

3) Image Forming Performance

The light-sensitive material and a full-automatic plate making machine ELP-404V (manufactured by Fuji Photo Film Co., Ltd.) were allowed to stand for a whole day and night under condition of normal temperature and normal humidity (20° C. and 65% RH) (I), and a duplicated image was formed by plate making using the material and machine. The duplicated image formed on the printing plate precursor was subjected to visual evaluation of the fog and image quality. For the plate making Liquid Developer LD-4 described below was employed. Further, the same procedure was conducted under high temperature and high humidity condition (30° C. and 80% RH) (II), followed by evaluating the resulting image.

Preparation of Liquid Developer LD-4

(1) Synthesis of Toner Particles:

A mixed solution of 60 g of methyl methacrylate, 40 g of methyl acrylate, 20 g of the dispersion polymer described in Example 2-1, and 680 g of Isopar H was heated to 65° C. under nitrogen gas stream with stirring. To the solution was added 1.2 g of 2,2'-azobis(isovaleronitrile) (AIVN), followed by allowing the mixture to react for 2 hours. To the reaction mixture was further added 0.5 g of AIVN, and the reaction was continued for 2 hours. To the reaction mixture was further added 0.5 g of AIVN, and the reaction was continued for 2 hours. The temperature was raised up to 90° C., and the mixture was stirred under reduced pressure of 30 mm Hg for 1 hour to remove any unreacted monomers. After cooling to room temperature, the reaction mixture was filtered through a nylon cloth of 200 mesh to obtain a white dispersion. The reaction rate of the monomers was 95% by weight, and the resulting dispersion had an average grain diameter of resin grain of 0.25 μm (grain diameter being measured by CAPA-500 manufactured by Horiba, Ltd.) and good monodispersity.

(2) Preparation of Colored Particles:

Ten grams of a tetradecyl methacrylate/methacrylic acid copolymer (95/5 ratio by weight), 10 g of nigrosine, and 30 g of Isopar G were put in a paint shaker (manufactured by Tokyo Seiki Seisakusho KK) together with glass beads and dispersed for 4 hours to prepare a fine dispersion of nigrosine.

(3) Preparation of Liquid Developer:

A mixture of 45 g of the above-described toner particle dispersion, 25 g of the above-described nigrosine dispersion, 0.06 g of a hexadecene/maleic acid mono-octadecylamide copolymer, and 15 g of FOC 1800 was diluted with 1 l of Isopar G to prepare a liquid developer for electrophotography.

4) Water Retentivity at the Start of Printing

The light-sensitive material (without plate making, i.e., a raw plate) was immersed in Oil-Desensitizing Solution E-4 having the composition shown below at 40° C. for 3 minutes.

Oil-Desensitizing Solution E-4

Monoethanolamine 60 g

Neosoap 8 g (manufactured by Matsumoto Yushi KK)

Benzyl alcohol 100 g

These components were dissolved in distilled water to make a total volume of 1.0 liter, and a pH thereof was adjusted with potassium hydroxide to 13.5.

Then, the resulting plate was subjected to printing using a printing machine and Dampening Water F-4 each described below, and a 50th print from the start of printing was visually evaluated on background stain thereof.

Dampening Water F-4

Aqueous solution made by diluting 200-folds dampening water for PS plate (Alky A manufactured by Toyo Ink Mfg. Co., Ltd.) with distilled water (pH: 9.5)

Water Retentivity at the Start of Printing I

Ryobi 3200 CD manufactured by Ryobi Ltd. was used as a printing machine of molton type.

Water Retentivity at the Start of Printing II

Ryobi 3200 MCD manufactured by Ryobi Ltd. was used as a printing machine of syn-flow type.

5) Printing Durability

The light-sensitive material was subjected to plate making under the same conditions as in the above described item 3), immersed in Oil-Desensitizing Solution E-4 described in the item 4) above for 3 minutes. The resulting printing plate was subjected to printing using Dampening Water F-4 described in the item 4) above as dampening water, neutral paper as printing paper and a printing machine of large size capable of printing paper of Kikuzen-size (1003×800 mm) (Oliver 94 manufactured by Sakurai Seisakusho K.K.) as a printing machine. A number of prints having clear images which could be obtained without the occurrence of background stain was determined in a case wherein a printing pressure on an offset printing machine was increased.

As shown in Table v, each of the light-sensitive materials had good smoothness of photoconductive layer. The electrostatic characteristics under the condition of normal temperature and normal humidity were in a range of practically no problem although they were somewhat low in Comparative Example D-4 wherein the resin ($B_3$) was not used. However, under the severe condition of high temperature and high humidity, the electrostatic characteristics (particularly, D.R.R. and $E_{1/10}$ ) of Comparative Example D-4 were remarkably decreased. On the contrary, with other light-sensitive materials, the change of the electrostatic characteristics was controlled small and they were maintained in a range of practical use. With respect to the image forming performance, the occurrence of background fog in non-image areas and degradation of image quality (i.e., decrease in density, cutting of fine lines and letters, etc.) were observed under the high temperature and high humidity condition. Other light-sensitive materials provided good duplicated images.

Concerning the water retentivity at the start of printing, the printing plates according to Example 4-1 and Comparative Example D-4 provided excellent water retentivity and adhesion of ink to the non-image area thereof was not observed at all irrespective of the type of printing machine. On the contrary, a plate according to Comparative Example A-4 wherein only carboxy group had been formed exhibited a large difference in the occurrence of background stain on print at the start of printing depending on a system of supplying damping water and ink. Specifically, in a case of using a printing machine of syn-flow type in which the supply of dampening water is less sufficient than in a printing machine of molton type, adhesion of ink occurred in the non-image area on print and the formation of background stain was observed at the start of printing. It is presumed in the plate of Comparative Example A-4 that although the surface of the photoconductive layer thereof which had been rendered hydrophilic had sufficiently good wettability with water, a super-thin layer of water (weak boundary layer abbreviated as WBL hereinafter) which had been formed on the surface of the plate could not be maintained, since the amount of water which was held in the whole photoconductive layer (amount of water retained in the layer) was insufficient, when the balance of amount of dampening water supplied was lost at the start of printing.

On the other hand, with a plate according to Comparative Example B-4 wherein only sulfo group had been formed, adhesion of ink was restrained as compared with the plate of Comparative Example A-4 in a case of using a printing machine of syn-flow type. However, it is presumed that the formation of WBL was insufficient in a case of using a printing machine of molton type since the amount of water retained in the layer was large.

Further, with Comparative Example C-4 wherein the resins used in Comparative Examples A-4 and B-4 were mixed the faults of both resins could not be covered up and provided the same results as Comparative Example A-4.

As a result of the evaluation on printing durability using a printing machine of large size, more than 10,000 prints of clear image were obtained. With Comparative Example D-4 which exhibited good water using retentivity at the start of printing in case of the raw plate, the image on prints were poor from the start of printing when the plate formed by practical plate-making was employed. On the contrary, the printing durability in each of Comparative Examples A-4, B-4 and C-4 was around 2,000 prints to 4,000 prints. The reason for the low printing durability in Comparative Example A-4 is considered to be based on the fact that the formation of WBL on the surface of the plate or the amount of water retained in the layer became poor with the progress of printing. Also, in case of Comparative Examples B-4 and C-4, it is presumed that a film strength of the layer was insufficient and the layer was broken, resulting in the low printing durability because of the large amount of water retained in the layer formed from the resin having sulfo group and crosslinking structure.

From these results it can be seen that only the light-sensitive material according to the present invention produces a printing plate which can provide a large number of prints having good quality even when the ambient conditions at the image formation and conditions at the printing are fluctuated.

EXAMPLE 4-2

A mixture of 35 g of Resin (A-2), 10 g of Resin ($B_3$-1), 4 g of Resin (P-2) described in Example 1-2, 200 g of photoconductive zinc oxide, 0.02 g of uranine, 0.015 g of Dye (I) described in Example 1-2, 0.012 g of Dye (II) described in Example 1-2, 0.18 g of N-hydroxyphthalimide and 300 g of toluene was dispersed by a homogenizer (manufactured by Nippon Seiki K.K.) at a rotation of $7\times10^3$ r.p.m. for 8 minutes. To the dispersion were added 0.1 g of phthalic anhydride and 0.002 g of zirconium acetylacetone, and the mixture was dispersed by a homogenizer at a rotation of $1\times10^3$ r.p.m. for 1 minute. The resulting coating composition for a light-sensitive layer was coated on paper, which had been subjected to electrically conductive treatment, by a wire bar at a dry coverage of 25 g/m$^2$, followed by drying at 100° C. for 30 seconds and then heating at 140° C. for 1 hour. The coated material was allowed to stand in a dark place at 20° C. and 65% RH for 24 hours to prepare an electrophotographic light-sensitive material.

COMPARATIVE EXAMPLE E-4

An electrophotographic light-sensitive material was prepared in the same manner as in Example 4-2, except for using 35 g of Resin (2R-3) described in Comparative Example E-2 in place of 35 g of Resin (A-2) used in Example 4-2.

COMPARATIVE EXAMPLE F-4

An electrophotographic light-sensitive material was prepared in the same manner as in Example 4-2, except for using 35 g of Resin (2R-4) described in Comparative Example F-2 in place of 35 g of Resin (A-2) used in Example 4-2.

COMPARATIVE EXAMPLE G-4

An electrophotographic light-sensitive material was prepared in the same manner as in Example 4-2, except for using 20.6 g of Resin (2R-3) and 14.4 g of Resin (2R-4) (weight ratio of Resin (2R-3)/Resin (2R- 4)=58.8/41.2) in place of 35 g of Resin (A-2) used in Example 4-2.

COMPARATIVE EXAMPLE H-4

An electrophotographic light-sensitive material was prepared in the same manner as in Example 4-2, except for using only 45 g of Resin (A-2) in place of 35 g of Resin (A-2) and 10 g of Resin ($B_3$-1) used in Example 4-2.

With each of the light-sensitive materials thus-prepared, the smoothness of photoconductive layer, electrostatic characteristics, image forming performance and water retentivity at the start of printing were evaluated in the same manner as in Example 4-1. Further, using dampening water each having a different pH value (i.e., pH 4.5, pH 7.0 and pH 9.5), influence on print was evaluated.

The results obtained are shown in Table w below.

TABLE w

| | | Example 4-2 | Comparative Example E-4 | Comparative Example F-4 | Comparative Example G-4 | Comparative Example H-4 |
|---|---|---|---|---|---|---|
| Smoothness of Photoconductive Layer (sec/cc) | | 365 | 355 | 350 | 360 | 350 |
| Electrostatic Characteristics | | | | | | |
| $V_{10}$(−V) | I | 780 | 770 | 750 | 750 | 565 |
| | II | 765 | 750 | 730 | 735 | 540 |
| D.R.R. (%) | I | 88 | 87 | 85 | 86 | 83 |
| | II | 84 | 84 | 82 | 82 | 73 |
| $E_{1/10}$ (lux · sec) | I | 11.2 | 11.5 | 11.8 | 11.7 | 12.8 |
| | II | 12.1 | 12.5 | 12.7 | 12.7 | 15.0 |
| Image Forming Performance | | | | | | |
| | I | ○ good | ○ good | ○ good | ○ good | ○ good |
| | II | ○ good | ○ good | ○ good | ○ good | × low density, occurrence of background fog, occurrence of cutting of fine lines and letters |
| Water Retentivity at the Start of Printing | | | | | | |
| I Molton Type | | ○ good | ○ good | ○~Δ occurrence of very slight background stain | ○ good | ○ good |
| II Syn-Flow Type | | ○ good | × occurrence of severe background stain | Δ~○ occurrence of slight background stain | × occurrence of severe background stain | ○ good |
| Dependency on[6] Dampening Water | | | | | | |
| I | | 10,000 prints | severe background stain at the start of printing | background stain at the start of printing | severe background stain at the start of printing | severe background stain from the start of printing, occurrence of cutting of fine lines and letters |
| II | | 10,000 prints | severe background stain at the start of printing | background stain at the start of | background stain at the start | severe background stain from the start of printing, |

TABLE w-continued

| | Example 4-2 | Comparative Example E-4 | Comparative Example F-4 | Comparative Example G-4 | Comparative Example H-4 |
|---|---|---|---|---|---|
| | | | printing | of printing | occurrence of cutting of fine lines and letters |
| III | 10,000 prints | 2,000 prints | 3,000 prints | 2,000 prints | severe background stain from the start of printing, occurrence of cutting of fine lines and letters |

6) Dependency on Dampening Water

The production of printing plate and printing were conducted in the same manner as described in the item 5) above, except for using the solution shown below as dampening water at the printing.

I: an aqueous solution (pH: 4.5) prepared by diluting 100-folds dampening water for PS plate (EU-3 manufactured by Fuji Photo Film Co., Ltd.) with distilled water.

II: an aqueous solution (pH: 7.0) prepared by diluting 130-folds dampening water for PS plate (SG-23 manufactured by Tokyo Ink K.K.) with distilled water.

III: an aqueous solution (pH: 9.5) prepared by diluting 200-folds dampening water for PS plate (Alky A manufactured by Toyo Ink Mfg. Co., Ltd.) with distilled water.

As shown above, the smoothness of photoconductive layer of each light-sensitive material was good. Example 4-2 and Comparative Examples E-4 to G-4 exhibited good electrostatic characteristics and image forming performance regardless of ambient condition. However, with Comparative Example H-4 wherein the resin ($B_3$) was not used, the electrostatic characteristics were decreased and the occurrence of background fog and degradation of image (i.e., decrease in density, cutting of fine lines and letters, etc.) were observed on the image forming performance under the severe condition of high temperature and high humidity.

With respect to the water retentivity at the start of printing, the plate according to the present invention was good, although the water retentivity of the plates of Comparative Examples E-4 to G-4 was poor in a case of using a printing machine of syn-flow type. The reason for poor water retentivity obtained in Comparative Example F-4 by the syn-flow type printing machine is presumed that although the $PO3H_2$ group formed in Resin (2R-4) upon the oil-desensitizing treatment acted for keeping sufficient amount of water retained in the layer, the wettability of the surface of the layer with water was insufficient at the printing since the hydrophilic group was bonded to the polymer main chain through a hydrophobic linking group.

As a result of the evaluation on printing durability using three kinds of dampening water, the plate according to the present invention provided 10,000 prints of good quality irrespective of the kind of dampening water. On the contrary, the plates of Comparative Examples E-4 to G-4 exhibited good results only when Dampening Water III was used, and in case of using other dampening water, background stain due to adhesion of ink occurred at the start of printing while the degree thereof was different from each other and the background stain could not be removed by conducting further printing. The plate of Comparative Example H-4 could not provide prints of satisfactory image quality from the start of printing since the performance of printing plate precursor was poor due to poor image quality and background fog at the plate making.

It is believed that the large influence of pH of dampening water is related to a dissociation constant of the hydrophilic group formed. More specifically, with Comparative Example E-4 wherein the influence of pH is dominative, the COOH group formed in Resin (2R-3) is present as a dissociated form of $COO^-$ and has good compatibility with water under a high pH condition, but the amount of dissociated group decreases under a low pH condition, resulting in reduction of the water compatibility. It has been found that the water retentivity is widely varied depending on the kind of dampening water when a hydrophilic group having a small value of dissociation constant (pKa) is not formed simultaneously.

Since the printing plate according to the present invention is capable of conducting printing using dampening water for PS plate in a large size printing machine as described above, it can be easily used in common with other printing plates without cleaning and inspection of the printing machine.

EXAMPLES 4-3 TO 4-13

Each electrophotographic light-sensitive material was prepared in the same manner as described in Example 4-1, except for using 32 g of each of the resins (A) and 8 g of each of the resins ($B_3$) shown in Table x below in place of 32 g of Resin (A-1) and 8 g of Resin ($B_3$-26) used in Example 4-1.

TABLE x

| Example | Resin (A) | Resin ($B_3$) |
|---|---|---|
| 4-3 | A-3 | $B_3$-2 |
| 4-4 | A-4 | $B_3$-4 |
| 4-5 | A-5 | $B_3$-5 |
| 4-6 | A-6 | $B_3$-9 |
| 4-7 | A-7 | $B_3$-17 |
| 4-8 | A-8 | $B_3$-19 |
| 4-9 | A-9 | $B_3$-21 |
| 4-10 | A-10 | $B_3$-23 |
| 4-11 | A-11 | $B_3$-24 |
| 4-12 | A-12 | $B_3$-25 |
| 4-13 | A-13 | $B_3$-28 |

With each of the light-sensitive materials thus prepared, various characteristics were evaluated in the same manner as in Example 4-1. Each of the light-sensitive materials exhibited good electrostatic characteristics and image forming performance similar to those obtained in the light-sensitive material of Example 4-1, even when the ambient condition was varied. When they were used as printing plates, they exhibited good water retentivity at the start of printing on both printing machines of molton type and syn-flow type and the printing durability thereof was more than 10,000 prints.

EXAMPLES 4-14 TO 4-25

Each electrophotographic light-sensitive material was prepared in the same manner as described in Example 4-1, except for using each of the compounds shown in Table y below in place of Resin (A-1), Resin ($B_3$-26), Resin (2P-1) and phthalic anhydride and o-chlorophenol as crosslinking compounds used in Example 4-1. Resins (P-3) to (P-12) used are described in Examples 1-14 to 1-25 respectively.

TABLE y

| Example | Resin (A) | Resin ($B_3$) | Resin (P) | Crosslinking Compound |
|---|---|---|---|---|
| 4-14 | (A-14) | ($B_3$-34) | (P-3) | $R'OOCNH(CH_2)_6NHCOOR'$<br>R': $-CH(COCH_3)-COOC_2H_5$<br>Dibutyltin dilaurate |
| 4-15 | (A-15) | ($B_3$-35) | (P-4) | Tetrabutoxy titanate |
| 4-16 | (A-16) | ($B_3$-33) | (P-5) | Gluconic acid |
| 4-17 | (A-17) | ($B_3$-32) | (P-6) | 3-Glycidoxy propyl trimethoxy silane |
| 4-18 | (A-18) | ($B_3$-12) | (P-7) | — |
| 4-19 | (A-19) | ($B_3$-18) | (P-8) | Propylene glycol<br>Tetrabutoxy titanate |
| 4-20 | (A-20) | ($B_3$-27) | (P-9) | N,N-Dimethylpropylamine |
| 4-21 | (A-21) | ($B_3$-28) | (P-10) | Divinyl adipate<br>Benzoyl peroxide |
| 4-22 | (A-22) | ($B_3$-30) | — | — |
| 4-23 | (A-16) | ($B_3$-15) | (P-11) | Phthalic anhydride<br>o-Chlorophenol |
| 4-24 | (A-23) | ($B_3$-12) | (P-12) | Allyl methacrylate<br>Benzoyl peroxide |
| 4-25 | (A-24) | ($B_3$-30) | — | 3-Aminopropyl trimethoxy silane |

With each of the light-sensitive materials thus prepared, various characteristics were evaluated in the same manner as in Example 4-1. Each of the light-sensitive materials exhibited good electrostatic characteristics and image forming performance similar to those obtained in the light-sensitive material of Example 4-1, even when the ambient condition was varied. When they were used as printing plates, they exhibited good water retentivity at the start of printing on both printing machines of molton type and syn-flow type and the printing durability thereof was more than 10,000 prints.

EXAMPLE 4-26

A mixture of 1 g of X-form metal-free phthalocyanine (manufactured by Dainippon Ink and Chemicals, Inc.), 8 g of Resin (A-25), 2 g of Resin ($B_3$-17), 0.3 g of Resin (2P-1) and 80 g of tetrahydrofuran was put in a 500 ml-volume glass container together with glass beads and dispersed in a paint shaker (manufactured by Toyo Seiki Seisakusho Co.) for 60 minutes. To the dispersion was added 0.3 g of ethylene glycol diglycidyl ether, followed by further dispersing for 2 minutes. The glass beads were separated by filtration to prepare a dispersion for a light-sensitive layer.

The dispersion was coated on base paper for a paper master having a thickness of 0.2 mm, which had been subjected to electrically conductive treatment and solvent-resistant treatment, by a wire bar, set to touch, heated in a circulating oven at 110° C. for 20 seconds, and then further heated at 140° C. for 1 hour to form a light-sensitive layer having a thickness of 8 μm.

The resulting light-sensitive material was subjected to the evaluations of electrostatic characteristics and image forming performance in the same manner as described in Example 4-1, and good results shown in Table z below were obtained.

TABLE z

| Electrostatic Characteristics | Ambient Condition 20° C., 65% RH | Ambient Condition 30° C., 80% RH |
|---|---|---|
| $V_{10}$ (−V) | 550 | 540 |
| D.R.R. (%) | 85 | 83 |
| $E_{1/10}$ (erg/cm$^2$) | 30 | 28 |
| Image Forming Performance | ○ good | ○ good |

Of the evaluations, the D.R.R., $E_{1/10}$ and image forming performance were conducted according to the following methods.

D.R.R. and $E_{1/10}$

The light-sensitive material was charged with a corona discharge to a voltage of −6 kV for 20 seconds in a dark room at a temperature of 20° C. and 65% RH using a paper analyzer ("Paper Analyzer SP-428" manufactured by Kawaguchi Denki K.K.). Ten seconds after the corona discharge, the surface potential $V_{10}$ was measured. The sample was then allowed to stand in the dark for an additional 90 seconds, and the potential $V_{100}$ was measured. The dark charge retention rate, i.e., percent retention of potential after dark decay for 90 seconds, was calculated from the following equation:

$$DRR\ (\%)=(V_{100}/V_{10})\times 100$$

Separately, the surface of photoconductive layer was charged to −500 V with a corona discharge and then exposed to monochromatic light of 780 nm, and the time required for decay of the surface potential $V_{10}$ to one-tenth was measured, and the exposure amount $E_{1/10}$ (erg/cm$^2$) was calculated therefrom.

This is denoted as Condition (I).

Further, the same procedure was conducted under the ambient condition of 30° C. and 80% RH. This is denoted as Condition (II).

Image Forming Performance

After the light-sensitive material was allowed to stand for a whole day and night under the condition of 20° C. and 65% RH, the light-sensitive material was charged to −6 kV and exposed to light emitted from a gallium-aluminum-arsenic semi-conductor laser (oscillation wavelength: 780 nm; output: 2.8 mW) at an exposure amount of 64 erg/cm$^2$ (on the surface of the photoconductive layer) at a pitch of 25 μm and a scanning speed of 300 m/sec. The thus formed electrostatic latent image was developed with Liquid Developer LD-2 prepared by dispersing 5 g of polymethyl methacrylate particles having a particle size of 0.3 μm in 1 l of Isopar H (manufactured by Esso Standard Co.), and adding 0.01 g of soybean oil lecithin thereto as a charge control agent, washed with a rinse solution of isoparaffinic solvent Isopar G (manufactured by Esso Chemical K.K.) and fixed. The duplicated image thus obtained was visually evaluated for fog and image quality.

This is denoted as Condition (I).

Further, the same procedure was conducted under the ambient condition of 30° C. and 80% RH. This is denoted as Condition (II).

Further, the light-sensitive material was subjected to the plate making in the same manner as described above and then the oil desensitizing treatment and printing were conducted under the same conditions as described in Example 4-1.

As a result, it was found that both of the water retentivities (I) and (II) at the start of printing were good. With respect to the printing durability, more than 10,000 prints of cleat prints were obtained.

EXAMPLE 4 - 27

An electrophotographic light-sensitive material was prepared in the same manner as described in Example 4-26 except that 10.3 g of Resin (A-26) was used alone in place of 8 g of Resin (A-25), 2 g of Resin ($B_3$-17), 0.3 g of Resin (2P-1 ), and 0.3 g of ethylene glycol diglycidyl ether used in Example 4-26. Further, the crosslinking of layer was conducted in the method described below in place of the heating at 140° C. for 1 hour.

Curing Method

The light-sensitive material was irradiated with light from a super high-pressure mercury lamp of 2 Kw as a light source at a distance of 50 cm for 1.5 minutes.

The electrostatic characteristics and printing properties of the light-sensitive material thus obtained were evaluated in the same manner as described in Example 4-26. The good results similar to those obtained with respect to the light-sensitive material of Example 4-26 were obtained.

EXAMPLES 4-28 TO 4-30

Each electrophotographic light-sensitive material was prepared in the same manner as in Example 4-1, except for using 32 g of each of the resins (A) and 8 g of each of the resins ($B_3$) shown in Table $A_1$ below in place of 32 g of Resin (A-1) and 8 g of Resin ($B_3$-26) used in Example 4-1.

TABLE $A_1$

| Example | Resin (A) | Resin ($B_3$) |
|---|---|---|
| 4-28 | A-27 | $B_3$-3 |
| 4-29 | A-28 | $B_3$-10 |
| 4-30 | A-29 | $B_3$-16 |

With each of the light-sensitive materials thus prepared, the electrostatic characteristics and printing properties were evaluated in the same manner as in Example 4-1. The good results similar to those of the light-sensitive material in Example 4-1 were obtained.

EXAMPLE 4-31

A mixture of 40 g (solid basis) of Resin (A-30), 10 g (solid basis) of Resin ($B_3$-30), 200 g of photoconductive zinc oxide, 0.018 g of Cyanine Dye (I-2) described in Example 2-31, 0.20 g of phthalic anhydride and 300 g of toluene was dispersed by a homogenizer (manufactured by Nippon Seiki K.K.) at a rotation of $6\times10^3$ r.p.m. for 10 minutes. To the dispersion was added 2.5 g of the crosslinking compound described in Example 2-31, and the mixture was dispersed by a homogenizer at a rotation of $1\times10^3$ r.p.m. for 1 minute to prepare a coating composition for a light-sensitive layer. The coating composition was coated on paper, which had been subjected to electrically conductive treatment, by a wire bar at a dry coverage of 22 g/m$^2$, followed by drying at 110° C. for 10 seconds and allowed to stand in a dark place at 50° C. and 80% RH for 1 week. Then the coated material was allowed to stand in a dark place at 20° C. and 65% RH for 24 hours to prepare an electrophotographic light-sensitive material.

COMPARATIVE EXAMPLE I-4

An electrophotographic light-sensitive material was prepared in the same manner as described in Example 4-31 except that 50 g of Resin (A-30) was used alone in place of 40 g of Resin (A-30) and 10 g of Resin ($B_3$-30) used in Example 4-31.

With each of the light-sensitive materials thus prepared, the electrostatic characteristics and image forming performance were evaluated in the same manner as in Example 4-26, and other characteristic items were evaluated in the same manner as in Example 4-1.

TABLE $B_1$

| | | Example 4-31 | Comparative Example I-4 |
|---|---|---|---|
| Smoothness of Photoconductive Layer (sec/cc) | | 300 | 285 |
| Electrostatic Characteristics | | | |
| $V_{10}$(−V) | I (20° C., 65% RH) | 680 | 545 |
| | II (30° C., 80% RH) | 665 | 500 |
| D.R.R. (%) | I | 84 | 78 |
| | II | 79 | 50 |
| $E_{1/10}$ (erg/cm$^2$) | I | 38 | 85 |
| | II | 45 | 120 |
| Image Forming Performance | I | ○ good | ○ good |
| | II | ○ good | x low density, cutting of fine lines and letters, severe fog |
| Water Retentivity at the Start of Printing | | | |
| I Molton Type | | ○ good | ○ good |
| II Syn-Flow Type | | ○ good | ○ good |
| Printing Durability | | 10,000 prints | severe background stain from the start of printing |

As shown above, the smoothness of photoconductive layer was good with each light-sensitive material.

The electrostatic characteristics of the light-sensitive material according to the present invention were good not only at normal temperature and normal humidity but also at high temperature and high humidity. On the contrary, with the light-sensitive material of Comparative Example I-4, D.R.R. and $E_{1/10}$ were low even at normal temperature and normal humidity and they further degraded at high temperature and high humidity. With respect to image forming performance, the material according to the present invention provided good duplicated images irrespective of the ambient condition. On the contrary, with the material of Comparative Example I-4, although duplicated images formed at normal temperature and normal humidity were practically usable, duplicated images formed at high temperature and high humidity could not be used in practice because of occurrence of severe background stain and degradation of image (e.g., decrease in density, cutting of fine lines and letters).

Further, as a result of printing using the printing plates prepared therefrom, the printing plate according to the present invention provided 10,000 good prints from the start of printing irrespective of the kind of printing machine. The printing plate of Comparative Example I-4 prepared under Condition II provided prints of poor image from the start of printing.

EXAMPLES 4-32 TO 4-43

Each light-sensitive material was prepared in the same manner as in Example 4-31, except for using g of each of the resins ($B_3$) shown in Table $C_1$ below in place of 10 g of Resin ($B_3$-30) used in Example 4-31.

TABLE $C_1$

| Example | Resin ($B_3$) |
|---|---|
| 4-32 | $B_3$-19 |
| 4-33 | $B_3$-21 |
| 4-34 | $B_3$-25 |
| 4-35 | $B_3$-4 |
| 4-36 | $B_3$-9 |
| 4-37 | $B_3$-14 |
| 4-38 | $B_3$-15 |
| 4-39 | $B_3$-13 |
| 4-40 | $B_3$-16 |
| 4-41 | $B_3$-31 |
| 4-42 | $B_3$-27 |
| 4-43 | $B_3$-10 |

With each of the light-sensitive materials thus prepared, the various characteristics were evaluated in the same manner as in Example 4-31. The good results similar to those of Example 4-31 were obtained.

EXAMPLES 4-44 TO 4-55

An offset printing plate was prepared by subjecting some of the light-sensitive materials used in Examples described above to electrophotographic processings for forming a toner image, followed by the oil-desensitizing treatment described below. Specifically, to 0.2 mol of each of the nucleophilic compounds shown in Table $D_1$ below, 100 g of each of the organic solvents shown in Table $D_1$ below, and 2 g of Newcol $B_4$SN (manufactured by Nippon Nyukazai K.K.) was added distilled water to make 1 l, and the solution was adjusted to a pH of 13.5. Each light-sensitive material was immersed in the resulting treating solution at a temperature of 35° C. for 3 minutes to conduct the oil-desensitizing treatment.

Printing was carried out using the resulting printing plate under the same conditions as in the respective basis Example. Each plate exhibited good characteristics similar to those of the respective basis Example.

EXAMPLE 5-1

A mixture of 32 g of Resin (A-1), 8 g of Resin ($B_4$-2), 200 g of photoconductive zinc oxide, 0.02 g of uranine, 0.04 g of Rose Bengal, 0.03 g of bromophenol blue, 0.15 g of salicylic acid and 300 g of toluene was dispersed by a homogenizer (manufactured by Nippon Seiki K.K.) at a rotation of $7\times10^3$ r.p.m. for 5 minutes. To the dispersion were added 5 g of Resin (2P-1) described in Example 2-1, 0.2 g of phthalic anhydride and 0.02 g of o-chlorophenol, and the mixture was dispersed by a homogenizer at a rotation of $1\times10^3$ r.p.m. for 1 minute. The resulting coating composition for a light-sensitive layer was coated on paper, which had been subjected to electrically conductive treatment, by a wire bar at a dry coverage of 25 g/m$^2$, dried at 100° C. for 30 seconds and then heating at 140° C. for 1 hour. The coated material was then allowed to stand in a dark place at 20° C. and 65% RH for 24 hours to prepare an electrophotographic light-sensitive material.

COMPARATIVE EXAMPLE A-5

An electrophotographic light-sensitive material was prepared in the same manner as in Example 5-1, except for using 32 g of Resin (R-1) described in Comparative Example A-1 in place of 32 g of Resin (A-1) used in Example 5-1.

COMPARATIVE EXAMPLE B-5

An electrophotographic light-sensitive material was prepared in the same manner as in Example 5-1, except for using 32 g of Resin (5R-2) having the structure shown below in place of 32 g of Resin (A-1) used in Example 5-1.

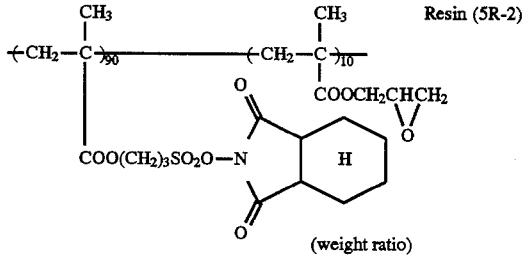

Weight average molecular weight: $3.5\times10^4$

COMPARATIVE EXAMPLE C-5

An electrophotographic light-sensitive material was prepared in the same manner as in Example 5-1, except for

TABLE $D_1$

| Example | Basis Example of Light-sensitive Material | Nucleophilic Compound | Organic Solvent |
|---|---|---|---|
| 4-44 | Example 4-6 | Sodium sulfite | Benzyl alcohol |
| 4-45 | Example 4-8 | Monoethanolamine | N-Methylpyrrolidone |
| 4-46 | Example 4-2 | Diethanolamine | Methyl ethyl ketone |
| 4-47 | Example 4-5 | Thiomalic acid | Ethylene glycol |
| 4-48 | Example 4-11 | Thiosalicylic acid | N,N-Dimethylacetamide |
| 4-49 | Example 4-9 | Taurine | Isopropyl alcohol |
| 4-50 | Example 4-13 | 4-Sulfobenzenesulfinic acid | Sulfolane |
| 4-51 | Example 4-5 | Thioglycolic acid | Pyrrolidone |
| 4-52 | Example 4-10 | 2-Mercaptoethylphosphonic acid | Dioxane |
| 4-53 | Example 4-30 | Serine | N,N-Dimethylamino ethanol |
| 4-54 | Example 4-12 | Sodium thiosulfate | N-Methylacetamide |
| 4-55 | Example 4-29 | Ammonium sulfite | Tetrahydrofuran |

using 23 g of Resin (R-1) and 9 g of Resin (5R-2) (weight ratio of Resin (R-1)/Resin (5R-2)=72/28) in place of 32 g of Resin (A-1) used in Example 5-1.

COMPARATIVE EXAMPLE D-5

An electrophotographic light-sensitive material was prepared in the same manner as in Example 5-1, except for using only 40 g of Resin (A-1) in place of 32 g of Resin (A-1) and 8 g of Resin ($B_4$-2) used in Example 5-1.

With each of the light-sensitive material thus prepared, various characteristics shown in Table $E_1$ below were evaluated.

retention ratio (D.R.R. (%)) represented by $(V_{70}/V_{10})\times100$ (%). Moreover, the surface of the photoconductive layer was charged to −400 V by corona discharge, then irradiated by visible light of the illuminance of 2.0 lux and the time required for decay of the surface potential $V_{10}$ to 1/10 was measured, and the exposure amount $E_{1/10}$ (lux·sec) was calculated therefrom.

Further, the same procedure was conducted under the ambient condition of 30° C. and 80% RH. The ambient condition of 20° C. and 65% RH is denoted as I and that of 30° C. and 80% RH is denoted as II.

3) Image Forming Performance

TABLE $E_1$

| | | Example 5-1 | Comparative Example A-5 | Comparative Example B-5 | Comparative Example C-5 | Comparative Example D-5 |
|---|---|---|---|---|---|---|
| Smoothness of Photo-[1] conductive Layer (sec/cc) | | 200 | 210 | 190 | 205 | 215 |
| Electrostatic[2] Characteristics | | | | | | |
| $V_{10}$(−V) | I | 705 | 650 | 680 | 645 | 550 |
| | II | 685 | 630 | 660 | 620 | 520 |
| D.R.R. (%) | I | 87 | 85 | 87 | 84 | 80 |
| | II | 84 | 82 | 83 | 81 | 74 |
| $E_{1/10}$ (lux · sec) | I | 12.3 | 14.2 | 12.9 | 14.0 | 14.2 |
| | II | 13.1 | 15.0 | 13.5 | 14.8 | 15.3 |
| Image Forming[3] Performance | I | ○ good | ○ good | ○ good | ○ good | ○ good |
| | II | ○ good | Δ~○ occurrence of slight cutting of fine lines | ○ good | Δ~○ occurrence of slight cutting of fine lines | x low density, occurrence of unevenness of fine lines, occurrence of background fog |
| Water Retentivity at[4] the Start of Printing | | | | | | |
| I Molton Type | | ○ good | ○ good | Δ occurrence of background stain | Δ occurrence of background stain | ○ good |
| II Syn-Flow Type | | ○ good | x occurrence of severe background stain | x~Δ occurrence of background stain | x occurrence of background stain | ○ good |
| Printing Durability[5] | | 10,000 prints | 2,000 prints | 4,000 prints | 3,000 prints | occurrence of background stain from the start of printing |

The characteristic items described in Table $E_1$ were evaluated as follows:

1) Smoothness of Photoconductive Layer

The resulting light-sensitive material was subjected to measurement of its smoothness (sec/cc) under an air volume condition of 1 cc using a Beck smoothness test machine (manufactured by Kumagaya Riko KK).

2) Electrostatic Characteristics

The light-sensitive material was subjected to corona discharge at a voltage of −6 kV for 20 seconds in a dark room at 20° C. and 65% RH using a paper analyzer (Paper Analyzer SP-428 manufactured by Kawaguchi Denki KK) and after allowed to stand for 10 seconds, the surface potential $V_{10}$ was measured. Then, the sample was further allowed to stand in the dark room for 60 seconds to measure the surface potential V70, thus obtaining the retention of potential after the dark decay for 60 seconds, i.e., dark decay The light-sensitive material and a full-automatic plate making machine ELP-404V (manufactured by Fuji Photo Film Co., Ltd.) were allowed to stand for a whole day and night under condition of normal temperature and normal humidity (20° C. and 65% RH) (I), and a duplicated image was formed by plate making using the material and machine. The duplicated image formed on the printing plate precursor was subjected to visual evaluation of the fog and image quality. For the plate making Liquid Developer LD-5 described below was employed. Further, the same procedure was conducted under high temperature and high humidity condition (30° C. and 80% RH) (II), followed by evaluating the resulting image.

Preparation of Liquid Developer LD-5

(1) Synthesis of Toner Particles:

A mixed solution of 60 g of methyl methacrylate, 40 g of methyl acrylate, 20 g of the dispersion polymer described in Example 2-1, and 680 g of Isopar H was heated to 65° C. under nitrogen gas stream with stirring. To the solution was added 1.2 g of 2,2'-azobis(isovaleronitrile) (AIVN), followed by allowing the mixture to react for 2 hours. To the reaction mixture was further added 0.5 g of AIVN, and the reaction was continued for 2 hours. To the reaction mixture was further added 0.5 g of AIVN, and the reaction was continued for 2 hours. The temperature was raised up to 90° C., and the mixture was stirred under reduced pressure of 30 mm Hg for 1 hour to remove any unreacted monomers. After cooling to room temperature, the reaction mixture was filtered through a nylon cloth of 200 mesh to obtain a white dispersion. The reaction rate of the monomers was 95% by weight, and the resulting dispersion had an average grain diameter of resin grain of 0.25 μm (grain diameter being measured by CAPA-500 manufactured by Horiba, Ltd.) and good monodispersity.

(2) Preparation of Colored Particles:

Ten grams of a tetradecyl methacrylate/methacrylic acid copolymer (95/5 ratio by weight), 10 g of nigrosine, and 30 g of Isopar G were put in a paint shaker (manufactured by Toyo Seiki Seisakusho KK) together with glass beads and dispersed for 4 hours to prepare a fine dispersion of nigrosine.

(3) Preparation of Liquid Developer:

A mixture of 45 g of the above-described toner particle dispersion, 25 g of the above-described nigrosine dispersion, 0.06 g of a hexadecene/maleic acid mono-octadecylamide copolymer, and 15 g of FOC 1800 was diluted with 1 l of Isopar G to prepare a liquid developer for electrophotography.

4) Water Retentivity at the Start of Printing

The light-sensitive material (without plate making, i.e., a raw plate) was immersed in Oil-Desensitizing Solution E-5 having the composition shown below at 40° C. for 3 minutes.

Oil-Desensitizing Solution E-5

Monoethanolamine 60 g

Neosoap 8 g (manufactured by Matsumoto Yushi KK)

Benzyl alcohol 100 g

These components were dissolved in distilled water to make a total volume of 1.0 liter, and a pH thereof was adjusted with potassium hydroxide to 13.5.

Then, the resulting plate was subjected to printing using a printing machine and Dampening Water F-5 each described below, and a 50th print from the start of printing was visually evaluated on background stain thereof.

Dampening Water F-5

Aqueous solution made by diluting 200-folds dampening water for PS plate (Alky A manufactured by Toyo Ink Mfg. Co., Ltd.) with distilled water (pH: 9.5)

Water Retentivity at the Start of Printing I

Ryobi 3200 CD manufactured by Ryobi Ltd. was used as a printing machine of molton type.

Water Retentivity at the Start of Printing II

Ryobi 3200 MCD manufactured by Ryobi Ltd. was used as a printing machine of syn-flow type.

5) Printing Durability

The light-sensitive material was subjected to plate making under the same-conditions as in the above described item 3), immersed in Oil-Desensitizing Solution E-5 described in the item 4) above for 3 minutes. The resulting printing plate was subjected to printing using Dampening Water F-5 described in the item 4) above as dampening water, neutral paper as printing paper and a printing machine of large size capable of printing paper of Kikuzen-size (1003×800 mm) (Oliver 94 manufactured by Sakurai Seisakusho K.K.) as a printing machine. A number of prints having clear images which could be obtained without the occurrence of background stain was determined in a case wherein a printing pressure on an offset printing machine was increased.

As shown in Table $E_1$, each of the light-sensitive materials had good smoothness of photoconductive layer. The electrostatic characteristics under the condition of normal temperature and normal humidity were in a range of practically no problem although they were somewhat low in Comparative Example D-5 wherein the resin ($B_4$) was not used. However, under the severe condition of high temperature and high humidity, the electrostatic characteristics (particularly, D.R.R. and $E_{1/10}$ ) of Comparative Example D-5 were remarkably decreased. On the contrary, with other light-sensitive materials, the change of the electrostatic characteristics was controlled small and they were maintained in a range of practical use. With respect to the image forming performance, the occurrence of background fog in non-image areas and degradation of image quality (i.e., decrease in density, cutting of fine lines and letters, etc.) were observed under the high temperature and high humidity condition. Other light-sensitive materials provided good duplicated images.

Concerning the water retentivity at the start of printing, the printing plates according to Example 5-1 and Comparative Example D-5 provided excellent water retentivity and adhesion of ink to the non-image area thereof was not observed at all irrespective of the type of printing machine. On the contrary, a plate according to Comparative Example A-5 wherein only carboxy group had been formed exhibited a large difference in the occurrence of background stain on print at the start of printing depending on a system of supplying damping water and ink. Specifically, in a case of using a printing machine of syn-flow type in which the supply of dampening water is less sufficient than in a printing machine of molton type, adhesion of ink occurred in the non-image area on print and the formation of background stain was observed at the start of printing. It is presumed in the plate of Comparative Example A-5 that although the surface of the photoconductive layer thereof which had been rendered hydrophilic had sufficiently good wettability with water, a super-thin layer of water (weak boundary layer abbreviated as WBL hereinafter) which had been formed on the surface of the plate could not be maintained, since the amount of water which was held in the whole photoconductive layer (amount of water retained in the layer) was insufficient, when the balance of amount of dampening water supplied was lost at the start of printing.

On the other hand, with a plate according to Comparative Example B-5 wherein only sulfo group had been formed, adhesion of ink was restrained as compared with the plate of Comparative Example A-5 in a case of using a printing machine of syn-flow type. However, it is presumed that the formation of WBL was insufficient in a case of using a printing machine of molton type since the amount of water retained in the layer was large.

Further, with Comparative Example C-5 wherein the resins used in Comparative Examples A-5 and B-5 were mixed the faults of both resins could not be covered up and provided the same results as Comparative Example A-5.

As a result of the evaluation on printing durability using a printing machine of large size, more than 10,000 prints of clear image were obtained. With Comparative Example D-5 which exhibited good water retentivity ,at the start of printing in case of using the raw plate, the image on prints were poor from the start of printing when the plate formed by practical plate-making was employed. On the contrary, the printing durability in each of Comparative Examples A-5, B-5 and C-5 was around 2,000 prints to 4,000 prints. The reason for the low printing durability in Comparative Example A-5 is considered to be based on the fact that the formation of WBL on the surface of the plate or the amount of water retained in the layer became poor with the progress of printing. Also, in case of Comparative Examples B-5 and C-5, it is presumed that a film strength of the layer was insufficient and the layer was broken, resulting in the low printing durability because of the large amount of water retained in the layer formed from the resin having sulfo group and crosslinking structure.

From these results it can be seen that only the light-sensitive material according to the present invention produces a printing plate which can provide a large number of prints having good quality even when the ambient conditions at the image formation and conditions at the printing are fluctuated.

EXAMPLE 5-2

A mixture of 35 g of Resin (A-2), 10 g of Resin ($B_4$-1), 4 g of Resin (P-2) described in Example 1-2, 200 g of photoconductive zinc oxide, 0.02 g of uranine, 0.015 g of Dye (I) described in Example 1-2, 0.012 g of Dye (II) described in Example 1-2, 0.18 g of N-hydroxyphthalimide and 300 g of toluene was dispersed by a homogenizer (manufactured by Nippon Seiki K.K.) at a rotation of $7\times10^3$ r.p.m. for 5 minutes. To the dispersion were added 0.1 g of phthalic anhydride and 0.002 g of zirconium acetylacetone, and the mixture was dispersed by a homogenizer at a rotation of $1\times10^3$ r.p.m. for 1 minute. The resulting coating composition for a light-sensitive layer was coated on paper, which had been subjected to electrically conductive treatment, by a wire bar at a dry coverage of 25 g/m$^2$, followed by drying at 100° C. for 30 seconds and then heating at 140° C. for 1 hour. The coated material was allowed to stand in a dark place at 20° C. and 65% RH for 24 hours to prepare an electrophotographic light-sensitive material.

COMPARATIVE EXAMPLE E-5

An electrophotographic light-sensitive material was prepared in the same manner as in Example 5-2, except for using 35 g of Resin (2R-3) described in Comparative Example E-2 in place of 35 g of Resin (A-2) used in Example 5-2.

COMPARATIVE EXAMPLE F-5

An electrophotographic light-sensitive material was prepared in the same manner as in Example 5-2, except for using 35 g of Resin (2R-4) described in Comparative Example F-2 in place of 35 g of Resin (A-2) used in Example 5-2.

COMPARATIVE EXAMPLE G-5

An electrophotographic light-sensitive material was prepared in the same manner as in Example 5-2, except for using 20.6 g of Resin (2R-3) and 14.4 g of Resin (2R-4) (weight ratio of Resin (2R-3)/Resin (2R-4)=58.8/41.2) in place of 35 g of Resin (A-2) used in Example 5-2.

COMPARATIVE EXAMPLE H-5

An electrophotographic light-sensitive material was prepared in the same manner as in Example 5-2, except for using only 45 g of Resin (A-2) in place of 35 g of Resin (A-2) and 10 g of Resin ($B_4$-1) used in Example 5-2.

With each of the light-sensitive materials thus-prepared, the smoothness of photoconductive layer, electrostatic characteristics, image forming performance and water retentivity at the start of printing were evaluated in the same manner as in Example 5-1. Further, using dampening water each having a different pH value (i.e., pH 4.5, pH 7.0 and pH 9.5), influence on print was evaluated.

The results obtained are shown in Table $F_1$ below.

TABLE $F_1$

| | | Example 5-2 | Comparative Example E-5 | Comparative Example F-5 | Comparative Example G-5 | Comparative Example H-5 |
|---|---|---|---|---|---|---|
| Smoothness of Photoconductive Layer (sec/cc) | | 185 | 200 | 195 | 180 | 205 |
| Electrostatic Characteristics | | | | | | |
| $V_{10}$(−V) | I | 580 | 560 | 545 | 550 | 480 |
| | II | 565 | 540 | 520 | 520 | 450 |
| D.R.R. (%) | I | 88 | 85 | 80 | 82 | 75 |
| | II | 84 | 82 | 76 | 76 | 70 |
| $E_{1/10}$ (lux · sec) | I | 12.3 | 12.8 | 13.4 | 13.5 | 14.8 |
| | II | 13.1 | 13.7 | 14.2 | 14.5 | 16.0 |
| Image Forming Performance | I | ○ good | ○ good | Δ~○ occurrence of slight cutting of fine lines | ○ good | Δ occurrence of slight cutting of fine lines, low density |
| | II | ○ good | ○ good | Δ occurrence of cutting of fine lines, low density | Δ occurrence of slight cutting of fine lines | x low density, occurrence of background fog, occurrence of cutting of fine lines and letters |
| Water Retentivity at the Start of Printing | | | | | | |
| I Molton Type | | ○ good | ○ good | ○Δ occurrence of | ○ good | ○ good |

TABLE $F_1$-continued

| | Example 5-2 | Comparative Example E-5 | Comparative Example F-5 | Comparative Example G-5 | Comparative Example H-5 |
|---|---|---|---|---|---|
| II Syn-Flow Type | o good | x occurrence of severe background stain | very slight background stain Δ~o occurrence of slight background stain | x occurrence of severe background stain | o good |
| Dependency on[6] Dampening Water | | | | | |
| I | 10,000 prints | severe background stain at the start of printing | background stain at the start of printing | severe background stain at the start of printing | severe background stain from the start of printing, occurrence of cutting of fine lines and letters |
| II | 10,000 prints | severe background stain at the start of printing | background stain at the start of printing | background stain at the start of printing | severe background stain from the start of printing, occurrence of cutting of fine lines and letters |
| III | 10,000 prints | 2,000 prints | 3,000 prints | 2,000 prints | severe background stain from the start of printing, occurrence of cutting of fine lines and letters |

6) Dependency on Dampening Water

The production of printing plate and printing were conducted in the same manner as described in the item 5) above, except for using the solution shown below as dampening water at the printing.

I: an aqueous solution (pH: 4.5) prepared by diluting 100-folds dampening water for PS plate (EU-3 manufactured by Fuji Photo Film Co., Ltd.) with distilled water.

II: an aqueous solution (pH: 7.0) prepared by diluting 130-folds dampening water for PS plate (SG-23 manufactured by Tokyo Ink K.K.) with distilled water.

III: an aqueous solution (pH: 9.5) prepared by diluting 200-folds dampening water for PS plate (Alky A manufactured by Toyo Ink Mfg. Co., Ltd.) with distilled water.

As shown above, the smoothness of photoconductive layer of each light-sensitive material was good. Example 5-2 and Comparative Examples E-5 to G-5 exhibited good electrostatic characteristics and image forming performance regardless of ambient condition. However, with Comparative Example H-5 wherein the resin ($B_4$) was not used, the electrostatic characteristics were decreased and the occurrence of background fog and degradation of image (i.e., decrease in density, cutting of fine lines and letters, etc.) were observed on the image forming performance under the severe condition of high temperature and high humidity.

With respect to the water retentivity at the start of printing, the plate according to the present invention was good, although the water retentivity of the plates of Comparative Examples E-5 to G-5 was poor in a case of using a printing machine of syn-flow type. The reason for poor water retentivity obtained in Comparative Example F-5 by the syn-flow type printing machine is presumed that although the $PO_3H_2$ group formed in Resin (2R-4) upon the oil-desensitizing treatment acted for keeping sufficient amount of water retained in the layer, the wettability of the surface of the layer with water was insufficient at the printing since the hydrophilic group was bonded to the polymer main chain through a hydrophobic linking group.

As a result of the evaluation on printing durability using three kinds of dampening water, the plate according to the present invention provided 10,000 prints of good quality irrespective of the kind of dampening water. On the contrary, the plates of Comparative Examples E-5 to G-5 exhibited good results only when Dampening Water III was used, and in case of using other dampening water, background stain due to adhesion of ink occurred at the start of printing while the degree thereof was different from each other and the background stain could not be removed by conducting further printing. The plate of Comparative Example H-5 could not provide prints of satisfactory image quality from the start of printing since the performance of printing plate precursor was poor due to poor image quality and background fog at the plate making.

It is believed that the large influence of pH of dampening water is related to a dissociation constant of the hydrophilic group formed. More specifically, with Comparative Example E-5 wherein the influence of pH is dominative, the COOH group formed in Resin (2R-3) is present as a dissociated form of $COO^-$ and has good compatibility with water under a high pH condition, but the amount of dissociated group decreases under a low pH condition, resulting in reduction of the water compatibility. It has been found that the water retentivity is widely varied depending on the kind of dampening water when a hydrophilic group having a small value of dissociation constant (pKa) is not formed simultaneously.

Since the printing plate according to the present invention is capable of conducting printing using dampening water for PS plate in a large size printing machine as described above, it can be easily used in common with other printing plates without cleaning and inspection of the printing machine.

EXAMPLES 5-3 TO 5-13

Each electrophotographic light-sensitive material was prepared in the same manner as described in Example 5-1, except for using 32 g of each of the resins (A) and 8 g of each of the resins ($B_4$) shown in Table $G_1$ below in place of 32 g of Resin (A-1) and 8 g of Resin ($B_4$-2) used in Example 5-1.

TABLE $G_1$

| Example | Resin (A) | Resin ($B_4$) |
|---|---|---|
| 5-3 | A-3 | $B_4$-2 |
| 5-4 | A-4 | $B_4$-4 |
| 5-5 | A-5 | $B_4$-5 |
| 5-6 | A-6 | $B_4$-9 |
| 5-7 | A-7 | $B_4$-17 |
| 5-8 | A-8 | $B_4$-19 |
| 5-9 | A-9 | $B_4$-21 |
| 5-10 | A-10 | $B_4$-23 |
| 5-11 | A-11 | $B_4$-24 |
| 5-12 | A-12 | $B_4$-25 |
| 5-13 | A-13 | $B_4$-28 |

With each of the light-sensitive materials thus prepared, various characteristics were evaluated in the same manner as in Example 5-1. Each of the light-sensitive materials exhibited good electrostatic characteristics and image forming performance similar to those obtained in the light-sensitive material of Example 5-1, even when the ambient condition was varied. When they were used as printing plates, they exhibited good water retentivity at the start of printing on both printing machines of molton type and syn-flow type and the printing durability thereof was more than 10,000 prints.

EXAMPLES 5-14 TO 5-25

Each electrophotographic light-sensitive material was prepared in the same manner as described in Example 5-1, except for using each of the compounds shown in Table $H_1$ below in place of Resin (A-1), Resin ($B_4$-2), Resin (2P-1) and phthalic anhydride and o-chlorophenol as crosslinking compounds used in Example 5-1. Resins (P-3) to (P-12) used are described in Examples 1-14 to 1-25 respectively.

TABLE $H_1$

| Example | Resin (A) | Resin ($B_4$) | Resin (P) | Crosslinking Compound |
|---|---|---|---|---|
| 5-14 | (A-14) | ($B_4$-34) | (P-3) | R'OOCNH$(CH_2)_6$NHCOOR'<br>R': $-CH(COCH_3)-COOC_2H_5$<br>Dibutyltin dilaurate |
| 5-15 | (A-15) | ($B_4$-35) | (P-4) | Tetrabutoxy titanate |
| 5-16 | (A-16) | ($B_4$-33) | (P-5) | Gluconic acid |
| 5-17 | (A-17) | ($B_4$-32) | (P-6) | 3-Glycidoxy propyl trimethoxy silane |
| 5-18 | (A-18) | ($B_4$-26) | (P-7) | — |
| 5-19 | (A-19) | ($B_4$-18) | (P-8) | Propylene glycol<br>Tetrabutoxy titanate |
| 5-20 | (A-20) | ($B_4$-27) | (P-9) | N,N-Dimethylpropylamine |
| 5-21 | (A-21) | ($B_4$-28) | (P-10) | Divinyl adipate<br>Benzoyl peroxide |
| 5-22 | (A-22) | ($B_4$-30) | — | — |
| 5-23 | (A-16) | ($B_4$-15) | (P-11) | Phthalic anhydride<br>o-Chlorophenol |
| 5-24 | (A-23) | ($B_4$-12) | (P-12) | Allyl methacrylate<br>Benzoyl peroxide |
| 5-25 | (A-24) | ($B_4$-30) | — | 3-Aminopropyl trimethoxy silane |

With each of the light-sensitive materials thus prepared, various characteristics were evaluated in the same manner as in Example 5-1. Each of the light-sensitive materials exhibited good electrostatic characteristics and image forming performance similar to those obtained in the light-sensitive material of Example 5-1, even when the ambient condition was varied. When they were used as printing plates, they exhibited good water retentivity at the start of printing on both printing machines of molton type and syn-flow type and the printing durability thereof was more than 10,000 prints.

EXAMPLE 5-26

A mixture of 1 g of X-form metal-free phthalocyanine (manufactured by Dainippon Ink and Chemicals, Inc.), 8 g of Resin (A-25), 2 g of-Resin ($B_4$-16), 0.3 g of Resin (2P-1) and 80 g of tetrahydrofuran was put in a 500 ml-volume glass container together with glass beads and dispersed in a paint shaker (manufactured by Toyo Seiki Seisakusho Co.) for 60 minutes. To the dispersion was added 0.3 g of ethylene glycol diglycidyl ether, followed by further dispersing for 2 minutes. The glass beads were separated by filtration to prepare a dispersion for a light-sensitive layer.

The dispersion was coated on base paper for a paper master having a thickness of 0.2 mm, which had been subjected to electrically conductive treatment and solvent-resistant treatment, by a wire bar, set to touch, heated in a circulating oven at 110° C. for 20 seconds, and then further heated at 140° C. for 1 hour to form a light-sensitive layer having a thickness of 8 μm.

The resulting light-sensitive material was subjected to the evaluations of electrostatic characteristics and image forming performance in the same manner as described in Example 5-1, and good results shown below were obtained.

TABLE $I_1$

| | 20° C., 65% RH | 30° C., 80% RH |
|---|---|---|
| Electrostatic Characteristics | | |
| $V_{10}$(−V) | 580 | 570 |
| D.R.R. (%) | 86 | 84 |
| $E_{1/10}$ (erg/cm$^2$) | 33 | 30 |
| Image Forming Performance | ○<br>good | ○<br>good |

Of the evaluations, the D.R.R., $E_{1/10}$ and image forming performance were conducted according to the following methods.

D.R.R. and $E_{1/10}$

The light-sensitive material was charged with a corona discharge to a voltage of −6 kV for 20 seconds in a dark room at a temperature of 20° C. and 65% RH using a paper analyzer ("Paper Analyzer SP-428" manufactured by Kawaguchi Denki K.K.). Ten seconds after the corona discharge, the surface potential $V_{10}$ was measured. The sample was then allowed to stand in the dark for an additional 90 seconds, and the potential $V_{100}$ was measured. The dark charge retention rate, i.e., percent retention of potential after dark decay for 90 seconds, was calculated from the following equation:

$$DRR(\%)=(V_{100}/V_{10})\times 100$$

Separately, the surface of photoconductive layer was charged to −500 V with a corona discharge and then exposed to monochromatic light of 780 nm, and the time required for decay of the surface potential $V_{10}$ to one-tenth was measured, and the exposure amount $E_{1/100}$ (erg/cm$^2$) was calculated therefrom.

This is denoted as Condition (I).

Further, the same procedure was conducted under the ambient condition of 30° C. and 80% RH. This is denoted as Condition (II).

Image Forming Performance

After the light-sensitive material was allowed to stand for a whole day and night under the condition of 20° C. and 65% RH, the light-sensitive material was charged to −6 kV and exposed to light emitted from a gallium-aluminum-arsenic semi-conductor laser (oscillation wavelength: 780 nm; output: 2.8 mW) at an exposure amount of 64 erg/cm$^2$ (on the surface of the photoconductive layer) at a pitch of 25 μm and a scanning speed of 300 m/sec. The thus formed electrostatic latent image was developed with Liquid Developer LD-2 prepared by dispersing 5 g of polymethyl methacrylate particles having a particle size of 0.3 μm in 1 l of Isopar H (manufactured by Esso Standard Co.), and adding 0.01 g of soybean oil lecithin thereto as a charge control agent, washed with a rinse solution of isoparaffinic solvent Isopar G (manufactured by Esso Chemical K.K.) and fixed. The duplicated image thus obtained was visually evaluated for fog and image quality.

This is denoted as Condition (I).

Further, the same procedure was conducted under the ambient condition of 30° C. and 80% RH. This is denoted as Condition (II).

Further, the light-sensitive material was subjected to the plate making in the same manner as described above and then the oil desensitizing treatment and printing were conducted under the same conditions as described in Example 5-1.

As a result, it was found that both of the water retentivities (I) and (II) at the start of printing were good. With respect to the printing durability, more than 10,000 prints of cleat prints were obtained.

EXAMPLE 5-27

An electrophotographic light-sensitive material was prepared in the same manner as described in Example 5-26 except that 10.3 g of Resin (A-26) was used alone in place of 8 g of Resin (A-25), 2 g of Resin ($B_4$-16), 0.3 g of Resin (2P-1), and 0.3 g of ethylene glycol diglycidyl ether used in Example 5-26. Further, the crosslinking of layer was conducted in the method described below in place of the heating at 140° C. for 1 hour.

Curing Method

The light-sensitive material was irradiated with light from a super high-pressure mercury lamp of 2 Kw as a light source at a distance of 50 cm for 1.5 minutes.

The electrostatic characteristics and printing properties of the light-sensitive material thus obtained were evaluated in the same manner as described in Example 5-26. The good results similar to those obtained with respect to the light-sensitive material of Example 5-26 were obtained.

EXAMPLES 5-28 TO 5-30

Each electrophotographic light-sensitive material was prepared in the same manner as in Example 5-1, except for using 32 g of each of the resins (A) and 8 g of each of the resins ($B_4$) shown in Table $J_1$ below in place of 32 g of Resin (A-1) and 8 g of Resin ($B_4$-2) used in Example 5-1.

TABLE $J_1$

| Example | Resin (A) | Resin ($B_4$) |
|---|---|---|
| 5-28 | A-27 | $B_4$-3 |
| 5-29 | A-28 | $B_4$-10 |
| 5-30 | A-29 | $B_4$-16 |

With each of the light-sensitive materials thus prepared, the electrostatic characteristics and printing properties were evaluated in the same manner as in Example 5-1. The good results similar to those of the light-sensitive material in Example 5-1 were obtained.

EXAMPLE 5-31

A mixture of 40 g (solid basis) of Resin (A-30), 10 g (solid basis) of Resin ($B_4$-30), 200 g of photoconductive zinc oxide, 0.018 g of Cyanine Dye (I-2) described in Example 2-31, 0.20 g of phthalic anhydride and 300 g of toluene was dispersed by a homogenizer (manufactured by Nippon Seiki K.K.) at a rotation of $6\times10^3$ r.p.m. for 5 minutes. To the dispersion was added 2.5 g of the crosslinking compound described in Example 2-31, and the mixture was dispersed by a homogenizer at a rotation of $1\times10^3$ r.p.m. for 1 minute to prepare a coating composition for a light-sensitive layer. The coating composition was coated on paper, which had been subjected to electrically conductive treatment, by a wire bar at a dry coverage of 22 g/m$^2$, followed by drying at 110° C. for 10 seconds and allowed to stand in a dark place at 50° C. and 80% RH for 1 week. Then the coated material was allowed to stand in a dark place at 20° C. and 65% RH for 24 hours to prepare an electrophotographic light-sensitive material.

COMPARATIVE EXAMPLE I-5

An electrophotographic light-sensitive material was prepared in the same manner as described in Example 5-31 except that 50 g of Resin (A-30) was used alone in place of 40 g of Resin (A-30) and 10 g of Resin ($B_4$-30) used in Example 5-31.

With each of the light-sensitive materials thus prepared, the electrostatic characteristics and image forming performance were evaluated in the same manner as in Example 5-26, and other characteristic items were evaluated in the same manner as in Example 5-1.

TABLE $K_1$

| | | Example 5-31 | Comparative Example I-5 |
|---|---|---|---|
| Smoothness of Photoconductive Layer (sec/cc) | | 160 | 170 |
| Electrostatic Characteristics | | | |
| $V_{10}$(−V) | I (20° C., 65% RH) | 630 | 530 |
| | II (30° C., 80% RH) | 610 | 485 |
| D.R.R. (%) | I | 88 | 80 |
| | II | 84 | 74 |
| $E_{1/10}$ (erg/cm$^2$) | I | 33 | 85 |
| | II | 38 | 105 |
| Image Forming Performance | I | ○ good | Δ low density occurrence of scratch of fine lines |
| | II | ○ good | x low density, cutting of fine lines |

TABLE $K_1$-continued

| | Example 5-31 | Comparative Example I-5 |
|---|---|---|
| | | and letters, severe fog |
| Water Retentivity at the Start of Printing | | |
| I Molton Type | o good | o good |
| II Syn-Flow Type | o good | o good |
| Printing Durability | 10,000 prints | severe background stain from the start of printing |

As shown above, the smoothness of photoconductive layer was good with each light-sensitive material.

The electrostatic characteristics of the light-sensitive material according to the present invention were good not only at normal temperature and normal humidity but also at high temperature and high humidity. On the contrary, with the light-sensitive material of Comparative Example I-5, D.R.R. and $E_{1/10}$ were low even at normal temperature and normal humidity and they further degraded at high temperature and high humidity. With respect to image forming performance, the material according to the present invention provided good duplicated images irrespective of the ambient condition. On the contrary, with the material of Comparative Example I-5, although duplicated images formed at normal temperature and normal humidity were practically usable, duplicated images formed at high temperature and high humidity could not be used in practice because of occurrence of severe background stain and degradation of image (e.g., decrease in density, cutting of fine lines and letters).

Further, as a result of printing using the printing plates prepared therefrom, the printing plate according to the present invention provided 10,000 good prints from the start of printing irrespective of the kind of printing machine. The printing plate of Comparative Example I-5 prepared under Condition II provided prints of poor image from the start of printing.

EXAMPLES 5-32 TO 5-43

Each light-sensitive material was prepared in the same manner as in Example 5-31, except for using 10 g of each of the resins ($B_4$) shown in Table $L_1$ below in place of 10 g of Resin ($B_4$-30) used in Example 5-31.

TABLE $L_1$

| Example | Resin ($B_4$) |
|---|---|
| 5-32 | $B_4$-19 |
| 5-33 | $B_4$-21 |
| 5-34 | $B_4$-26 |
| 5-35 | $B_4$-15 |
| 5-36 | $B_4$-9 |
| 5-37 | $B_4$-14 |
| 5-38 | $B_4$-15 |
| 5-39 | $B_4$-35 |
| 5-40 | $B_4$-30 |
| 5-41 | $B_4$-31 |
| 5-42 | $B_4$-29 |
| 5-43 | $B_4$-10 |

With each of the light-sensitive materials thus prepared, the various characteristics were evaluated in the same manner as in Example 5-31. The good results similar to those of Example 5-31 were obtained.

EXAMPLES 5-44 TO 5-55

An offset printing plate was prepared by subjecting some of the light-sensitive materials used in Examples described above to electrophotographic processings for forming a toner image, followed by the oil-desensitizing treatment described below. Specifically, to 0.2 mol of each of the nucleophilic compounds shown in Table $M_1$ below, 100 g of each of the organic solvents shown in Table $M_1$ below, and 2 g of Newcol B4SN (manufactured by Nippon Nyukazai K.K.) was added distilled water to make 1 l, and the solution was adjusted to a pH of 13.5. Each light-sensitive material was immersed in the resulting treating solution at a temperature of 35° C. for 3 minutes to conduct the oil-desensitizing treatment.

Printing was carried out using the resulting printing plate under the same conditions as in the respective basis Example. Each plate exhibited good characteristics similar to those of the respective basis Example.

TABLE $M_1$

| Example | Basis Example of Light-sensitive Material | Nucleophilic Compound | Organic Solvent |
|---|---|---|---|
| 5-44 | Example 5-6 | Sodium sulfite | Tetrahydrofuran |
| 5-45 | Example 5-8 | Monoethanolamine | Pyrrolidone |
| 5-46 | Example 5-2 | Diethanolamine | Methyl ethyl ketone |
| 5-47 | Example 5-5 | Thiomalic acid | Ethylene glycol dimethyl ether |
| 5-48 | Example 5-11 | Thiosalicylic acid | Benzyl alcohol |
| 5-49 | Example 5-9 | Taurine | N-Methylpyrrolidone |
| 5-50 | Example 5-13 | 4-Sulfobenzenesulfinic acid | Sulfolane |
| 5-51 | Example 5-5 | Thioglycolic acid | N-Methylacetamide |
| 5-52 | Example 5-10 | 2-Mercaptoethylphosphonic acid | Dioxane |
| 5-53 | Example 5-30 | Serine | N,N-Dimethylamino ethanol |
| 5-54 | Example 5-12 | Sodium thiosulfate | N,N-Dimethylacetamide |
| 5-55 | Example 5-29 | Ammonium sulfite | N,N,N',N'-Tetramethylurea |

EXAMPLE 6-1

A mixture of 32 g of Resin (A-1), 8 g of Resin ($B_5$-3), 200 g of photoconductive zinc oxide, 0.02 g of uranine, 0.04 g of Rose Bengal, 0.03 g of bromophenol blue, 0.15 g of salicylic acid and 300 g of toluene was dispersed by a homogenizer (manufactured by Nippon Seiki K.K.) at a rotation of $7\times10^3$ r.p.m. for 5 minutes. To the dispersion were added 5 g of Resin (2P-1) described in Example 2-1, 0.2 g of phthalic anhydride and 0.02 g of o-chlorophenol, and the mixture was dispersed by a homogenizer at a rotation of $1\times10^3$ r.p.m. for 1 minute. The resulting coating composition for a light-sensitive layer was coated on paper, which had been subjected to electrically conductive treatment, by a wire bar at a dry coverage of 25 g/m$^2$, dried at 100° C. for 30 seconds and then heating at 140° C. for 1 hour. The coated material was then allowed to stand in a dark place at 20° C. and 65% RH for 24 hours to prepare an electrophotographic light-sensitive material.

COMPARATIVE EXAMPLE A-6

An electrophotographic light-sensitive material was prepared in the same manner as in Example 6-1, except for using 32 g of Resin (6R-1) having the structure shown below in place of 32 g of Resin (A-1) used in Example 6-1.

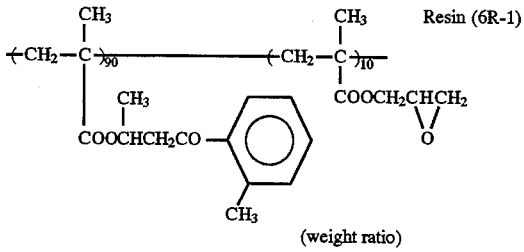

Weight average molecular weight: $4 \times 10^4$

COMPARATIVE EXAMPLE B-6

An electrophotographic light-sensitive material was prepared in the same manner as in Example 6-1, except for using 32 g of Resin (5R-2) described in Comparative Example B-5 in place of 32 g of Resin (A-1) used in Example 6-1.

COMPARATIVE EXAMPLE C-6

An electrophotographic light-sensitive material was prepared in the same manner as in Example 6-1, except for using 23 g of Resin (6R-1) and 9 g of Resin (5R-2) (weight ratio of Resin (6R-1)/Resin (5R-2)=72/28) in place of 32 g of Resin (A-1) used in Example 6-1.

COMPARATIVE EXAMPLE D-6

An electrophotographic light-sensitive material was prepared in the same manner as in Example 6-1, except for using only 40 g of Resin (A-1) in place of 32 g of Resin (A-1) and 8 g of Resin ($B_5$-3) used in Example 6-1.

With each of the light-sensitive material thus prepared, various characteristics shown in Table $N_1$ below were evaluated.

TABLE $N_1$

| | | Example 6-1 | Comparative Example A-6 | Comparative Example B-6 | Comparative Example C-6 | Comparative Example D-6 |
|---|---|---|---|---|---|---|
| Smoothness of Photo-[1] conductive Layer (sec/cc) | | 230 | 220 | 225 | 235 | 230 |
| Electrostatic[2] Characteristics | | | | | | |
| $V_{10}$(−V) | I | 685 | 690 | 670 | 675 | 570 |
| | II | 660 | 670 | 645 | 650 | 540 |
| D.R.R. (%) | I | 87 | 88 | 85 | 85 | 83 |
| | II | 84 | 85 | 81 | 81 | 75 |
| $E_{1/10}$ (lux · sec) | I | 13.1 | 12.8 | 13.6 | 13.7 | 14.9 |
| | II | 13.8 | 13.4 | 14.0 | 14.0 | 16.2 |
| Image Forming[3] Performance | I | ○ good | ○ good | ○ good | ○ good | ○ good |
| | II | ○ good | ○ good | ○ good | ○ good | x low density, occurrence of unevenness of fine lines, occurrence of background fog |
| Water Retentivity at[4] the Start of Printing | | | | | | |
| I Molton Type | | ○ good | ○ good | Δ occurrence of background stain | Δ occurrence of background stain | ○ good |
| II Syn-Flow Type | | ○ good | x occurrence of severe background stain | x~Δ occurrence of background stain | x occurrence of background stain | ○ good |
| Printing Durability[5] | | 10,000 prints | 2,000 prints | 4,000 prints | 3,000 prints | occurrence of background stain from the start of printing |

The characteristic items described in Table $N_1$ were evaluated as follows:

1) Smoothness of Photoconductive Layer

The resulting light-sensitive material was subjected to measurement of its smoothness (sec/cc) under an air volume condition of 1 cc using a Beck smoothness test machine (manufactured by Kumagaya Riko KK).

2) Electrostatic Characteristics

The light-sensitive material was subjected to corona discharge at a voltage of −6 kV for 20 seconds in a dark room at 20° C. and 65% RH using a paper analyzer (Paper Analyzer SP-428 manufactured by Kawaguchi Denki KK) and after allowed to stand for 10 seconds, the surface potential $V_{10}$ was measured. Then, the sample was further allowed to stand in the dark room for 60 seconds to measure the surface potential $V_{70}$, thus obtaining the retention of potential after the dark decay for 60 seconds, i.e., dark decay retention ratio (D.R.R. (%)) represented by $(V_{70}/V_{10})\times 100$ (%). Moreover, the surface of the photoconductive layer was charged to −400 V by corona discharge, then irradiated by visible light of the illuminance of 2.0 lux and the time required for decay of the surface potential $V_{10}$ to 1/10 was measured, and the exposure amount $E_{1/10}$ (lux·sec) was calculated therefrom.

Further, the same procedure was conducted under the ambient condition of 30° C. and 80% RH. The ambient condition of 20° C. and 65% RH is denoted as I and that of 30° C. and 80% RH is denoted as II.

3) Image Forming Performance

The light-sensitive material and a full-automatic plate making machine ELP-404V (manufactured by Fuji Photo Film Co., Ltd.) were allowed to stand for a whole day and night under condition of normal temperature and normal humidity (20° C. and 65% RH) (I), and a duplicated image was formed by plate making using the material and machine. The duplicated image formed on the printing plate precursor was subjected to visual evaluation of the fog and image quality. For the plate making Liquid Developer LD-6 described below was employed. Further, the same procedure was conducted under high temperature and high humidity condition (30° C. and 80% RH) (II), followed by evaluating the resulting image.

Preparation of Liquid Developer LD-6

(1) Synthesis of Toner Particles:

A mixed solution of 60 g of methyl methacrylate, 40 g of methyl acrylate, 20 g of the dispersion polymer described in Example 2-1, and 680 g of Isopar H was heated to 65° C. under nitrogen gas stream with stirring. To the solution was added 1.2 g of 2,2'-azobis(isovaleronitrile) (AIVN), followed by allowing the mixture to react for 2 hours. To the reaction mixture was further added 0.5 g of AIVN, and the reaction was continued for 2 hours. To the reaction mixture was further added 0.5 g of AIVN, and the reaction was continued for 2 hours. The temperature was raised up to 90° C., and the mixture was stirred under reduced pressure of 30 mm Hg for 1 hour to remove any unreacted monomers. After cooling to room temperature, the reaction mixture was filtered through a nylon cloth of 200 mesh to obtain a white dispersion. The reaction rate of the monomers was 95% by weight, and the resulting dispersion had an average grain diameter of resin grain of 0.25 μm (grain diameter being measured by CAPA-500 manufactured by Horiba, Ltd.) and good monodispersity.

(2) Preparation of Colored Particles:

Ten grams of a tetradecyl methacrylate/methacrylic acid copolymer (95/5 ratio by weight), 10 g of nigrosine, and 30 g of Isopar G were put in a paint shaker (manufactured by Tokyo Seiki Seisakusho KK) together with glass beads and dispersed for 4 hours to prepare a fine dispersion of nigrosine.

(3) Preparation of Liquid Developer:

A mixture of 45 g of the above-described toner particle dispersion, 25 g of the above-described nigrosine dispersion, 0.06 g of a hexadecene/maleic acid mono-octadecylamide copolymer, and 15 g of FOC 1800 was diluted with 1 l of Isopar G to prepare a liquid developer for electrophotography.

4) Water Retentivity at the Start of Printing

The light-sensitive material (without plate making, i.e., a raw plate) was immersed in Oil-Desensitizing Solution E-6 having the composition shown below at 40° C. for 3 minutes.

Oil-Desensitizing Solution E-6

Monoethanolamine 60 g

Neosoap (manufactured by Matsumoto Yushi KK) 8 g

Benzyl alcohol 100 g

These components were dissolved in distilled water to make a total volume of 1.0 liter, and a pH thereof was adjusted with potassium hydroxide to 13.5.

Then, the resulting plate was subjected to printing using a printing machine and Dampening Water F-6 each described below, and a 50th print from the start of printing was visually evaluated on background stain thereof.

Dampening Water F-6

Aqueous solution made by diluting 200-folds dampening water for PS plate (Alky A manufactured by Toyo Ink Mfg. Co., Ltd.) with distilled water (pH: 9.5)

Water Retentivity at the Start of Printing I

Ryobi 3200 CD manufactured by Ryobi Ltd. was used as a printing machine of molton type.

Water Retentivity at the Start of Printing II

Ryobi 3200 MCD manufactured by Ryobi Ltd. was used as a printing machine of syn-flow type.

5) Printing Durability

The light-sensitive material was subjected to plate making under the same conditions as in the above described item 3), immersed in Oil-Desensitizing Solution E-6 described in the item 4) above for 3 minutes. The resulting printing plate was subjected to printing using Dampening Water F-6 described in the item 4) above as dampening water, neutral paper as printing paper and a printing machine of large size capable of printing paper of Kikuzen-size (1003×800 mm) (Oliver 94 manufactured by Sakurai Seisakusho K.K.) as a printing machine. A number of prints having clear images which could be obtained without the occurrence of background stain was determined in a case wherein a printing pressure on an offset printing machine was increased.

As shown in Table $N_1$, each of the light-sensitive materials had good smoothness of photoconductive layer. The electrostatic characteristics under the condition of normal temperature and normal humidity were in a range of practically no problem although they were somewhat low in Comparative Example D-6 wherein the resin ($B_5$) was not used. However, under the severe condition of high temperature and high humidity, the electrostatic characteristics (particularly, D.R.R. and $E_{1/10}$) of Comparative Example D-6 were remarkably decreased. On the contrary, with other light-sensitive materials, the change of the electrostatic characteristics was controlled small and they were maintained in a range of practical use. With respect to the image forming performance, the occurrence of background fog in non-image areas and degradation of image quality (i.e., decrease in density, cutting of fine lines and letters, etc.)

were observed under the high temperature and high humidity condition. Other light-sensitive materials provided good duplicated images.

Concerning the water retentivity at the start of printing, the printing plates according to Example 6-1 and Comparative Example D-6 provided excellent water retentivity and adhesion of ink to the non-image area thereof was not observed at all irrespective of the type of printing machine. On the contrary, a plate according to Comparative Example A-6 wherein only carboxy group had been formed exhibited a large difference in the occurrence of background stain on print at the start of printing depending on a system of supplying damping water and ink. Specifically, in a case of using a printing machine of syn-flow type in which the supply of dampening water is less sufficient than in a printing machine of molton type, adhesion of ink occurred in the non-image area on print and the formation of background stain was observed at the start of printing. It is presumed in the plate of Comparative Example A-6 that although the surface of the photoconductive layer thereof which had been rendered hydrophilic had sufficiently good wettability with water, a super-thin layer of water (weak boundary layer abbreviated as WBL hereinafter) which had been formed on the surface of the plate could not be maintained, since the amount of water which was held in the whole photoconductive layer (amount of water retained in the layer) was insufficient, when the balance of amount of dampening water supplied was lost at the start of printing.

On the other hand, with a plate according to Comparative Example B-6 wherein only sulfo group had been formed, adhesion of ink was restrained as compared with the plate of Comparative Example A-6 in a case of using a printing machine of syn-flow type. However, it is presumed that the formation of WBL was insufficient in a case of using a printing machine of molton type since the amount of water retained in the layer was large.

Further, with Comparative Example C-6 wherein the resins used in Comparative Examples A-6 and B-6 were mixed the faults of both resins could not be covered up and provided the same results as Comparative Example A-6.

As a result of the evaluation on printing durability using a printing machine of large size, more than 10,000 prints of clear image were obtained. With Comparative Example D-6 which exhibited good water retentivity at the start of printing in case of using the raw plate, the image on prints were poor from the start of printing when the plate formed by practical plate-making was employed. On the contrary, the printing durability in each of Comparative Examples A-6, B-6 and C-6 was around 2,000 prints to 4,000 prints. The reason for the low printing durability in Comparative Example A-6 is considered to be based on the fact that the formation of WBL on the surface of the plate or the amount of water retained in the layer became poor with the progress of printing. Also, in case of Comparative Examples B-6 and C-6, it is presumed that a film strength of the layer was insufficient and the layer was broken, resulting in the low printing durability because of the large amount of water retained in the layer formed from the resin having sulfo group and crosslinking structure.

From these results it can be seen that only the light-sensitive material according to the present invention produces a printing plate which can provide a large number of prints having good quality even when the ambient conditions at the image formation and conditions at the printing are fluctuated.

EXAMPLE 6-2

A mixture of 35 g of Resin (A-2), 10 g of Resin ($B_5$-11), 4 g of Resin (P-2) described in Example 1-2, 200 g of photoconductive zinc oxide, 0.02 g of uranine, 0.015 g of Dye (I) described in Example 1-2, 0.012 g of Dye (II) described in Example 1-2, 0.18 g of N-hydroxyphthalimide and 300 g of toluene was dispersed by a homogenizer (manufactured by Nippon Seiki K.K.) at a rotation of $6\times10^3$ r.p.m. for 5 minutes. To the dispersion were added 0.1 g of phthalic anhydride and 0.002 g of zirconium acetylacetone, and the mixture was dispersed by a homogenizer at a rotation of $1\times10^3$ r.p.m. for 1 minute. The resulting coating composition for a light-sensitive layer was coated on paper, which had been subjected to electrically conductive treatment, by a wire bar at a dry coverage of 25 g/m$^2$, followed by drying at 100° C. for 30 seconds and then heating at 140° C. for 1 hour. The coated material was allowed to stand in a dark place at 20° C. and 65% RH for 24 hours to prepare an electrophotographic light-sensitive material.

COMPARATIVE EXAMPLE E-6

An electrophotographic light-sensitive material was prepared in the same manner as in Example 6-2, except for using 35 g of Resin (2R-3) described in Comparative Example E-2 in place of 35 g of Resin (A-2) used in Example 6-2.

COMPARATIVE EXAMPLE F-6

An electrophotographic light-sensitive material was prepared in the same manner as in Example 6-2, except for using 35 g of Resin (2R-4) described in Comparative Example F-2 in place of 35 g of Resin (A-2) used in Example 6-2.

COMPARATIVE EXAMPLE G-6

An electrophotographic light-sensitive material was prepared in the same manner as in Example 6-2, except for using 20.6 g of Resin (2R-3) and 14.4 g of Resin (2R-4) (weight ratio of Resin (2R-3)/Resin (2 R-4)=58.8/41.2) in place of 35 g of Resin (A-2) used in Example 6-2.

COMPARATIVE EXAMPLE H-6

An electrophotographic light-sensitive material was prepared in the same manner as in Example 6-2, except for using only 45 g of Resin (A-2) in place of 35 g of Resin (A-2) and 10 g of Resin ($B_5$-11) used in Example 6-2.

With each of the light-sensitive materials thus-prepared, the smoothness of photoconductive layer, electrostatic characteristics, image forming performance and water retentivity at the start of printing were evaluated in the same manner as in Example 6-1. Further, using dampening water each having a different pH value (i.e., pH 4.5, pH 7.0 and pH 9.5), influence on print was evaluated.

The results obtained are shown in Table $O_1$ below.

TABLE $O_1$

| | | Example 6-2 | Comparative Example E-6 | Comparative Example F-6 | Comparative Example G-6 | Comparative Example H-6 |
|---|---|---|---|---|---|---|
| Smoothness of Photoconductive Layer (sec/cc) | | 185 | 200 | 180 | 190 | 195 |
| Electrostatic Characteristics | | | | | | |
| $V_{10}$(−V) | I | 600 | 620 | 585 | 585 | 570 |
| | II | 580 | 595 | 570 | 570 | 540 |
| D.R.R. (%) | I | 85 | 86 | 85 | 84 | 80 |
| | II | 82 | 82 | 81 | 80 | 72 |
| $E_{1/10}$ (lux · sec) | I | 12.0 | 11.8 | 12.3 | 12.4 | 14.8 |
| | II | 13.1 | 12.7 | 13.4 | 13.4 | 17.5 |
| Image Forming Performance | I | o good | o good | o good | o good | o good |
| | II | o good | o good | o good | o good | x low density, occurrence of background fog, occurrence of cutting of fine lines and letters |
| Water Retentivity at the Start of Printing | | | | | | |
| I Molton Type | | o good | o good | oΔ occurrence of very slight background stain | o good | o good |
| II Syn-Flow Type | | o good | x occurrence of severe background stain | Δ~o occurrence of slight background stain | x occurrence of severe background stain | o good |
| Dependency on[6] Dampening Water | | | | | | |
| I | | 10,000 prints | severe background stain at the start of printing | background stain at the start of printing | severe background stain at the start of printing | severe background stain from the start of printing, occurrence of cutting of fine lines and letters |
| II | | 10,000 prints | severe background stain at the start of printing | background stain at the start of printing | background stain at the start of printing | severe background stain from the start of printing, occurrence of cutting of fine lines and letters |
| III | | 10,000 prints | 2,000 prints | 3,000 prints | 2,000 prints | severe background stain from the start of printing, occurrence of cutting of fine lines and letters |

6) Dependency on Dampening Water

The production of printing plate and printing were conducted in the same manner as described in the item 5) above, except for using the solution shown below as dampening water at the printing.

I: an aqueous solution (pH: 4.5) prepared by diluting 100-folds dampening water for PS plate (EU-3 manufactured by Fuji Photo Film Co., Ltd.) with distilled water.

II: an aqueous solution (pH: 7.0) prepared by diluting 130-folds dampening water for PS plate (SG-23 manufactured by Tokyo Ink K.K.) with distilled water.

III: an aqueous solution (pH: 9.5) prepared by diluting 200-folds dampening water for PS plate (Alky A manufactured by Toyo Ink Mfg. Co., Ltd.) with distilled water.

As shown above, the smoothness of photoconductive layer of each light-sensitive material was good. Example 6-2 and Comparative Examples E-6 to G-6 exhibited good electrostatic characteristics and image forming performance regardless of ambient condition. However, with Comparative Example H-6 wherein the resin ($B_5$) was not used, the electrostatic characteristics were decreased and the occurrence of background fog and degradation of image (i.e., decrease in density, cutting of fine lines and letters, etc.) were observed on the image forming performance under the severe condition of high temperature and high humidity.

With respect to the water retentivity at the start of printing, the plate according to the present invention was good, although the water retentivity of the plates of Comparative Examples E-6 to G-6 was poor in a case of using a printing machine of syn-flow type. The reason for poor water retentivity obtained in Comparative Example F-6 by the syn-flow type printing machine is presumed that although the $PO_3H_2$ group formed in Resin (2R-4) upon the oil-desensitizing treatment acted for keeping sufficient amount of water retained in the layer, the wettability of the surface of the layer with water was insufficient at the printing since the hydrophilic group was bonded to the polymer main chain through a hydrophobic linking group.

As a result of the evaluation on printing durability using three kinds of dampening water, the plate according to the present invention provided 10,000 prints of good quality irrespective of the kind of dampening water. On the contrary, the plates of Comparative Examples E-6 to G-6 exhibited good results only when Dampening Water III was used, and in case of using other dampening water, background stain due to adhesion of ink occurred at the start of printing while the degree thereof was different from each other and the background stain could not be removed by conducting further printing. The plate of Comparative Example H-6 could not provide prints of satisfactory image quality from the start of printing since the performance of printing plate precursor was poor due to poor image quality and background fog at the plate making.

It is believed that the large influence of pH of dampening water is related to a dissociation constant of the hydrophilic group formed. More specifically, with Comparative Example E-6 wherein the influence of pH is dominative, the COOH group formed in Resin (2R-3) is present as a dissociated form of $COO^-$ and has good compatibility with water under a high pH condition, but the amount of dissociated group decreases under a low pH condition, resulting in reduction of the water compatibility. It has been found that the water retentivity is widely varied depending on the kind of dampening water when a hydrophilic group having a small value of dissociation constant (pKa) is not formed simultaneously.

Since the printing plate according to the present invention is capable of conducting printing using dampening water for PS plate in a large size printing machine as described above, it can be easily used in common with other printing plates without cleaning and inspection of the printing machine.

EXAMPLES 6-3 TO 6-13

Each electrophotographic light-sensitive material was prepared in the same manner as described in Example 6-1, except for using 32 g of each of the resins (A) and 8 g of each of the resins ($B_5$) shown in Table $P_1$ below in place of 32 g of Resin (A-1) and 8 g of Resin ($B_5$-3 ) used in Example 6-1.

TABLE $P_1$

| Example | Resin (A) | Resin ($B_5$) |
|---|---|---|
| 6-3 | A-3 | $B_5$-2 |
| 6-4 | A-4 | $B_5$-4 |
| 6-5 | A-5 | $B_5$-7 |
| 6-6 | A-6 | $B_5$-13 |
| 6-7 | A-7 | $B_5$-14 |
| 6-8 | A-8 | $B_5$-17 |
| 6-9 | A-9 | $B_5$-20 |
| 6-10 | A-10 | $B_5$-23 |
| 6-11 | A-11 | $B_5$-24 |
| 6-12 | A-12 | $B_5$-25 |
| 6-13 | A-13 | $B_5$-30 |

With each of the light-sensitive materials thus prepared, various characteristics were evaluated in the same manner as in Example 6-1. Each of the light-sensitive materials exhibited good electrostatic characteristics and image forming performance similar to those obtained in the light-sensitive material of Example 6-1, even when the ambient condition was varied. When they were used as printing plates, they exhibited good water retentivity at the start of printing on both printing machines of molton type and syn-flow type and the printing durability thereof was more than 10,000 prints.

EXAMPLES 6-14 TO 6-25

Each electrophotographic light-sensitive material was prepared in the same manner as described in Example 6-1, except for using each of the compounds shown in Table $Q_1$ below in place of Resin (A-1), Resin ($B_5$-3), Resin (2P-1) and phthalic anhydride and o-chlorophenol as crosslinking compounds used in Example 6-1. Resins (P-3) to (P-12) used are described in Examples 1-14 to 1-25 respectively.

TABLE $Q_1$

| Example | Resin (A) | Resin ($B_5$) | Resin (P) | Crosslinking Compound |
|---|---|---|---|---|
| 6-14 | (A-14) | ($B_5$-29) | (P-3) | $R'OOCNH(CH_2)_6NHCOOR'$<br>R': $-CH(COCH_3)-COOC_2H_5$<br>Dibutyltin dilaurate |
| 6-15 | (A-15) | ($B_5$-26) | (P-4) | Tetrabutoxy titanate |
| 6-16 | (A-16) | ($B_5$-23) | (P-5) | Gluconic acid |
| 6-17 | (A-17) | ($B_5$-16) | (P-6) | 3-Glycidoxy propyl trimethoxy silane |
| 6-18 | (A-18) | ($B_5$-15) | (P-7) | — |
| 6-19 | (A-19) | ($B_5$-13) | (P-8) | Propylene glycol<br>Tetrabutoxy titanate |
| 6-20 | (A-20) | ($B_5$-6) | (P-9) | N,N-Dimethylpropylamine |
| 6-21 | (A-21) | ($B_5$-19) | (P-10) | Divinyl adipate<br>Benzoyl peroxide |
| 6-22 | (A-22) | ($B_5$-23) | — | — |
| 6-23 | (A-16) | ($B_5$-27) | (P-11) | Phthalic anhydride<br>o-Chlorophenol |
| 6-24 | (A-23) | ($B_5$-26) | (P-12) | Allyl methacrylate<br>Benzoyl peroxide |
| 6-25 | (A-24) | ($B_5$-28) | — | 3-Aminopropyl trimethoxy silane |

With each of the light-sensitive materials thus prepared, various characteristics were evaluated in the same manner as in Example -6-1. Each of the light-sensitive materials exhibited good electrostatic characteristics and image forming performance similar to those obtained in the light-sensitive material of Example 6-1, even when the ambient condition was varied. When they were used as printing plates, they exhibited good water retentivity at the start of printing on both printing machines of molton type and syn-flow type and the printing durability thereof was more than 10,000 prints.

EXAMPLE 6-26

A mixture of 1 g of X-form metal-free phthalocyanine (manufactured by Dainippon Ink and Chemicals, Inc.), 8 g of Resin (A-25), 2 g of Resin ($B_5$-19), 0.3 g of Resin (2P-1) and 80 g of tetrahydrofuran was put in a 500 ml-volume glass container together with glass beads and dispersed in a paint shaker (manufactured by Toyo Seiki Seisakusho Co.) for 60 minutes. To the dispersion was added 0.3 g of ethylene glycol diglycidyl ether, followed by further dispersing for 2 minutes. The glass beads were separated by filtration to prepare a dispersion for a light-sensitive layer.

The dispersion was coated on base paper for a paper master having a thickness of 0.2 mm, which had been subjected to electrically conductive treatment and solvent-resistant treatment, by a wire bar, set to touch, heated in a circulating oven at 110° C. for 20 seconds, and then further heated at 140° C. for 1 hour to form a light-sensitive layer having a thickness of 10 μm.

The resulting light-sensitive material was subjected to the evaluations of electrostatic characteristics and image forming performance in the same manner as described in Example 6-1, and good results shown below were obtained.

TABLE $R_1$

| | 20° C., 65% RH | 30° C., 80% RH |
|---|---|---|
| Electrostatic Characteristics | | |
| $V_{10}$(−V) | 615 | 600 |
| D.R.R. (%) | 88 | 84 |
| $E_{1/10}$ (erg/cm$^2$) | 34 | 35 |
| Image Forming Performance | o good | o good |

Of the evaluations, the D.R.R., $E_{1/10}$ and image forming performance were conducted according to the following methods.

D.R.R. and $E_{1/10}$

The light-sensitive material was charged with a corona discharge to a voltage of −6 kV for 20 seconds in a dark room at a temperature of 20° C. and 65% RH using a paper analyzer ("Paper Analyzer SP-428" manufactured by Kawaguchi Denki K.K.). Ten seconds after the corona discharge, the surface potential $V_{10}$ was measured. The sample was then allowed to stand in the dark for an additional 90 seconds, and the potential $V_{100}$ was measured. The dark charge retention rate, i.e., percent retention of potential after dark decay for 90 seconds, was calculated from the following equation:

$$DRR(\%)=(V_{100}/V_{10})\times 100$$

Separately, the surface of photoconductive layer was charged to −500 V with a corona discharge and then exposed to monochromatic light of 780 nm, and the time required for decay of the surface potential $V_{10}$ to one-tenth was measured, and the exposure amount $E_{1/10}$ (erg/cm$^2$) was calculated therefrom.

This is denoted as Condition (I).

Further, the same procedure was conducted under the ambient condition of 30° C. and 80% RH. This is denoted as Condition (II).

Image Forming Performance

After the light-sensitive material was allowed to stand for a whole day and night under the condition of 20° C. and 65% RH, the light-sensitive material was charged to −6 kV and exposed to light emitted from a gallium-aluminum-arsenic semi-conductor laser (oscillation wavelength: 780 nm; output: 2.8 mW) at an exposure amount of 64 erg/cm$^2$ (on the surface of the photoconductive layer) at a pitch of 25 μm and a scanning speed of 300 m/sec. The thus formed electrostatic latent image was developed with Liquid Developer LD-2 prepared by dispersing 5 g of polymethyl methacrylate particles having a particle size of 0.3 μm in 1 l of Isopar H (manufactured by Esso Standard Co.), and adding 0.01 g of soybean oil lecithin thereto as a charge control agent, washed with a rinse solution of isoparaffinic solvent Isopar G (manufactured by Esso Chemical K.K.) and fixed. The duplicated image thus obtained was visually evaluated for fog and image quality.

This is denoted as Condition (I).

Further, the same procedure was conducted under the ambient condition of 30° C. and 80% RH. This is denoted as Condition (II).

Further, the light-sensitive material was subjected to the plate making in the same manner as described above and then the oil desensitizing treatment and printing were conducted under the same conditions as described in Example 6-1.

As a result, it was found that both of the water retentivities (I) and (II) at the start of printing were good. With respect to the printing durability, more than 10,000 prints of cleat prints were obtained.

EXAMPLE 6-27

An electrophotographic light-sensitive material was prepared in the same manner as described in Example 6-26 except that 10.3 g of Resin (A-26) was used alone in place of 8 g of Resin (A-25), 2 g of Resin ($B_5$-19), 0.3 g of Resin (2P-1), and 0.3 g of ethylene glycol diglycidyl ether used in Example 6-26. Further, the crosslinking of layer was conducted in the method described below in place of the heating at 140° C. for 1 hour.

Curing Method

The light-sensitive material was irradiated with light from a super high-pressure mercury lamp of 2 Kw as a light source at a distance of 50 cm for 1.5 minutes.

The electrostatic characteristics and printing properties of the light-sensitive material thus obtained were evaluated in the same manner as described in Example 6-26. The good results similar to those obtained with respect to the light-sensitive material of Example 6-26 were obtained.

EXAMPLES 6-28 TO 6-30

Each electrophotographic light-sensitive material was prepared in the same manner as in Example 6-1, except for using 32 g of each of the resins (A) and 8 g of each of the resins ($B_5$) shown in Table $S_1$ below in place of 32 g of Resin (A-1) and 8 g of Resin ($B_5$-3) used in Example 6-1.

TABLE $S_1$

| Example | Resin (A) | Resin ($B_5$) |
|---|---|---|
| 6-28 | A-27 | $B_5$-3 |
| 6-29 | A-28 | $B_5$-10 |
| 6-30 | A-29 | $B_5$-16 |

With each of the light-sensitive materials thus prepared, the electrostatic characteristics and printing properties were evaluated in the same manner as in Example 6-1. The good results similar to those of the light-sensitive material in Example 6-1 were obtained.

EXAMPLE 6-31

A mixture of 40 g (solid basis) of Resin (A-30), 10 g (solid basis) of Resin ($B_5$-12), 200 g of photoconductive zinc oxide, 0.018 g of Cyanine Dye (I-2) described in Example 2-31, 0.20 g of phthalic anhydride and 300 g of toluene was dispersed by a homogenizer (manufactured by Nippon Seiki K.K.) at a rotation of $6\times10^3$ r.p.m. for 6 minutes. To the dispersion was added 2.5 g of the crosslinking compound described in Example 2-31, and the mixture was dispersed by a homogenizer at a rotation of $1\times10^3$ r.p.m. for 1 minute to prepare a coating composition for a light-sensitive layer. The coating composition was coated on paper, which had been subjected to electrically conductive treatment, by a wire bar at a dry coverage of 22 g/m$^2$, followed by drying at 110° C. for 10 seconds and allowed to stand in a dark place at 50° C. and 80% RH for 1 week. Then the coated material was allowed to stand in a dark place at 20° C. and 65% RH for 24 hours to prepare an electrophotographic light-sensitive material.

COMPARATIVE EXAMPLE I-6

An electrophotographic light-sensitive material was prepared in the same manner as described in Example 6-31 except that 50 g of Resin (A-30) was used alone in place of 40 g of Resin (A-30) and 10 g of Resin ($B_5$-12) used in Example 6-31.

With each of the light-sensitive materials thus prepared, the electrostatic characteristics and image forming performance were evaluated in the same manner as in Example 6-26, and other characteristic items were evaluated in the same manner as in Example 6-1.

TABLE $T_1$

| | | Example 6-31 | Comparative Example I-6 |
|---|---|---|---|
| Smoothness of Photoconductive Layer (sec/cc) | | 185 | 200 |
| Electrostatic Characteristics | | | |
| $V_{10}$(−V) | I (20° C., 65% RH) | 635 | 480 |
| | II (30° C., 80% RH) | 620 | 440 |
| D.R.R. (%) | I | 83 | 73 |
| | II | 75 | 45 |
| $E_{1/10}$ (erg/cm$^2$) | I | 38 | 98 |
| | II | 45 | ≦120 |
| Image Forming Performance | I | ○ good | Δ occurrence of cutting of fine lines and letters |
| | II | ○ good | x low density, cutting of fine lines and letters, severe fog |
| Water Retentivity at the Start of Printing | | | |
| I Molton Type | | ○ good | ○ good |
| II Syn-Flow Type | | ○ good | ○ good |
| Printing Durability | | 10,000 prints | severe background stain from the start of printing |

As shown above, the smoothness of photoconductive layer was good with each light-sensitive material.

The electrostatic characteristics of the light-sensitive material according to the present invention were good not only at normal temperature and normal humidity but also at high temperature and high humidity. On the contrary, with the light-sensitive material of Comparative Example I-6, D.R.R. and $E_{1/10}$ were low even at normal temperature and normal humidity and they further degraded at high temperature and high humidity. With respect to image forming performance, the material according to the present invention provided good duplicated images irrespective of the ambient condition. On the contrary, with the material of Comparative Example I-6, although duplicated images formed at normal temperature and normal humidity were practically usable, duplicated images formed at high temperature and high humidity could not be used in practice because of occurrence of severe background stain and degradation of image (e.g., decrease in density, cutting of fine lines and letters).

Further, as a result of printing using the printing plates prepared therefrom, the printing plate according to the present invention provided 10,000 good prints from the start of printing irrespective of the kind of printing machine. The printing plate of Comparative Example I-6 prepared under Condition II provided prints of poor image from the start of printing.

EXAMPLES 6-32 TO 6-43

Each light-sensitive material was prepared in the same manner as in Example 6-31, except for using 10 g of each of the resins ($B_5$) shown in Table $U_1$ below in place of 10 g of Resin ($B_5$-12) used in Example 6-31.

TABLE $U_1$

| Example | Resin ($B_5$) |
|---|---|
| 6-32 | $B_5$-3 |
| 6-33 | $B_5$-6 |
| 6-34 | $B_5$-9 |
| 6-35 | $B_5$-13 |
| 6-36 | $B_5$-14 |
| 6-37 | $B_5$-16 |
| 6-38 | $B_5$-19 |
| 6-39 | $B_5$-24 |
| 6-40 | $B_5$-25 |
| 6-41 | $B_5$-26 |
| 6-42 | $B_5$-29 |
| 6-43 | $B_5$-30 |

With each of the light-sensitive materials thus prepared, the various characteristics were evaluated in the same manner as in Example 6-31. The good results similar to those of Example 6-31 were obtained.

EXAMPLES 6-44 TO 6-55

An offset printing plate was prepared by subjecting some of the light-sensitive materials used in Examples described above to electrophotographic processings for forming a toner image, followed by the oil-desensitizing treatment described below. Specifically, to 0.2 mol of each of the nucleophilic compounds shown in Table $V_1$ below, 100 g of each of the organic solvents shown in Table $V_1$ below, and 2 g of Newcol B4SN (manufactured by Nippon Nyukazai K.K.) was added distilled water to make 1 l, and the solution was adjusted to a pH of 13.5. Each light-sensitive material was immersed in the resulting treating solution at a temperature of 35° C. for 3 minutes to conduct the oil-desensitizing treatment.

Printing was carried out using the resulting printing plate under the same conditions as in the respective basis Example. Each plate exhibited good characteristics similar to those of the respective basis Example.

TABLE $V_1$

| Example | Basis Example of Light-sensitive Material | Nucleophilic Compound | Organic Solvent |
|---|---|---|---|
| 6-44 | Example 6-6 | Sodium sulfite | N-Methylacetamide |
| 6-45 | Example 6-8 | Monoethanolamine | Benzyl alcohol |
| 6-46 | Example 6-2 | Diethanolamine | Methyl ethyl ketone |
| 6-47 | Example 6-5 | Thiomalic acid | Sulfolane |
| 6-48 | Example 6-11 | Thiosalicylic acid | Benzyl alcohol |
| 6-49 | Example 6-9 | Taurine | Isopropyl alcohol |
| 6-50 | Example 6-13 | 4-Sulfobenzenesulfinic acid | N,N,N',N'-Tetramethylurea |
| 6-51 | Example 6-5 | Thioglycolic acid | N-Methylpyrrolidone |
| 6-52 | Example 6-10 | 2-Mercaptoethylphosphonic acid | Dioxane |
| 6-53 | Example 6-30 | Serine | N,N-Dimethylamino ethanol |
| 6-54 | Example 6-12 | Sodium thiosulfate | N,N-Dimethylacetamide |
| 6-55 | Example 6-29 | Ammonium sulfite | Tetrahydrofuran |

EXAMPLE 7-1

A mixture of 32 g of Resin (A-1), 8 g of Resin ($B_6$-2), 200 g of photoconductive zinc oxide, 0.02 g of uranine, 0.04 g of Rose Bengal, 0.03 g of bromophenol blue, 0.15 g of salicylic acid and 300 g of toluene was dispersed by a homogenizer (manufactured by Nippon Seiki K.K.) at a rotation of $6\times10^3$ r.p.m. for 8 minutes. To the dispersion were added 5 g of Resin (2P-1) described in Example 2-1, 0.2 g of phthalic anhydride and 0.02 g of o-chlorophenol, and the mixture was dispersed by a homogenizer at a rotation of $1\times10^3$ r.p.m. for 1 minute. The resulting coating composition for a light-sensitive layer was coated on paper, which had been subjected to electrically conductive treatment, by a wire bar at a dry coverage of 25 g/m$^2$, dried at 100° C. for 30 seconds and then heating at 140° C. for 1 hour. The coated material was then allowed to stand in a dark place at 20° C. and 65% RH for 24 hours to prepare an electrophotographic light-sensitive material.

COMPARATIVE EXAMPLE A-7

An electrophotographic light-sensitive material was prepared in the same manner as in Example 7-1, except for using 32 g of Resin (7R-1) having the structure shown below in place of 32 g of Resin (A-1) used in Example 7-1.

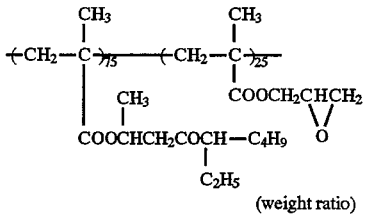

Resin (7R-1)

Weight average molecular weight: $4\times10^4$

COMPARATIVE EXAMPLE B-7

An electrophotographic light-sensitive material was prepared in the same manner as in Example 7-1, except for using 32 g of Resin (5R-2) described in Comparative Example B-5 in place of 32 g of Resin (A-1) used in Example 7-1.

COMPARATIVE EXAMPLE C-7

An electrophotographic light-sensitive material was prepared in the same manner as in Example 7-1, except for using 19.2 g of Resin (7R-1) and 12.8 g of Resin (5R-2) (weight ratio of Resin (7R-1)/Resin (5R-2)=60/40) in place of 32 g of Resin (A-1) used in Example 7-1.

COMPARATIVE EXAMPLE D-7

An electrophotographic light-sensitive material was prepared in the same manner as in Example 7-1, except for using only 40 g of Resin (A-1) in place of 32 g of Resin (A-1) and 8 g of Resin ($B_6$-2) used in Example 7-1.

With each of the light-sensitive material thus prepared, various characteristics shown in Table $W_1$ below were evaluated.

TABLE $W_1$

| | | Example 7-1 | Comparative Example A-7 | Comparative Example B-7 | Comparative Example C-7 | Comparative Example D-7 |
|---|---|---|---|---|---|---|
| Smoothness of Photo-[1] conductive Layer (sec/cc) | | 280 | 290 | 300 | 300 | 285 |
| Electrostatic[2] Characteristics | | | | | | |
| $V_{10}$(−V) | I | 750 | 755 | 750 | 740 | 600 |
| | II | 730 | 730 | 730 | 720 | 555 |
| D.R.R. (%) | I | 88 | 90 | 89 | 87 | 80 |

TABLE $W_1$-continued

| | | Example 7-1 | Comparative Example A-7 | Comparative Example B-7 | Comparative Example C-7 | Comparative Example D-7 |
|---|---|---|---|---|---|---|
| | II | 84 | 86 | 85 | 83 | 73 |
| $E_{1/10}$ (lux · sec) | I | 11.3 | 11.2 | 11.5 | 11.9 | 16.5 |
| | II | 11.8 | 11.7 | 12.0 | 12.3 | 18.0 |
| Image Forming[3] Performance | I | ○ good | ○ good | ○ good | ○ good | ○ good |
| | II | ○ good | ○ good | ○ good | ○ good | x low density, occurrence of unevenness of fine lines, occurrence of background fog |
| Water Retentivity at[4] the Start of Printing | | | | | | |
| I Molton Type | | ○ good | ○ good | Δ occurrence of background stain | Δ occurrence of background stain | ○ good |
| II Syn-Flow Type | | ○ good | x occurrence of severe back-ground stain | x~Δ occurrence of background stain | x occurrence of background stain | ○ good |
| Printing Durability[5] | | 10,000 prints | 2,000 prints | 4,000 prints | 3,000 prints | occurrence of background stain from the start of printing |

The characteristic items described in Table $W_1$ were evaluated as follows:

1) Smoothness of Photoconductive Layer

The resulting light-sensitive material was subjected to measurement of its smoothness (sec/cc) under an air volume condition of 1 cc using a Beck smoothness test machine (manufactured by Kumagaya Riko KK).

2) Electrostatic Characteristics

The light-sensitive material was subjected to corona discharge at a voltage of −6 kV for 20 seconds in a dark room at 20° C. and 65% RH using a paper analyzer (Paper Analyzer SP-428 manufactured by Kawaguchi Denki KK) and after allowed to stand for 10 seconds, the surface potential $V_{10}$ was measured. Then, the sample was further allowed to stand in the dark room for 60 seconds to measure the surface potential $V_{70}$, thus obtaining the retention of potential after the dark decay for 60 seconds, i.e., dark decay retention ratio (D.R.R. (%)) represented by $(V_{70}/V_{10})\times 100$ (%). Moreover, the surface of the photoconductive layer was charged to −400 V by corona discharge, then irradiated by visible light of the illuminance of 2.0 lux and the time required for decay of the surface potential $V_{10}$ to 1/10 was measured, and the exposure amount $E_{1/10}$ (lux·sec) was calculated therefrom.

Further, the same procedure was conducted under the ambient condition of 30° C. and 80% RH. The ambient condition of 20° C. and 65% RH is denoted as I and that of 30° C. and 80% RH is denoted as II.

3) Image Forming Performance

The light-sensitive material and a full-automatic plate making machine ELP-404V (manufactured by Fuji Photo Film Co., Ltd.) were allowed to stand for a whole day and night under condition of normal temperature and normal humidity (20° C. and 65% RH) (I), and a duplicated image was formed by plate making using the material and machine. The duplicated image formed on the printing plate precursor was subjected to visual evaluation of the fog and image quality. For the plate making Liquid Developer LD-7 described below was employed. Further, the same procedure was conducted under high temperature and high humidity condition (30° C. and 80% RH) (II), followed by evaluating the resulting image.

Preparation of Liquid Developer LD-7

(1) Synthesis of Toner Particles:

A mixed solution of 60 g of methyl methacrylate, 40 g of methyl acrylate, 20 g of the dispersion polymer described Example 2-1, and 680 g of Isopar H was heated to 65° C. under nitrogen gas stream with stirring. To the solution was added 1.2 g of 2,2'-azobis(isovaleronitrile) (AIVN), followed by allowing the mixture to react for 2 hours. To the reaction mixture was further added 0.5 g of AIVN, and the reaction was continued for 2 hours. To the reaction mixture was further added 0.5 g of AIVN, and the reaction was continued for 2 hours. The temperature was raised up to 90° C., and the mixture was stirred under reduced pressure of 30 mm Hg for 1 hour to remove any unreacted monomers. After cooling to room temperature, the reaction mixture was filtered through a nylon cloth of 200 mesh to obtain a white dispersion. The reaction rate of the monomers was 95% by weight, and the resulting dispersion had an average grain diameter of resin grain of 0.25 μm (grain diameter being measured by CAPA-500 manufactured by Horiba, Ltd.) and good monodispersity.

(2) Preparation of Colored Particles:

Ten grams of a tetradecyl methacrylate/methacrylic acid copolymer (95/5 ratio by weight), 10 g of nigrosine, and 30 g of Isopar G were put in a paint shaker (manufactured by Tokyo Seiki Seisakusho KK) together with glass beads and dispersed for 4 hours to prepare a fine dispersion of nigrosine.

(3) Preparation of Liquid Developer:

A mixture of 45 g of the above-described toner particle dispersion, 25 g of the above-described nigrosine dispersion, 0.06 g of a hexadecene/maleic acid mono-octadecylamide copolymer, and 15 g of FOC 1800 was diluted with 1 l of Isopar G to prepare a liquid developer for electrophotography.

4) Water Retentivity at the Start of Printing

The light-sensitive material (without plate making, i.e., a raw plate) was immersed in Oil-Desensitizing Solution E-7 having the composition shown below at 40° C. for 3 minutes.

Oil-Desensitizing Solution E-7

Monoethanolamine 60 g

Neosoap (manufactured by Matsumoto Yushi KK) 8 g

Benzyl alcohol 100 g

These components were dissolved in distilled water to make a total volume of 1.0 liter, and a pH thereof was adjusted with potassium hydroxide to 13.5.

Then, the resulting plate was subjected to printing using a printing machine and Dampening Water F-7 each described below, and a 50th print from the start of printing was visually evaluated on background stain thereof.

Dampening Water F-7

Aqueous solution made by diluting 200-folds dampening water for PS plate (Alky A manufactured by Toyo Ink Mfg. Co., Ltd.) with distilled water (pH: 9.5) Water Retentivity at the Start of Printing I Ryobi 3200 CD manufactured by Ryobi Ltd. was used as a printing machine of molton type. Water Retentivity at the Start of Printing II Ryobi 3200 MCD manufactured by Ryobi Ltd. was used as a printing machine of syn-flow type.

5) Printing Durability

The light-sensitive material was subjected to plate making under the same conditions as in the above described item 3), immersed in Oil-Desensitizing Solution E-7 described in the item 4) above for 3 minutes. The resulting printing plate was subjected to printing using Dampening Water F-7 described in the item 4) above as dampening water, neutral paper as printing paper and a printing machine of large size capable of printing paper of Kikuzen-size (1003×800 mm) (Oliver 94 manufactured by Sakurai Seisakusho K.K.) as a printing machine. A number of prints having clear images which could be obtained without the occurrence of background stain was determined in a case wherein a printing pressure on an offset printing machine was increased.

As shown in Table $W_1$, each of the light-sensitive materials had good smoothness of photoconductive layer. The electrostatic characteristics under the condition of normal temperature and normal humidity were in a range of practically no problem although they were somewhat low in Comparative Example D-7 wherein the resin ($B_6$) was not used. However, under the severe condition of high temperature and high humidity, the electrostatic characteristics (particularly, D.R.R. and $E_{1/10}$) of Comparative Example D-7 were remarkably decreased. On the contrary, with other light-sensitive materials, the change of the electrostatic characteristics was controlled small and they were maintained in a range of practical use. With respect to the image forming performance, the occurrence of background fog in non-image areas and degradation of image quality (i.e., decrease in density, cutting of fine lines and letters, etc.) were observed under the high temperature and high humidity condition. Other light-sensitive materials provided good duplicated images.

Concerning the water retentivity at the start of printing, the printing plates according to Example 7-1 and Comparative Example D-7 provided excellent water retentivity and adhesion of ink to the non-image area thereof was not observed at all irrespective of the type of printing machine. On the contrary, a plate according to Comparative Example A-7 wherein only carboxy group had been formed exhibited a large difference in the occurrence of background stain on print at the start of printing depending on a system of supplying damping water and ink. Specifically, in a case of using a printing machine of syn-flow type in which the supply of dampening water is less sufficient than in a printing machine of molton type, adhesion of ink occurred in the non-image area on print and the formation of background stain was observed at the start of printing. It is presumed in the plate of Comparative Example A-7 that although the surface of the photoconductive layer thereof which had been rendered hydrophilic had sufficiently good wettability with water, a super-thin layer of water (weak boundary layer abbreviated as WBL hereinafter) which had been formed on the surface of the plate could not be maintained, since the amount of water which was held in the whole photoconductive layer (amount of water retained in the layer) was insufficient, when the balance of amount of dampening water supplied was lost at the start of printing.

On the other hand, with a plate according to Comparative Example B-7 wherein only sulfo group had been formed, adhesion of ink was restrained as compared with the plate of Comparative Example A-7 in a case of using a printing machine of syn-flow type. However, it is presumed that the formation of WBL was insufficient in a case of using a printing machine of molton type since the amount of water retained in the layer was large.

Further, with Comparative Example C-7 wherein the resins used in Comparative Examples A-7 and B-7 were mixed the faults of both resins could not be covered up and provided the same results as Comparative Example A-7.

As a result of the evaluation on printing durability using a printing machine of large size, more than 10,000 prints of clear image were obtained. With Comparative Example D-7 which exhibited good water retentivity at the start of printing in case of using the raw plate, the image on prints were poor from the start of printing when the plate formed by practical plate-making was employed. On the contrary, the printing durability in each of Comparative Examples A-7, B-7 and C-7 was around 2,000 prints to 4,000 prints. The reason for the low printing durability in Comparative Example A-7 is considered to be based on the fact that the formation of WBL on the surface of the plate or the amount of water retained in the layer became poor with the progress of printing. Also, in case of Comparative Examples B-7 and C-7, it is presumed that a film strength of the layer was insufficient and the layer was broken, resulting in the low printing durability because of the large amount of water retained in the layer formed from the resin having sulfo group and crosslinking structure.

From these results it can be seen that only the light-sensitive material according to the present invention produces a printing plate which can provide a large number of prints having good quality even when the ambient conditions at the image formation and conditions at the printing are fluctuated.

EXAMPLE 7-2

A mixture of 35 g of Resin (A-2), 10 g of Resin ($B_6$-11), 4 g of Resin (P-2) described in Example 1-2, 200 g of photoconductive zinc oxide, 0.02 g of uranine, 0.015 g of Dye (I) described in Example 1-2, 0.012 g of Dye (II) described in Example 1-2, 0.18 g of N-hydroxyphthalimide and 300 g of toluene was dispersed by a homogenizer (manufactured by Nippon Seiki K.K.) at a rotation of $7\times10^3$ r.p.m. for 5 minutes. To the dispersion were added 0.1 g of phthalic anhydride and 0.002 g of zirconium acetylacetone, and the mixture was dispersed by a homogenizer at a rotation of $1\times10^3$ r.p.m. for 1 minute. The resulting coating composition for a light-sensitive layer was coated on paper, which had been subjected to electrically conductive treatment, by a wire bar at a dry coverage of 25 g/m$^2$, followed by drying at 100° C. for 30 seconds and then heating at 140° C. for 1 hour. The coated material was allowed to stand in a dark place at 20° C. and 65% RH for 24 hours to prepare an electrophotographic light-sensitive material.

COMPARATIVE EXAMPLE E-7

An electrophotographic light-sensitive material was prepared in -the same manner as in Example 7-2, except for using 35 g of Resin (2R-3) described in Comparative Example E-2 in place of 35 g of Resin (A-2) used in Example 7-2.

COMPARATIVE EXAMPLE F-7

An electrophotographic light-sensitive material was prepared in the same manner as in Example 7-2, except for using 35 g of Resin (2R-4) described in Comparative Example F-2 in place of 35 g of Resin (A-2) used in Example 7-2.

COMPARATIVE EXAMPLE G-7

An electrophotographic light-sensitive material was prepared in the same manner as in Example 7-2, except for using 20.6 g of Resin (2R-3) and 14.4 g of Resin (2R-4) (weight ratio of Resin (2R-3)/Resin (2R-4)=58.8/41.2) in place of 35 g of Resin (A-2) used in Example 7-2.

COMPARATIVE EXAMPLE H-7

An electrophotographic light-sensitive material was prepared in the same manner as in Example 7-2, except for using only 45 g of Resin (A-2) in place of 35 g of Resin (A-2) and 10 g of Resin ($B_6$-11) used in Example 7-2.

With each of the light-sensitive materials thus-prepared, the smoothness of photoconductive layer, electrostatic characteristics, image forming performance and water retentivity at the start of printing were evaluated in the same manner as in Example 7-1. Further, using dampening water each having a different pH value (i.e., pH 4.5, pH 7.0 and pH 9.5), influence on print was evaluated.

The results obtained are shown in Table $X_1$ below.

TABLE $X_1$

| | | Example 7-2 | Comparative Example E-7 | Comparative Example F-7 | Comparative Example G-7 | Comparative Example H-7 |
|---|---|---|---|---|---|---|
| Smoothness of Photoconductive Layer (sec/cc) | | 250 | 260 | 240 | 255 | 240 |
| Electrostatic Characteristics | | | | | | |
| $V_{10}$(−V) | I | 760 | 750 | 750 | 745 | 530 |
| | II | 745 | 730 | 725 | 730 | 500 |
| D.R.R. (%) | I | 88 | 86 | 85 | 86 | 82 |
| | II | 85 | 83 | 82 | 83 | 70 |
| $E_{1/10}$ (lux · sec) | I | 11.5 | 11.8 | 12.2 | 12.3 | 15.6 |
| | II | 12.4 | 12.5 | 13.1 | 13.3 | 18.5 |
| Image Forming Performance | I | ○ good | ○ good | ○ good | ○ good | ○ good |
| | II | ○ good | ○ good | ○ good | ○ good | x low density, occurrence of background fog, occurrence of cutting of fine lines and letters |
| Water Retentivity at the Start of Printing | | | | | | |
| I Molton Type | | ○ good | ○ good | ○Δ occurrence of very slight background stain | ○ good | ○ good |
| II Syn-Flow Type | | ○ good | x occurrence of severe background stain | Δ~○ occurrence of slight background stain | x occurrence of severe background stain | ○ good |
| Dependency on[6] Dampening Water | | | | | | |
| I | | 10,000 prints | severe background stain at the start of printing | background stain at the start of printing | severe background stain at the start of printing | severe background stain from the start of printing, occurrence of cutting of fine lines and letters |
| II | | 10,000 prints | severe background stain at the start of printing | background stain at the start of printing | background stain at the start of printing | severe background stain from the start of printing, occurrence of cutting of fine lines and letters |

TABLE $X_1$-continued

| | Example 7-2 | Comparative Example E-7 | Comparative Example F-7 | Comparative Example G-7 | Comparative Example H-7 |
|---|---|---|---|---|---|
| III | 10,000 prints | 2,000 prints | 3,000 prints | 2,000 prints | severe background stain from the start of printing, occurrence of cutting of fine lines and letters |

6) Dependency on Dampening Water

The production of printing plate and printing were conducted in the same manner as described in the item 5) above, except for using the solution shown below as dampening water at the printing.

I: an aqueous solution (pH: 4.5) prepared by diluting 100-folds dampening water for PS plate (EU-3 manufactured by Fuji Photo Film Co., Ltd.) with distilled water.

II: an aqueous solution (pH: 7.0) prepared by diluting 130-folds dampening water for PS plate (SG-23 manufactured by Tokyo Ink K.K.) with distilled water.

III: an aqueous solution (pH: 9.5) prepared by diluting 200-folds dampening water for PS plate (Alky A manufactured by Toyo Ink Mfg. Co., Ltd.) with distilled water.

As shown above, the smoothness of photoconductive layer of each light-sensitive material was good. Example 7-2 and Comparative Examples E-7 to G-7 exhibited good electrostatic characteristics and image forming performance regardless of ambient condition. However, with Comparative Example H-7 wherein the resin ($B_6$) was not used, the electrostatic characteristics were decreased and the occurrence of background fog and degradation of image (i.e., decrease in density, cutting of fine lines and letters, etc.) were observed on the image forming performance under the severe condition of high temperature and high humidity.

With respect to the water retentivity at the start of printing, the plate according to the present invention was good, although the water retentivity of the plates of Comparative Examples E-7 to G-7 was poor in a case of using a printing machine of syn-flow type. The reason for poor water retentivity obtained in Comparative Example F-7 by the syn-flow type printing machine is presumed that although the $PO_3H_2$ group formed in Resin (2R-4) upon the oil-desensitizing treatment acted for keeping sufficient amount of water retained in the layer, the wettability of the surface of the layer with water was insufficient at the printing since the hydrophilic group was bonded to the polymer main chain through a hydrophobic linking group.

As a result of the evaluation on printing durability using three kinds of dampening water, the plate according to the present invention provided 10,000 prints of good quality irrespective of the kind of dampening water. On the contrary, the plates of Comparative Examples E-7 to G-7 exhibited good results only when Dampening Water III was used, and in case of using other dampening water, background stain due to adhesion of ink occurred at the start of printing while the degree thereof was different from each other and the background stain could not be removed by conducting further printing. The plate of Comparative Example H-7 could not provide prints of satisfactory image quality from the start of printing since the performance of printing plate precursor was poor due to poor image quality and background fog at the plate making.

It is believed that the large influence of pH of dampening water is related to a dissociation constant of the hydrophilic group formed. More specifically, with Comparative Example E-7 wherein the influence of pH is dominative, the COOH group formed in Resin (2R-3) is present as a dissociated form of $COO^-$ and has good compatibility with water under a high pH condition, but the amount of dissociated group decreases under a low pH condition, resulting in reduction of the water compatibility. It has been found that the water retentivity is widely varied depending on the kind of dampening water when a hydrophilic group having a small value of dissociation constant (pKa) is not formed simultaneously.

Since the printing plate according to the present invention is capable of conducting printing using dampening water for PS plate in a large size printing machine as described above, it can be easily used in common with other printing plates without cleaning and inspection of the printing machine.

EXAMPLES 7-3 TO 7-13

Each electrophotographic light-sensitive material was prepared in the same manner as described in Example 7-1, except for using 32 g of each of the resins (A) and 8 g of each of the resins ($B_6$) shown in Table $Y_1$ below in place of 32 g of Resin (A-1) and 8 g of Resin ($B_6$-2) used in Example 7-1.

TABLE $Y_1$

| Example | Resin (A) | Resin ($B_6$) |
|---|---|---|
| 7-3 | A-3 | $B_6$-2 |
| 7-4 | A-4 | $B_6$-4 |
| 7-5 | A-5 | $B_6$-5 |
| 7-6 | A-6 | $B_6$-9 |
| 7-7 | A-7 | $B_6$-17 |
| 7-8 | A-8 | $B_6$-19 |
| 7-9 | A-9 | $B_6$-21 |
| 7-10 | A-10 | $B_6$-23 |
| 7-11 | A-11 | $B_6$-24 |
| 7-12 | A-12 | $B_6$-25 |
| 7-13 | A-13 | $B_6$-28 |

With each of the light-sensitive materials thus prepared, various characteristics were evaluated in the same manner as in Example 7-1. Each of the light-sensitive materials exhibited good electrostatic characteristics and image forming performance similar to those obtained in the light-sensitive material of Example 7-1, even when the ambient condition was varied. When they were used as printing plates, they exhibited good water retentivity at the start of printing on both printing machines of molton type and syn-flow type and the printing durability thereof was more than 10,000 prints.

EXAMPLES 7-14 TO 7-25

Each electrophotographic light-sensitive material was prepared in the same manner as described in Example 7-1, except for using each of the compounds shown in Table $Z_1$ below in place of Resin (A-1), Resin ($B_6$-2), Resin (2P-1) and phthalic anhydride and o-chlorophenol as crosslinking compounds used in Example 7-1. Resins (P-3) to (P-12) used are described in Examples 1-14 to 1-25 respectively.

TABLE $Z_1$

| Example | Resin (A) | Resin ($B_6$) | Resin (P) | Crosslinking Compound |
|---|---|---|---|---|
| 7-14 | (A-14) | ($B_6$-2) | (P-3) | $R'OOCNH(CH_2)_6NHCOOR'$<br>R': $-CH(COCH_3)-COOC_2H_5$<br>Dibutyltin dilaurate |
| 7-15 | (A-15) | ($B_6$-3) | (P-4) | Tetrabutoxy titanate |
| 7-16 | (A-16) | ($B_6$-8) | (P-5) | Gluconic acid |
| 7-17 | (A-17) | ($B_6$-11) | (P-6) | 3-Glycidoxy propyl trimethoxy silane |
| 7-18 | (A-18) | ($B_6$-14) | (P-7) | — |
| 7-19 | (A-19) | ($B_6$-18) | (P-8) | Propylene glycol<br>Tetrabutoxy titanate |
| 7-20 | (A-20) | ($B_6$-27) | (P-9) | N,N-Dimethylpropylamine |
| 7-21 | (A-21) | ($B_6$-28) | (P-10) | Divinyl adipate<br>Benzoyl peroxide |
| 7-22 | (A-22) | ($B_6$-30) | — | — |
| 7-23 | (A-16) | ($B_6$-15) | (P-11) | Phthalic anhydride<br>o-Chlorophenol |
| 7-24 | (A-23) | ($B_6$-12) | (P-12) | Allyl methacrylate<br>Benzoyl peroxide |
| 7-25 | (A-24) | ($B_6$-30) | — | 3-Aminopropyl trimethoxy silane |

With each of the light-sensitive materials thus prepared, various characteristics were evaluated in the same manner as in Example 7-1. Each of the light-sensitive materials exhibited good electrostatic characteristics and image forming performance similar to those obtained in the light-sensitive material of Example 7-1, even when the ambient condition was varied. When they were used as printing plates, they exhibited good water retentivity at the start of printing on both printing machines of molton type and syn-flow type and the printing durability thereof was more than 10,000 prints.

EXAMPLE 7-26

A mixture of 1 g of X-form metal-free phthalocyanine (manufactured by Dainippon Ink and Chemicals, Inc.), 8 g of Resin (A-25), 2 g of Resin ($B_6$-30), 0.3 g of Resin (2P-1) and 80 g of tetrahydrofuran was put in a 500 ml-volume glass container together with glass beads and dispersed in a paint shaker (manufactured by Toyo Seiki Seisakusho Co.) for 60 minutes. To the dispersion was added 0.3 g of ethylene glycol diglycidyl ether, followed by further dispersing for 2 minutes. The glass beads were separated by filtration to prepare a dispersion for a light-sensitive layer.

The dispersion was coated on base paper for a paper master having a thickness of 0.2 mm, which had been subjected to electrically conductive treatment and solvent-resistant treatment, by a wire bar, set to touch, heated in a circulating oven at 110° C. for 20 seconds, and then further heated at 140° C. for 1 hour to form a light-sensitive layer having a thickness of 8 μm.

The resulting light-sensitive material was subjected to the evaluations of electrostatic characteristics and image forming performance in the same manner as described in Example 7-1, and good results shown in Table $a_1$ below were obtained.

TABLE $a_1$

| | 20° C., 65% RH | 30° C., 80% RH |
|---|---|---|
| Electrostatic Characteristics | | |
| $V_{10}$(−V) | 570 | 555 |
| D.R.R. (%) | 87 | 84 |
| $E_{1/10}$ (erg/cm$^2$) | 29 | 30 |
| Image Forming Performance | ○<br>good | ○<br>good |

Of the evaluations, the D.R.R., $E_{1/10}$ and image forming performance were conducted according to the following methods.

D.R.R. and $E_{1/10}$

The light-sensitive material was charged with a corona discharge to a voltage of −6 kV for 20 seconds in a dark room at a temperature of 20° C. and 65% RH using a paper analyzer ("Paper Analyzer SP-428" manufactured by Kawaguchi Denki K.K.). Ten seconds after the corona discharge, the surface potential $V_{10}$ was measured. The sample was then allowed to stand in the dark for an additional 90 seconds, and the potential $V_{100}$ was measured. The dark charge retention rate, i.e., percent retention of potential after dark decay for 90 seconds, was calculated from the following equation:

$$DRR(\ )=(V_{100}/V_{10})\times 100$$

Separately, the surface of photoconductive layer was charged to −500 V with a corona discharge and then exposed to monochromatic light of 780 nm, and the time required for decay of the surface potential $V_{10}$ to one-tenth was measured, and the exposure amount $E_{1/10}$ (erg/cm$^2$) was calculated therefrom.

This is denoted as Condition (I).

Further, the same procedure was conducted under the ambient condition of 30° C. and 80% RH. This is denoted as Condition (II).

Image Forming Performance

After the light-sensitive material was allowed to stand for a whole day and night under the condition of 20° C. and 65% RH, the light-sensitive material was charged to −6 kV and exposed to light emitted from a gallium-aluminum-arsenic semi-conductor laser (oscillation-wavelength: 780 nm; output: 2.8 mW) at an exposure amount of 64 erg/cm$^2$ (on the surface of the photoconductive layer) at a pitch of 25 μm and a scanning speed of 300 m/sec. The thus formed electrostatic latent image was developed with Liquid Developer LD-2 prepared by dispersing 5 g of polymethyl methacrylate particles having a particle size of 0.3 μm in 1 l of Isopar H (manufactured by Esso Standard Co.), and adding 0.01 g of soybean oil lecithin thereto as a charge control agent, washed with a rinse solution of isoparaffinic solvent Isopar G (manufactured by Esso Chemical K.K.) and fixed. The duplicated image thus obtained was visually evaluated for fog and image quality.

This is denoted as Condition (I).

Further, the same procedure was conducted under the ambient condition of 30° C. and 80% RH. This is denoted as Condition (II).

Further, the light-sensitive material was subjected to the plate making in the same manner as described above and then the oil desensitizing treatment and printing were conducted under the same conditions as described in Example 7-1.

As a result, it was found that both of the water retentivities (I) and (II) at the start of printing were good. With respect to the printing durability, more than 10,000 prints of cleat prints were obtained.

EXAMPLE 7-27

An electrophotographic light-sensitive material was prepared in the same manner as described in Example 7-26 except that 10.3 g of Resin (A-26) was used alone in place of 8 g of Resin (A-25), 2 g of Resin ($B_6$-30), 0.3 g of Resin (2P-1), and 0.3 g of ethylene glycol diglycidyl ether used in Example 7-26. Further, the crosslinking of layer was conducted in the method described below in place of the heating at 140° C. for 1 hour.

Curing Method

The light-sensitive material was irradiated with light from a super high-pressure mercury lamp of 2 Kw as a light source at a distance of 50 cm for 1.5 minutes.

The electrostatic characteristics and printing properties of the light-sensitive material thus obtained were evaluated in the same manner as described in Example 7-26. The good results similar to those obtained with respect to the light-sensitive material of Example 7-26 were obtained.

EXAMPLES 7-28 TO 7-30

Each electrophotographic light-sensitive material was prepared in the same manner as in Example 7-1, except for using 32 g of each of the resins (A) and 8 g of each of the resins ($B_6$) shown in Table $b_1$ below in place of 32 g of Resin (A-1) and 8 g of Resin ($B_6$-2) used in Example 7-1.

TABLE $b_1$

| Example | Resin (A) | Resin ($B_6$) |
|---|---|---|
| 7-28 | A-27 | $B_6$-3 |
| 7-29 | A-28 | $B_6$-10 |
| 7-30 | A-29 | $B_6$-16 |

With each of the light-sensitive materials thus prepared, the electrostatic characteristics and printing properties were evaluated in the same manner as in Example 7-1. The good results similar to those of the light-sensitive material in Example 7-1 were obtained.

EXAMPLE 7-31

A mixture of 40 g (solid basis) of Resin (A-30), 10 g (solid basis) of Resin ($B_6$-31), 200 g of photoconductive zinc oxide, 0.018 g of Cyanine Dye (I-2) described in Example 2-31, 0.20 g of phthalic anhydride and 300 g of toluene was dispersed by a homogenizer (manufactured by Nippon Seiki K.K.) at a rotation of $6\times10^3$ r.p.m. for 7 minutes. To the dispersion was added 2.5 g of the crosslinking compound described in Example 2-31, and the mixture was dispersed by a homogenizer at a rotation of $1\times10^3$ r.p.m. for 1 minute to prepare a coating composition for a light-sensitive layer. The coating composition was coated on paper, which had been subjected to electrically conductive treatment, by a wire bar at a dry coverage of 25 g/m$^2$, followed by drying at 110° C. for 10 seconds and allowed to stand in a dark place at 50° C. and 80% RH for 1 week. Then the coated material was allowed to stand in a dark place at 20° C. and 65% RH for 24 hours to prepare an electrophotographic light-sensitive material.

COMPARATIVE EXAMPLE I-7

An electrophotographic light-sensitive material was prepared in the same manner as described in Example 7-31 except that 50 g of Resin (A-30) was used alone in place of 40 g of Resin (A-30) and 10 g of Resin ($B_6$-31) used in Example 7-31.

With each of the light-sensitive materials thus prepared, the electrostatic characteristics and image forming performance were evaluated in the same manner as in Example 7-26, and other characteristic items were evaluated in the same manner as in Example 7-1.

TABLE $c_1$

| | | Example 7-31 | Comparative Example I-7 |
|---|---|---|---|
| Smoothness of Photoconductive Layer (sec/cc) | | 260 | 240 |
| Electrostatic Characteristics | | | |
| $V_{10}$(−V) | I (20° C., 65% RH) | 690 | 500 |
| | II (30° C., 80% RH) | 670 | 430 |
| D.R.R. (%) | I | 85 | 70 |
| | II | 78 | 45 |
| $E_{1/10}$ (erg/cm$^2$) | I | 39 | 98 |
| | II | 47 | 125 |
| Image Forming Performance | I | o good | o good |
| | II | o good | x low density, cutting of fine lines and letters, severe fog |
| Water Retentivity at the Start of Printing | | | |
| I Molton Type | | o good | o good |
| II Syn-Flow Type | | o good | o good |
| Printing Durability | | 10,000 prints | severe background stain from the start of printing |

As shown above, the smoothness of photoconductive layer was good with each light-sensitive material.

The electrostatic characteristics of the light-sensitive material according to the present invention were good not only at normal temperature and normal humidity but also at high temperature and high humidity. On the contrary, with the light-sensitive material of Comparative Example I-7, D.R.R. and $E_{1/10}$ were low even at normal temperature and normal humidity and they further degraded at high temperature and high humidity. With respect to image forming performance, the material according to the present invention provided good duplicated images irrespective of the ambient condition. On the contrary, with the material of Comparative. Example I-7, although duplicated images formed at normal temperature and normal humidity were practically usable, duplicated images formed at high temperature and high humidity could not be used in practice because of occurrence of severe background stain and degradation of image (e.g., decrease in density, cutting of fine lines and letters).

Further, as a result of printing using the printing plates prepared therefrom, the printing plate according to the present invention provided 10,000 good prints from the start of printing irrespective of the kind of printing machine. The printing plate of Comparative Example I-7 prepared under Condition II provided prints of poor image from the start of printing.

EXAMPLES 7-32 TO 7-43

Each light-sensitive material was prepared in the same manner as in Example 7-31, except for using 10 g of each of the resins ($B_1$) shown in Table $d_1$ below in place of 10 g of Resin ($B_6$-31) used in Example 7-31.

TABLE $d_1$

| Example | Resin ($B_6$) |
|---|---|
| 7-32 | $B_6$-2 |
| 7-33 | $B_6$-3 |
| 7-34 | $B_6$-4 |
| 7-35 | $B_6$-6 |
| 7-36 | $B_6$-8 |
| 7-37 | $B_6$-12 |
| 7-38 | $B_6$-14 |
| 7-39 | $B_6$-19 |
| 7-40 | $B_6$-21 |
| 7-41 | $B_6$-23 |
| 7-42 | $B_6$-29 |
| 7-43 | $B_6$-30 |

With each of the light-sensitive materials thus prepared, the Various characteristics were evaluated in the same manner as in Example 7-31. The good results similar to those of Example 7-31 were obtained.

EXAMPLES 7-44 TO 7-55

An offset printing plate was prepared by subjecting some of the light-sensitive materials used in Examples described above to electrophotographic processings for forming a toner image, followed by the oil-desensitizing treatment described below. Specifically, to 0.2 mol of each of the nucleophilic compounds shown in Table $e_1$ below, 100 g of each of the organic solvents shown in Table $e_1$ below, and 2 g of Newcol B4SN (manufactured by Nippon Nyukazai K.K.) was added distilled water to make 1 l, and the solution was adjusted to a pH of 13.5. Each light-sensitive material was immersed in the resulting treating solution at a temperature of 35° C. for 3 minutes to conduct the oil-desensitizing treatment.

Printing was carried out using the resulting printing plate under the same conditions as in the respective basis Example. Each plate exhibited good characteristics similar to those of the respective basis Example.

TABLE $e_1$

| Example | Basis Example of Light-sensitive Material | Nucleophilic Compound | Organic Solvent |
|---|---|---|---|
| 7-44 | Example 7-6 | Sodium sulfite | N,N-Dimethylacetamide |
| 7-45 | Example 7-8 | Monoethanolamine | Tetrahydrofuran |
| 7-46 | Example 7-2 | Diethanolamine | Methyl ethyl ketone |
| 7-47 | Example 7-5 | Thiomalic acid | Ethylene glycol |
| 7-48 | Example 7-11 | Thiosalicylic acid | N-Methylpyrrolidone |
| 7-49 | Example 7-9 | Taurine | Isopropyl alcohol |
| 7-50 | Example 7-13 | 4-Sulfobenzenesulfinic acid | N-Methylacetamide |
| 7-51 | Example 7-5 | Thioglycolic acid | Sulfolane |
| 7-52 | Example 7-10 | 2-Mercaptoethylphosphonic acid | Dioxane |
| 7-53 | Example 7-30 | Serine | N,N-Dimethylamino ethanol |
| 7-54 | Example 7-12 | Sodium thiosulfate | N,N-Dimethylacetamide |
| 7-55 | Example 7-29 | Ammonium sulfite | Benzyl alcohol |

APPLICABILITY IN INDUSTRIAL FIELD

According to the present invention, a lithographic printing plate precursor which is prevented from the formation of background stain and has excellent oil-desensitivity and high printing durability is provided.

What is claimed is:

1. An electrophotographic lithographic printing plate precursor comprising a conductive support having thereon at least one photoconductive layer containing a photoconductive compound and a binder resin, wherein the binder resin of the photoconductive layer comprises at least one binder resin (A) and further comprises binder resin (B) both described below;

Binder Resin (A):

a copolymer comprising a polymer component (a) containing at least one functional group capable of conversion to a —COOH group and a polymer component (b) containing at least one functional group capable of conversion to a member selected from the group consisting of a $—SO_3H$ group, a $—SO_2H$ group and a $—PO_3H_2$ group, and having a crosslinking structure formed from a polymer component (c) containing at least one heat- and/or photo-curable group;

Binder Resin (B):

a resin having a weight average molecular weight of from $1\times10^3$ to $2\times10^4$ and containing not less than 30% by weight of a polymer component corresponding to a repeating unit represented by the general formula (I) described below and from 0.05 to 15% by weight of a polymer component having at least one polar group selected from the group consisting of $—PO_3H_2$, $—SO_3H$, —COOH, $—P(=O)(OH)Q^1$ (wherein $Q^1$ represents a hydrocarbon group or $—OQ^2$ (wherein $Q^2$ represents a hydrocarbon group)) and a cyclic acid anhydride group,

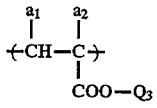

General Formula (I)

wherein $a_1$ and $a_2$ each represents a hydrogen atom, a halogen atom, a cyano group or a hydrocarbon group; and $Q_3$ represents a hydrocarbon group.

2. An electrophotographic lithographic printing plate precursor as claimed in claim 1, wherein at least one functional group capable of conversion to a —COOH group in the polymer component (a) is directly bonded to the polymer main chain of the binder resin (A).

3. An electrophotographic lithographic printing plate precursor as claimed in claim 1, wherein the photoconductive layer contains a heat- and/a photocurable compound together with the binder resin (A).

4. An electrophotographic lithographic printing plate precursor as claimed in claim 1, wherein the photoconductive layer contains a photoconductive component selected from the group consisting of photoconductive zinc oxide and photoconductive titanium oxide, and a spectral sensitizer dye.

5. An electrophotographic lithographic printing plate precursor as claimed in claim 1, wherein the resin (B) contains, as the polymer component represented by the general formula (I), at least one methacrylate component having an aryl group, represented by the following general formula (Ia) or (Ib):

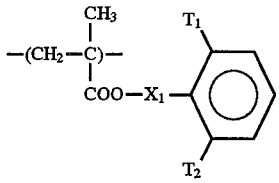

General Formula (Ia)

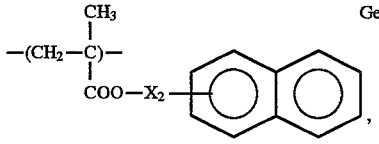

General Formula (Ib)

wherein $T_1$ and $T_2$ each represents a hydrogen atom, a hydrocarbon group having from 1 to 10 carbon atoms, a chlorine atom, a bromine atom, —$COQ_4$ or —$COOQ_5$ (wherein $Q_4$ and $Q_5$ each represents a hydrocarbon group having from 1 to 10 carbon atoms); and $X_1$ represents a mere bond or a linking group containing from 1 to 4 linking atoms, which connects —COO— and the benzene ring and $X_2$ represents a mere bond or a linking group containing from 1 to 4 linking atoms, which connects —COO— and the naphthalene ring.

6. An electrophotographic lithographic printing plate precursor as claimed in claim 1, wherein the functional group capable of conversion to a —COOH group in the resin (A) is a group represented by the following general formula (II):

General Formula (II)

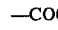

wherein $L_1$ represents

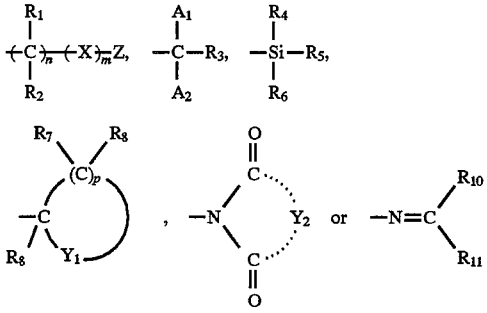

wherein $R_1$ and $R_2$, which may be the same or different, each represents a hydrogen atom or a hydrocarbon group; X represents an aromatic group; Z represents a hydrogen atom, a halogen atom, a trihalomethyl group, an alkyl group, a cyano group, a nitro group, —$SO_2$—$R_1$', —COO—$R_2$', —O—$R_3$', or —CO—$R_4$' (wherein $R_1$', $R_2$', $R_3$', and $R_4$' each represents a hydrocarbon group); n and m each represents 0, 1 or 2, provided that when both n and m are 0, Z is not a hydrogen atom; $A_1$ and $A_2$, which may be the same or different, each represents an electron attracting group having a positive Hammett's substituent constant of σ value; $R_3$ represents a hydrogen atom or a hydrocarbon group; $R_4$, $R_5$, $R_6$, $R_{10}$ and $R_{11}$, which may be the same or different, each represents a hydrocarbon group or —O—$R_5$' (wherein $R_5$' represents a hydrocarbon group); $Y_1$ represents an oxygen atom or a sulfur atom; $R_7$, $R_8$, and $R_9$, which may be the same or different, each represents a hydrogen atom, a hydrocarbon group or —O—$R_6$' (wherein $R_6$' represents a hydrocarbon group); p represents an integer of 3 or 4; $Y_2$ represents an organic residue for forming a cyclic imido group.

7. An electrophotographic lithographic printing plate precursor as claimed in claim 1, wherein the functional group capable of conversion to a —COOH group in the resin (A) is a group containing an oxazolone ring represented by the following general formula (V):

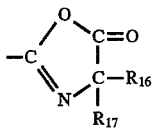

General Formula (V)

wherein $R_{16}$ and $R_{17}$, which may be the same or different, each represents a hydrogen atom or a hydrocarbon group, or $R_{16}$ and $R_{17}$ may be taken together to form a ring.

8. An electrophotographic lithographic printing plate precursor as claimed in claim 1, wherein the functional group capable of conversion to a —$SO_3H$ group in the resin (A) is a group represented by the following general formula (VI) or (VII):

—$SO_2$—O—$L_2$ General Formula (VI)

—$SO_2$—S—$L_2$ General Formula (VII)

wherein $L_2$ represents

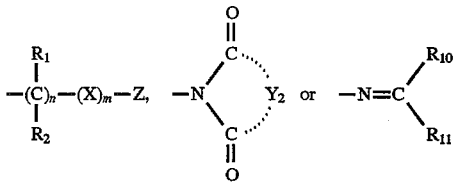

wherein $R_1$ and $R_2$ which may be the same or different, each represents a hydrogen atom or a hydrocarbon group; X represents an aromatic group; Z represents a hydrogen atom, a halogen atom, a trihalomethyl group, an alkyl group, a cyano group, a nitro group, —$SO_2$—$R_1$', —COO—$R_2$', —O—$R_3$', or —CO—$R_4$' (wherein $R_1$', $R_2$', $R_3$', and $R_4$' each represents a hydrocarbon group); n and m each represents 0, 1 or 2, provided that when both n and m are 0, Z is not a hydrogen atom; $Y_2$ represents an organic residue for forming a cyclic imido group; $R_{10}$ and $R_{11}$ which may be the same or different, each represents a hydrocarbon group or —O—$R_5$' (wherein $R_5$' represents a hydrocarbon group).

9. An electrophotographic lithographic printing plate precursor as claimed in claim 1, wherein the functional group capable of conversion to a —$SO_2H$ group in the resin (A) is a group represented by the following general formula (VIII):

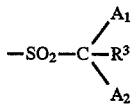

General Formula (VIII)

wherein $A_1$ and $A_2$ which may be the same or different, each represents an electron attracting group having a positive Hammetts' substituent constant of σ value; $R_3$ represents a hydrogen atom or a hydrocarbon group.

10. An electrophotographic lithographic printing plate precursor as claimed in claim 1, wherein the functional group capable of conversion to a $—PO_3H_2$ group in the resin (A) is a group represented by the following general formula (IX):

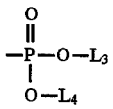

General Formula (IX)

wherein $L_3$ and $L_4$, which may be the same or different, represent

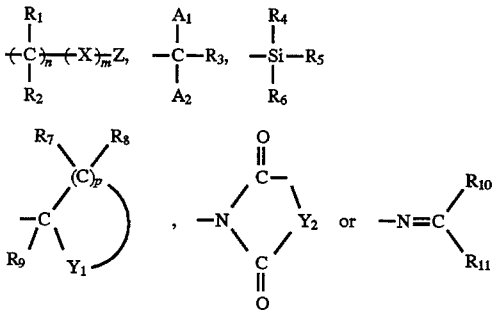

wherein $R_1$ and $R_2$, which may be the same or different, each represents a hydrogen atom or a hydrocarbon group; X represents an aromatic group; Z represents a hydrogen atom, a halogen atom, a trihalomethyl group, an alkyl group, a cyano group, a nitro group, $—SO_2—R_1'$, $—COO—R_2'$, $—O—R_3'$ or $—CO—R_4'$ (wherein $R_1'$, $R_2'$, $R_3'$, and $R_4'$ each represents a hydrocarbon group); n and m each represents 0, 1 or 2, provided that when both n and m are 0, Z is not a hydrogen atom; $A_1$ and $A_2$, which may be the same or different, each represents an electron attracting group having a positive Hammett's substituent constant of a value; $R_3$ represents a hydrogen atom or hydrocarbon group; $R_4$, $R_5$, $R_6$, $R_{10}$ and $R_{11}$, which may be the same or different, each represents a hydrocarbon group or $—O—R_5'$ (wherein $R_5'$ represents a hydrocarbon group); $Y_1$ represents an oxygen atom or a sulfur atom; $R_7$, $R_8$, and $R_9$, which may be the same or different, each represents a hydrogen atom, a hydrocarbon group or $—O—R_6'$ (wherein $R_6'$ represents a hydrocarbon group); p represents an integer of 3 or 4; $Y_2$ represents an organic residue for forming a cyclic imido group.

11. An electrophotographic lithographic printing plate precursor as claimed in claim 1, wherein the binder resin (B) is a binder resin ($B_1$) described below:

Binder Resin ($B_1$):

a random polymer containing a polymer component corresponding to the repeating unit represented by the general formula (I) and having the polar group in the polymer chain and/or bonded at one terminal of the polymer main chain.

12. An electrophotographic lithographic printing plate precursor as claimed in claim 1, wherein the binder resin (B) is a binder resin ($B_2$) described below:

Binder Resin ($B_2$):

an AB or ABA block polymer comprising an A block containing a polymer component corresponding to the repeating unit represented by the general formula (I) and a B block containing a polymer component having the polar group.

13. An electrophotographic lithographic printing plate precursor as claimed in claim 1, wherein the binder resin (B) is a binder resin ($B_3$) described below:

Binder Resin ($B_3$):

a graft copolymer formed from a monomer corresponding to the repeating unit represented by the general formula (I) and a monofunctional macromonomer ($M_1$) having a weight average molecular weight of not more than $1\times10^4$ and a polymerizable double bond group at one terminal of a polymer chain comprising a polymer component having the polar group.

14. An electrophotographic lithographic printing plate precursor as claimed in claim 1, wherein the binder resin (B) is a binder resin ($B_4$) described below:

Binder Resin ($B_4$):

a graft copolymer formed from a monofunctional macromonomer ($M_2$) which is an AB block copolymer comprising an A block containing a polymer component having the polar group and a B block containing a polymer component corresponding to the repeating unit represented the the general formula (I) and which has a polymerizable double bond group at the terminal of the polymer main chain of the B block.

15. An electrophotographic lithographic printing plate precursor as claimed in claim 1, wherein the binder resin (B) is a binder resin ($B_5$) described below:

Binder Resin ($B_5$):

a star copolymer comprising an organic molecule having bonded thereto at least three polymer chains each containing at random a polymer component corresponding to the repeating unit represented by the general formula (I) and a polymer component having the polar group.

16. An electrophotographic lithographic printing plate precursor as claimed in claim 1, wherein the binder resin (B) is a binder resin ($B_6$) described below:

Binder Resin ($B_6$):

a star copolymer comprising an organic molecule having bonded thereto at least three AB block polymer chains each comprising an A block containing a polymer component corresponding to the repeating unit represented by the general formula (I) and a B block containing a polymer component having the polar group.

* * * * *